US008113115B2

(12) United States Patent
Umetsu et al.

(10) Patent No.: US 8,113,115 B2
(45) Date of Patent: Feb. 14, 2012

(54) LIQUID TRANSFER MEMBER PRESSING FORCE ADJUSTING METHOD AND APPARATUS OF ROTARY STENCIL PRINTING PLATE LIQUID COATING MACHINE

(75) Inventors: Isao Umetsu, Tsukuba (JP); Hiromitsu Numauchi, Tsukuba (JP); Isao Komuro, Noda (JP); Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 411 days.

(21) Appl. No.: 12/155,672

(22) Filed: Jun. 6, 2008

(65) Prior Publication Data

US 2008/0307986 A1 Dec. 18, 2008

(30) Foreign Application Priority Data

Jun. 14, 2007 (JP) ..... 2007-157299
Mar. 12, 2008 (JP) ..... 2008-062360

(51) Int. Cl.
*B41L 13/00* (2006.01)

(52) U.S. Cl. ..... 101/120; 101/129

(58) Field of Classification Search ..... 101/116, 101/119, 120, 129
See application file for complete search history.

(56) References Cited

U.S. PATENT DOCUMENTS

| | | | | |
|---|---|---|---|---|
| 3,930,445 | A | 1/1976 | Jaffa | |
| 3,960,076 | A * | 6/1976 | Wick | 101/119 |
| 5,081,924 | A * | 1/1992 | Ohinata | 101/120 |
| 5,323,700 | A * | 6/1994 | Katsuyama et al. | 101/119 |
| 5,517,913 | A * | 5/1996 | Oshio et al. | 101/119 |
| 5,603,260 | A * | 2/1997 | Ohinata et al. | 101/129 |
| 6,477,946 | B1 * | 11/2002 | Ogata | 101/119 |
| 2008/0134913 | A1 * | 6/2008 | Sato | 101/118 |

FOREIGN PATENT DOCUMENTS

| | | | |
|---|---|---|---|
| DE | 199 49 099 | A1 | 4/2001 |
| GB | 2 240 950 | A | 8/1991 |
| WO | WO 80/02400 | A1 | 11/1980 |

* cited by examiner

*Primary Examiner* — Ren Yan
(74) *Attorney, Agent, or Firm* — Birch, Stewart, Kolasch & Birch, LLP

(57) ABSTRACT

A rotary screen printing press includes, a rotary screen cylinder which supports a screen printing form and is supported rotatably; an impression cylinder which is provided to oppose the rotary screen cylinder, and is supported rotatably; and a squeegee which is located within the rotary screen cylinder and, during printing, contacts an inner peripheral surface of the screen printing form, while being pressed against it, to transfer ink stored within the rotary screen cylinder to a material to be printed, which is held on the impression cylinder, via holes of the screen printing form. The printing press has a squeegee throw-on and throw-off control device which controls the pressing force of the squeegee acting on the inner peripheral surface of the screen printing form during printing in accordance with the type and thickness of the material to be printed.

18 Claims, 65 Drawing Sheets

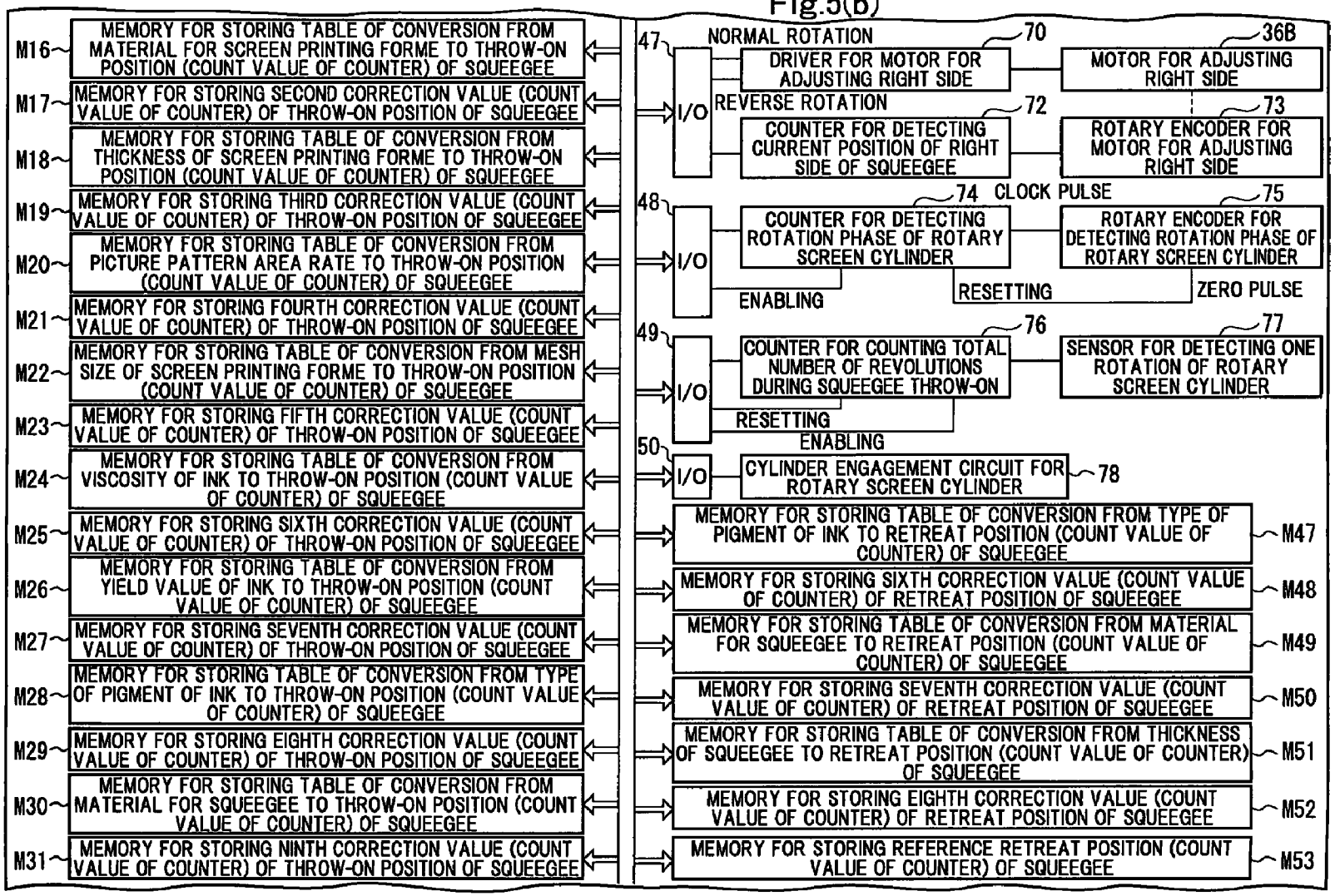
Fig.5(b)
NORMAL ROTATION
REVERSE ROTATION
DRIVER FOR MOTOR FOR ADJUSTING RIGHT SIDE
70
MOTOR FOR ADJUSTING RIGHT SIDE
36B
COUNTER FOR DETECTING CURRENT POSITION OF RIGHT SIDE OF SQUEEGEE
72
ROTARY ENCODER FOR MOTOR FOR ADJUSTING RIGHT SIDE
73
CLOCK PULSE
COUNTER FOR DETECTING ROTATION PHASE OF ROTARY SCREEN CYLINDER
74
ROTARY ENCODER FOR DETECTING ROTATION PHASE OF ROTARY SCREEN CYLINDER
75
ZERO PULSE
ENABLING
RESETTING
COUNTER FOR COUNTING TOTAL NUMBER OF REVOLUTIONS DURING SQUEEGEE THROW-ON
76
SENSOR FOR DETECTING ONE ROTATION OF ROTARY SCREEN CYLINDER
77
CYLINDER ENGAGEMENT CIRCUIT FOR ROTARY SCREEN CYLINDER
78
I/O
47
48
49
50
M16 MEMORY FOR STORING TABLE OF CONVERSION FROM MATERIAL FOR SCREEN PRINTING FORME TO THROW-ON POSITION (COUNT VALUE OF COUNTER) OF SQUEEGEE
M17 MEMORY FOR STORING SECOND CORRECTION VALUE (COUNT VALUE OF COUNTER) OF THROW-ON POSITION OF SQUEEGEE
M18 MEMORY FOR STORING TABLE OF CONVERSION FROM THICKNESS OF SCREEN PRINTING FORME TO THROW-ON POSITION (COUNT VALUE OF COUNTER) OF SQUEEGEE
M19 MEMORY FOR STORING THIRD CORRECTION VALUE (COUNT VALUE OF COUNTER) OF THROW-ON POSITION OF SQUEEGEE
M20 MEMORY FOR STORING TABLE OF CONVERSION FROM PICTURE PATTERN AREA RATE TO THROW-ON POSITION (COUNT VALUE OF COUNTER) OF SQUEEGEE
M21 MEMORY FOR STORING FOURTH CORRECTION VALUE (COUNT VALUE OF COUNTER) OF THROW-ON POSITION OF SQUEEGEE
M22 MEMORY FOR STORING TABLE OF CONVERSION FROM MESH SIZE OF SCREEN PRINTING FORME TO THROW-ON POSITION (COUNT VALUE OF COUNTER) OF SQUEEGEE
M23 MEMORY FOR STORING FIFTH CORRECTION VALUE (COUNT VALUE OF COUNTER) OF THROW-ON POSITION OF SQUEEGEE
M24 MEMORY FOR STORING TABLE OF CONVERSION FROM VISCOSITY OF INK TO THROW-ON POSITION (COUNT VALUE OF COUNTER) OF SQUEEGEE
M25 MEMORY FOR STORING SIXTH CORRECTION VALUE (COUNT VALUE OF COUNTER) OF THROW-ON POSITION OF SQUEEGEE
M26 MEMORY FOR STORING TABLE OF CONVERSION FROM YIELD VALUE OF INK TO THROW-ON POSITION (COUNT VALUE OF COUNTER) OF SQUEEGEE
M27 MEMORY FOR STORING SEVENTH CORRECTION VALUE (COUNT VALUE OF COUNTER) OF THROW-ON POSITION OF SQUEEGEE
M28 MEMORY FOR STORING TABLE OF CONVERSION FROM TYPE OF PIGMENT OF INK TO THROW-ON POSITION (COUNT VALUE OF COUNTER) OF SQUEEGEE
M29 MEMORY FOR STORING EIGHTH CORRECTION VALUE (COUNT VALUE OF COUNTER) OF THROW-ON POSITION OF SQUEEGEE
M30 MEMORY FOR STORING TABLE OF CONVERSION FROM MATERIAL FOR SQUEEGEE TO THROW-ON POSITION (COUNT VALUE OF COUNTER) OF SQUEEGEE
M31 MEMORY FOR STORING NINTH CORRECTION VALUE (COUNT VALUE OF COUNTER) OF THROW-ON POSITION OF SQUEEGEE
M47 MEMORY FOR STORING TABLE OF CONVERSION FROM TYPE OF PIGMENT OF INK TO RETREAT POSITION (COUNT VALUE OF COUNTER) OF SQUEEGEE
M48 MEMORY FOR STORING SIXTH CORRECTION VALUE (COUNT VALUE OF COUNTER) OF RETREAT POSITION OF SQUEEGEE
M49 MEMORY FOR STORING TABLE OF CONVERSION FROM MATERIAL FOR SQUEEGEE TO RETREAT POSITION (COUNT VALUE OF COUNTER) OF SQUEEGEE
M50 MEMORY FOR STORING SEVENTH CORRECTION VALUE (COUNT VALUE OF COUNTER) OF RETREAT POSITION OF SQUEEGEE
M51 MEMORY FOR STORING TABLE OF CONVERSION FROM THICKNESS OF SQUEEGEE TO RETREAT POSITION (COUNT VALUE OF COUNTER) OF SQUEEGEE
M52 MEMORY FOR STORING EIGHTH CORRECTION VALUE (COUNT VALUE OF COUNTER) OF RETREAT POSITION OF SQUEEGEE
M53 MEMORY FOR STORING REFERENCE RETREAT POSITION (COUNT VALUE OF COUNTER) OF SQUEEGEE

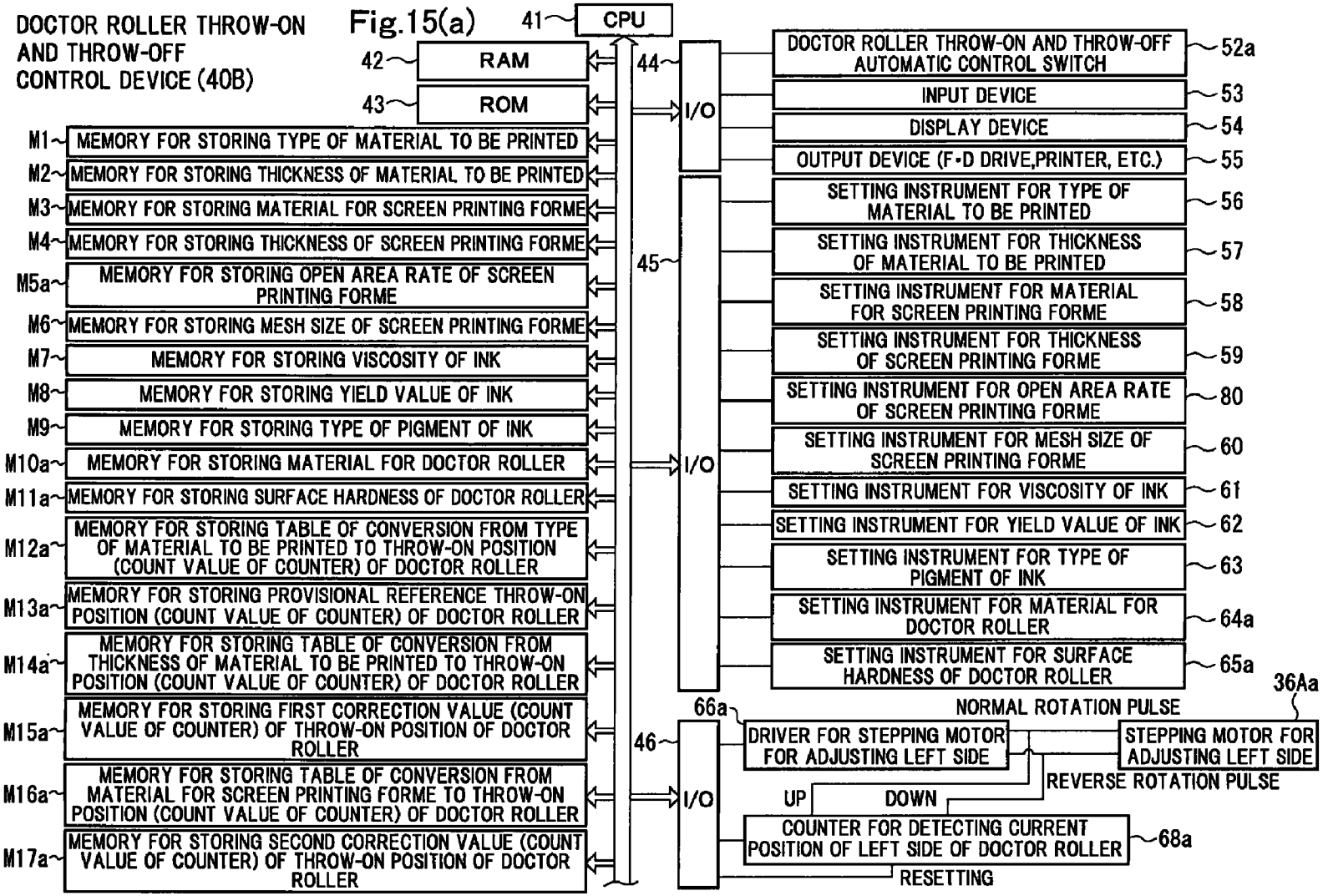
DOCTOR ROLLER THROW-ON AND THROW-OFF CONTROL DEVICE (40B)
Fig.15(a)
CPU
41
RAM
42
ROM
43
I/O
44
I/O
45
I/O
46
M1 MEMORY FOR STORING TYPE OF MATERIAL TO BE PRINTED
M2 MEMORY FOR STORING THICKNESS OF MATERIAL TO BE PRINTED
M3 MEMORY FOR STORING MATERIAL FOR SCREEN PRINTING FORME
M4 MEMORY FOR STORING THICKNESS OF SCREEN PRINTING FORME
M5a MEMORY FOR STORING OPEN AREA RATE OF SCREEN PRINTING FORME
M6 MEMORY FOR STORING MESH SIZE OF SCREEN PRINTING FORME
M7 MEMORY FOR STORING VISCOSITY OF INK
M8 MEMORY FOR STORING YIELD VALUE OF INK
M9 MEMORY FOR STORING TYPE OF PIGMENT OF INK
M10a MEMORY FOR STORING MATERIAL FOR DOCTOR ROLLER
M11a MEMORY FOR STORING SURFACE HARDNESS OF DOCTOR ROLLER
M12a MEMORY FOR STORING TABLE OF CONVERSION FROM TYPE OF MATERIAL TO BE PRINTED TO THROW-ON POSITION (COUNT VALUE OF COUNTER) OF DOCTOR ROLLER
M13a MEMORY FOR STORING PROVISIONAL REFERENCE THROW-ON POSITION (COUNT VALUE OF COUNTER) OF DOCTOR ROLLER
M14a MEMORY FOR STORING TABLE OF CONVERSION FROM THICKNESS OF MATERIAL TO BE PRINTED TO THROW-ON POSITION (COUNT VALUE OF COUNTER) OF DOCTOR ROLLER
M15a MEMORY FOR STORING FIRST CORRECTION VALUE (COUNT VALUE OF COUNTER) OF THROW-ON POSITION OF DOCTOR ROLLER
M16a MEMORY FOR STORING TABLE OF CONVERSION FROM MATERIAL FOR SCREEN PRINTING FORME TO THROW-ON POSITION (COUNT VALUE OF COUNTER) OF DOCTOR ROLLER
M17a MEMORY FOR STORING SECOND CORRECTION VALUE (COUNT VALUE OF COUNTER) OF THROW-ON POSITION OF DOCTOR ROLLER
52a DOCTOR ROLLER THROW-ON AND THROW-OFF AUTOMATIC CONTROL SWITCH
53 INPUT DEVICE
54 DISPLAY DEVICE
55 OUTPUT DEVICE (F·D DRIVE,PRINTER, ETC.)
56 SETTING INSTRUMENT FOR TYPE OF MATERIAL TO BE PRINTED
57 SETTING INSTRUMENT FOR THICKNESS OF MATERIAL TO BE PRINTED
58 SETTING INSTRUMENT FOR MATERIAL FOR SCREEN PRINTING FORME
59 SETTING INSTRUMENT FOR THICKNESS OF SCREEN PRINTING FORME
80 SETTING INSTRUMENT FOR OPEN AREA RATE OF SCREEN PRINTING FORME
60 SETTING INSTRUMENT FOR MESH SIZE OF SCREEN PRINTING FORME
61 SETTING INSTRUMENT FOR VISCOSITY OF INK
62 SETTING INSTRUMENT FOR YIELD VALUE OF INK
63 SETTING INSTRUMENT FOR TYPE OF PIGMENT OF INK
64a SETTING INSTRUMENT FOR MATERIAL FOR DOCTOR ROLLER
65a SETTING INSTRUMENT FOR SURFACE HARDNESS OF DOCTOR ROLLER
36Aa STEPPING MOTOR FOR ADJUSTING LEFT SIDE
NORMAL ROTATION PULSE
REVERSE ROTATION PULSE
66a DRIVER FOR STEPPING MOTOR FOR ADJUSTING LEFT SIDE
UP
DOWN
68a COUNTER FOR DETECTING CURRENT POSITION OF LEFT SIDE OF DOCTOR ROLLER
RESETTING

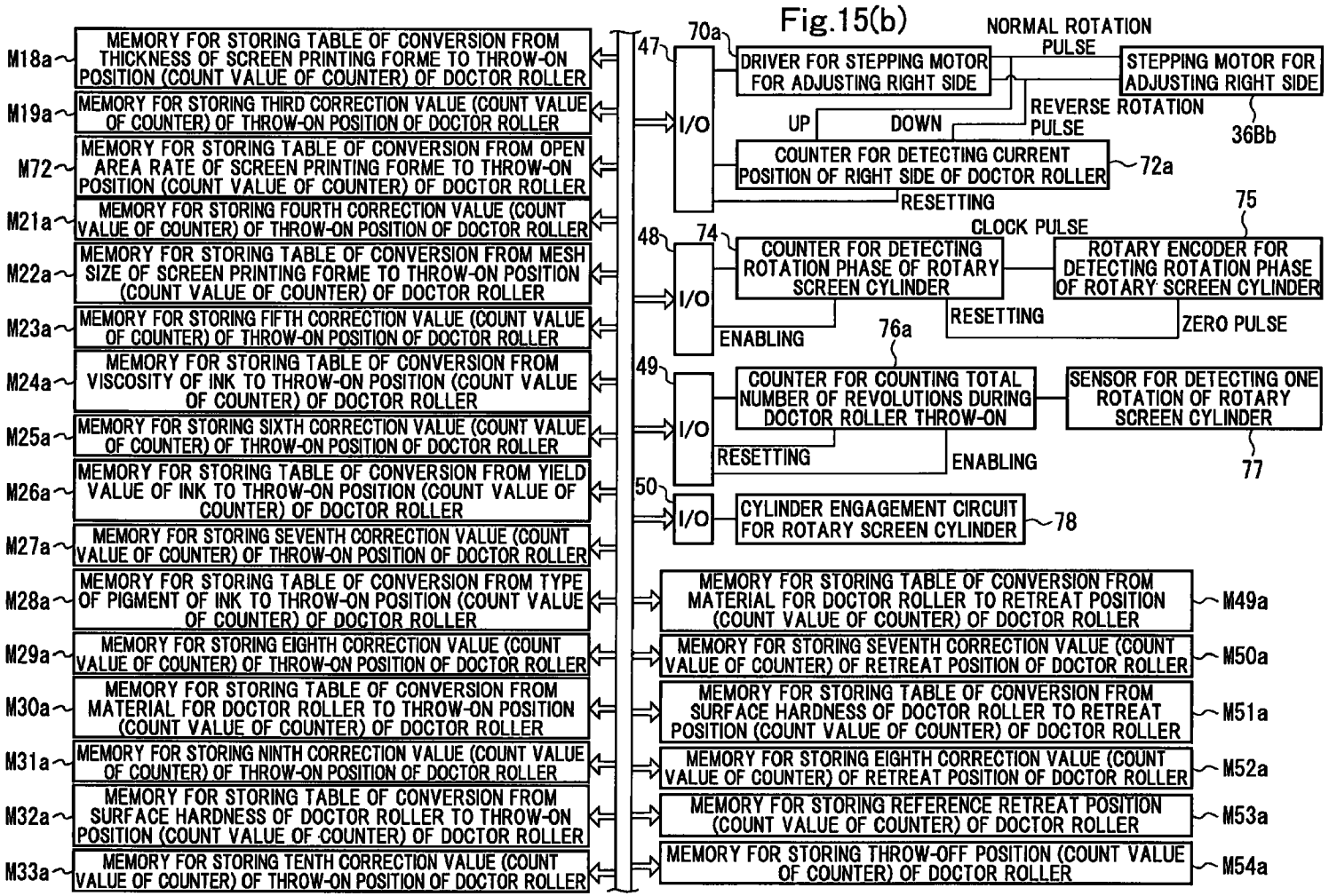
Fig.15(b)
70a
DRIVER FOR STEPPING MOTOR FOR ADJUSTING RIGHT SIDE
NORMAL ROTATION PULSE
STEPPING MOTOR FOR ADJUSTING RIGHT SIDE
36Bb
REVERSE ROTATION PULSE
UP
DOWN
COUNTER FOR DETECTING CURRENT POSITION OF RIGHT SIDE OF DOCTOR ROLLER
72a
RESETTING
I/O
47
74
COUNTER FOR DETECTING ROTATION PHASE OF ROTARY SCREEN CYLINDER
CLOCK PULSE
ROTARY ENCODER FOR DETECTING ROTATION PHASE OF ROTARY SCREEN CYLINDER
75
ZERO PULSE
RESETTING
ENABLING
76a
48
COUNTER FOR COUNTING TOTAL NUMBER OF REVOLUTIONS DURING DOCTOR ROLLER THROW-ON
SENSOR FOR DETECTING ONE ROTATION OF ROTARY SCREEN CYLINDER
77
ENABLING
RESETTING
49
CYLINDER ENGAGEMENT CIRCUIT FOR ROTARY SCREEN CYLINDER
78
50
MEMORY FOR STORING TABLE OF CONVERSION FROM MATERIAL FOR DOCTOR ROLLER TO RETREAT POSITION (COUNT VALUE OF COUNTER) OF DOCTOR ROLLER
M49a
MEMORY FOR STORING SEVENTH CORRECTION VALUE (COUNT VALUE OF COUNTER) OF RETREAT POSITION OF DOCTOR ROLLER
M50a
MEMORY FOR STORING TABLE OF CONVERSION FROM SURFACE HARDNESS OF DOCTOR ROLLER TO RETREAT POSITION (COUNT VALUE OF COUNTER) OF DOCTOR ROLLER
M51a
MEMORY FOR STORING EIGHTH CORRECTION VALUE (COUNT VALUE OF COUNTER) OF RETREAT POSITION OF DOCTOR ROLLER
M52a
MEMORY FOR STORING REFERENCE RETREAT POSITION (COUNT VALUE OF COUNTER) OF DOCTOR ROLLER
M53a
MEMORY FOR STORING THROW-OFF POSITION (COUNT VALUE OF COUNTER) OF DOCTOR ROLLER
M54a
MEMORY FOR STORING TABLE OF CONVERSION FROM THICKNESS OF SCREEN PRINTING FORME TO THROW-ON POSITION (COUNT VALUE OF COUNTER) OF DOCTOR ROLLER
M18a
MEMORY FOR STORING THIRD CORRECTION VALUE (COUNT VALUE OF COUNTER) OF THROW-ON POSITION OF DOCTOR ROLLER
M19a
MEMORY FOR STORING TABLE OF CONVERSION FROM OPEN AREA RATE OF SCREEN PRINTING FORME TO THROW-ON POSITION (COUNT VALUE OF COUNTER) OF DOCTOR ROLLER
M72
MEMORY FOR STORING FOURTH CORRECTION VALUE (COUNT VALUE OF COUNTER) OF THROW-ON POSITION OF DOCTOR ROLLER
M21a
MEMORY FOR STORING TABLE OF CONVERSION FROM MESH SIZE OF SCREEN PRINTING FORME TO THROW-ON POSITION (COUNT VALUE OF COUNTER) OF DOCTOR ROLLER
M22a
MEMORY FOR STORING FIFTH CORRECTION VALUE (COUNT VALUE OF COUNTER) OF THROW-ON POSITION OF DOCTOR ROLLER
M23a
MEMORY FOR STORING TABLE OF CONVERSION FROM VISCOSITY OF INK TO THROW-ON POSITION (COUNT VALUE OF COUNTER) OF DOCTOR ROLLER
M24a
MEMORY FOR STORING SIXTH CORRECTION VALUE (COUNT VALUE OF COUNTER) OF THROW-ON POSITION OF DOCTOR ROLLER
M25a
MEMORY FOR STORING TABLE OF CONVERSION FROM YIELD VALUE OF INK TO THROW-ON POSITION (COUNT VALUE OF COUNTER) OF DOCTOR ROLLER
M26a
MEMORY FOR STORING SEVENTH CORRECTION VALUE (COUNT VALUE OF COUNTER) OF THROW-ON POSITION OF DOCTOR ROLLER
M27a
MEMORY FOR STORING TABLE OF CONVERSION FROM TYPE OF PIGMENT OF INK TO THROW-ON POSITION (COUNT VALUE OF COUNTER) OF DOCTOR ROLLER
M28a
MEMORY FOR STORING EIGHTH CORRECTION VALUE (COUNT VALUE OF COUNTER) OF THROW-ON POSITION OF DOCTOR ROLLER
M29a
MEMORY FOR STORING TABLE OF CONVERSION FROM MATERIAL FOR DOCTOR ROLLER TO THROW-ON POSITION (COUNT VALUE OF COUNTER) OF DOCTOR ROLLER
M30a
MEMORY FOR STORING NINTH CORRECTION VALUE (COUNT VALUE OF COUNTER) OF THROW-ON POSITION OF DOCTOR ROLLER
M31a
MEMORY FOR STORING TABLE OF CONVERSION FROM SURFACE HARDNESS OF DOCTOR ROLLER TO THROW-ON POSITION (COUNT VALUE OF COUNTER) OF DOCTOR ROLLER
M32a
MEMORY FOR STORING TENTH CORRECTION VALUE (COUNT VALUE OF COUNTER) OF THROW-ON POSITION OF DOCTOR ROLLER
M33a

LIQUID TRANSFER MEMBER PRESSING FORCE ADJUSTING METHOD AND APPARATUS OF ROTARY STENCIL PRINTING PLATE LIQUID COATING MACHINE

BACKGROUND OF THE INVENTION

1. Field of the Invention

This invention relates to a liquid transfer member pressing force adjusting method and apparatus of a rotary stencil printing plate liquid coating machine such as a rotary screen printing press. In the descriptions to follow, examples, in which a rotary screen printing press is used as a rotary stencil printing plate liquid coating machine, and ink is used as a liquid to be coated on a material to be liquid coated, will be explained to facilitate understanding. It goes without saying, however, that the present invention is similarly applied to a liquid coating machine using a stencil printing plate put to other uses instead of the rotary screen printing press, the liquid coating machine using a rotary screen coater for coating varnish in place of ink. Furthermore, the examples using a machine for coating the liquid on a sheet as the rotary stencil printing plate liquid coating machine will be explained. Needless to say, however, the present invention is similarly applied to a machine for coating the liquid on a web. If the liquid is coated on the web, a pressing roll without a notch for accommodating a gripper is used as a pressing body opposing a stencil printing plate cylinder, instead of an impression cylinder to be described below.

2. Description of the Related Art

A rotary screen printing press equipped with a squeegee or a doctor roller (ink transfer member=liquid transfer member), which is located within a rotary screen cylinder (stencil printing plate cylinder) and, during printing (liquid coating), is brought into contact with the inner peripheral surface of a screen printing forme (stencil printing plate), while being pressed against it, to transfer ink (liquid) stored within the rotary screen cylinder to a material to be printed (material to be liquid coated) supplied between the rotary screen cylinder and an impression cylinder through the holes of the screen printing forme, is generally well known.

With the conventional rotary screen printing press described above, an operator manually adjusts the pressing force of the squeegee or doctor roller acting on the inner peripheral surface of the screen printing forme in the rotary screen cylinder while printing.

Thus, the operator is burdened, and time is taken until normal printing products can be obtained by printing. Consequently, the rate of operation decreases and, during this process, a large amount of wasted paper occurs.

The present invention has been accomplished in light of the above-described problems. It is an object of the invention to provide a liquid transfer member pressing force adjusting method and apparatus of a rotary stencil printing plate liquid coating machine, which can lessen burden on the operator, increase the rate of operation, and curtail the occurrence of wasted paper.

SUMMARY OF THE INVENTION

A first aspect of the present invention is a liquid transfer member pressing force adjusting method of a rotary stencil printing plate liquid coating machine including, a stencil printing plate cylinder which supports a stencil printing plate and is supported rotatably, a pressing body which is provided to oppose the stencil printing plate cylinder, and is supported rotatably, and a liquid transfer member which is located within the stencil printing plate cylinder and, during liquid coating, contacts an inner peripheral surface of the stencil printing plate, while being pressed against the inner peripheral surface of the stencil printing plate, to transfer a liquid stored within the stencil printing plate cylinder to a material to be liquid coated, which is supplied between the stencil printing plate cylinder and the pressing body, via holes of the stencil printing plate, wherein a pressing force of the liquid transfer member acting on the inner peripheral surface of the stencil printing plate during the liquid coating is obtained from a type and a thickness of the material to be liquid coated.

The pressing force of the liquid transfer member acting on the inner peripheral surface of the stencil printing plate during the liquid coating may be obtained from a type of the stencil printing plate.

The pressing force of the liquid transfer member acting on the inner peripheral surface of the stencil printing plate during the liquid coating may be obtained from a picture pattern area rate of a picture pattern to be applied by the liquid coating to the material to be liquid coated, and from a size of each of the holes of the stencil printing plate.

The pressing force of the liquid transfer member acting on the inner peripheral surface of the stencil printing plate during the liquid coating may be obtained from a type of the liquid used in the liquid coating.

The pressing force of the liquid transfer member acting on the inner peripheral surface of the stencil printing plate during the liquid coating may be obtained from a type of the liquid transfer member.

Adjustment of the pressing force of the liquid transfer member acting on the inner peripheral surface of the stencil printing plate may be made by adjusting a position of the liquid transfer member.

Adjustment of the position of the liquid transfer member may be made by a motor.

A second aspect of the present invention is a liquid transfer member pressing force adjusting apparatus of a rotary stencil printing plate liquid coating machine including, a stencil printing plate cylinder which supports a stencil printing plate and is supported rotatably, a pressing body which is provided to oppose the stencil printing plate cylinder, and is supported rotatably, and a liquid transfer member which is located within the stencil printing plate cylinder and, during liquid coating, contacts an inner peripheral surface of the stencil printing plate, while being pressed against the inner peripheral surface of the stencil printing plate, to transfer a liquid stored within the stencil printing plate cylinder to a material to be liquid coated, which is supplied between the stencil printing plate cylinder and the pressing body, via holes of the stencil printing plate, the liquid transfer member pressing force adjusting apparatus comprising control means which controls a pressing force of the liquid transfer member acting on the inner peripheral surface of the stencil printing plate during the liquid coating in accordance with a type and a thickness of the material to be liquid coated.

The control means may control the pressing force of the liquid transfer member, which acts on the inner peripheral surface of the stencil printing plate during the liquid coating, in accordance with a type of the stencil printing plate.

The control means may control the pressing force of the liquid transfer member, which acts on the inner peripheral surface of the stencil printing plate during the liquid coating, in accordance with a picture pattern area rate of a picture pattern to be applied by the liquid coating to the material to be liquid coated, and in accordance with a size of each of the holes of the stencil printing plate.

The control means may control the pressing force of the liquid transfer member, which acts on the inner peripheral surface of the stencil printing plate during the liquid coating, in accordance with a type of the liquid used in the liquid coating.

The control means may control the pressing force of the liquid transfer member, which acts on the inner peripheral surface of the stencil printing plate during the liquid coating, in accordance with a type of the liquid transfer member.

The control means may make adjustment of the pressing force of the liquid transfer member acting on the inner peripheral surface of the stencil printing plate by controlling a position of the liquid transfer member.

The control means may make adjustment of the position of the liquid transfer member by drivingly controlling a motor.

According to the features of the present invention, the position of the liquid transfer member during liquid coating can be preset, in conformity with the type of the material to be liquid coated (i.e., difference in the material, e.g., paper, cloth, film or corrugated board), the thickness of the material to be liquid coated, the type of the stencil printing plate, the picture pattern area rate of the picture pattern to be applied by liquid coating to the material to be liquid coated and the size of each hole of the stencil printing plate, the type of the liquid, and the type of the liquid transfer member. Thus, burden on the operator can be lessened by automation, and the rate of operation can be increased and the occurrence of wasted paper can be curtailed by shortening the period of time until normally liquid coated materials can be obtained by liquid coating.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4(*b*) is an operating state view;

FIG. 5(*b*) is a control block diagram of the squeegee throw-on and throw-off control device;

FIG. 5(*c*) is a control block diagram of the squeegee throw-on and throw-off control device;

FIG. 6(*b*) is a motion flow chart of the squeegee throw-on and throw-off control device;

FIG. 6(*c*) is a motion flow chart of the squeegee throw-on and throw-off control device;

FIG. 6(*d*) is a motion flow chart of the squeegee throw-on and throw-off control device;

FIG. 6(*e*) is a motion flow chart of the squeegee throw-on and throw-off control device;

FIG. 7(*b*) is a motion flow chart of the squeegee throw-on and throw-off control device;

FIG. 7(*c*) is a motion flow chart of the squeegee throw-on and throw-off control device;

FIG. 7(*d*) is a motion flow chart of the squeegee throw-on and throw-off control device;

FIG. 8(*b*) is a motion flow chart of the squeegee throw-on and throw-off control device;

FIG. 8(*c*) is a motion flow chart of the squeegee throw-on and throw-off control device;

FIG. 8(*d*) is a motion flow chart of the squeegee throw-on and throw-off control device;

FIG. 9(*b*) is a motion flow chart of the squeegee throw-on and throw-off control device;

FIG. 9(*c*) is a motion flow chart of the squeegee throw-on and throw-off control device;

FIG. 9(*d*) is a motion flow chart of the squeegee throw-on and throw-off control device;

FIG. 10(*b*) is a motion flow chart of the squeegee throw-on and throw-off control device;

FIG. 10(*c*) is a motion flow chart of the squeegee throw-on and throw-off control device;

FIG. 10(*d*) is a motion flow chart of the squeegee throw-on and throw-off control device;

FIG. 11(*b*) is a motion flow chart of the squeegee throw-on and throw-off control device;

FIG. 11(*c*) is a motion flow chart of the squeegee throw-on and throw-off control device;

FIG. 11(*d*) is a motion flow chart of the squeegee throw-on and throw-off control device;

FIG. 12(*b*) is a motion flow chart of the squeegee throw-on and throw-off control device;

FIG. 12(*c*) is a motion flow chart of the squeegee throw-on and throw-off control device;

FIG. 12(*d*) is a motion flow chart of the squeegee throw-on and throw-off control device;

FIG. 14(*b*) is an explanation drawing of an ink supply pipe;

FIG. 15(*b*) is a control block diagram of the doctor roller throw-on and throw-off control device;

FIG. 15(*c*) is a control block diagram of the doctor roller throw-on and throw-off control device;

FIG. 16(*b*) is a motion flow chart of the doctor roller throw-on and throw-off control device;

FIG. 16(*c*) is a motion flow chart of the doctor roller throw-on and throw-off control device;

FIG. 16(*d*) is a motion flow chart of the doctor roller throw-on and throw-off control device;

FIG. 16(*e*) is a motion flow chart of the doctor roller throw-on and throw-off control device;

FIG. 17(*b*) is a motion flow chart of the doctor roller throw-on and throw-off control device;

FIG. 17(*c*) is a motion flow chart of the doctor roller throw-on and throw-off control device;

FIG. 17(*d*) is a motion flow chart of the doctor roller throw-on and throw-off control device;

FIG. 18(*b*) is a motion flow chart of the doctor roller throw-on and throw-off control device;

FIG. 18(*c*) is a motion flow chart of the doctor roller throw-on and throw-off control device;

FIG. 19(*b*) is a motion flow chart of the doctor roller throw-on and throw-off control device;

FIG. 19(*c*) is a motion flow chart of the doctor roller throw-on and throw-off control device;

FIG. 20(*b*) is a motion flow chart of the doctor roller throw-on and throw-off control device;

FIG. 20(*c*) is a motion flow chart of the doctor roller throw-on and throw-off control device;

FIG. 21(*b*) is a motion flow chart of the doctor roller throw-on and throw-off control device;

FIG. 21(*c*) is a motion flow chart of the doctor roller throw-on and throw-off control device;

FIG. 22(*b*) is a motion flow chart of the doctor roller throw-on and throw-off control device; and FIG. 22(*c*) is a motion flow chart of the doctor roller throw-on and throw-off control device.

DETAILED DESCRIPTION OF THE INVENTION

The liquid transfer member pressing force adjusting method and apparatus of a rotary stencil printing plate liquid coating machine according to the present invention will be described in detail by embodiments of the invention by reference to the accompanying drawings.

Embodiment 1

Figure 1:
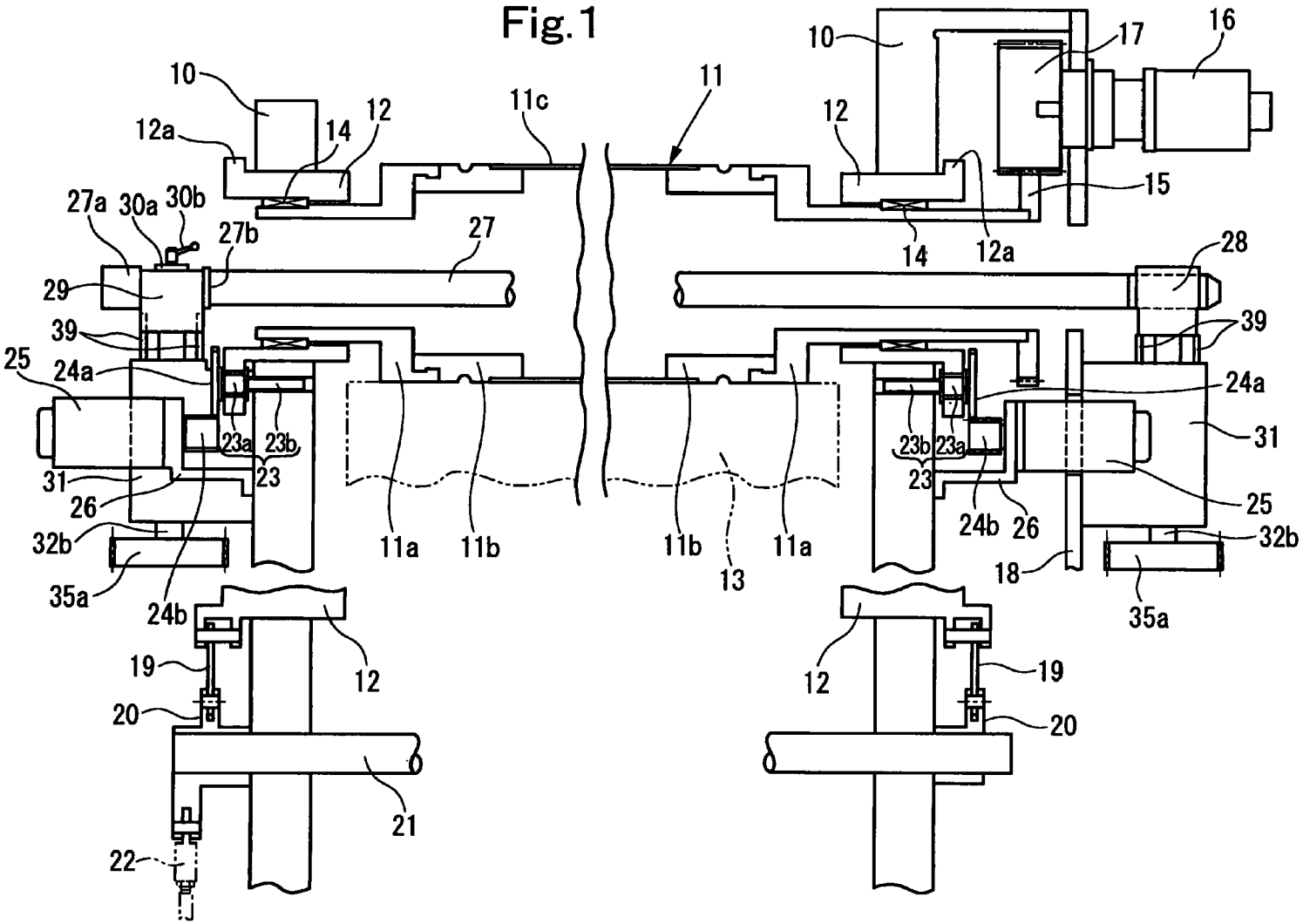
FIG. 1 is a schematic configurational sectional view of a rotary screen printing unit in a rotary screen printing press showing Embodiment 1 of the present invention.
Figure 2:
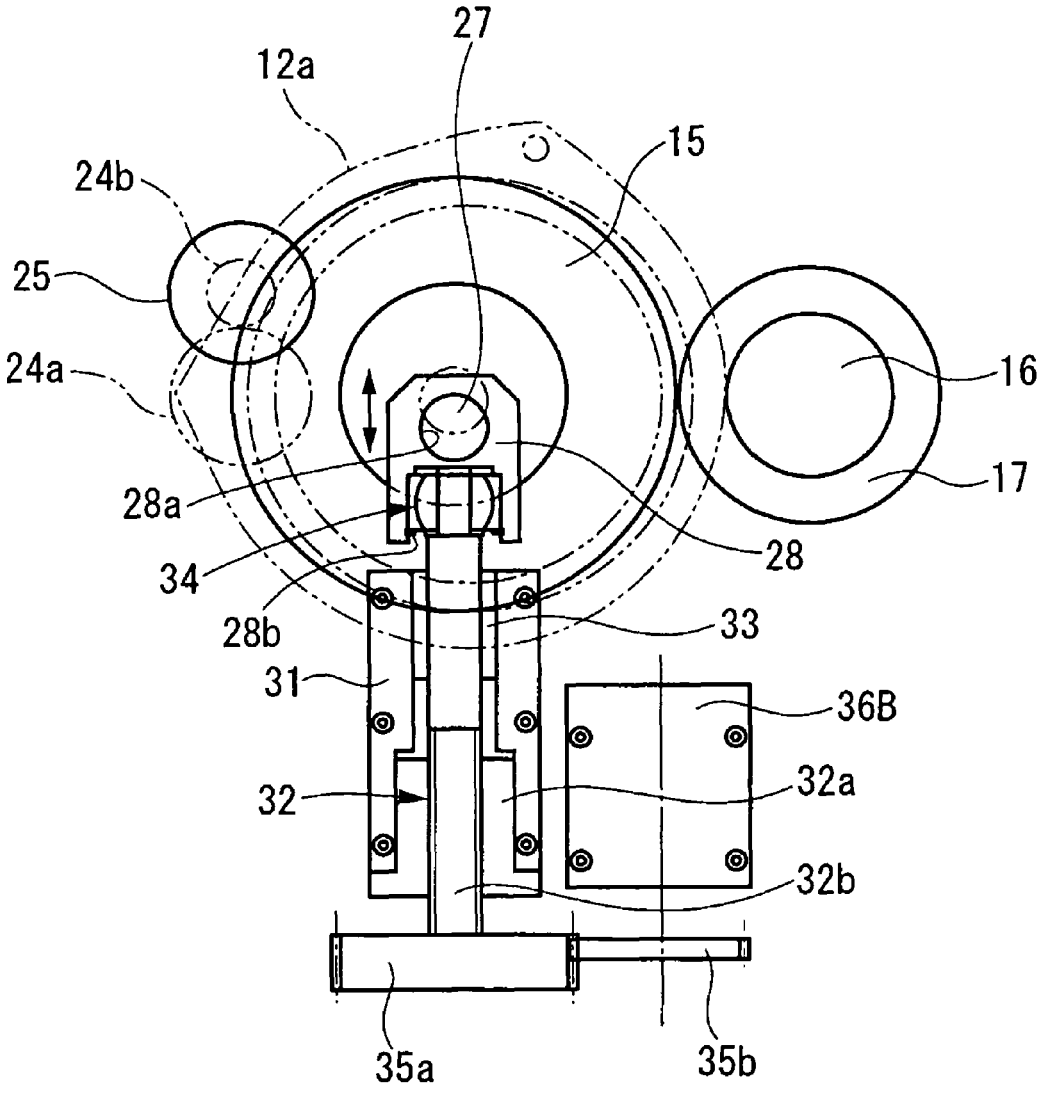
FIG. 2 is a right side view of the rotary screen printing unit in FIG. 1.
Figure 3:
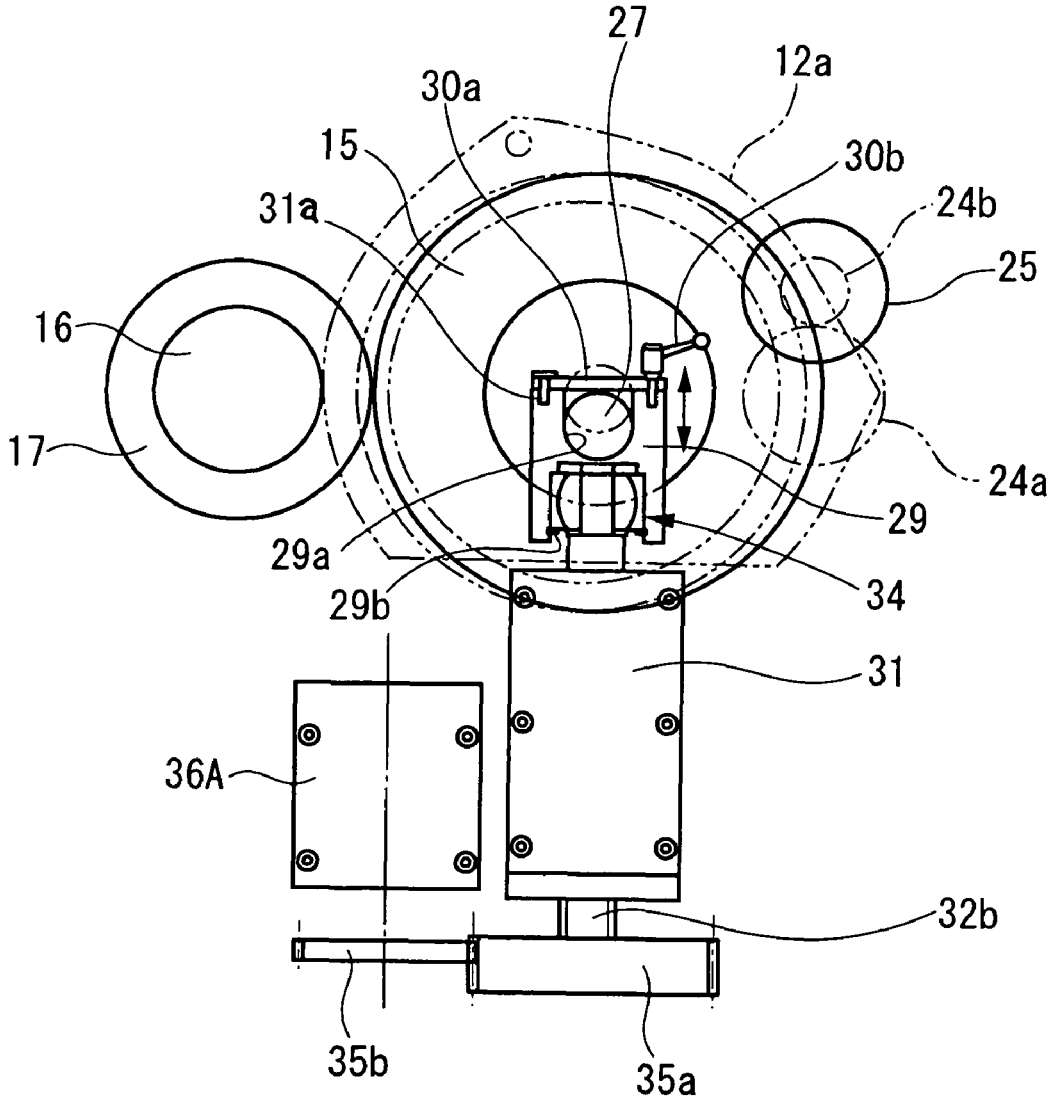
FIG. 3 is a left side view of the rotary screen printing unit in FIG. 1.
Figure 4A:
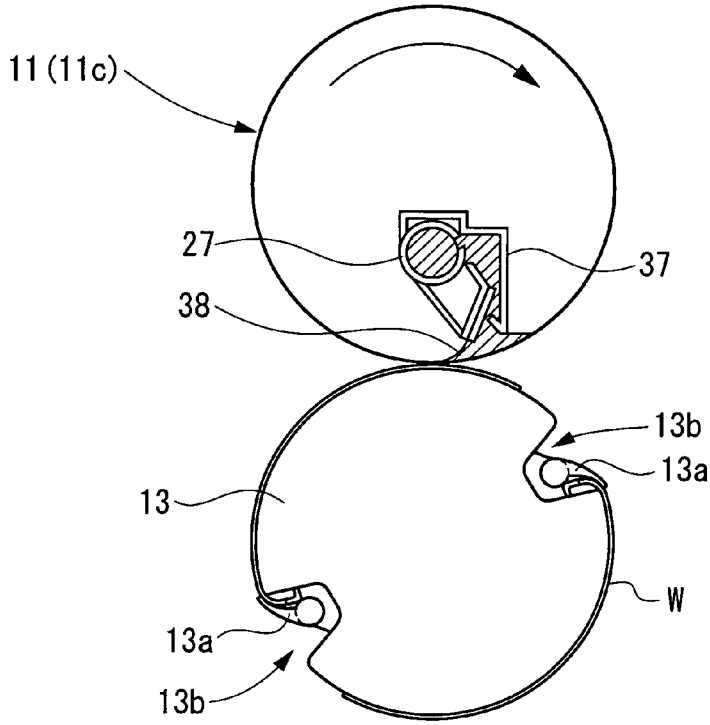
FIG. 4(*a*) is an operating state view.
Figure 4B:
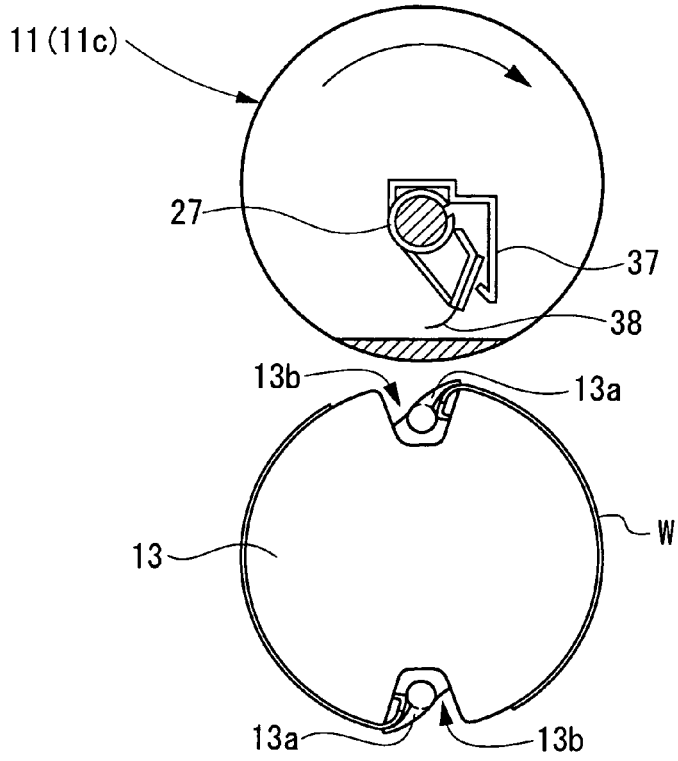
Figure 5A:
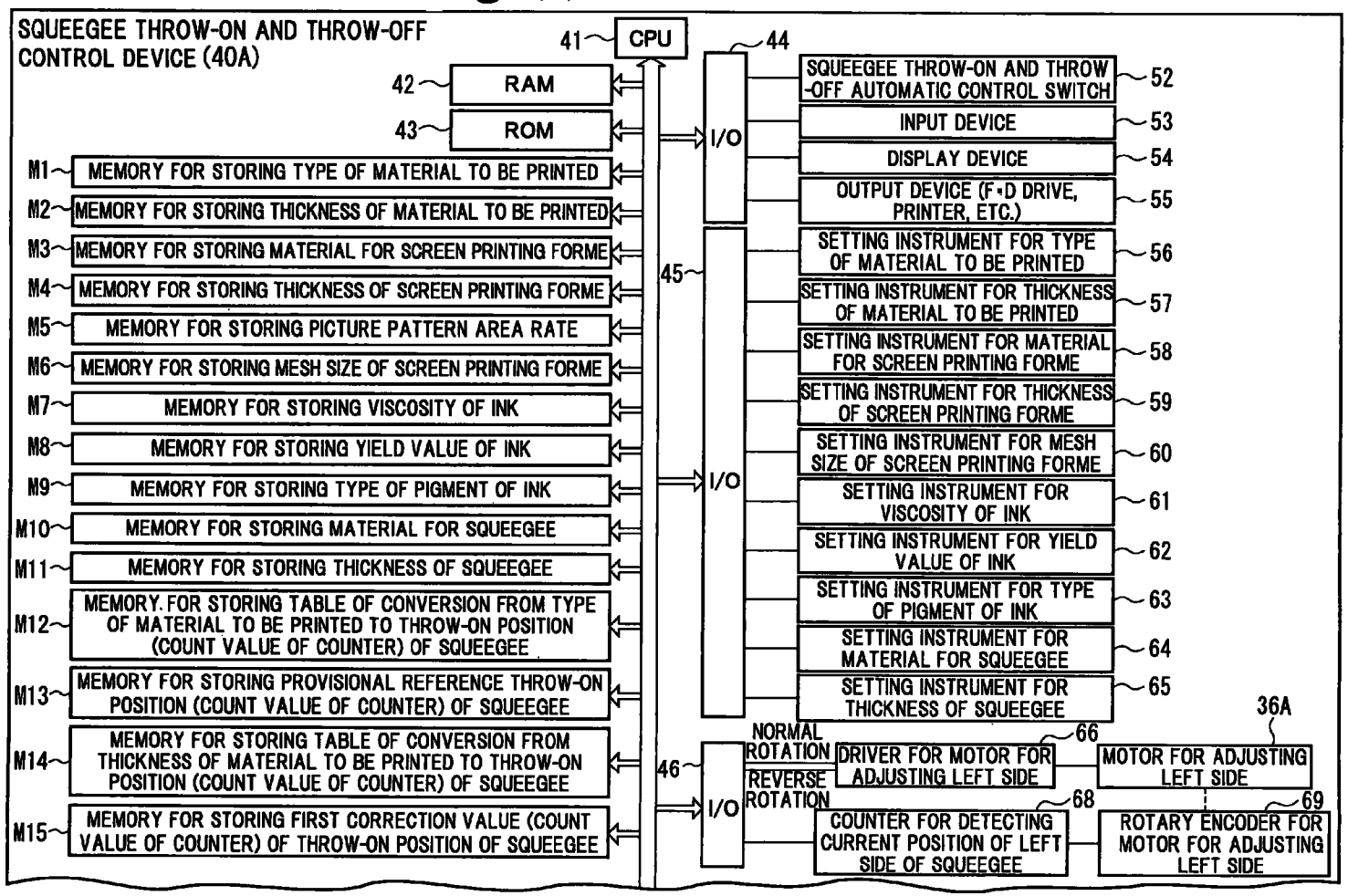
FIG. 5(*a*) is a control block diagram of a squeegee throw-on and throw-off control device.
Figure 5C:
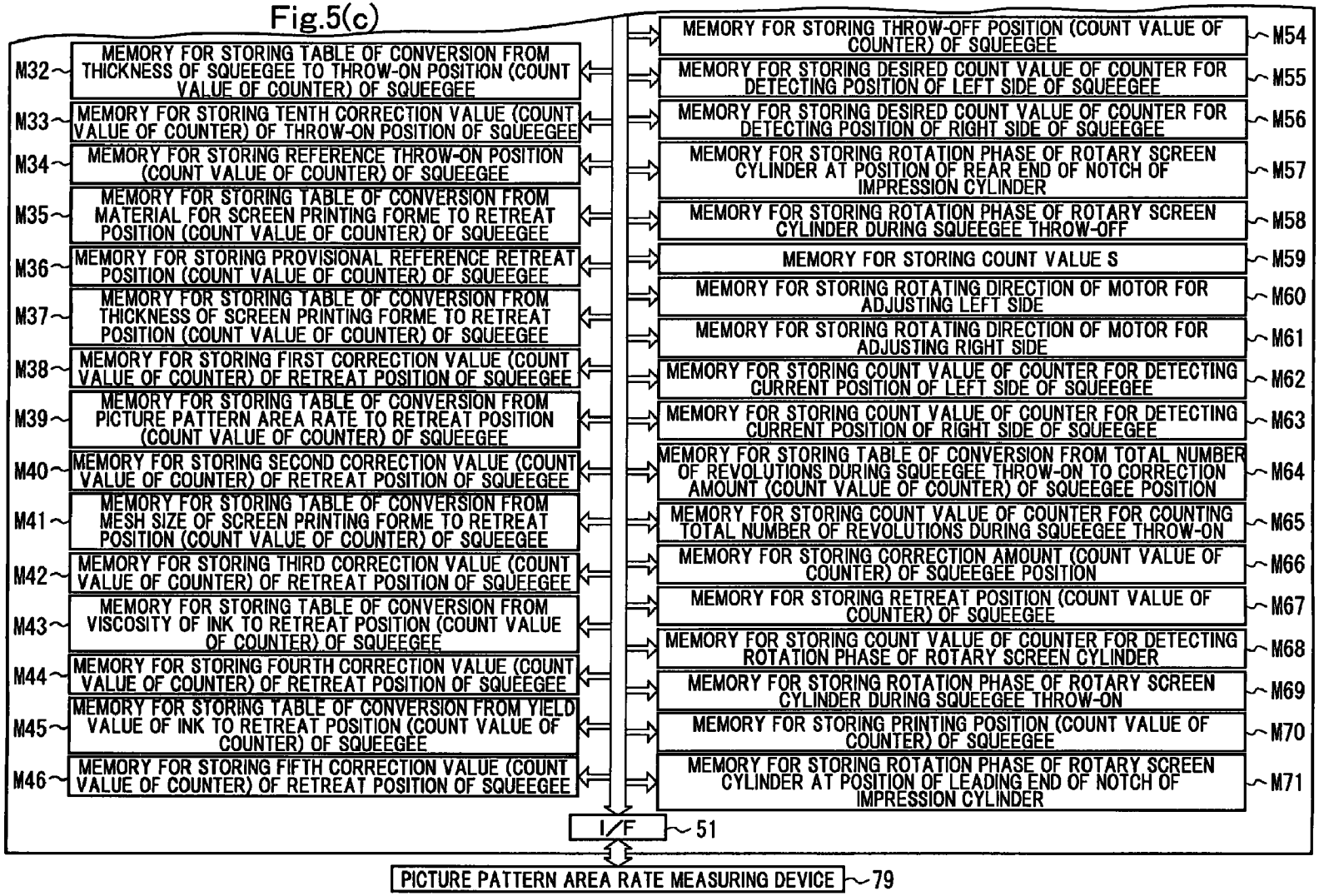
Figure 6A:
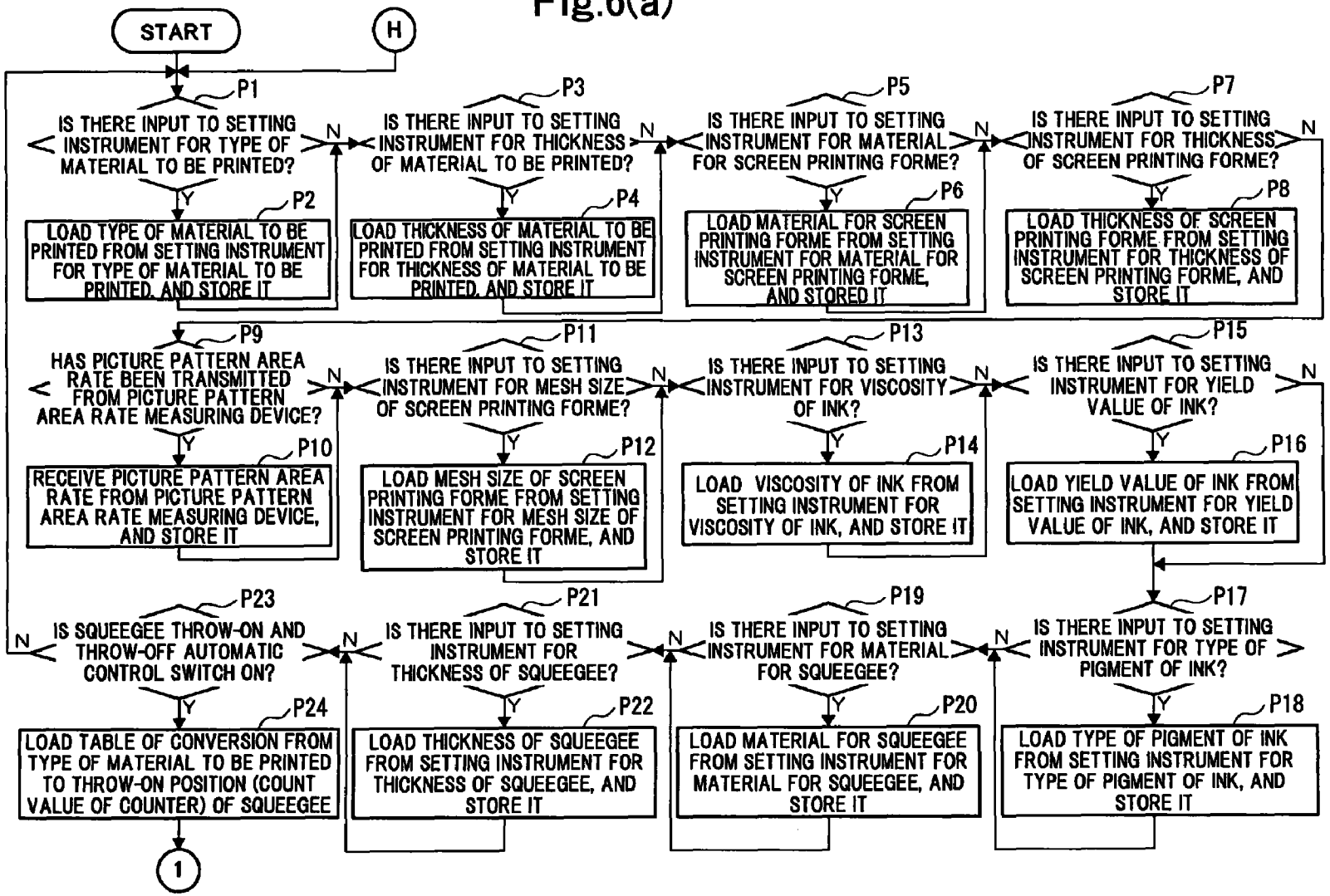
FIG. 6(*a*) is a motion flow chart of the squeegee throw-on and throw-off control device.
Figure 6B:
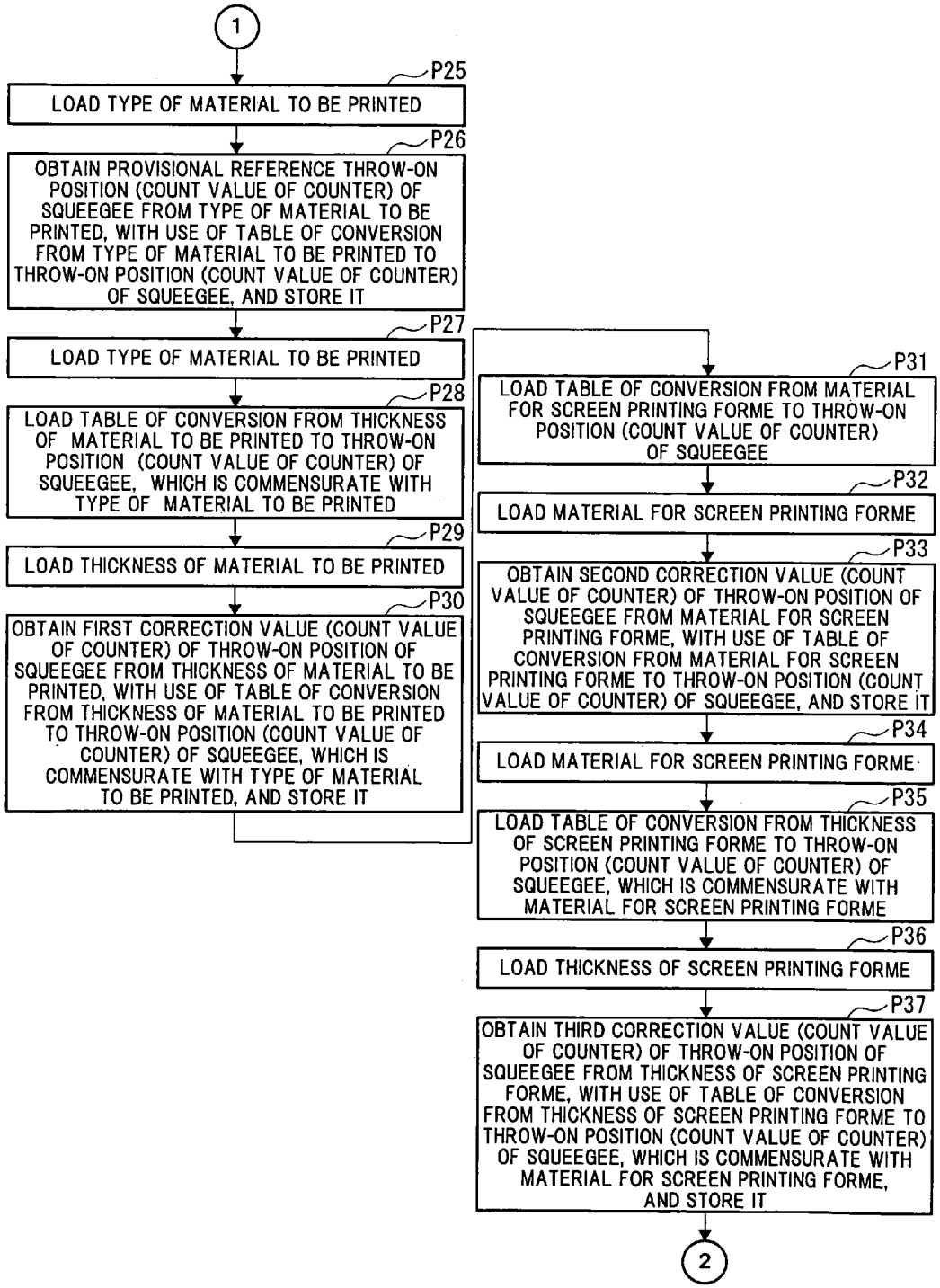
Figure 6C:
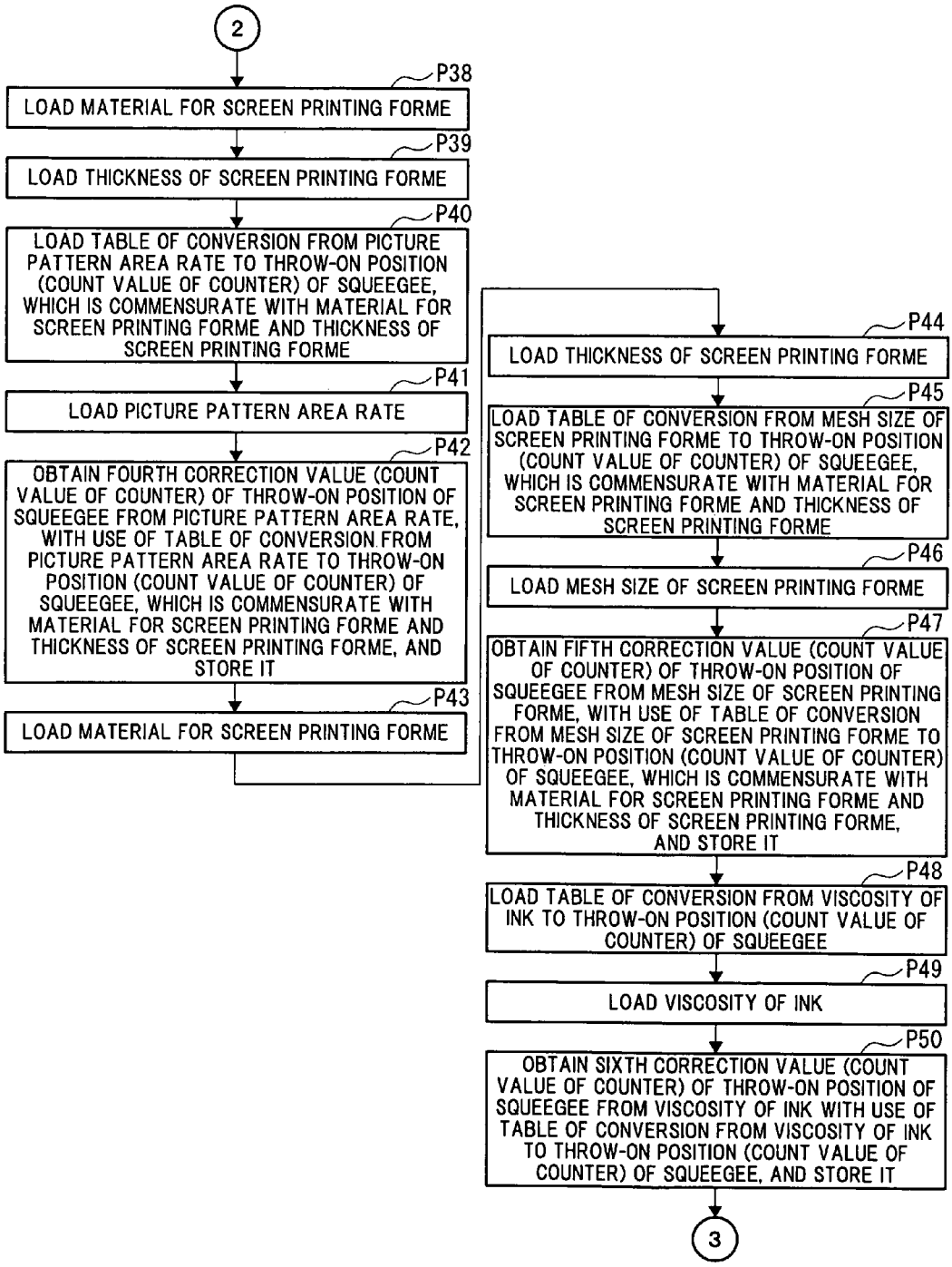
Figure 6D:
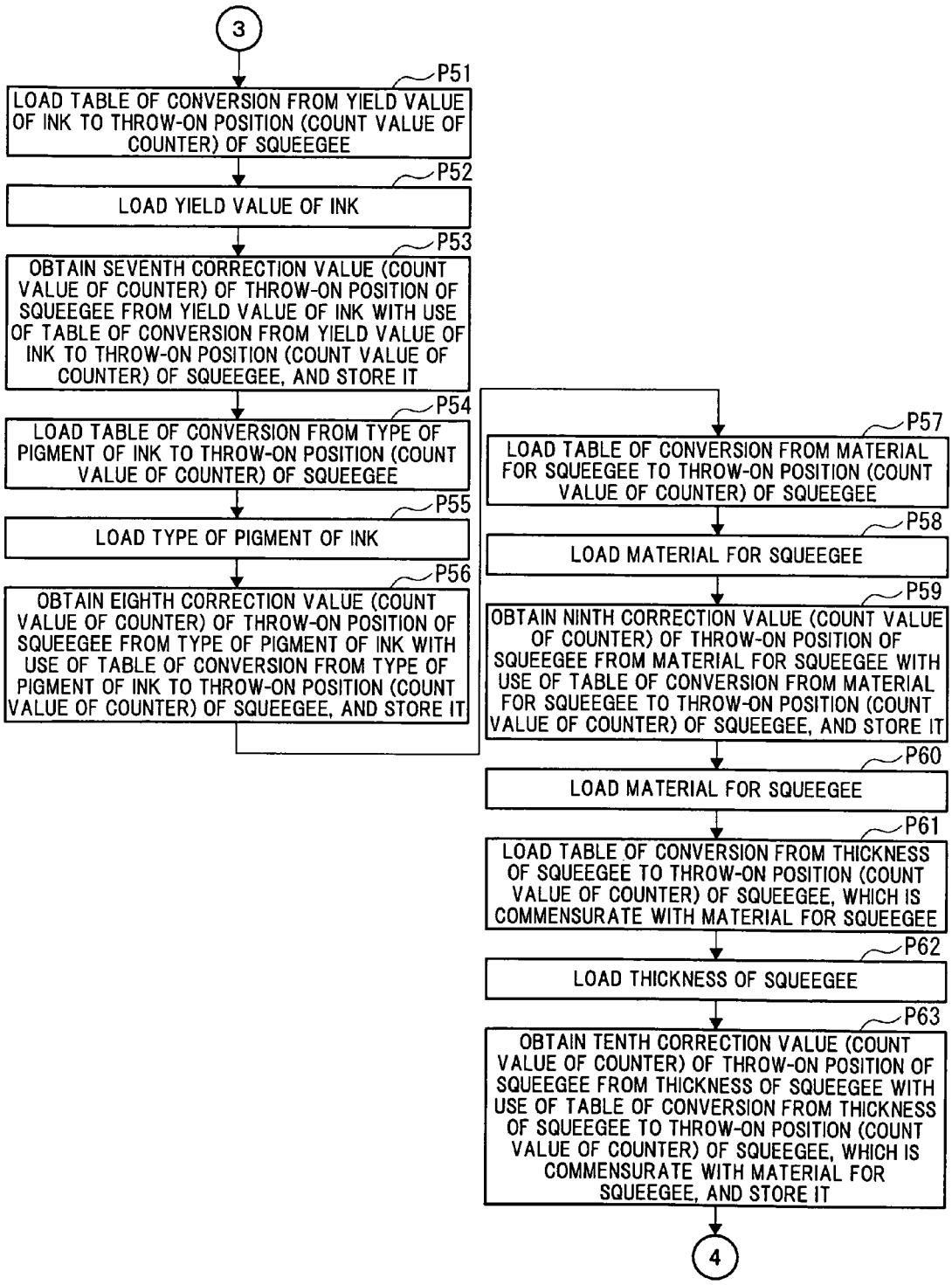
Figure 6E:
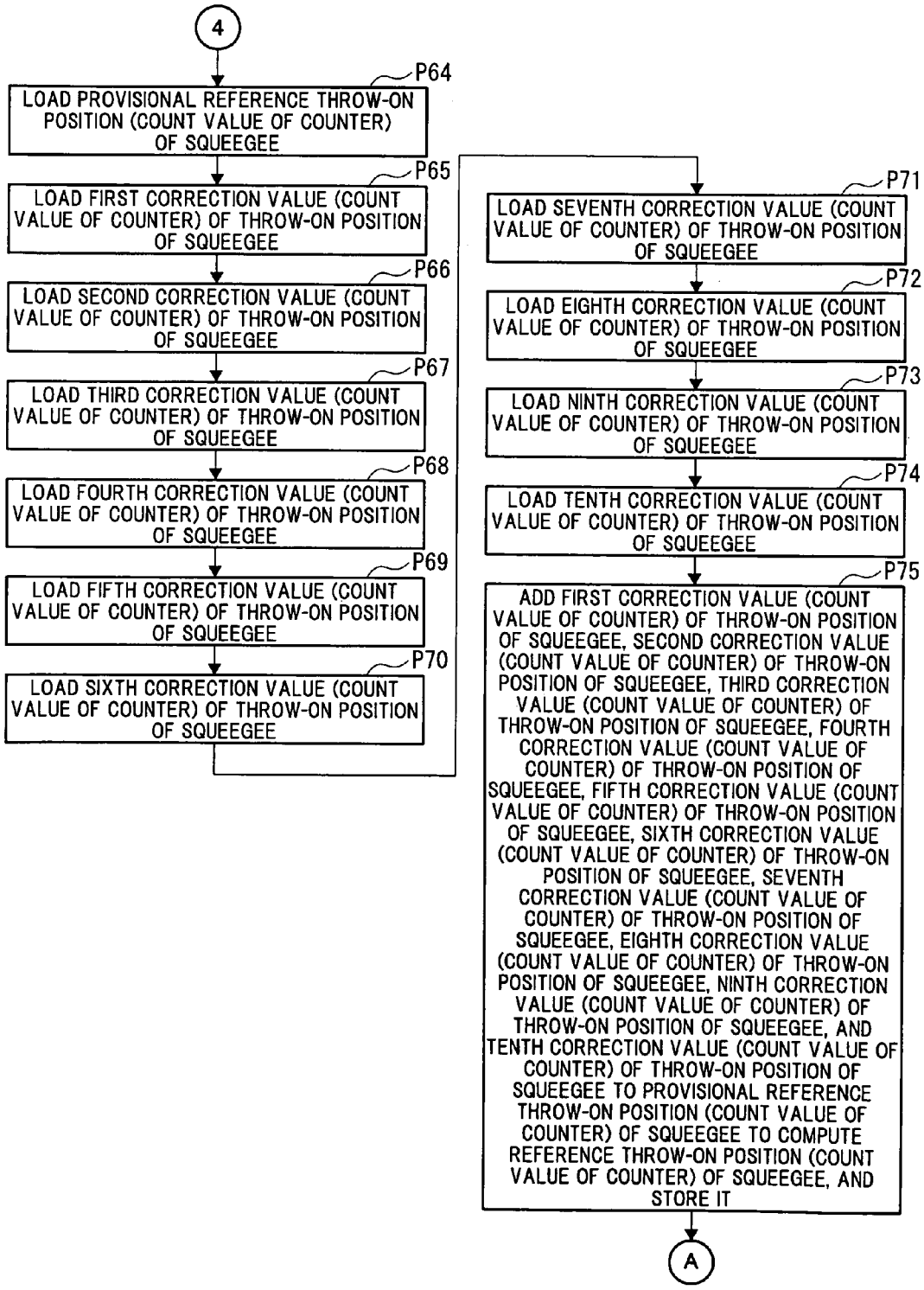
Figure 7A:
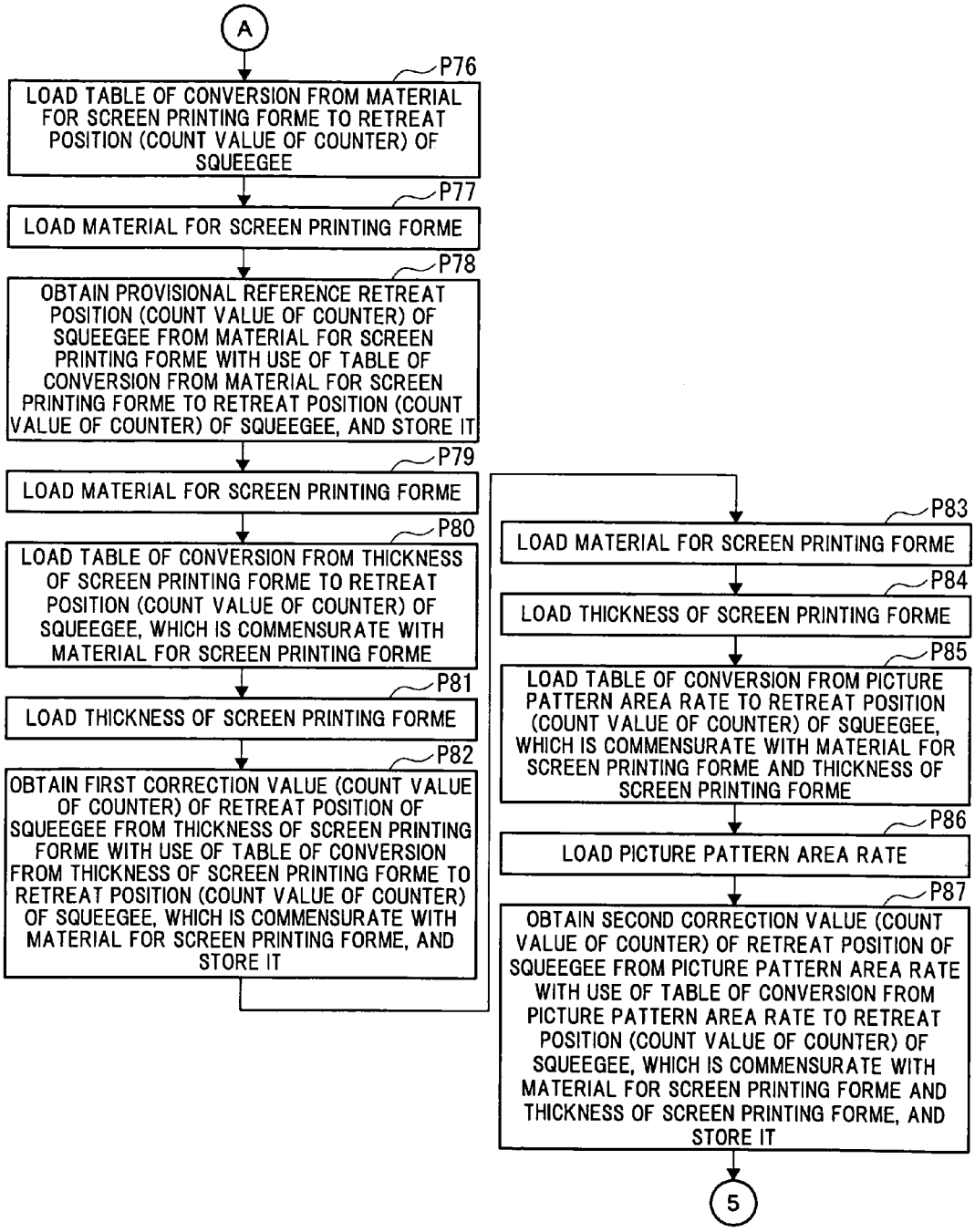
FIG. 7(*a*) is a motion flow chart of the squeegee throw-on and throw-off control device.
Figure 7B:
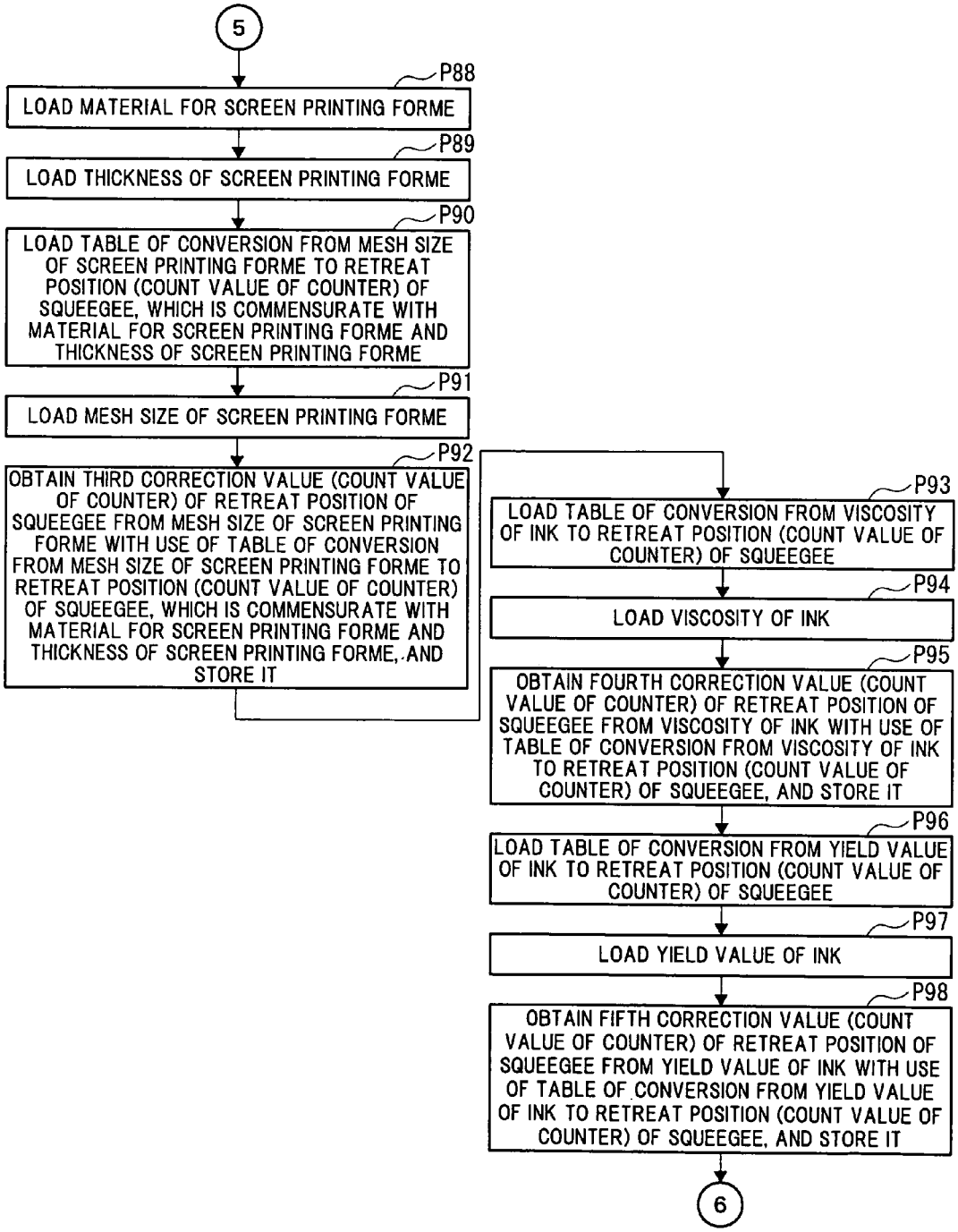
Figure 7C:
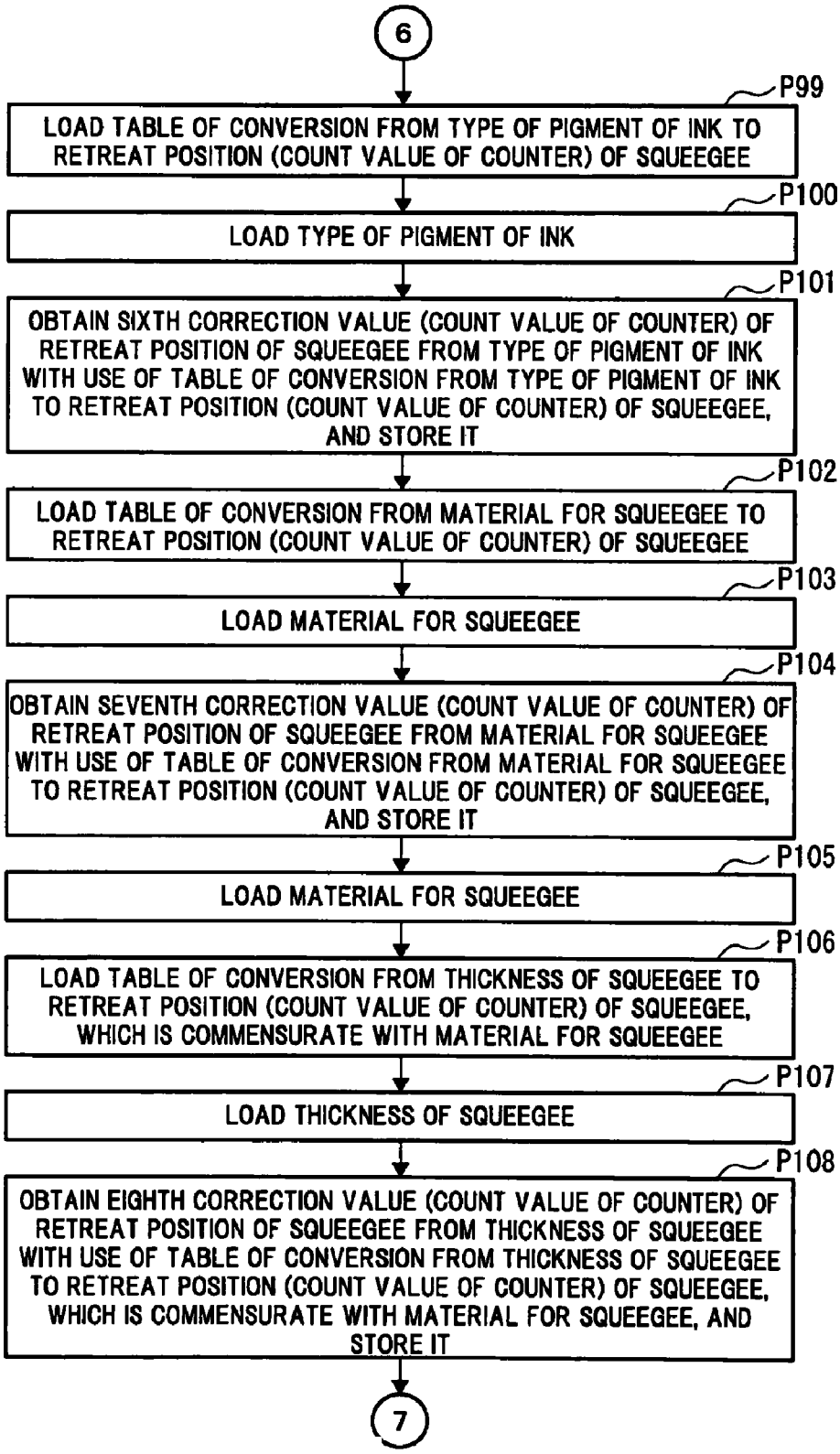
Figure 7D:
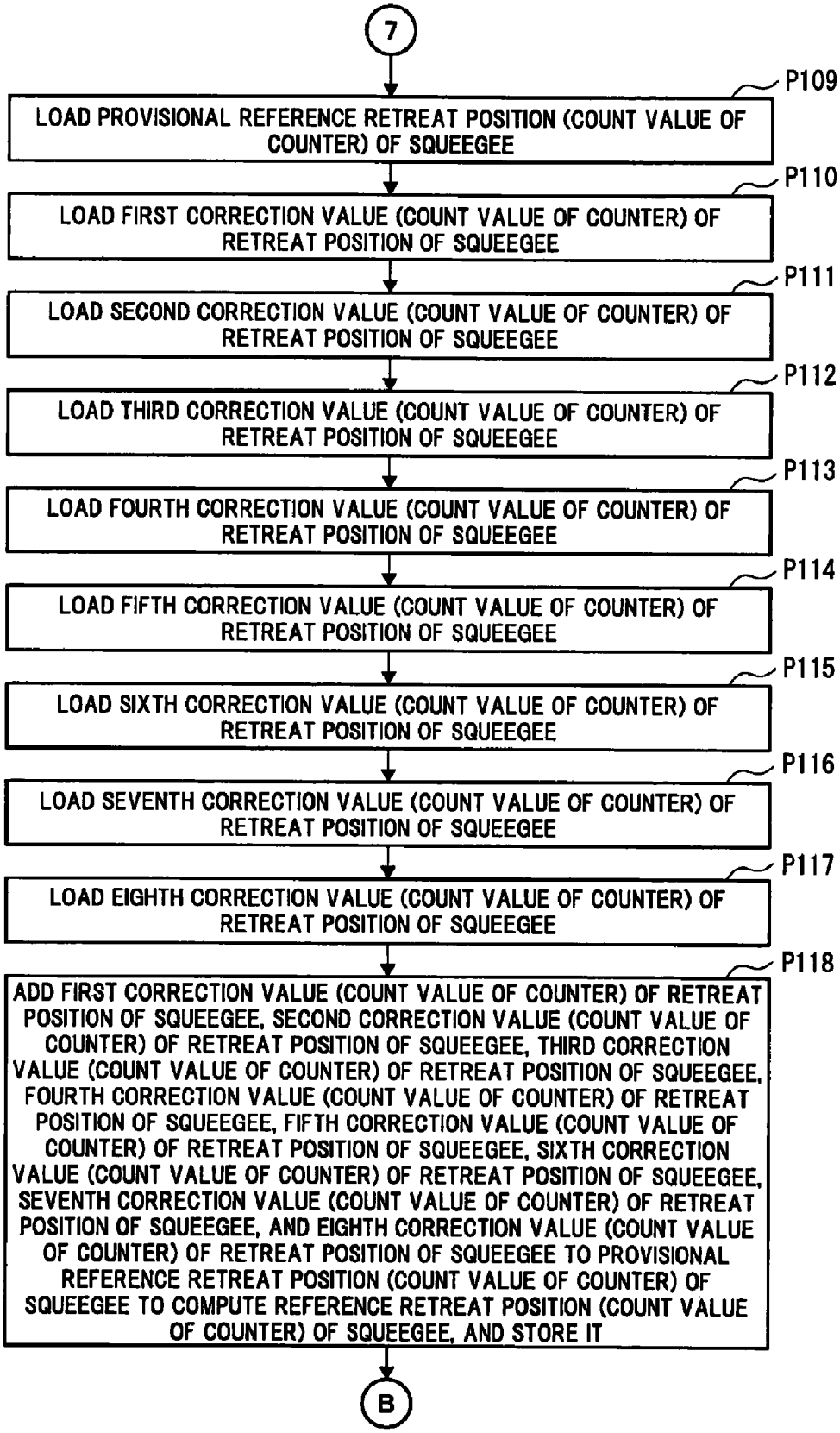
Figure 8A:
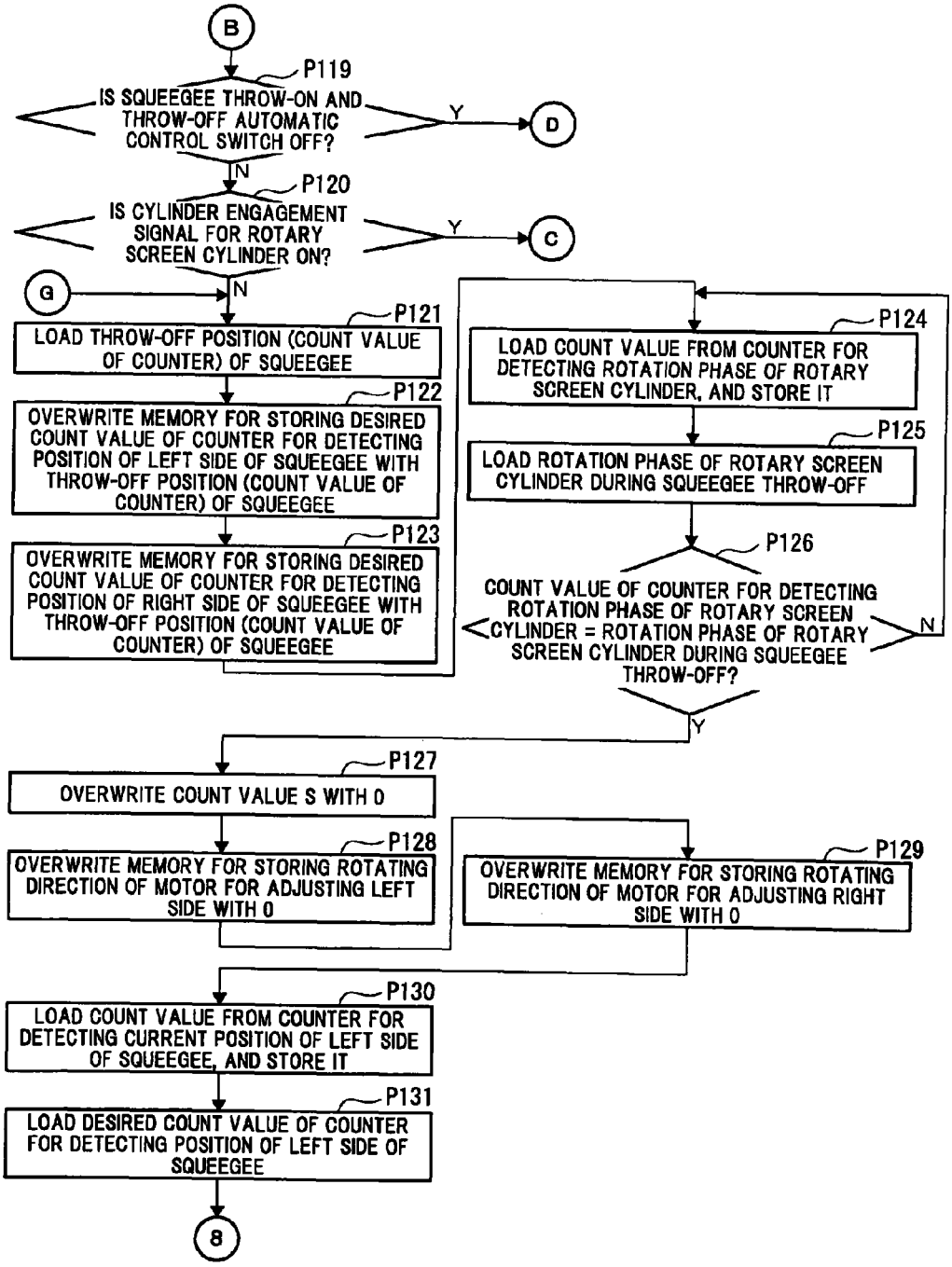
FIG. 8(*a*) is a motion flow chart of the squeegee throw-on and throw-off control device.
Figure 8B:
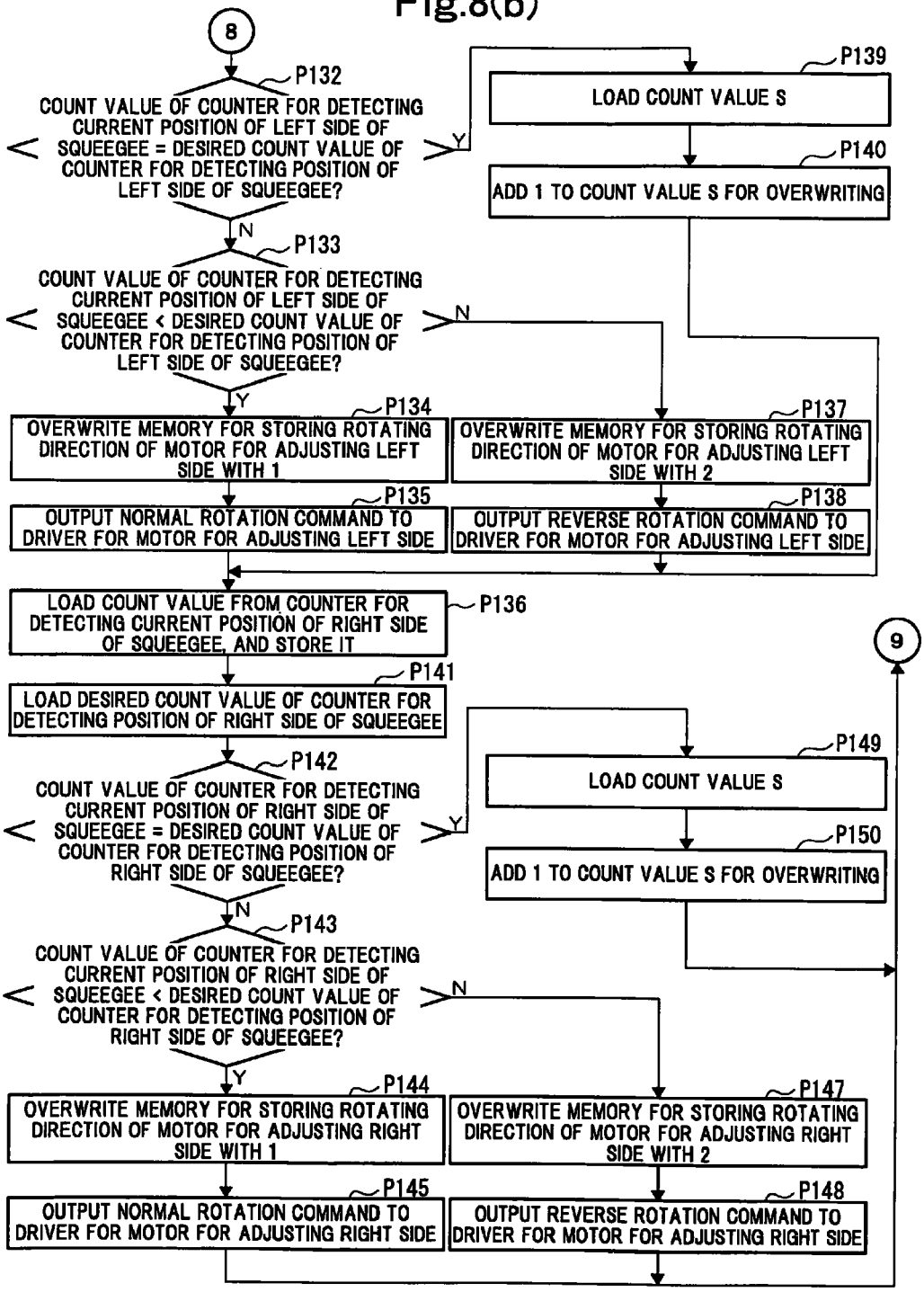
Figure 8C:
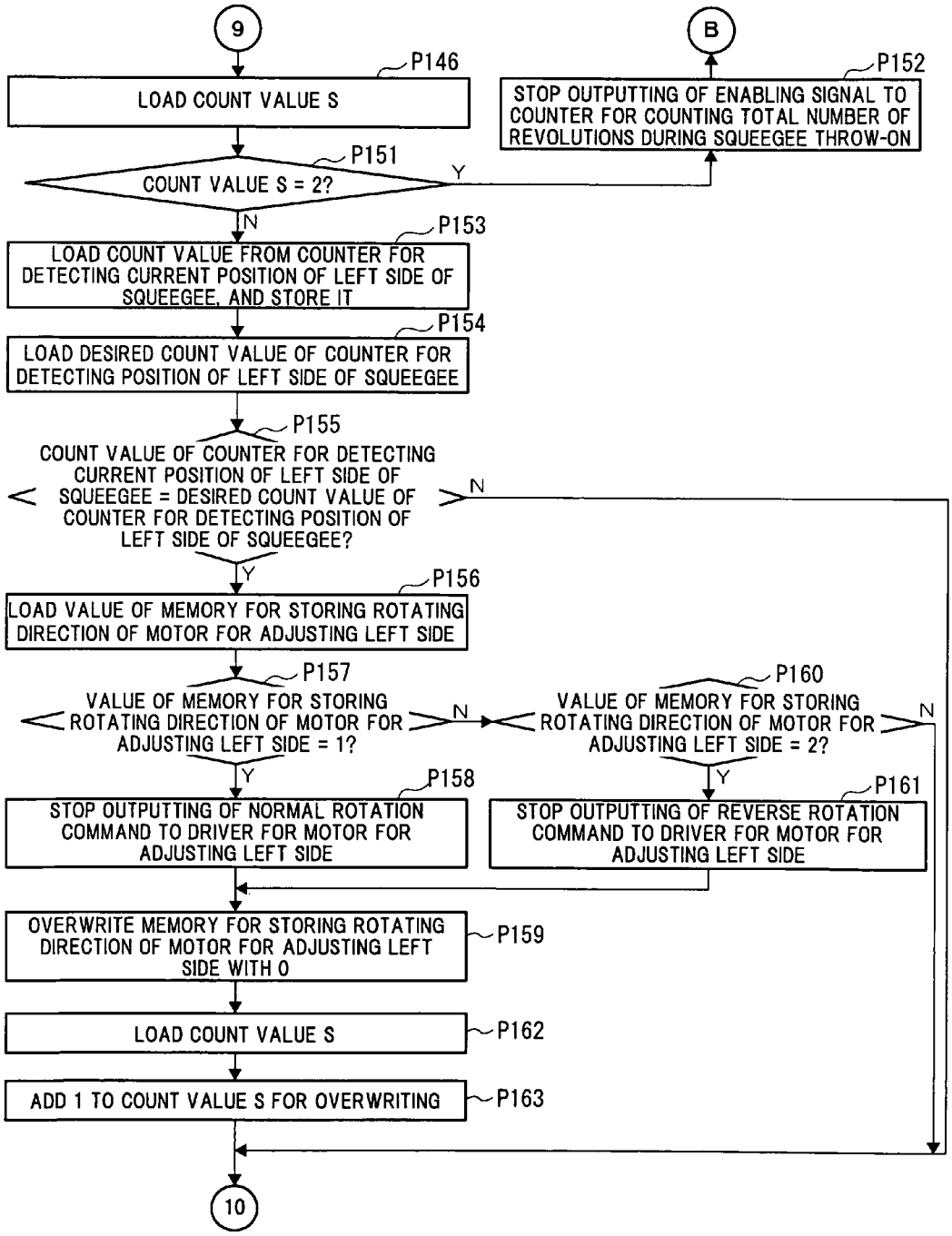
Figure 8D:
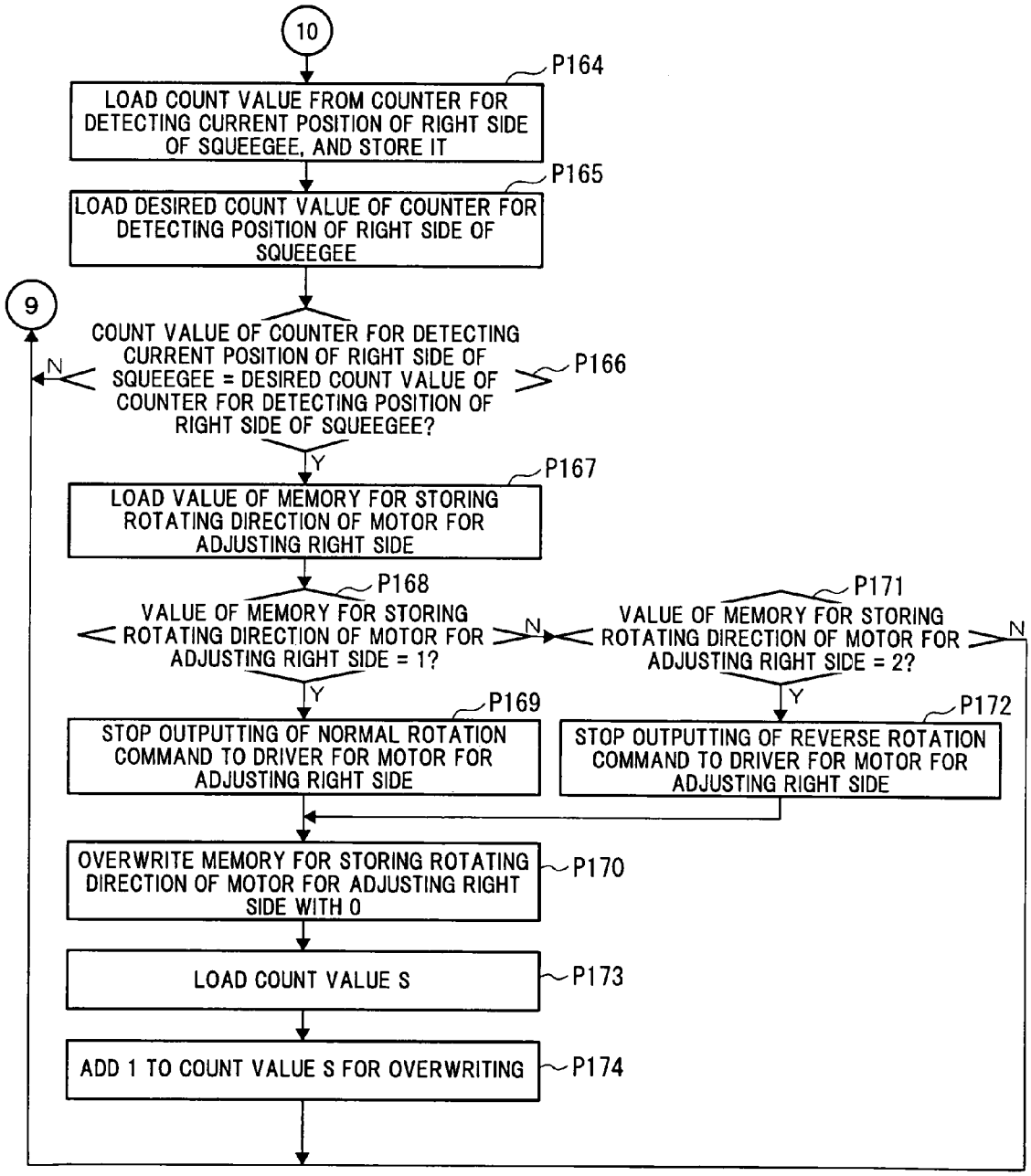
Figure 9A:
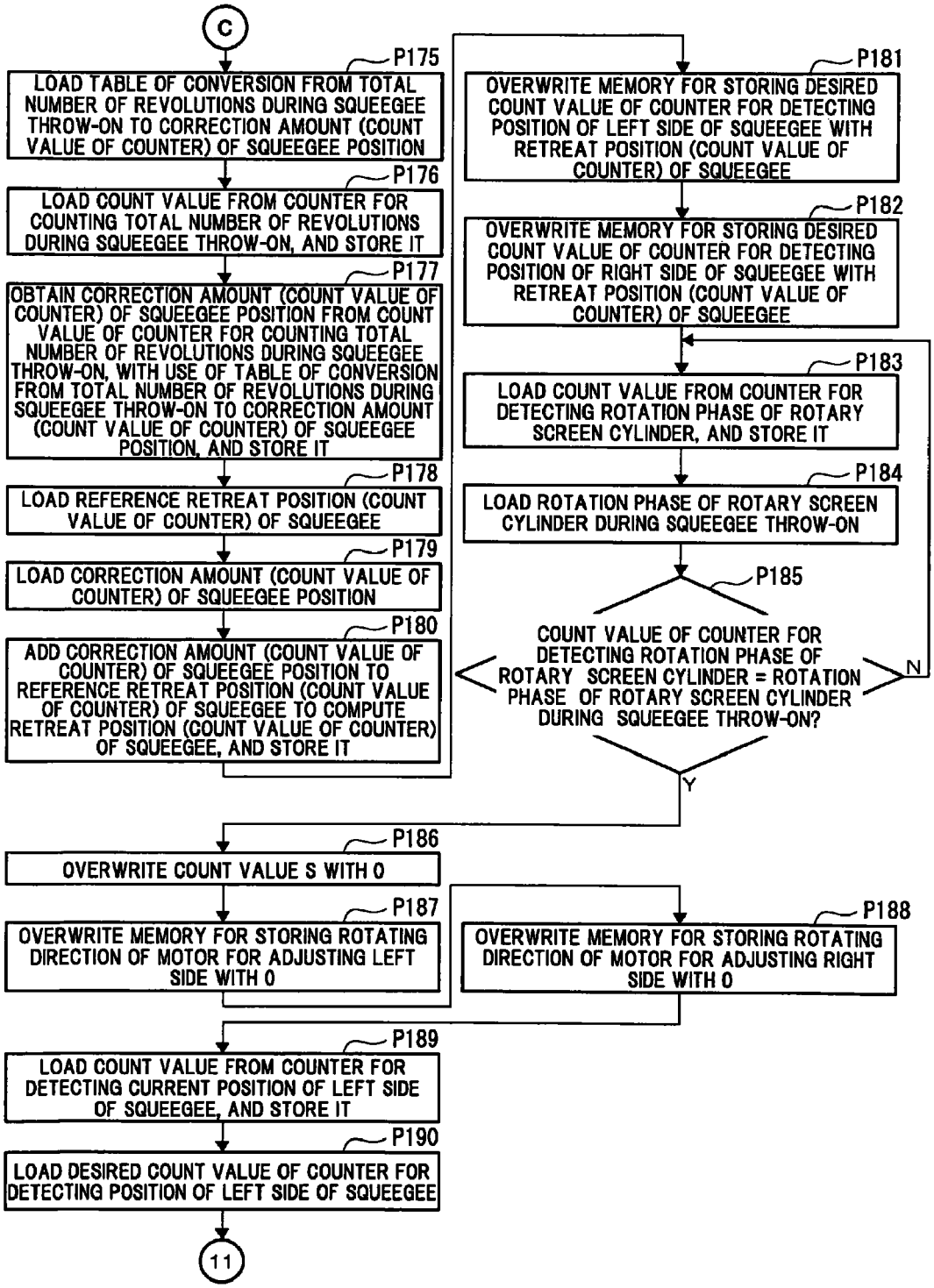
FIG. 9(*a*) is a motion flow chart of the squeegee throw-on and throw-off control device.
Figure 9B:
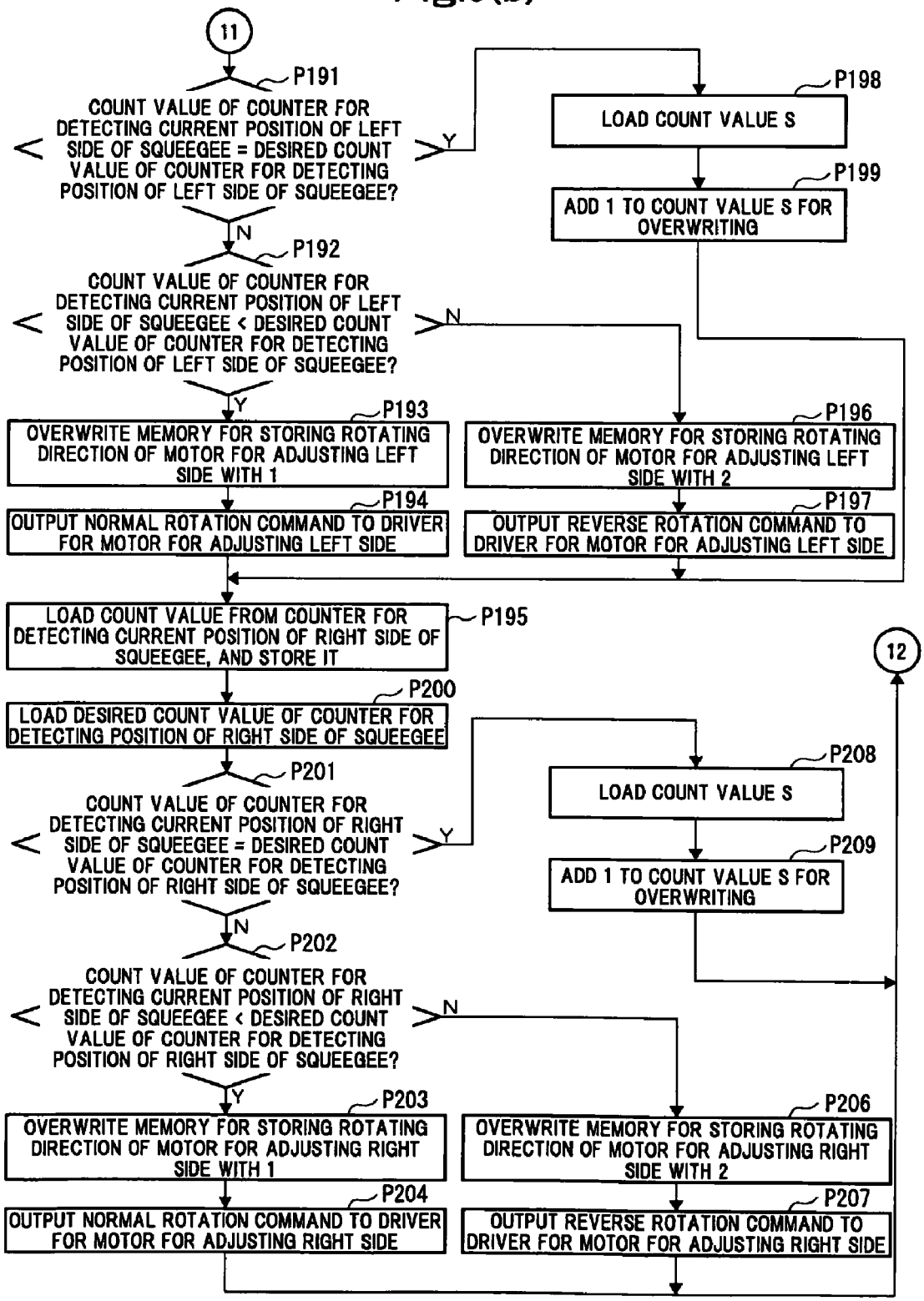
Figure 9C:
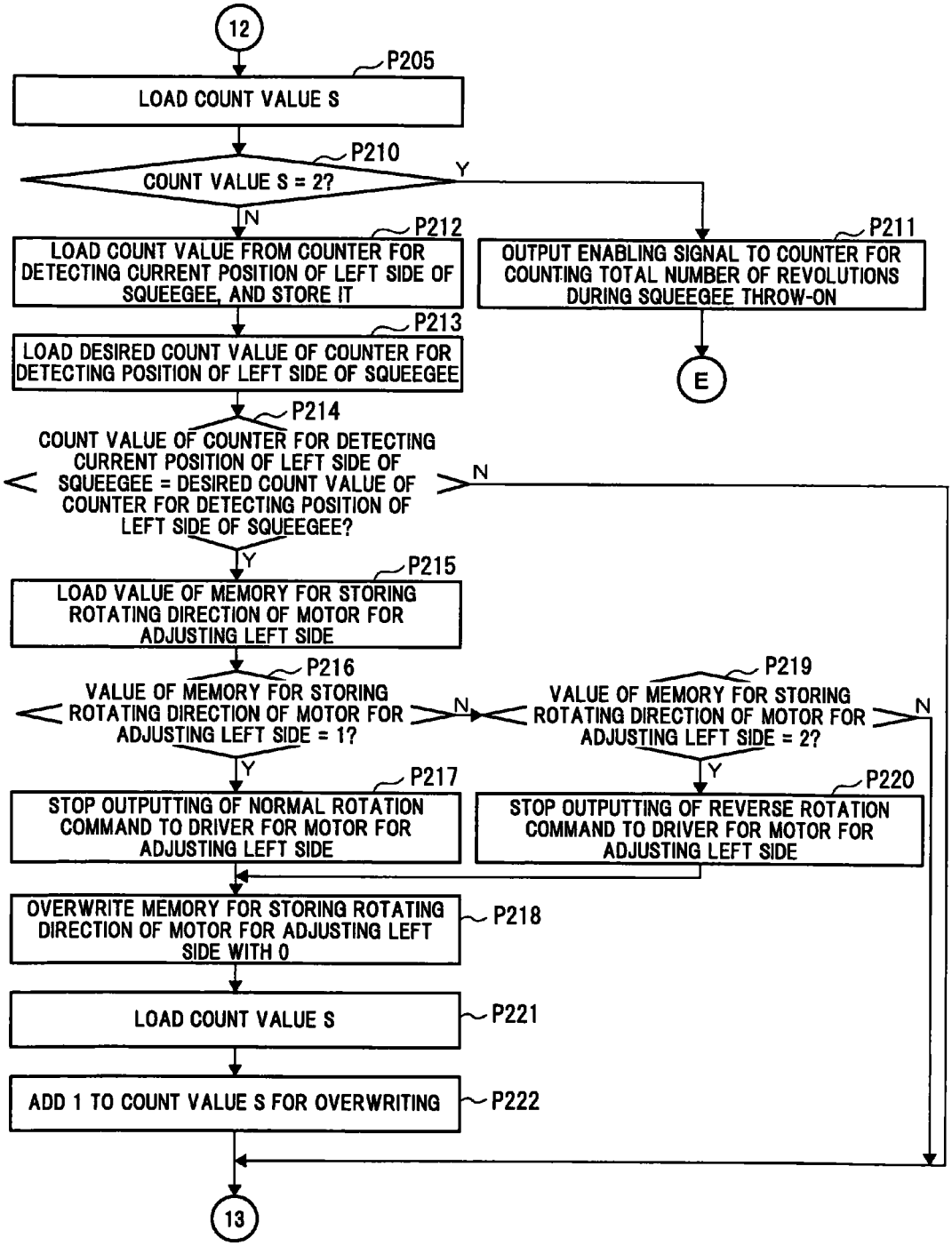
Figure 9D:
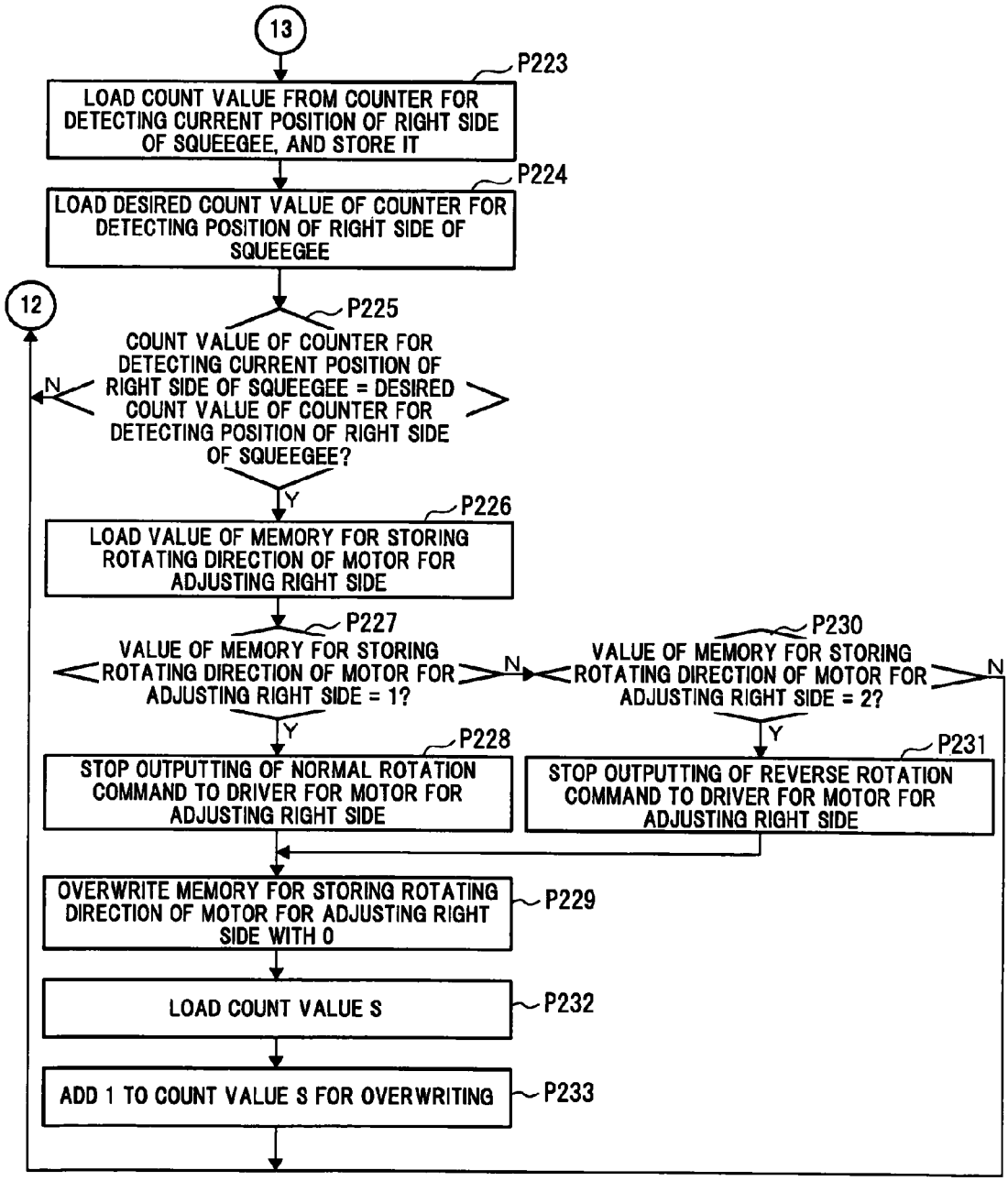
Figure 10A:
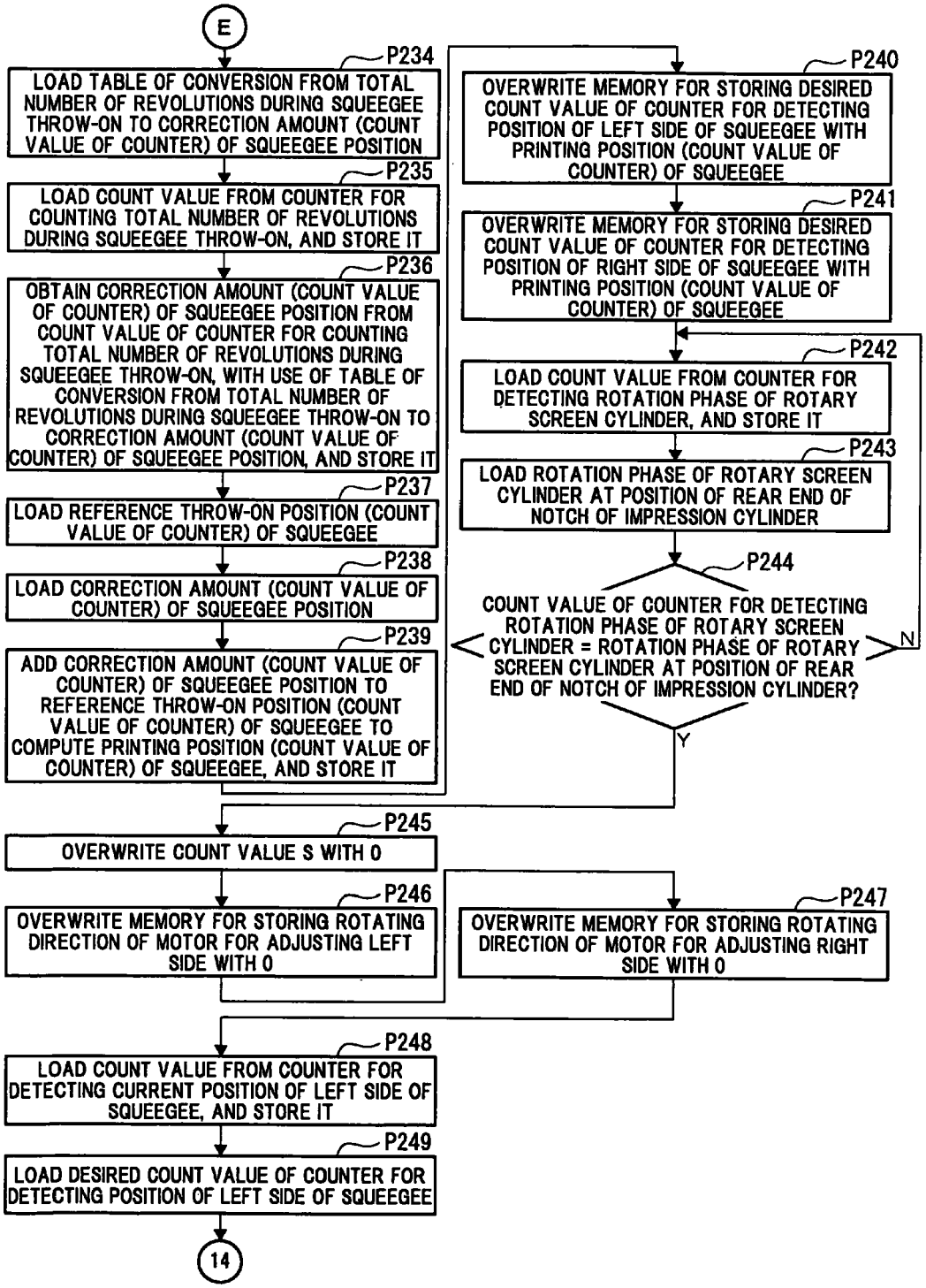
FIG. 10(*a*) is a motion flow chart of the squeegee throw-on and throw-off control device.
Figure 10B:
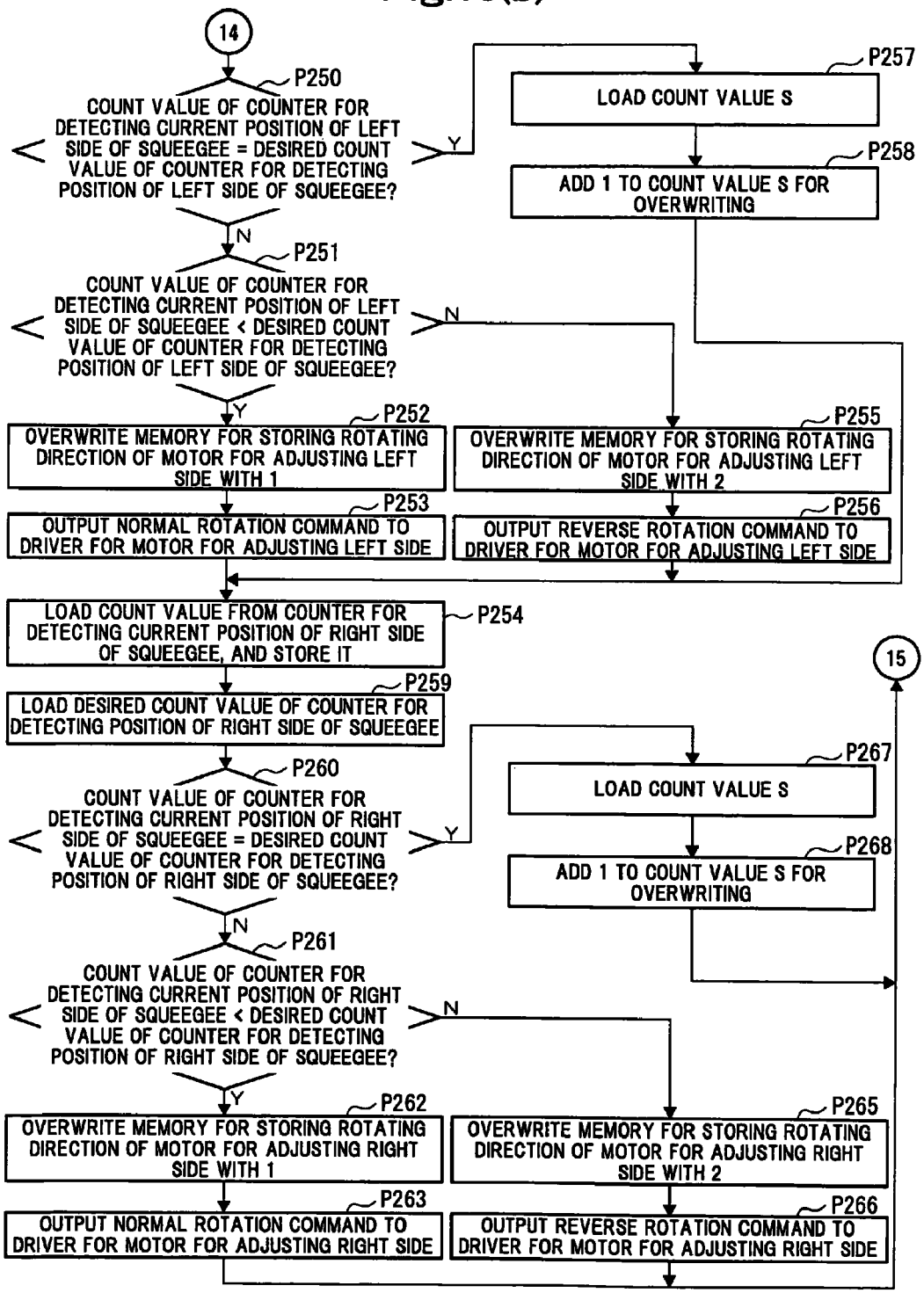
Figure 10C:
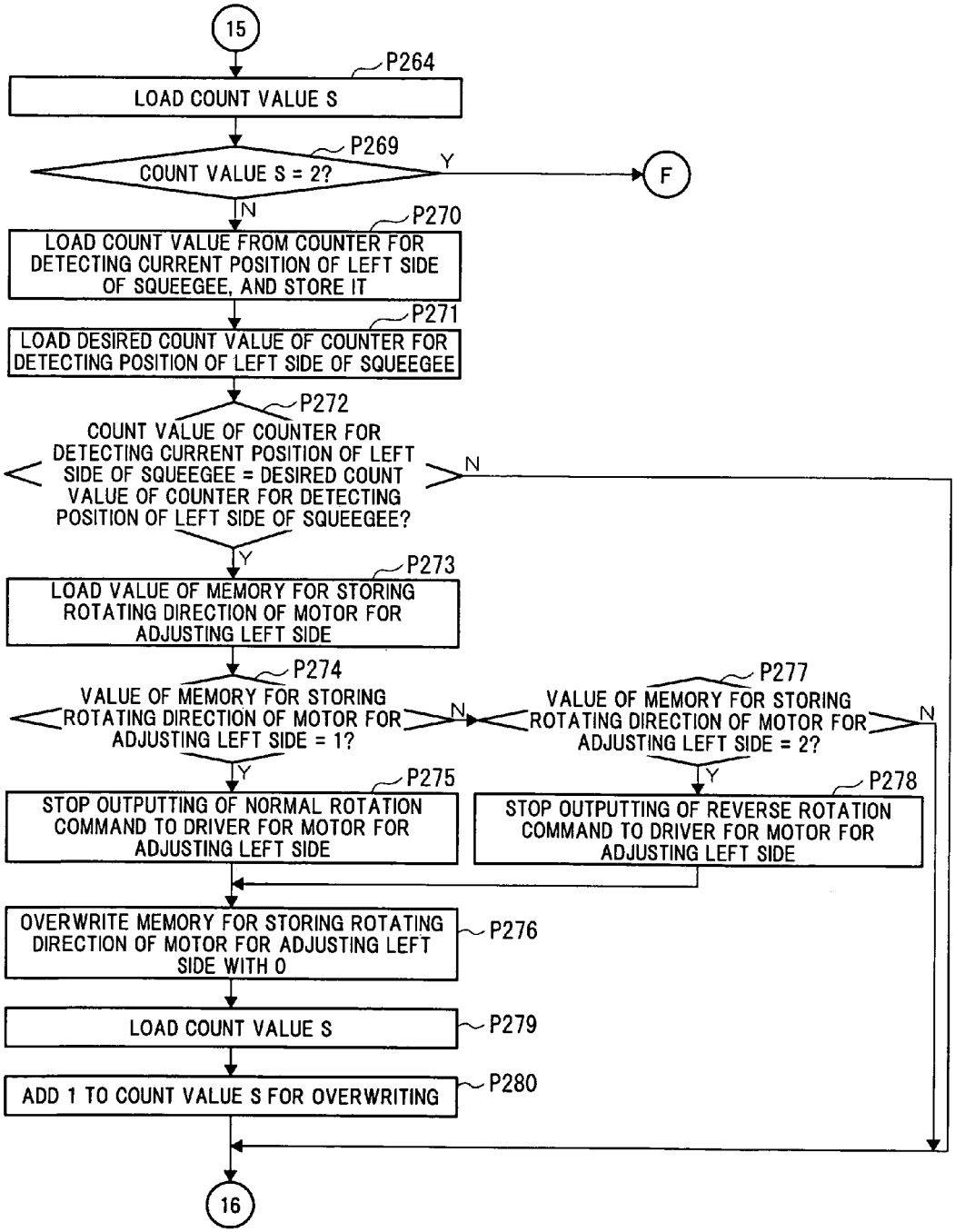
Figure 10D:
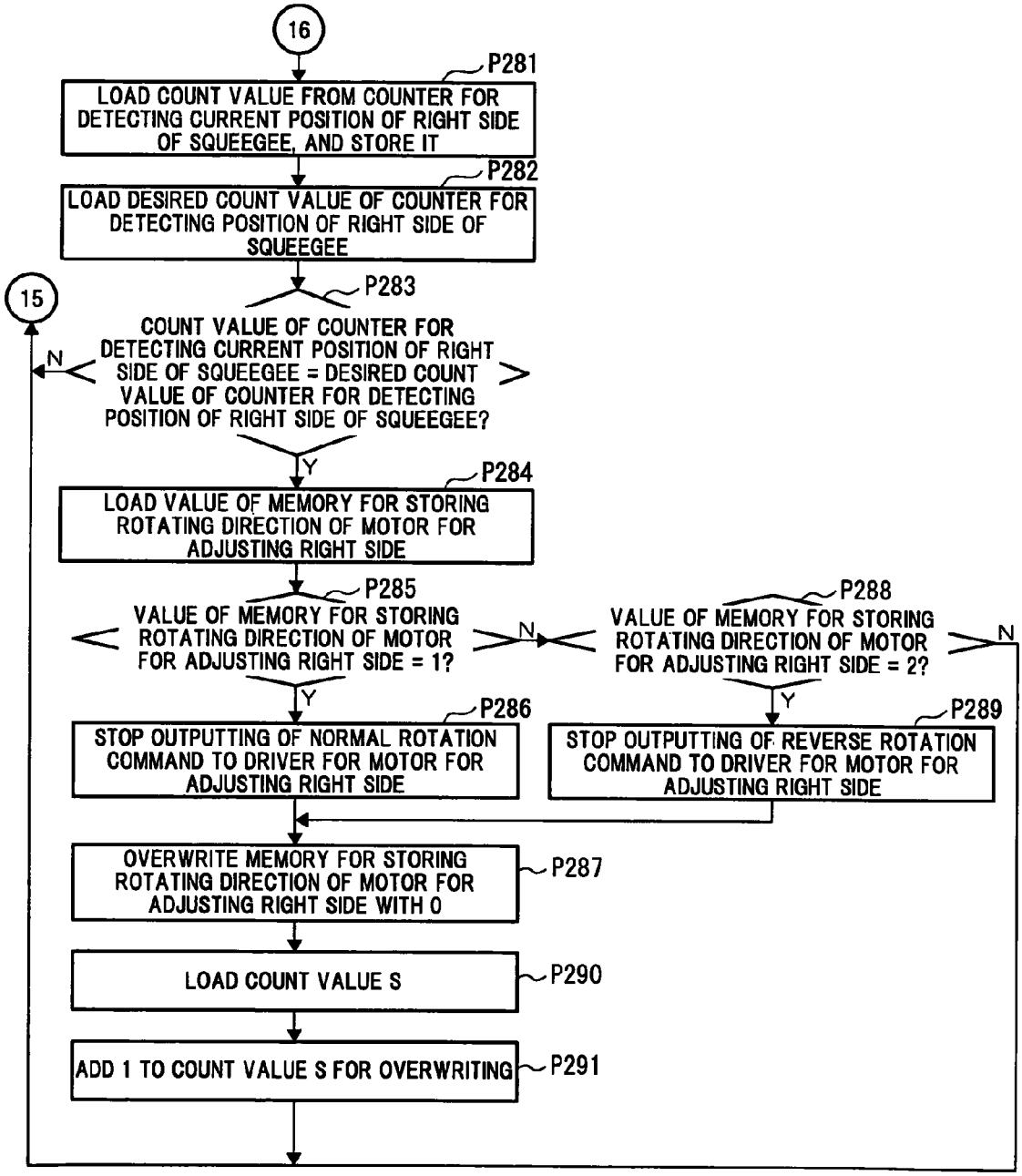
Figure 11A:
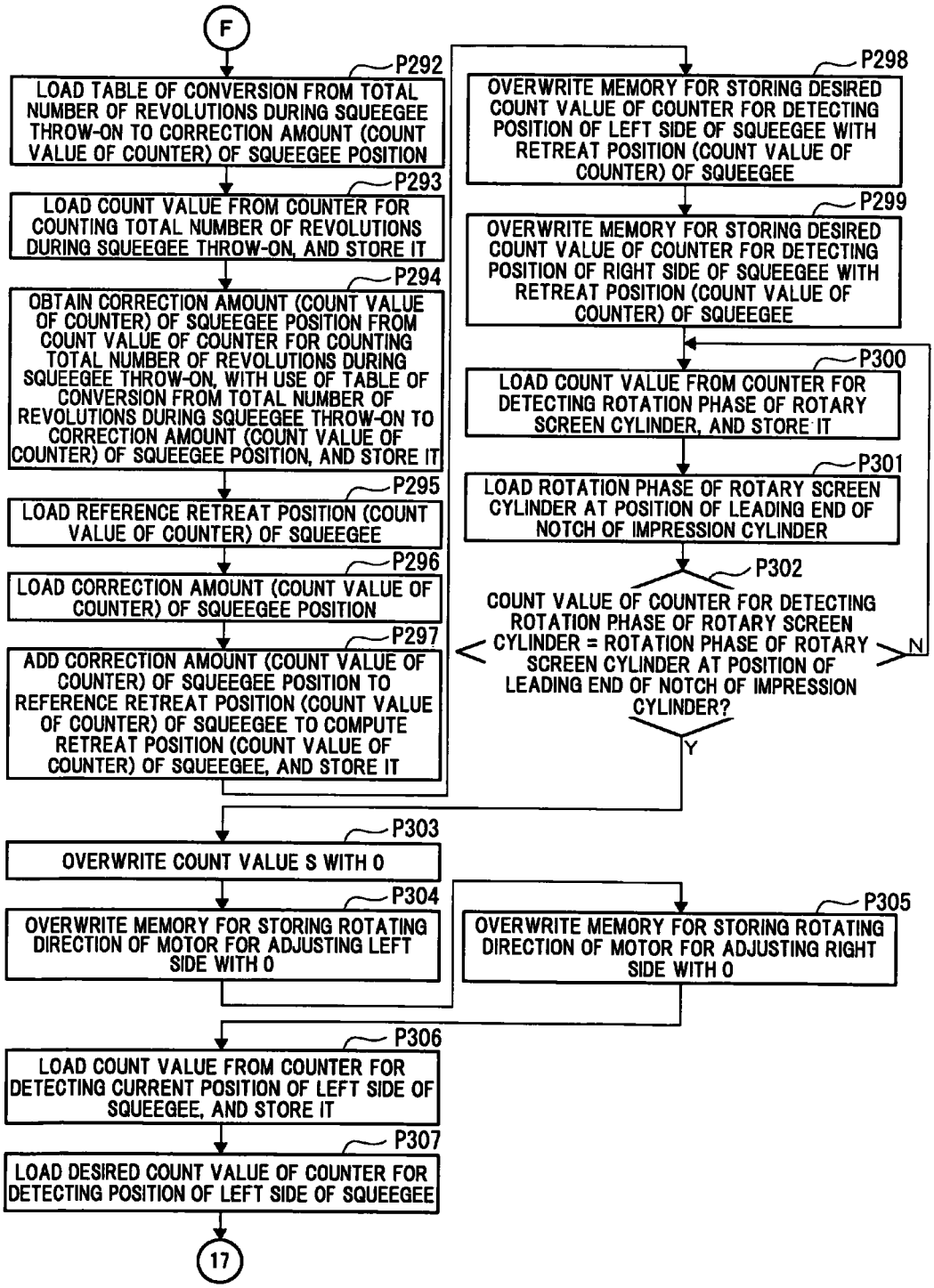
FIG. 11(*a*) is a motion flow chart of the squeegee throw-on and throw-off control device.
Figure 11B:
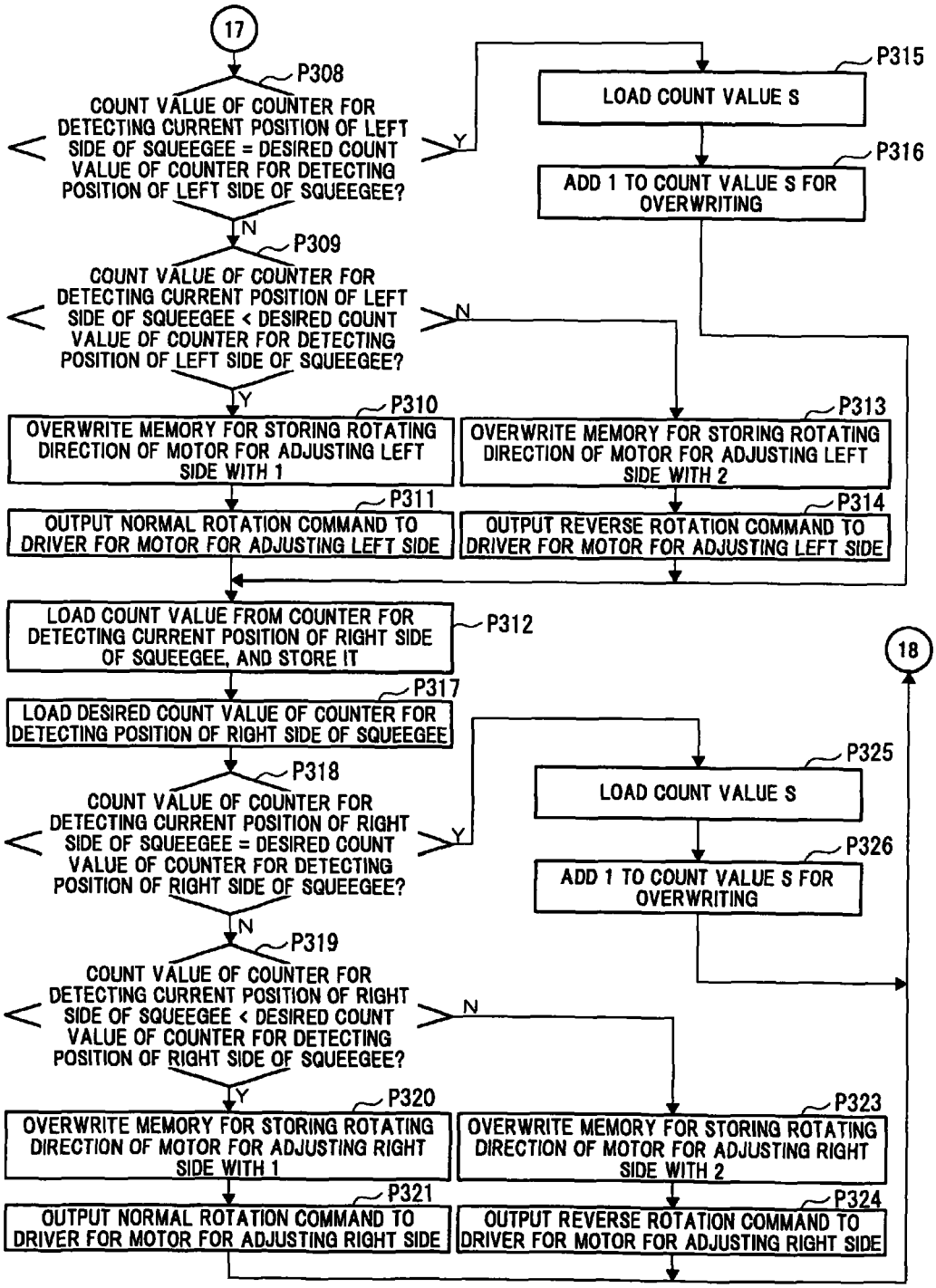
Figure 11C:
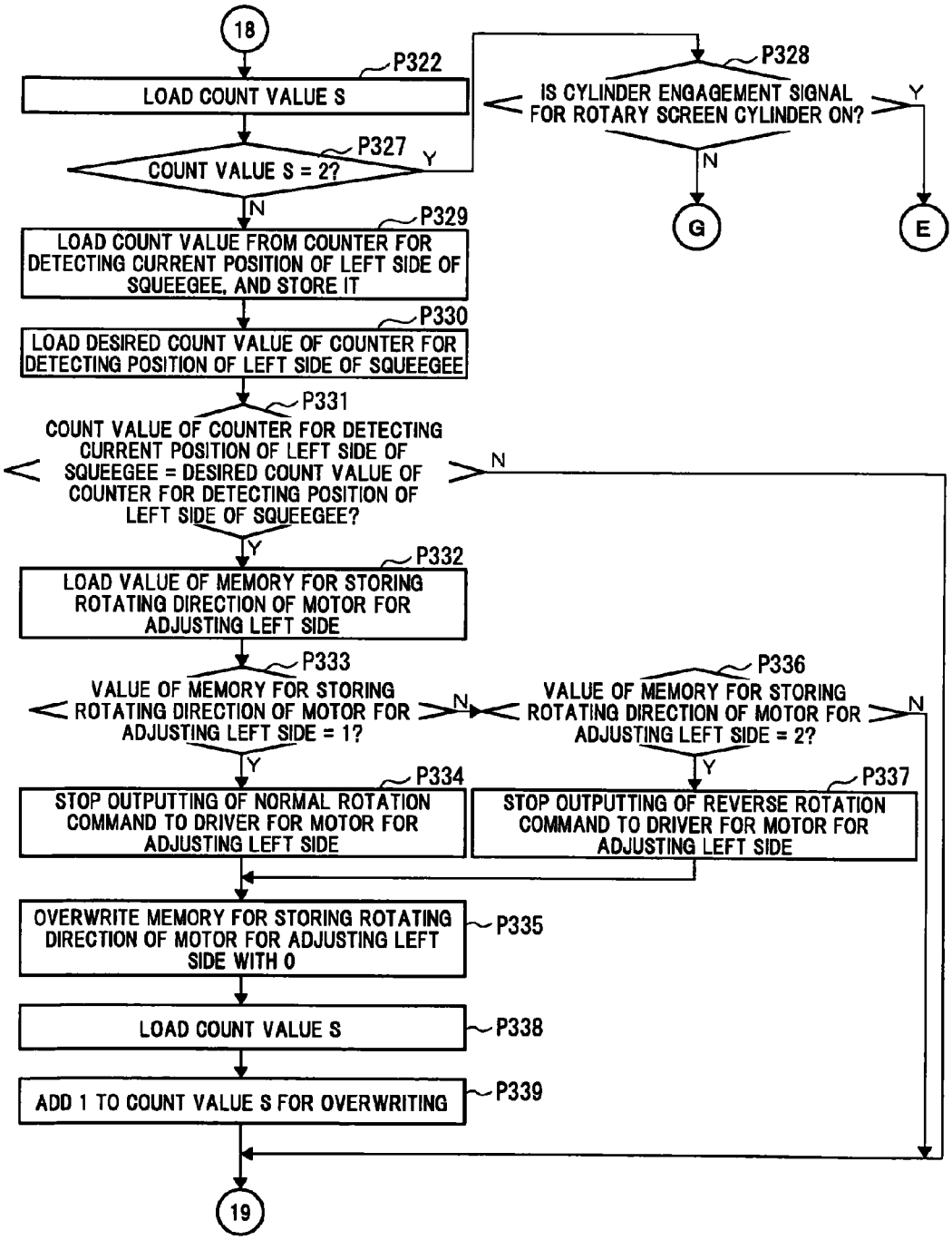
Figure 11D:
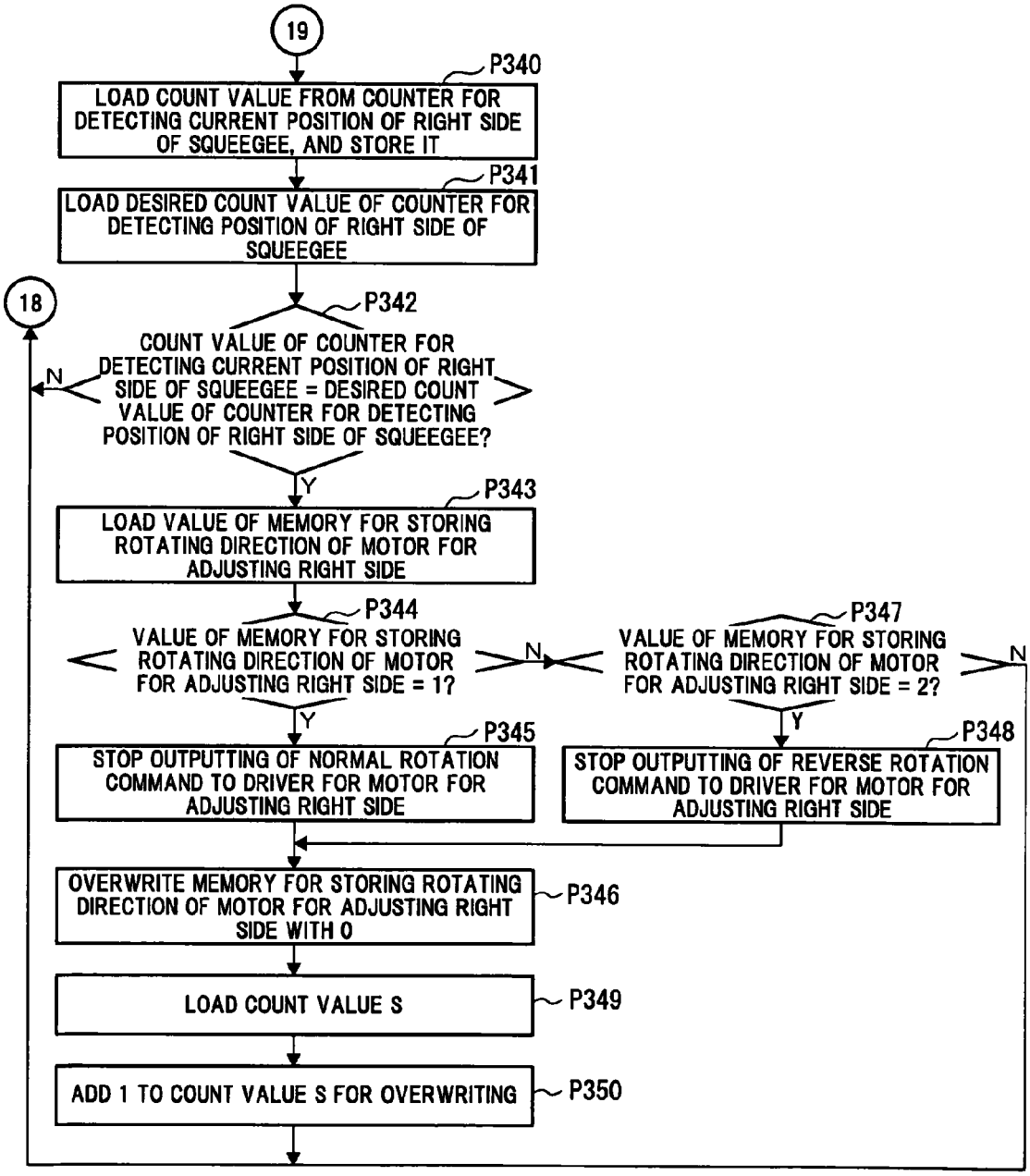
Figure 12A:
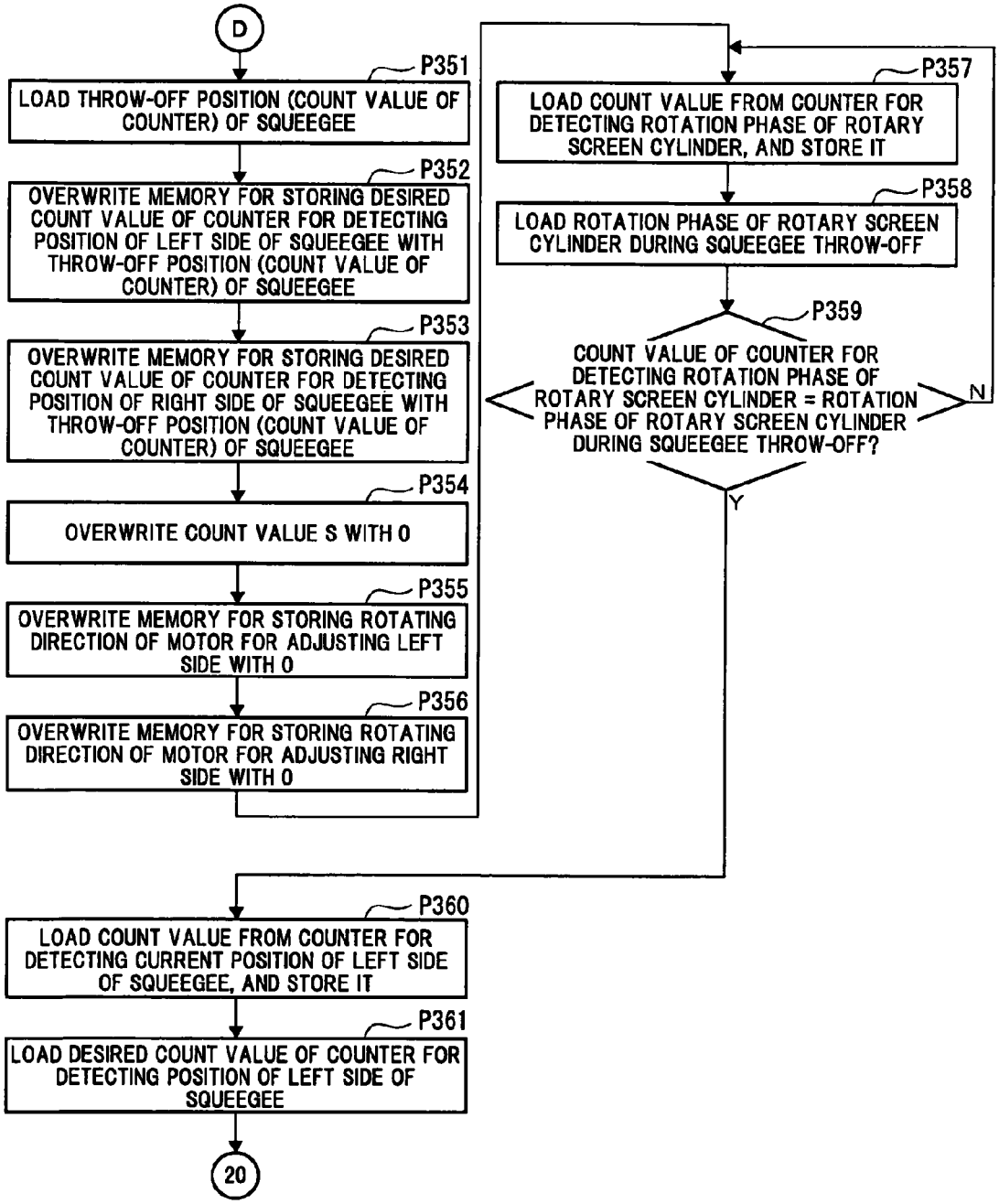
FIG. 12(*a*) is a motion flow chart of the squeegee throw-on and throw-off control device.
Figure 12B:
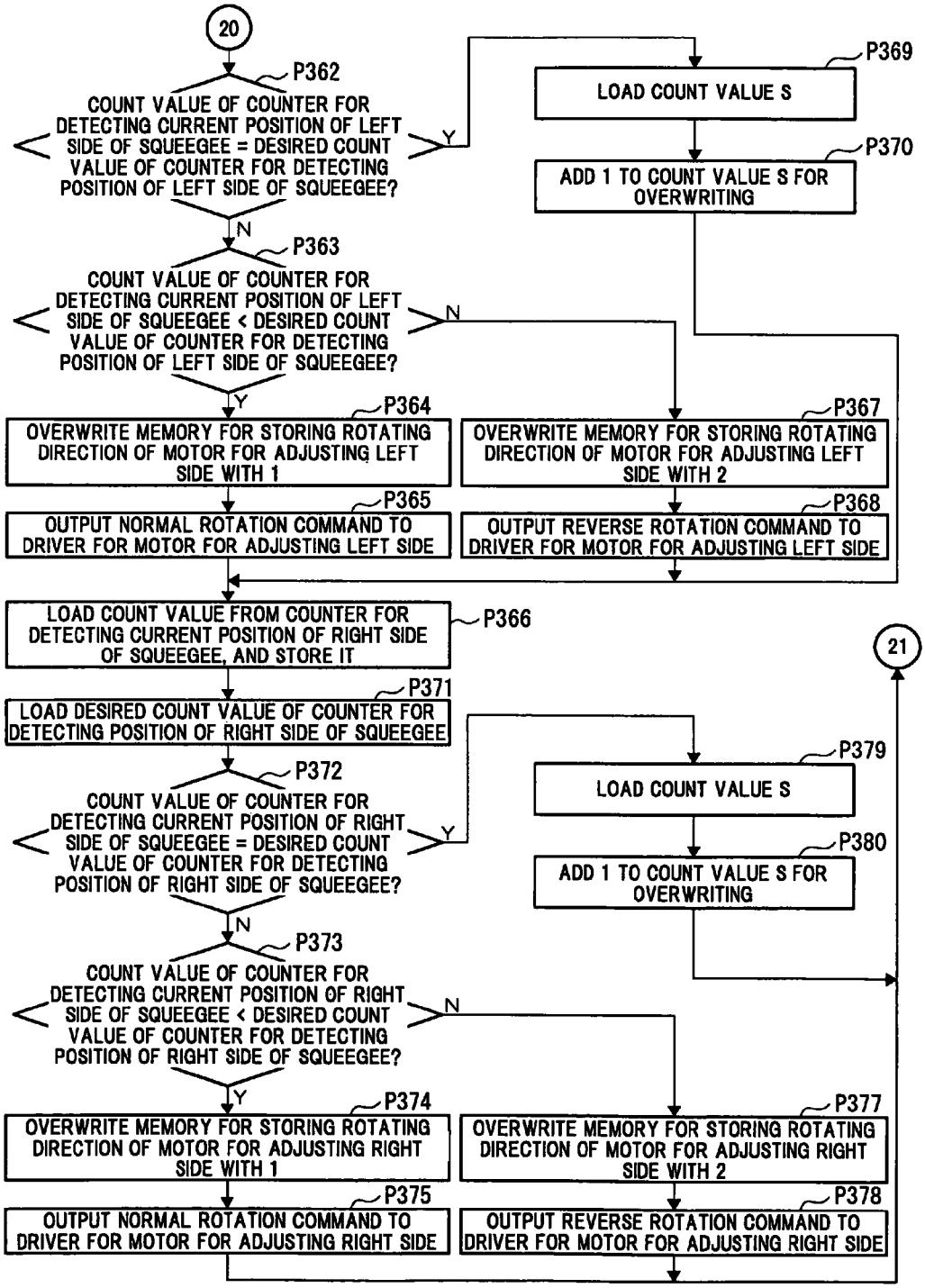
Figure 12C:
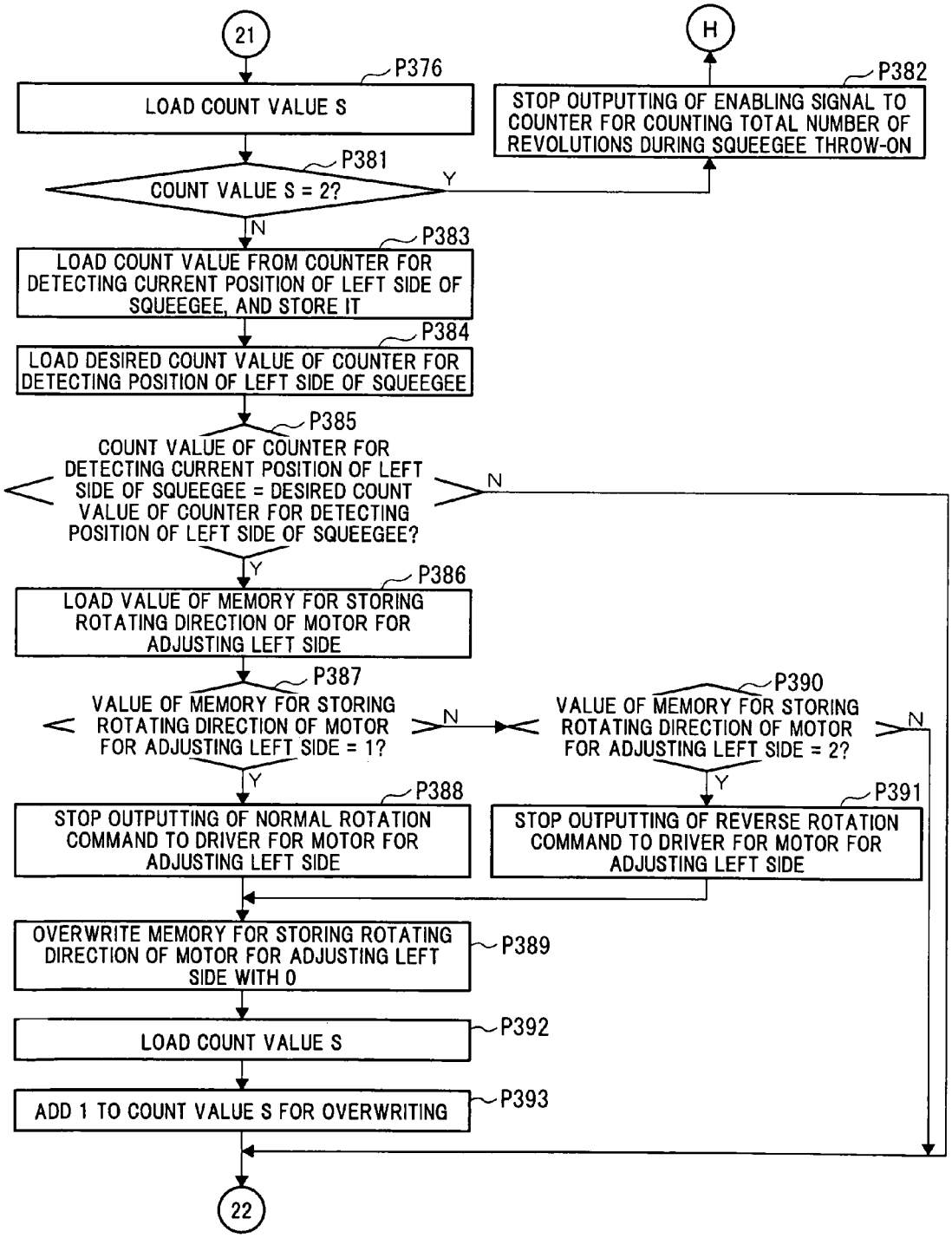
Figure 12D:
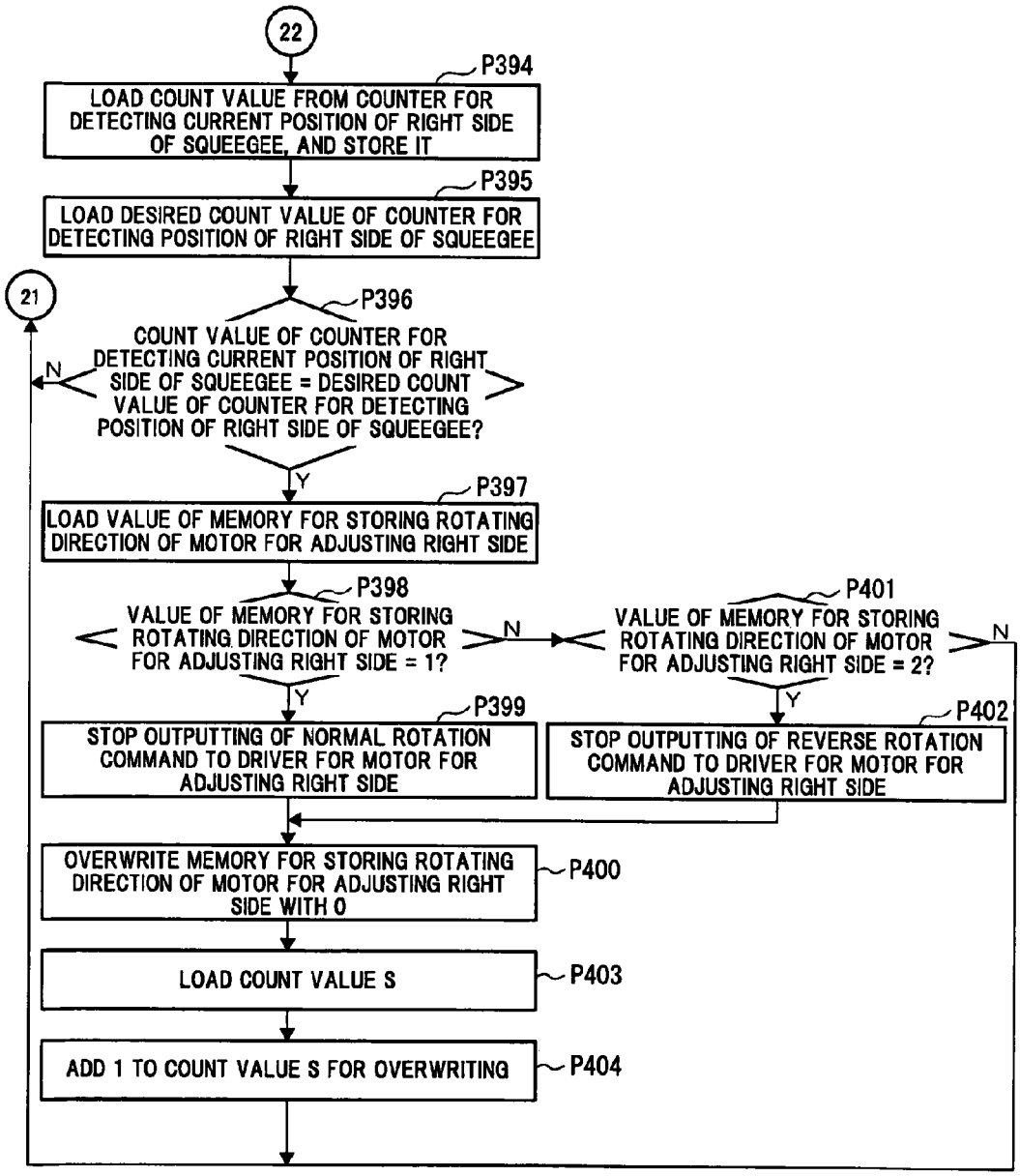

FIG. 1 is a schematic configurational sectional view of a rotary screen printing unit in a rotary screen printing press showing Embodiment 1 of the present invention. FIG. 2 is a right side view of the rotary screen printing unit in FIG. 1. FIG. 3 is a left side view of the rotary screen printing unit in FIG. 1. FIGS. 4(*a*) and 4(*b*) are operating state views. FIGS. 5(*a*) to 5(*c*) are control block diagrams of a squeegee throw-on and throw-off control device. FIGS. 6(*a*) to 6(*e*) are motion flow charts of the squeegee throw-on and throw-off control device. FIGS. 7(*a*) to 7(*d*) are motion flow charts of the squeegee throw-on and throw-off control device. FIGS. 8(*a*) to 8(*d*) are motion flow charts of the squeegee throw-on and throw-off control device. FIGS. 9(*a*) to 9(*d*) are motion flow charts of the squeegee throw-on and throw-off control device. FIGS. 10(*a*) to 10(*d*) are motion flow charts of the squeegee throw-on and throw-off control device. FIGS. 11(*a*) to 11(*d*) are motion flow charts of the squeegee throw-on and throw-off control device. FIGS. 12(*a*) to 12(*d*) are motion flow charts of the squeegee throw-on and throw-off control device.

In the rotary screen printing unit in the rotary screen printing press (rotary stencil printing press=rotary stencil printing plate liquid coating machine), as shown in FIG. 1, a rotary screen cylinder (stencil printing plate cylinder) 11 is supported between right and left frames 10 via eccentric bearings 12 to be capable of being thrown on and thrown off an impression cylinder (pressing body) 13. The right and left eccentric bearings 12 are supported by the right and left frames 10 to be pivotable and slidable in a lateral direction (axial direction).

The impression cylinder 13 has notches (concavities) 13*b* provided in an outer peripheral surface thereof, each notch 13*b* accommodating a gripper device (a device for holding a material to be printed) 13*a* for holding a material to be printed (a material to be liquid coated), W, such as a sheet, as shown in FIGS. 4(*a*) and 4(*b*). In the illustrated embodiment, two of the notches 13*b* are provided at positions symmetrical with respect to the central point of the impression cylinder 13, but this is not limitative.

The rotary screen cylinder 11 has a cylindrical screen printing forme (stencil printing plate) 11*c* supported between right and left tubular end members 11*a* via intermediate members 11*b*. Also, the rotary screen cylinder 11 is supported by bearings 14 at small-diameter portions of the right and left tubular end members 11*a* to be rotatable with respect to the eccentric bearings 12.

A gear 15 is located at, and secured to, an end part of the small-diameter portion of the right tubular end member 11*a*, and a gear 17 secured onto an output shaft of a motor 16 meshes with the gear 15. The motor 16 is mounted on a subframe 18 bound to the right frame 10.

Thus, the rotary screen cylinder 11 can be rotationally driven and circumferentially registered by the motor 16 via the above-mentioned gear mechanism.

One end of a link 19 is pinned to each of the right and left eccentric bearings 12, and the leading end of a lever 20 is pinned to the other end of the link 19. Proximal end portions of the right and left levers 20 are secured to right and left end portions of a rotating shaft 21 journaled between the right and left frames 10. A leading end of an actuator 22 is pinned to the left lever 20.

Hence, the eccentric bearing 12 is pivoted by the actuator 22 via the above-mentioned link mechanism, whereby the rotary screen cylinder 11 is eccentrically rotated to be capable of being thrown on and thrown off the impression cylinder 13 (see FIG. 4(*a*) and FIG. 4(*b*)).

An elongated hole, which is formed in a flange portion 12*a* of each of the right and left eccentric bearings 12, is fitted with a head 23*a* of a bolt 23 such that the head 23*a* is rotatable, and movable in the direction of the major diameter of the elongated hole, but immovable in the axial direction. On the other hand, a threaded portion 23*b* of the bolt 23 is fitted into a tapped hole of the frame 10. A gear 24*a* is secured to the head 23*a* of each of the right and left bolts 23, and a gear 24*b* secured onto an output shaft of a motor 25 meshes with the gear 24*a*. The right and left motors 25 are mounted on support brackets 26 bound to the right and left frames 10.

Thus, the right and left eccentric bearings 12 are slid in the lateral direction (axial direction) by the motors 25 via the aforementioned gear mechanism and feed screw mechanism to make possible the tension adjustment of the screen printing forme 11*c* and the movement of the bearing at the time of rotary screen cylinder removal.

As shown in FIGS. 2 and 3 as well, a pipe-shaped support shaft 27 closed at the right end is inserted through the interior of the rotary screen cylinder 11. The right end side of the support shaft 27 is fitted into, and supported by, a fitting hole 28*a* of a bearing member 28, which is located outwardly and laterally of the subframe 18, in such a manner as to be turnable and movable (slidable) in the lateral direction (axial direction), while the left end side of the support shaft 27 is fitted into, and supported by, a bearing member 29, which is located outwardly and laterally of the left frame 10, in such a manner as not to be turnable and movable (slidable) in the lateral direction (axial direction).

That is, the left end side of the support shaft 27 is inhibited from moving (sliding) in the lateral direction (axial direction) by stepped portions 27*a* and 27*b* at two (right and left) locations, and is also inhibited from turning because it is pressed from above by a holding plate 30*a* while being accommodated within a fitting groove 29*a* of the bearing member 29 having a groove bottom formed in a taper shape.

The holding plate 30*a* horizontally rotates about a fulcrum pin 31*a*, and can thus open and close the fitting groove 29*a*. With the fitting groove 29*a* being closed, a fixing lever 30*b* is screwed into the holding plate 30*a* and the bearing member 29, whereby the closed state is retained.

The right and left bearing members 28 and 29 are supported movably in a vertical direction via ball screws 32 by support cases 31 annexed to the frame 10 and the subframe 18. Concretely, a nut member 32*a* of the ball screw 32 is secured to the interior of the support case 31, and a screw member 32*b* screwed to the nut member 32*a* penetrates the interior of the support case 31 in a vertical direction. A non-screw-forming shaft portion of the screw member 32*b* is supported pivotably and slidably within the support case 31 via a bearing 33.

An upper end portion of the screw member 32*b* is engaged with an engaging hole 28*b* or 29*b* of the bearing member 28 or 29 via a spherical bearing 34 to permit the rotation of the screw member 32*b* and the inclination of the support shaft 27 during position adjustment (to be described later) of the support shaft 27. A gear 35*a* is secured to a lower end portion of the screw member 32*b*, and a gear 35*b* secured onto an output shaft of a motor 36A or 36B meshes with the gear 35*a*. The motor 36A for adjusting the left side is mounted on an outer surface of the frame 10, and the motor 36B for adjusting the right side is mounted on an outer surface of the subframe 18.

In FIG. 1, reference numeral 39 denotes a whirl-stop pin for positioning of the bearing member 28 or 29 in the absence of the support shaft 27, and for positioning, in the longitudinal direction, of the support shaft 27.

A rubber squeegee (ink transfer member=liquid transfer member) 38 is supported on the support shaft 27 via a holder 37, as shown in FIGS. 4(*a*) and 4(*b*). A leading end of the squeegee 38 makes a sliding contact with the inner peripheral surface of the screen printing forme 11*c*, with the result that ink (liquid) supplied into the screen printing forme 11*c* through the interior of the support shaft 27 is transferred onto a printing surface of the material to be printed, W, via holes of the screen printing forme 11*c*.

In the present Embodiment 1, the motors 36A and 36B are drivingly controlled, independently of each other, by a squeegee throw-on and throw-off control device (control means) 40A to be described later, whereby throw-on and throw-off of the squeegee 38 with respect to the inner peripheral surface of the screen printing forme 11*c*, and the adjustment of the throw-on position of the squeegee 38 are automatically carried out.

The squeegee throw-on and throw-off control device 40A can preset the throw-on position of the squeegee 38 during printing (liquid coating), based on the type of the material W to be printed (i.e., difference in the material, e.g., paper, cloth, film or corrugated board), in accordance with the thickness of the material to be printed, the material for the screen printing forme 11*c*, the thickness of the screen printing forme, the picture pattern area rate, the mesh size of the screen printing forme 11*c*, the viscosity of ink, the yield value of ink, the type of the pigment of ink, the material for the squeegee, and the thickness of the squeegee. Concretely, relevant motions will be described by motion flow charts to be offered later.

The squeegee throw-on and throw-off control device 40A comprises CPU 41, RAM 42, ROM 43, input/output devices 44 to 50, and an interface 51 connected together by BUS (bus line), as shown in FIGS. 5(*a*) to 5(*c*). To the BUS (bus line), the following memories are connected: A memory M1 for storing the type of the material to be printed, a memory M2 for storing the thickness of the material to be printed, a memory M3 for storing the material for the screen printing forme, a memory M4 for storing the thickness of the screen printing forme, a memory M5 for storing the picture pattern area rate, a memory M6 for storing the mesh size of the screen printing forme, a memory M7 for storing the viscosity of ink, a memory M8 for storing the yield value of ink, a memory M9 for storing the type of a pigment of ink, a memory M10 for storing the material for the squeegee, and a memory M11 for storing the thickness of the squeegee.

To the BUS (bus line), the following memories are further connected: A memory M12 for storing a table of conversion from the type of the material to be printed to the throw-on position (count value of a counter) of the squeegee, a memory M13 for storing the provisional reference throw-on position (count value of the counter) of the squeegee, a memory M14 for storing a table of conversion from the thickness of the material to be printed to the throw-on position (count value of the counter) of the squeegee, a memory M15 for storing the first correction value (count value of the counter) of the throw-on position of the squeegee, a memory M16 for storing a table of conversion from the material for the screen printing forme to the throw-on position (count value of the counter) of the squeegee, a memory M17 for storing the second correction value (count value of the counter) of the throw-on position of the squeegee, a memory M18 for storing a table of conversion from the thickness of the screen printing forme to the throw-on position (count value of the counter) of the squeegee, a memory M19 for storing the third correction value (count value of the counter) of the throw-on position of the squeegee, a memory M20 for storing a table of conversion from the picture pattern area rate to the throw-on position (count value of the counter) of the squeegee, and a memory M21 for storing the fourth correction value (count value of the counter) of the throw-on position of the squeegee.

To the BUS (bus line), the following memories are further connected: A memory M22 for storing a table of conversion from the mesh size of the screen printing forme to the throw-on position (count value of the counter) of the squeegee, a memory M23 for storing the fifth correction value (count value of the counter) of the throw-on position of the squeegee, a memory M24 for storing a table of conversion from the viscosity of ink to the throw-on position (count value of the counter) of the squeegee, a memory M25 for storing the sixth correction value (count value of the counter) of the throw-on position of the squeegee, a memory M26 for storing a table of conversion from the yield value of ink to the throw-on position (count value of the counter) of the squeegee, a memory M27 for storing the seventh correction value (count value of the counter) of the throw-on position of the squeegee, a memory M28 for storing a table of conversion from the type of the pigment of ink to the throw-on position (count value of the counter) of the squeegee, a memory M29 for storing the eighth correction value (count value of the counter) of the throw-on position of the squeegee, a memory M30 for storing a table of conversion from the material for the squeegee to the throw-on position (count value of the counter) of the squeegee, a memory M31 for storing the ninth correction value (count value of the counter) of the throw-on position of the squeegee, a memory M32 for storing a table of conversion from the thickness of the squeegee to the throw-on position (count value of the counter) of the squeegee, and a memory M33 for storing the tenth correction value (count value of the counter) of the throw-on position of the squeegee.

To the BUS (bus line), the following memories are further connected: A memory M34 for storing the reference throw-on position (count value of the counter) of the squeegee, a memory M35 for storing a table of conversion from the material for the screen printing forme to the retreat position (count value of the counter) of the squeegee, a memory M36 for storing the provisional reference retreat position (count value of the counter) of the squeegee, a memory M37 for storing a table of conversion from the thickness of the screen printing forme to the retreat position (count value of the counter) of the squeegee, a memory M38 for storing the first correction value (count value of the counter) of the retreat position of the squeegee, a memory M39 for storing a table of conversion from the picture pattern area rate to the retreat position (count value of the counter) of the squeegee, a memory M40 for storing the second correction value (count value of the counter) of the retreat position of the squeegee, a memory M41 for storing a table of conversion from the mesh size of the screen printing forme to the retreat position (count value of the counter) of the squeegee, a memory M42 for storing the third correction value (count value of the counter) of the retreat position of the squeegee, a memory M43 for storing a table of conversion from the viscosity of ink to the retreat position (count value of the counter) of the squeegee, a memory M44 for storing the fourth correction value (count value of the counter) of the retreat position of the squeegee, a memory M45 for storing a table of conversion from the yield value of ink to the retreat position (count value of the counter) of the squeegee, and a memory M46 for storing the fifth correction value (count value of the counter) of the retreat position of the squeegee.

To the BUS (bus line), the following memories are further connected: A memory M47 for storing a table of conversion from the type of the pigment of ink to the retreat position (count value of the counter) of the squeegee, a memory M48 for storing the sixth correction value (count value of the counter) of the retreat position of the squeegee, a memory M49 for storing a table of conversion from the material for the squeegee to the retreat position (count value of the counter) of the squeegee, a memory M50 for storing the seventh correction value (count value of the counter) of the retreat position of the squeegee, a memory M51 for storing a table of conversion from the thickness of the squeegee to the retreat position (count value of the counter) of the squeegee, a memory M52 for storing the eighth correction value (count value of the counter) of the retreat position of the squeegee, a memory M53 for storing the reference retreat position (count value of the counter) of the squeegee, a memory M54 for storing the throw-off position (count value of the counter) of the squeegee, a memory M55 for storing the desired count value of a counter for detecting the position of the left side of the squeegee, a memory M56 for storing the desired count value of a counter for detecting the position of the right side of the squeegee, a memory M57 for storing the rotation phase of the rotary screen cylinder at the position of the rear end of the notch of the impression cylinder, and a memory M58 for storing the rotation phase of the rotary screen cylinder during squeegee throw-off.

To the BUS (bus line), the following memories are further connected: A memory M59 for storing the count value S, a memory M60 for storing the rotating direction of the motor for adjusting the left side, a memory M61 for storing the rotating direction of the motor for adjusting the right side, a memory M62 for storing the count value of a counter for detecting the current position of the left side of the squeegee, a memory M63 for storing the count value of a counter for detecting the current position of the right side of the squeegee, a memory M64 for storing a table of conversion from the total number of revolutions during squeegee throw-on to the correction amount (count value of the counter) of the squeegee position, a memory M65 for storing the count value of a counter for counting the total number of revolutions during squeegee throw-on, a memory M66 for storing the correction amount (count value of the counter) of the squeegee position, a memory M67 for storing the retreat position (count value of the counter) of the squeegee, a memory M68 for storing the count value of a counter for detecting the rotation phase of the rotary screen cylinder, a memory M69 for storing the rotation phase of the rotary screen cylinder during squeegee throw-on, a memory M70 for storing the printing position (count value of the counter) of the squeegee, and a memory M71 for storing the rotation phase of the rotary screen cylinder at the position of the leading end of the notch of the impression cylinder.

To the input/output device 44, the following are connected: A squeegee throw-on and throw-off automatic control switch 52, an input device 53 such as a keyboard, a display device 54 such as CRT or a display, and an output device 55 such as a printer or a floppy disk (registered trademark) drive.

To the input/output device 45, the following are connected: A setting instrument 56 for the type of the material to be printed, a setting instrument 57 for the thickness of the material to be printed, a setting instrument 58 for the material for the screen printing forme, a setting instrument 59 for the thickness of the screen printing forme, a setting instrument 60 for the mesh size of the screen printing forme, a setting instrument 61 for the viscosity of ink, a setting instrument 62 for the yield value of ink, a setting instrument 63 for the type of the pigment of ink, a setting instrument 64 for the material for the squeegee, and a setting instrument 65 for the thickness of the squeegee.

To the input/output device 46, the motor 36A for adjusting the left side is connected via a driver 66 for the motor for adjusting the left side, and a rotary encoder 69 for the motor for adjusting the left side which is drivingly connected to the motor 36A is connected via a counter 68 for detecting the current position of the left side of the squeegee.

To the input/output device 47, the motor 36B for adjusting the right side is connected via a driver 70 for the motor for adjusting the right side, and a rotary encoder 73 for the motor for adjusting the right side which is drivingly connected to the motor 36B is connected via a counter 72 for detecting the current position of the right side of the squeegee.

To the input/output device 48, a rotary encoder 75 for detecting the rotation phase of the rotary screen cylinder is connected via a counter 74 for detecting the rotation phase of the rotary screen cylinder. The rotary encoder 75 for detecting the rotation phase of the rotary screen cylinder is provided on a rotating part of the rotary screen printing press rotating in synchronism with the rotary screen cylinder in such a manner as to generate a zero pulse in the reference rotation phase of the rotary screen cylinder. Thus, the counter 74 for detecting the rotation phase of the rotary screen cylinder is reset in the reference rotation phase of the rotary screen cylinder each time the rotary screen cylinder makes one rotation. Then, the counter 74 for detecting the rotation phase of the rotary screen cylinder counts clock pulses generated in accordance with the rotation of the rotary screen cylinder, producing a count value conformed to the rotation phase of the rotary screen cylinder.

To the input/output device 49, a sensor 77 for detecting one rotation of the rotary screen cylinder is connected via a counter 76 for counting the total number of revolutions during squeegee throw-on. The sensor 77 for detecting one rotation of the rotary screen cylinder is provided on a rotating part of the rotary screen printing press so as to produce one pulse each time the rotary screen cylinder makes one rotation. Thus, the counter 76 for counting the total number of revolutions during squeegee throw-on is adapted to count the number of revolutions of the rotary screen cylinder in an operating state.

To the input/output device 50, a cylinder engagement circuit 78 for the rotary screen cylinder is connected.

To the interface 51, a picture pattern area rate measuring device 79 for measuring the picture pattern area rate of the picture pattern to be printed on the material W to be printed is connected. The picture pattern area rate measuring device 79 used is a publicly known one, for example, that which images the picture pattern surface of the screen printing forme 11*c* by a TV camera having solid photoelectric conversion elements arranged in a matrix form, and measures the picture pattern area rate.

The control actions or motions of the squeegee throw-on and throw-off control device 40A configured as above will be described in detail based on the motion flow charts of FIGS. 6(*a*) to 6(*e*), FIGS. 7(*a*) to 7(*d*), FIGS. 8(*a*) to 8(*d*), FIGS. 9(*a*) to 9(*d*), FIGS. 10(*a*) to 10(*d*), FIGS. 11(*a*) to 11(*d*), and FIGS. 12(*a*) to 12(*d*).

In Step P1, it is determined whether there is an input to the setting instrument 56 for the type of the material to be printed. If the answer is Y (yes), the type of the material W to be printed is loaded from the setting instrument 56 for the type of the material to be printed, and stored into the memory M1, in Step P2, and the program proceeds to Step P3. If the answer is N (no), the program directly shifts to Step P3.

Then, in Step P3, it is determined whether there is an input to the setting instrument 57 for the thickness of the material to be printed. If the answer is Y, the thickness of the material to be printed is loaded from the setting instrument 57 for the thickness of the material to be printed, and stored into the memory M2, in Step P4. Then, the program proceeds to Step P5. If the answer is N, the program directly shifts to Step P5.

Then, in Step P5, it is determined whether there is an input to the setting instrument 58 for the material for the screen printing forme. If the answer is Y, the material for the screen printing forme 11*c* is loaded from the setting instrument 58 for the material for the screen printing forme, and stored into the memory M3, in Step P6. Then, the program proceeds to Step P7. If the answer is N, the program directly shifts to Step P7.

Then, in Step P7, it is determined whether there is an input to the setting instrument 59 for the thickness of the screen printing forme. If the answer is Y, the thickness of the screen printing forme is loaded from the setting instrument 59 for the thickness of the screen printing forme, and stored into the memory M4, in Step P8. Then, the program proceeds to Step P9. If the answer is N, the program directly shifts to Step P9.

Then, in Step P9, it is determined whether the picture pattern area rate has been transmitted from the picture pattern area rate measuring device 79. If the answer is Y, the picture pattern area rate is received from the picture pattern area rate measuring device 79, and stored into the memory M5, in Step P10. Then, the program proceeds to Step P11. If the answer is N, the program directly shifts to Step P11.

Then, in Step P11, it is determined whether there is an input to the setting instrument 60 for the mesh size of the screen printing forme. If the answer is Y, the mesh size of the screen printing forme 11*c* is loaded from the setting instrument 60 for the mesh size of the screen printing forme, and stored into the memory M6, in Step P12. Then, the program proceeds to Step P13. If the answer is N, the program directly shifts to Step P13.

Then, in Step P13, it is determined whether there is an input to the setting instrument 61 for the viscosity of ink. If the answer is Y, the viscosity of ink is loaded from the setting instrument 61 for the viscosity of ink, and stored into the memory M7, in Step P14. Then, the program proceeds to Step P15. If the answer is N, the program directly shifts to Step P15.

Then, in Step P15, it is determined whether there is an input to the setting instrument 62 for the yield value of ink. If the answer is Y, the yield value of ink is loaded from the setting instrument 62 for the yield value of ink, and stored into the memory M8, in Step P16. Then, the program proceeds to Step P17. If the answer is N, the program directly shifts to Step P17.

Then, in Step P17, it is determined whether there is an input to the setting instrument 63 for the type of the pigment of ink. If the answer is Y, the type of the pigment of ink is loaded from the setting instrument 63 for the type of the pigment of ink, and stored into the memory M9, in Step P18. Then, the program proceeds to Step P19. If the answer is N, the program directly shifts to Step P19.

Then, in Step P19, it is determined whether there is an input to the setting instrument 64 for the material for the squeegee. If the answer is Y, the material for the squeegee 38 is loaded from the setting instrument 64 for the material for the squeegee, and stored into the memory M10, in Step P20. Then, the program proceeds to Step P21. If the answer is N, the program directly shifts to Step P21.

Then, in Step P21, it is determined whether there is an input to the setting instrument 65 for the thickness of the squeegee. If the answer is Y, the thickness of the squeegee is loaded from the setting instrument 65 for the thickness of the squeegee, and stored into the memory M11, in Step P22. Then, the program proceeds to Step P23. If the answer is N, the program directly shifts to Step P23.

Then, in Step P23, it is determined whether the squeegee throw-on and throw-off automatic control switch 52 is ON. If the answer is Y, the table of conversion from the type of the material to be printed to the throw-on position (count value of the counter) of the squeegee is loaded from the memory M12 in Step P24. If the answer is N, the program returns to Step P1.

Then, in Step P25, the type of the material W to be printed is loaded from the memory M1. Then, in Step P26, the provisional reference throw-on position (count value of the counter) of the squeegee is obtained from the type of the material W to be printed, with the use of the table of conversion from the type of the material to be printed to the throw-on position (count value of the counter) of the squeegee, and is stored into the memory M13.

Then, in Step P27, the type of the material W to be printed is loaded from the memory M1. Then, in Step P28, the table of conversion from the thickness of the material to be printed to the throw-on position (count value of the counter) of the squeegee, which is commensurate with the type of the material to be printed, is loaded from the memory M14.

Then, in Step P29, the thickness of the material to be printed is loaded from the memory M2. Then, in Step P30, the first correction value (count value of the counter) of the throw-on position of the squeegee is obtained from the thickness of the material to be printed, with the use of the table of conversion from the thickness of the material to be printed to the throw-on position (count value of the counter) of the squeegee, which is commensurate with the type of the material to be printed, and this correction value is stored into the memory M15.

Then, in Step P31, the table of conversion from the material for the screen printing forme to the throw-on position (count value of the counter) of the squeegee is loaded from the memory M16. Then, in Step P32, the material for the screen printing forme 11*c* is loaded from the memory M3. Then, in Step P33, the second correction value (count value of the counter) of the throw-on position of the squeegee is obtained from the material for the screen printing forme 11*c*, with the use of the table of conversion from the material for the screen printing forme to the throw-on position (count value of the counter) of the squeegee, and this correction value is stored into the memory M17.

Then, in Step P34, the material for the screen printing forme 11*c* is loaded from the memory M3. Then, in Step P35, the table of conversion from the thickness of the screen printing forme to the throw-on position (count value of the counter) of the squeegee, which is commensurate with the material for the screen printing forme, is loaded from the memory M18.

Then, in Step P36, the thickness of the screen printing forme is loaded from the memory M4. Then, in Step P37, the third correction value (count value of the counter) of the throw-on position of the squeegee is obtained from the thickness of the screen printing forme, with the use of the table of conversion from the thickness of the screen printing forme to the throw-on position (count value of the counter) of the squeegee, which is commensurate with the material for the screen printing forme, and this correction value is stored into the memory M19.

Then, in Step P38, the material for the screen printing forme 11*c* is loaded from the memory M3. Then, in Step P39, the thickness of the screen printing forme is loaded from the memory M4. Then, in Step P40, the table of conversion from the picture pattern area rate to the throw-on position (count value of the counter) of the squeegee, which is commensurate with the material for the screen printing forme and the thickness of the screen printing forme, is loaded from the memory M20.

Then, in Step P41, the picture pattern area rate is loaded from the memory M5. Then, in Step P42, the fourth correction value (count value of the counter) of the throw-on position of the squeegee is obtained from the picture pattern area rate, with the use of the table of conversion from the picture pattern area rate to the throw-on position (count value of the counter) of the squeegee, which is commensurate with the material for the screen printing forme and the thickness of the screen printing forme, and this correction value is stored into the memory M21.

Then, in Step P43, the material for the screen printing forme 11*c* is loaded from the memory M3. Then, in Step P44, the thickness of the screen printing forme is loaded from the memory M4. Then, in Step P45, the table of conversion from the mesh size of the screen printing forme to the throw-on position (count value of the counter) of the squeegee, which is commensurate with the material for the screen printing forme and the thickness of the screen printing forme, is loaded from the memory M22.

Then, in Step P46, the mesh size of the screen printing forme is loaded from the memory M6. Then, in Step P47, the fifth correction value (count value of the counter) of the throw-on position of the squeegee is obtained from the mesh size of the screen printing forme, with the use of the table of conversion from the mesh size of the screen printing forme to the throw-on position (count value of the counter) of the squeegee, which is commensurate with the material for the screen printing forme and the thickness of the screen printing forme, and this correction value is stored into the memory M23.

Then, in Step P48, the table of conversion from the viscosity of ink to the throw-on position (count value of the counter) of the squeegee is loaded from the memory M24. Then, in Step P49, the viscosity of ink is loaded from the memory M7. Then, in Step P50, the sixth correction value (count value of the counter) of the throw-on position of the squeegee is obtained from the viscosity of ink with the use of the table of conversion from the viscosity of ink to the throw-on position (count value of the counter) of the squeegee, and this correction value is stored into the memory M25.

Then, in Step P51, the table of conversion from the yield value of ink to the throw-on position (count value of the counter) of the squeegee is loaded from the memory M26. Then, in Step P52, the yield value of ink is loaded from the memory M8. Then, in Step P53, the seventh correction value (count value of the counter) of the throw-on position of the squeegee is obtained from the yield value of ink with the use of the table of conversion from the yield value of ink to the throw-on position (count value of the counter) of the squeegee, and this correction value is stored into the memory M27.

Then, in Step P54, the table of conversion from the type of the pigment of ink to the throw-on position (count value of the counter) of the squeegee is loaded from the memory M28. Then, in Step P55, the type of the pigment of ink is loaded from the memory M9. Then, in Step P56, the eighth correction value (count value of the counter) of the throw-on position of the squeegee is obtained from the type of the pigment of ink with the use of the table of conversion from the type of the pigment of ink to the throw-on position (count value of the counter) of the squeegee, and this correction value is stored into the memory M29.

Then, in Step P57, the table of conversion from the material for the squeegee to the throw-on position (count value of the counter) of the squeegee is loaded from the memory M30. Then, in Step P58, the material for the squeegee 38 is loaded from the memory M10. Then, in Step P59, the ninth correction value (count value of the counter) of the throw-on position of the squeegee is obtained from the material for the squeegee 38 with the use of the table of conversion from the material for the squeegee to the throw-on position (count value of the counter) of the squeegee, and this correction value is stored into the memory M31.

Then, in Step P60, the material for the squeegee 38 is loaded from the memory M10. Then, in Step P61, the table of conversion from the thickness of the squeegee to the throw-on position (count value of the counter) of the squeegee, which is commensurate with the material for the squeegee, is loaded from the memory M32.

Then, in Step P62, the thickness of the squeegee is loaded from the memory M11. Then, in Step P63, the tenth correction value (count value of the counter) of the throw-on position of the squeegee is obtained from the thickness of the squeegee with the use of the table of conversion from the thickness of the squeegee to the throw-on position (count value of the counter) of the squeegee, which is commensurate with the material for the squeegee, and this correction value is stored into the memory M33.

Then, in Step P64, the provisional reference throw-on position (count value of the counter) of the squeegee is loaded from the memory M13, whereafter, in Step P65, the first correction value (count value of the counter) of the throw-on position of the squeegee is loaded from the memory M15. Then, in Step P66, the second correction value (count value of the counter) of the throw-on position of the squeegee is loaded from the memory M17.

Then, in Step P67, the third correction value (count value of the counter) of the throw-on position of the squeegee is loaded from the memory M19, whereafter, in Step P68, the fourth correction value (count value of the counter) of the throw-on position of the squeegee is loaded from the memory M21. Then, in Step P69, the fifth correction value (count value of the counter) of the throw-on position of the squeegee is loaded from the memory M23.

Then, in Step P70, the sixth correction value (count value of the counter) of the throw-on position of the squeegee is loaded from the memory M25, whereafter, in Step P71, the seventh correction value (count value of the counter) of the throw-on position of the squeegee is loaded from the memory M27. Then, in Step P72, the eighth correction value (count value of the counter) of the throw-on position of the squeegee is loaded from the memory M29.

Then, in Step P73, the ninth correction value (count value of the counter) of the throw-on position of the squeegee is loaded from the memory M31, whereafter, in Step P74, the tenth correction value (count value of the counter) of the throw-on position of the squeegee is loaded from the memory M33.

Then, in Step P75, the first correction value (count value of the counter) of the throw-on position of the squeegee, the second correction value (count value of the counter) of the throw-on position of the squeegee, the third correction value (count value of the counter) of the throw-on position of the squeegee, the fourth correction value (count value of the counter) of the throw-on position of the squeegee, the fifth correction value (count value of the counter) of the throw-on position of the squeegee, the sixth correction value (count value of the counter) of the throw-on position of the squeegee, the seventh correction value (count value of the counter) of the throw-on position of the squeegee, the eighth correction value (count value of the counter) of the throw-on position of the squeegee, the ninth correction value (count value of the counter) of the throw-on position of the squeegee, and the tenth correction value (count value of the counter) of the throw-on position of the squeegee are added to the provisional reference throw-on position (count value of the counter) of the squeegee to compute the reference throw-on position (count value of the counter) of the squeegee, and this reference throw-on position (count value of the counter) of the squeegee is stored into the memory M34.

In accordance with the above-described motion flow, the throw-on position of the squeegee 38 during printing is preset, based on the type of the material W to be printed (i.e., difference in the material, e.g., paper, cloth, film or corrugated board), in conformity with the thickness of the material to be printed, the material for the screen printing forme 11*c*, the thickness of the screen printing forme, the picture pattern area rate, the mesh size of the screen printing forme 11*c*, the viscosity of ink, the yield value of ink, the type of the pigment of ink, the material for the squeegee, and the thickness of the squeegee.

Then, in Step P76, the table of conversion from the material for the screen printing forme to the retreat position (count value of the counter) of the squeegee is loaded from the memory M35. Then, in Step P77, the material for the screen printing forme 11*c* is loaded from the memory M3. Then, in Step P78, the provisional reference retreat position (count value of the counter) of the squeegee is obtained from the material for the screen printing forme 11*c* with the use of the table of conversion from the material for the screen printing forme to the retreat position (count value of the counter) of the squeegee, and is stored into the memory M36.

Then, in Step P79, the material for the screen printing forme 11*c* is loaded from the memory M3. Then, in Step P80, the table of conversion from the thickness of the screen printing forme to the retreat position (count value of the counter) of the squeegee, which is commensurate with the material for the screen printing forme, is loaded from the memory M37.

Then, in Step P81, the thickness of the screen printing forme is loaded from the memory M4. Then, in Step P82, the first correction value (count value of the counter) of the retreat position of the squeegee is obtained from the thickness of the screen printing forme with the use of the table of conversion from the thickness of the screen printing forme to the retreat position (count value of the counter) of the squeegee, which is commensurate with the material for the screen printing forme, and this correction value is stored into the memory M38.

Then, in Step P83, the material for the screen printing forme 11*c* is loaded from the memory M3, whereafter, in Step P84, the thickness of the screen printing forme is loaded from the memory M4. Then, in Step P85, the table of conversion from the picture pattern area rate to the retreat position (count value of the counter) of the squeegee, which is commensurate with the material for the screen printing forme and the thickness of the screen printing forme, is loaded from the memory M39.

Then, in Step P86, the picture pattern area rate is loaded from the memory M5. Then, in Step P87, the second correction value (count value of the counter) of the retreat position of the squeegee is obtained from the picture pattern area rate with the use of the table of conversion from the picture pattern area rate to the retreat position (count value of the counter) of the squeegee, which is commensurate with the material for the screen printing forme and the thickness of the screen printing forme, and this correction value is stored into the memory M40.

Then, in Step P88, the material for the screen printing forme is loaded from the memory M3. Then, in Step P89, the thickness of the screen printing forme is loaded from the memory M4. Then, in Step P90, the table of conversion from the mesh size of the screen printing forme to the retreat position (count value of the counter) of the squeegee, which is commensurate with the material for the screen printing forme and the thickness of the screen printing forme, is loaded from the memory M41.

Then, in Step P91, the mesh size of the screen printing forme 11*c* is loaded from the memory M6. Then, in Step P92, the third correction value (count value of the counter) of the retreat position of the squeegee is obtained from the mesh size of the screen printing forme 11*c* with the use of the table of conversion from the mesh size of the screen printing forme to the retreat position (count value of the counter) of the squeegee, which is commensurate with the material for the screen printing forme and the thickness of the screen printing forme, and this correction value is stored into the memory M42.

Then, in Step P93, the table of conversion from the viscosity of ink to the retreat position (count value of the counter) of the squeegee is loaded from the memory M43. Then, in Step P94, the viscosity of ink is loaded from the memory M7. Then, in Step P95, the fourth correction value (count value of the counter) of the retreat position of the squeegee is obtained from the viscosity of ink with the use of the table of conversion from the viscosity of ink to the retreat position (count value of the counter) of the squeegee, and this correction value is stored into the memory M44.

Then, in Step P96, the table of conversion from the yield value of ink to the retreat position (count value of the counter) of the squeegee is loaded from the memory M45. Then, in Step P97, the yield value of ink is loaded from the memory M8. Then, in Step P98, the fifth correction value (count value of the counter) of the retreat position of the squeegee is obtained from the yield value of ink with the use of the table of conversion from the yield value of ink to the retreat position (count value of the counter) of the squeegee, and this correction value is stored into the memory M46.

Then, in Step P99, the table of conversion from the type of the pigment of ink to the retreat position (count value of the counter) of the squeegee is loaded from the memory M47. Then, in Step P100, the type of the pigment of ink is loaded from the memory M9. Then, in Step P101, the sixth correction value (count value of the counter) of the retreat position of the squeegee is obtained from the type of the pigment of ink with the use of the table of conversion from the type of the pigment of ink to the retreat position (count value of the counter) of the squeegee, and this correction value is stored into the memory M48.

Then, in Step P102, the table of conversion from the material for the squeegee to the retreat position (count value of the counter) of the squeegee is loaded from the memory M49. Then, in Step P103, the material for the squeegee is loaded from the memory M10. Then, in Step P104, the seventh correction value (count value of the counter) of the retreat position of the squeegee is obtained from the material for the squeegee with the use of the table of conversion from the material for the squeegee to the retreat position (count value of the counter) of the squeegee, and this correction value is stored into the memory M50.

Then, in Step P105, the material for the squeegee is loaded from the memory M10. Then, in Step P106, the table of conversion from the thickness of the squeegee to the retreat position (count value of the counter) of the squeegee, which is commensurate with the material for the squeegee, is loaded from the memory M51.

Then, in Step P107, the thickness of the squeegee is loaded from the memory M11. Then, in Step P108, the eighth correction value (count value of the counter) of the retreat position of the squeegee is obtained from the thickness of the squeegee with the use of the table of conversion from the thickness of the squeegee to the retreat position (count value of the counter) of the squeegee, which is commensurate with the material for the squeegee, and this correction value is stored into the memory M52.

Then, in Step P109, the provisional reference retreat position (count value of the counter) of the squeegee is loaded from the memory M36, whereafter, in Step P110, the first correction value (count value of the counter) of the retreat position of the squeegee is loaded from the memory M38. Then, in Step P111, the second correction value (count value of the counter) of the retreat position of the squeegee is loaded from the memory M40.

Then, in Step P112, the third correction value (count value of the counter) of the retreat position of the squeegee is loaded from the memory M42, whereafter, in Step P113, the fourth correction value (count value of the counter) of the retreat position of the squeegee is loaded from the memory M44. Then, in Step P114, the fifth correction value (count value of the counter) of the retreat position of the squeegee is loaded from the memory M46.

Then, in Step P115, the sixth correction value (count value of the counter) of the retreat position of the squeegee is loaded from the memory M48, whereafter, in Step P116, the seventh correction value (count value of the counter) of the retreat position of the squeegee is loaded from the memory M50. Then, in Step P117, the eighth correction value (count value of the counter) of the retreat position of the squeegee is loaded from the memory M52.

Then, in Step P118, the first correction value (count value of the counter) of the retreat position of the squeegee, the second correction value (count value of the counter) of the retreat position of the squeegee, the third correction value (count value of the counter) of the retreat position of the squeegee, the fourth correction value (count value of the counter) of the retreat position of the squeegee, the fifth correction value (count value of the counter) of the retreat position of the squeegee, the sixth correction value (count value of the counter) of the retreat position of the squeegee, the seventh correction value (count value of the counter) of the retreat position of the squeegee, and the eighth correction value (count value of the counter) of the retreat position of the squeegee are added to the provisional reference retreat position (count value of the counter) of the squeegee to compute the reference retreat position (count value of the counter) of the squeegee, and this reference retreat position (count value of the counter) of the squeegee is stored into the memory M53. The reference retreat position (count value of the counter) of the squeegee obtained is a position closer to the throw-off position of the squeegee than to the reference throw-on position of the squeegee obtained in Step P75, in other words, a position at which the leading end of the squeegee 38 does not leave the inner peripheral surface of the screen printing forme 11*c*, and its pressing force decreases.

In accordance with the above-described motion flow, the retreat position of the squeegee 38 when opposing the notch 13*b* of the impression cylinder 13 is preset, based on the material for the screen printing forme 11*c*, in conformity with the thickness of the screen printing forme, the picture pattern area rate, the mesh size of the screen printing forme 11*c*, the viscosity of ink, the yield value of ink, the type of the pigment of ink, the material for the squeegee, and the thickness of the squeegee.

Then, in Step P119, it is determined whether the squeegee throw-on and throw-off automatic control switch 52 is OFF. If the answer is Y (yes), the program shifts to Step P351 to be described later. If the answer is N (no), it is determined, in Step P120, whether a cylinder engagement signal from the cylinder engagement circuit 78 for the rotary screen cylinder is ON.

If the answer is Y in the above Step P120, the program shifts to Step P175 to be described later. If the answer is N, the throw-off position (count value of the counter) of the squeegee is loaded from the memory M54 in Step P121.

Then, in Step P122, the memory M55 for storing the desired count value of the counter for detecting the position of the left side of the squeegee is overwritten with the throw-off position (count value of the counter) of the squeegee. Then, in Step P123, the memory M56 for storing the desired count value of the counter for detecting the position of the right side of the squeegee is overwritten with the throw-off position (count value of the counter) of the squeegee.

Then, in Step P124, the count value is loaded from the counter 74 for detecting the rotation phase of the rotary screen cylinder, and stored into the memory M68. Then, in Step P125, the rotation phase of the rotary screen cylinder during squeegee throw-off is loaded from the memory M58.

Then, in Step P126, it is determined whether the count value of the counter for detecting the rotation phase of the rotary screen cylinder is equal to the rotation phase of the rotary screen cylinder during squeegee throw-off. If the answer is N, the program returns to Step P124 mentioned above. If the answer is Y, the count value S of the memory M59 is overwritten with 0 in Step P127.

Then, in Step P128, the memory M60 for storing the rotating direction of the motor for adjusting the left side is overwritten with 0. Then, in Step P129, the memory M61 for storing the rotating direction of the motor for adjusting the right side is overwritten with 0.

Then, in Step P130, the count value is loaded from the counter 68 for detecting the current position of the left side of the squeegee, and stored into the memory M62. Then, in Step P131, the desired count value of the counter for detecting the position of the left side of the squeegee is loaded from the memory M55.

Then, in Step P132, it is determined whether the count value of the counter for detecting the current position of the left side of the squeegee is equal to the desired count value of the counter for detecting the position of the left side of the squeegee. If the answer is N, it is determined, in Step P133, whether the count value of the counter for detecting the current position of the left side of the squeegee is less than the desired count value of the counter for detecting the position of the left side of the squeegee.

If the answer is Y in the above Step P133, the memory M60 for storing the rotating direction of the motor for adjusting the left side is overwritten with 1 in Step P134. Then, in Step P135, a normal rotation command is outputted to the driver 66 for the motor for adjusting the left side, whereafter the program proceeds to Step P136. If the answer is N in Step P133, the memory M60 for storing the rotating direction of the motor for adjusting the left side is overwritten with 2 in Step P137. Then, in Step P138, a reverse rotation command is outputted to the driver 66 for the motor for adjusting the left side, whereafter the program shifts to Step P136.

If the answer is Y in the aforementioned Step P132, the count value S is loaded from the memory M59. Then, in Step P140, 1 is added to the count value S of the memory M59 for overwriting, whereafter the program shifts to Step P136 mentioned above.

Then, in the aforementioned Step P136, the count value is loaded from the counter 72 for detecting the current position of the right side of the squeegee, and stored into the memory M63. Then, in Step P141, the desired count value of the counter for detecting the position of the right side of the squeegee is loaded from the memory M56.

Then, in Step P142, it is determined whether the count value of the counter for detecting the current position of the right side of the squeegee is equal to the desired count value of the counter for detecting the position of the right side of the squeegee. If the answer is N, it is determined, in Step P143, whether the count value of the counter for detecting the current position of the right side of the squeegee is less than the desired count value of the counter for detecting the position of the right side of the squeegee.

If the answer is Y in the above Step P143, the memory M61 for storing the rotating direction of the motor for adjusting the right side is overwritten with 1 in Step P144. Then, in Step P145, a normal rotation command is outputted to the driver 70 for the motor for adjusting the right side, whereafter the program proceeds to Step P146. If the answer is N in Step P143, the memory M61 for storing the rotating direction of the motor for adjusting the right side is overwritten with 2 in Step P147. Then, in Step P148, a reverse rotation command is outputted to the driver 70 for the motor for adjusting the right side, whereafter the program shifts to Step P146.

If the answer is Y in the aforementioned Step P142, the count value S is loaded from the memory M59 in Step P149. Then, in Step P150, 1 is added to the count value S of the memory M59 for overwriting, whereafter the program shifts to Step P146 mentioned above.

Then, in Step P146 mentioned above, the count value S is loaded from the memory M59, whereafter it is determined in Step P151 whether the count value S is 2. If the answer is Y, outputting of the enabling signal to the counter 76 for counting the total number of revolutions during squeegee throw-on is stopped in Step P152, and the program returns to Step P119 mentioned earlier.

Then, in Step P153, the count value is loaded from the counter 68 for detecting the current position of the left side of the squeegee, and stored into the memory M62. Then, in Step P154, the desired count value of the counter for detecting the position of the left side of the squeegee is loaded from the memory M55.

Then, in Step P155, it is determined whether the count value of the counter for detecting the current position of the left side of the squeegee is equal to the desired count value of the counter for detecting the position of the left side of the squeegee. If the answer is Y, the value of the memory M60 for storing the rotating direction of the motor for adjusting the left side is loaded in Step P156. If the answer is N, the program shifts to Step P164 to be described later.

Then, in Step P157, it is determined whether the value of the memory for storing the rotating direction of the motor for adjusting the left side is 1. If the answer is Y, outputting of the normal rotation command to the driver 66 for the motor for adjusting the left side is stopped in Step P158, and the program proceeds to Step P159. If the answer is N, it is determined in Step P160 whether the value of the memory for storing the rotating direction of the motor for adjusting the left side is 2.

If the answer is Y in the above Step P160, outputting of the reverse rotation command to the driver 66 for the motor for adjusting the left side is stopped in Step P161, and the program shifts to the aforementioned Step P159. If the answer is N, the program shifts to the aforementioned Step P164.

Then, in the above-mentioned Step P159, the memory M60 for storing the rotating direction of the motor for adjusting the left side is overwritten with 0. Then, in Step P162, the count value S is loaded from the memory M59, whereafter 1 is added to the count value S of the memory M59 for overwriting in Step P163.

Then, in Step P164, the count value is loaded from the counter 72 for detecting the current position of the right side of the squeegee, and stored into the memory M63. Then, in Step P165, the desired count value of the counter for detecting the position of the right side of the squeegee is loaded from the memory M56.

Then, in Step P166, it is determined whether the count value of the counter for detecting the current position of the right side of the squeegee is equal to the desired count value of the counter for detecting the position of the right side of the squeegee. If the answer is Y, the value of the memory M61 for storing the rotating direction of the motor for adjusting the right side is loaded in Step P167. If the answer is N, the program returns to Step P146.

Then, in Step P168, it is determined whether the value of the memory for storing the rotating direction of the motor for adjusting the right side is 1. If the answer is Y, outputting of the normal rotation command to the driver 70 for the motor for adjusting the right side is stopped in Step P169, and the program proceeds to Step P170. If the answer is N, it is determined in Step P171 whether the value of the memory for storing the rotating direction of the motor for adjusting the right side is 2.

If the answer is Y in the above Step P171, outputting of the reverse rotation command to the driver 70 for the motor for adjusting the right side is stopped in Step P172, and the program shifts to the aforementioned Step P170. If the answer is N, the program returns to Step P146.

Then, in the aforementioned Step P170, the memory M61 for storing the rotating direction of the motor for adjusting the right side is overwritten with 0. Then, in Step P173, the count value S is loaded from the memory M59, whereafter 1 is added to the count value S of the memory M59 for overwriting in Step P174. Then, the program returns to Step P146.

In accordance with the above-described motion flow, when the squeegee throw-on and throw-off automatic control switch 52 is ON and the cylinder engagement signal for the rotary screen cylinder 11 is OFF, the squeegee 38 is moved to the throw-off position.

Then, in Step P175 shifted from the aforementioned Step P120, the table of conversion from the total number of revolutions during squeegee throw-onto the correction amount (count value of the counter) of the squeegee position is loaded from the memory M64. Then, in Step P176, the count value is loaded from the counter 76 for counting the total number of revolutions during squeegee throw-on, and stored into the memory M65.

Then, in Step P177, the correction amount (count value of the counter) of the squeegee position is obtained from the count value of the counter 76 for counting the total number of revolutions during squeegee throw-on, with the use of the table of conversion from the total number of revolutions during squeegee throw-on to the correction amount (count value of the counter) of the squeegee position, and this correction amount is stored into the memory M66. Then, in Step P178, the reference retreat position (count value of the counter) of the squeegee is loaded from the memory M53.

Then, in Step P179, the correction amount (count value of the counter) of the squeegee position is loaded from the memory M66. Then, in Step P180, the correction amount (count value of the counter) of the squeegee position is added to the reference retreat position (count value of the counter) of the squeegee to compute the retreat position (count value of the counter) of the squeegee, which is stored into the memory M67.

Then, in Step P181, the memory M55 for storing the desired count value of the counter for detecting the position of the left side of the squeegee is overwritten with the retreat position (count value of the counter) of the squeegee. Then, in Step P182, the memory M56 for storing the desired count value of the counter for detecting the position of the right side of the squeegee is overwritten with the retreat position (count value of the counter) of the squeegee.

Then, in Step P183, the count value is loaded from the counter 74 for detecting the rotation phase of the rotary screen cylinder, and stored into the memory M68. Then, in Step P184, the rotation phase of the rotary screen cylinder during squeegee throw-on is loaded from the memory M69.

Then, in Step P185, it is determined whether the count value of the counter for detecting the rotation phase of the rotary screen cylinder is equal to the rotation phase of the rotary screen cylinder during squeegee throw-on. If the answer is N, the program returns to Step P183 mentioned above. If the answer is Y, the count value S of the memory M59 is overwritten with 0 in Step P186. Then, in Step P187, the memory M60 for storing the rotating direction of the motor for adjusting the left side is overwritten with 0. Then, in Step P188, the memory M61 for storing the rotating direction of the motor for adjusting the right side is overwritten with 0.

Then, in Step P189, the count value is loaded from the counter 68 for detecting the current position of the left side of the squeegee, and stored into the memory M62. Then, in Step P190, the desired count value of the counter for detecting the position of the left side of the squeegee is loaded from the memory M55.

Then, in Step P191, it is determined whether the count value of the counter for detecting the current position of the left side of the squeegee is equal to the desired count value of the counter for detecting the position of the left side of the squeegee. If the answer is N, it is determined, in Step P192, whether the count value of the counter for detecting the current position of the left side of the squeegee is less than the desired count value of the counter for detecting the position of the left side of the squeegee.

If the answer is Y in the above Step P192, the memory M60 for storing the rotating direction of the motor for adjusting the left side is overwritten with 1 in Step P193. Then, in Step P194, a normal rotation command is outputted to the driver 66 for the motor for adjusting the left side, whereafter the program proceeds to Step P195. If the answer is N in Step P192, the memory M60 for storing the rotating direction of the motor for adjusting the left side is overwritten with 2 in Step P196. Then, in Step P197, a reverse rotation command is outputted to the driver 66 for the motor for adjusting the left side, whereafter the program shifts to the aforementioned Step P195.

If the answer is Y in Step P191, the count value S is loaded from the memory M59 in Step P198. Then, in Step P199, 1 is added to the count value S of the memory M59 for overwriting, whereafter the program shifts to Step P195 mentioned above.

Then, in the aforementioned Step P195, the count value is loaded from the counter 72 for detecting the current position of the right side of the squeegee, and stored into the memory M63. Then, in Step P200, the desired count value of the counter for detecting the position of the right side of the squeegee is loaded from the memory M56.

Then, in Step P201, it is determined whether the count value of the counter for detecting the current position of the right side of the squeegee is equal to the desired count value of the counter for detecting the position of the right side of the squeegee. If the answer is N, it is determined, in Step P202, whether the count value of the counter for detecting the current position of the right side of the squeegee is less than the desired count value of the counter for detecting the position of the right side of the squeegee.

If the answer is Y in the above Step P202, the memory M61 for storing the rotating direction of the motor for adjusting the right side is overwritten with 1 in Step P203. Then, in Step P204, a normal rotation command is outputted to the driver 70 for the motor for adjusting the right side, whereafter the program proceeds to Step P205. If the answer is N in Step P202, the memory M61 for storing the rotating direction of the motor for adjusting the right side is overwritten with 2 in Step P206. Then, in Step P207, a reverse rotation command is outputted to the driver 70 for the motor for adjusting the right side, whereafter the program shifts to Step P205.

If the answer is Y in the aforementioned Step P201, the count value S is loaded from the memory M59 in Step P208. Then, in Step P209, 1 is added to the count value S of the memory M59 for overwriting, whereafter the program shifts to Step P205 mentioned above.

Then, in Step P205 mentioned above, the count value S is loaded from the memory M59, whereafter it is determined in Step P210 whether the count value S is 2. If the answer is Y, an enabling signal is outputted in Step P211 to the counter 76 for counting the total number of revolutions during squeegee throw-on, and the program shifts to Step P234 to be described later.

If the answer is N in the above-mentioned Step P210, the count value is loaded from the counter 68 for detecting the current position of the left side of the squeegee, and stored into the memory M62, in Step P212. Then, in Step P213, the desired count value of the counter for detecting the position of the left side of the squeegee is loaded from the memory M55.

Then, in Step P214, it is determined whether the count value of the counter for detecting the current position of the left side of the squeegee is equal to the desired count value of the counter for detecting the position of the left side of the squeegee. If the answer is Y, the value of the memory M60 for storing the rotating direction of the motor for adjusting the left side is loaded in Step P215. If the answer is N, the program shifts to Step P223 to be described later.

Then, in Step P216, it is determined whether the value of the memory for storing the rotating direction of the motor for adjusting the left side is 1. If the answer is Y, outputting of the normal rotation command to the driver 66 for the motor for adjusting the left side is stopped in Step P217, and the program proceeds to Step P218. If the answer is N, it is determined in Step P219 whether the value of the memory for storing the rotating direction of the motor for adjusting the left side is 2.

If the answer is Y in the above Step P219, outputting of the reverse rotation command to the driver 66 for the motor for adjusting the left side is stopped in Step P220, and the program shifts to the aforementioned Step P218. If the answer is N, the program shifts to the aforementioned Step P223.

Then, in the above-mentioned Step P218, the memory M60 for storing the rotating direction of the motor for adjusting the left side is overwritten with 0. Then, in Step P221, the count value S is loaded from the memory M59, whereafter 1 is added to the count value S of the memory M59 for overwriting in Step P222.

Then, in Step P223, the count value is loaded from the counter 72 for detecting the current position of the right side of the squeegee, and stored into the memory M63. Then, in Step P224, the desired count value of the counter for detecting the position of the right side of the squeegee is loaded from the memory M56.

Then, in Step P225, it is determined whether the count value of the counter for detecting the current position of the right side of the squeegee is equal to the desired count value of the counter for detecting the position of the right side of the squeegee. If the answer is Y, the value of the memory M61 for storing the rotating direction of the motor for adjusting the right side is loaded in Step P226. If the answer is N, the program returns to Step P205.

Then, in Step P227, it is determined whether the value of the memory for storing the rotating direction of the motor for adjusting the right side is 1. If the answer is Y, outputting of the normal rotation command to the driver 70 for the motor for adjusting the right side is stopped in Step P228, and the program proceeds to Step P229. If the answer is N, it is determined in Step P230 whether the value of the memory for storing the rotating direction of the motor for adjusting the right side is 2.

If the answer is Y in the above Step P230, outputting of the reverse rotation command to the driver 70 for the motor for adjusting the right side is stopped in Step P231, and the program shifts to the aforementioned Step P229. If the answer is N, the program returns to Step P205.

Then, in the aforementioned Step P229, the memory M61 for storing the rotating direction of the motor for adjusting the right side is overwritten with 0. Then, in Step P232, the count value S is loaded from the memory M59, whereafter 1 is added to the count value S of the memory M59 for overwriting in Step P233. Then, the program returns to Step P205.

In accordance with the above-described motion flow, when the squeegee throw-on and throw-off automatic control switch 52 is ON and the cylinder engagement signal for the rotary screen cylinder 11 is ON, the squeegee 38 is moved to the predetermined retreat position when it opposes the notch 13*b* of the impression cylinder 13.

Then, in Step P234 shifted from the aforementioned Step P211, the table of conversion from the total number of revolutions during squeegee throw-on to the correction amount (count value of the counter) of the squeegee position is loaded from the memory M64. Then, in Step P235, the count value is loaded from the counter 76 for counting the total number of revolutions during squeegee throw-on, and stored into the memory M65.

Then, in Step P236, the correction amount (count value of the counter) of the squeegee position is obtained from the count value of the counter 76 for counting the total number of revolutions during squeegee throw-on, with the use of the table of conversion from the total number of revolutions during squeegee throw-on to the correction amount (count value of the counter) of the squeegee position, and this correction amount is stored into the memory M66. Then, in Step P237, the reference throw-on position (count value of the counter) of the squeegee is loaded from the memory M34.

Then, in Step P238, the correction amount (count value of the counter) of the squeegee position is loaded from the memory M66. Then, in Step P239, the correction amount (count value of the counter) of the squeegee position is added to the reference throw-on position (count value of the counter) of the squeegee to compute the printing position (count value of the counter) of the squeegee, which is stored into the memory M70.

Then, in Step P240, the memory M55 for storing the desired count value of the counter for detecting the position of the left side of the squeegee is overwritten with the printing position (count value of the counter) of the squeegee. Then, in Step P241, the memory M56 for storing the desired count value of the counter for detecting the position of the right side of the squeegee is overwritten with the printing position (count value of the counter) of the squeegee.

Then, in Step P242, the count value is loaded from the counter 74 for detecting the rotation phase of the rotary screen cylinder, and stored into the memory M68. Then, in Step P243, the rotation phase of the rotary screen cylinder at the position of the rear end of the notch of the impression cylinder is loaded from the memory M57.

Then, in Step P244, it is determined whether the count value of the counter for detecting the rotation phase of the rotary screen cylinder is equal to the rotation phase of the rotary screen cylinder at the position of the rear end of the notch of the impression cylinder. If the answer is N, the program returns to Step P242 mentioned above. If the answer is Y, the count value S of the memory M59 is overwritten with 0 in Step P245. Then, in Step P246, the memory M60 for storing the rotating direction of the motor for adjusting the left side is overwritten with 0. Then, in Step P247, the memory M61 for storing the rotating direction of the motor for adjusting the right side is overwritten with 0.

Then, in Step P248, the count value is loaded from the counter 68 for detecting the current position of the left side of the squeegee, and stored into the memory M62. Then, in Step P249, the desired count value of the counter for detecting the position of the left side of the squeegee is loaded from the memory M55.

Then, in Step P250, it is determined whether the count value of the counter for detecting the current position of the left side of the squeegee is equal to the desired count value of the counter for detecting the position of the left side of the squeegee. If the answer is N, it is determined, in Step P251, whether the count value of the counter for detecting the current position of the left side of the squeegee is less than the desired count value of the counter for detecting the position of the left side of the squeegee.

If the answer is Y in the above Step P251, the memory M60 for storing the rotating direction of the motor for adjusting the left side is overwritten with 1 in Step P252. Then, in Step P253, a normal rotation command is outputted to the driver 66 for the motor for adjusting the left side, whereafter the program proceeds to Step P254. If the answer is N in Step P251, the memory M60 for storing the rotating direction of the motor for adjusting the left side is overwritten with 2 in Step P255. Then, in Step P256, a reverse rotation command is outputted to the driver 66 for the motor for adjusting the left side, whereafter the program shifts to the aforementioned Step P254.

If the answer is Y in the aforementioned Step P250, the count value S is loaded from the memory M59 in Step P257. Then, in Step P258, 1 is added to the count value S of the memory M59 for overwriting, whereafter the program shifts to Step P254 mentioned above.

Then, in the aforementioned Step P254, the count value is loaded from the counter 72 for detecting the current position of the right side of the squeegee, and stored into the memory M63. Then, in Step P259, the desired count value of the counter for detecting the position of the right side of the squeegee is loaded from the memory M56.

Then, in Step P260, it is determined whether the count value of the counter for detecting the current position of the right side of the squeegee is equal to the desired count value of the counter for detecting the position of the right side of the squeegee. If the answer is N, it is determined, in Step P261, whether the count value of the counter for detecting the current position of the right side of the squeegee is less than the desired count value of the counter for detecting the position of the right side of the squeegee.

If the answer is Y in the above Step P261, the memory M61 for storing the rotating direction of the motor for adjusting the right side is overwritten with 1 in Step P262. Then, in Step P263, a normal rotation command is outputted to the driver 70 for the motor for adjusting the right side, whereafter the program proceeds to Step P264. If the answer is N in Step P261, the memory M61 for storing the rotating direction of the motor for adjusting the right side is overwritten with 2 in Step P265. Then, in Step P266, a reverse rotation command is outputted to the driver 70 for the motor for adjusting the right side, whereafter the program shifts to Step P264.

If the answer is Y in the aforementioned Step P260, the count value S is loaded from the memory M59 in Step P267. Then, in Step P268, 1 is added to the count value S of the memory M59 for overwriting, whereafter the program shifts to Step P264 mentioned above.

Then, in Step P264 mentioned above, the count value S is loaded from the memory M59, whereafter it is determined in Step P269 whether the count value S is 2. If the answer is Y, the program shifts to Step P292 to be described later.

If the answer is N in the above-mentioned Step P269, the count value is loaded from the counter 68 for detecting the current position of the left side of the squeegee, and stored into the memory M62, in Step P270. Then, in Step P271, the desired count value of the counter for detecting the position of the left side of the squeegee is loaded from the memory M55.

Then, in Step P272, it is determined whether the count value of the counter for detecting the current position of the left side of the squeegee is equal to the desired count value of the counter for detecting the position of the left side of the squeegee. If the answer is Y, the value of the memory M60 for storing the rotating direction of the motor for adjusting the left side is loaded in Step P273. If the answer is N, the program shifts to Step P281 to be described later.

Then, in Step P274, it is determined whether the value of the memory for storing the rotating direction of the motor for adjusting the left side is 1. If the answer is Y, outputting of the normal rotation command to the driver 66 for the motor for adjusting the left side is stopped in Step P275, and the program proceeds to Step P276. If the answer is N, it is determined in Step P277 whether the value of the memory for storing the rotating direction of the motor for adjusting the left side is 2.

If the answer is Y in the above Step P277, outputting of the reverse rotation command to the driver 66 for the motor for adjusting the left side is stopped in Step P278, and the program shifts to the aforementioned Step P276. If the answer is N, the program shifts to the aforementioned Step P281.

Then, in the above-mentioned Step P276, the memory M60 for storing the rotating direction of the motor for adjusting the left side is overwritten with 0. Then, in Step P279, the count value S is loaded from the memory M59, whereafter 1 is added to the count value S of the memory M59 for overwriting in Step P280.

Then, in Step P281, the count value is loaded from the counter 72 for detecting the current position of the right side of the squeegee, and stored into the memory M63. Then, in Step P282, the desired count value of the counter for detecting the position of the right side of the squeegee is loaded from the memory M56.

Then, in Step P283, it is determined whether the count value of the counter for detecting the current position of the right side of the squeegee is equal to the desired count value of the counter for detecting the position of the right side of the squeegee. If the answer is Y, the value of the memory M61 for storing the rotating direction of the motor for adjusting the right side is loaded in Step P284. If the answer is N, the program returns to Step P264.

Then, in Step P285, it is determined whether the value of the memory for storing the rotating direction of the motor for adjusting the right side is 1. If the answer is Y, outputting of the normal rotation command to the driver 70 for the motor for adjusting the right side is stopped in Step P286, and the program proceeds to Step P287. If the answer is N, it is determined in Step P288 whether the value of the memory for storing the rotating direction of the motor for adjusting the right side is 2.

If the answer is Y in the above Step P288, outputting of the reverse rotation command to the driver 70 for the motor for adjusting the right side is stopped in Step P289, and the program shifts to the aforementioned Step P287. If the answer is N, the program returns to Step P264.

Then, in the aforementioned Step P287, the memory M61 for storing the rotating direction of the motor for adjusting the right side is overwritten with 0. Then, in Step P290, the count value S is loaded from the memory M59, whereafter 1 is added to the count value S of the memory M59 for overwriting in Step P291. Then, the program returns to Step P264.

In accordance with the above-described motion flow, when the squeegee throw-on and throw-off automatic control switch 52 is ON and the cylinder engagement signal for the rotary screen cylinder 11 is ON, the squeegee 38 is moved to the predetermined printing position when it enters the rotation phase of the rotary screen cylinder 11 corresponding to the position of the rear end of the notch of the impression cylinder 13.

Then, in Step P292 shifted from the aforementioned Step P269, the table of conversion from the total number of revolutions during squeegee throw-onto the correction amount (count value of the counter) of the squeegee position is loaded from the memory M64. Then, in Step P293, the count value is loaded from the counter 76 for counting the total number of revolutions during squeegee throw-on, and stored into the memory M65.

Then, in Step P294, the correction amount (count value of the counter) of the squeegee position is obtained from the count value of the counter 76 for counting the total number of revolutions during squeegee throw-on, with the use of the table of conversion from the total number of revolutions during squeegee throw-on to the correction amount (count value of the counter) of the squeegee position, and this correction amount is stored into the memory M66. Then, in Step P295, the reference retreat position (count value of the counter) of the squeegee is loaded from the memory M53.

Then, in Step P296, the correction amount (count value of the counter) of the squeegee position is loaded from the memory M66. Then, in Step P297, the correction amount (count value of the counter) of the squeegee position is added to the reference retreat position (count value of the counter) of the squeegee to compute the retreat position (count value of the counter) of the squeegee, which is stored into the memory M67.

Then, in Step P298, the memory M55 for storing the desired count value of the counter for detecting the position of the left side of the squeegee is overwritten with the retreat position (count value of the counter) of the squeegee. Then, in Step P299, the memory M56 for storing the desired count value of the counter for detecting the position of the right side of the squeegee is overwritten with the retreat position (count value of the counter) of the squeegee.

Then, in Step P300, the count value is loaded from the counter 74 for detecting the rotation phase of the rotary screen cylinder, and stored into the memory M68. Then, in Step P301, the rotation phase of the rotary screen cylinder at the position of the leading end of the notch of the impression cylinder is loaded from the memory M71.

Then, in Step P302, it is determined whether the count value of the counter for detecting the rotation phase of the rotary screen cylinder is equal to the rotation phase of the rotary screen cylinder at the position of the leading end of the notch of the impression cylinder. If the answer is N, the program returns to Step P300 mentioned above. If the answer is Y, the count value S of the memory M59 is overwritten with 0 in Step P303. Then, in Step P304, the memory M60 for storing the rotating direction of the motor for adjusting the left side is overwritten with 0. Then, in Step P305, the memory M61 for storing the rotating direction of the motor for adjusting the right side is overwritten with 0.

Then, in Step P306, the count value is loaded from the counter 68 for detecting the current position of the left side of the squeegee, and stored into the memory M62. Then, in Step P307, the desired count value of the counter for detecting the position of the left side of the squeegee is loaded from the memory M55.

Then, in Step P308, it is determined whether the count value of the counter for detecting the current position of the left side of the squeegee is equal to the desired count value of the counter for detecting the position of the left side of the squeegee. If the answer is N, it is determined, in Step P309, whether the count value of the counter for detecting the current position of the left side of the squeegee is less than the desired count value of the counter for detecting the position of the left side of the squeegee.

If the answer is Y in the above Step P309, the memory M60 for storing the rotating direction of the motor for adjusting the left side is overwritten with 1 in Step P310. Then, in Step P311, a normal rotation command is outputted to the driver 66 for the motor for adjusting the left side, whereafter the program proceeds to Step P312. If the answer is N in Step P309, the memory M60 for storing the rotating direction of the motor for adjusting the left side is overwritten with 2 in Step P313. Then, in Step P314, a reverse rotation command is outputted to the driver 66 for the motor for adjusting the left side, whereafter the program shifts to the aforementioned Step P312.

If the answer is Y in the aforementioned Step P308, the count value S is loaded from the memory M59 in Step P315. Then, in Step P316, 1 is added to the count value S of the memory M59 for overwriting, whereafter the program shifts to Step P312 mentioned above.

Then, in the aforementioned Step P312, the count value is loaded from the counter 72 for detecting the current position of the right side of the squeegee, and stored into the memory M63. Then, in Step P317, the desired count value of the counter for detecting the position of the right side of the squeegee is loaded from the memory M56.

Then, in Step P318, it is determined whether the count value of the counter for detecting the current position of the right side of the squeegee is equal to the desired count value of the counter for detecting the position of the right side of the squeegee. If the answer is N, it is determined, in Step P319, whether the count value of the counter for detecting the current position of the right side of the squeegee is less than the desired count value of the counter for detecting the position of the right side of the squeegee.

If the answer is Y in the above Step P319, the memory M61 for storing the rotating direction of the motor for adjusting the right side is overwritten with 1 in Step P320. Then, in Step P321, a normal rotation command is outputted to the driver 70 for the motor for adjusting the right side, whereafter the program proceeds to Step P322. If the answer is N in Step P319, the memory M61 for storing the rotating direction of the motor for adjusting the right side is overwritten with 2 in Step P323. Then, in Step P324, a reverse rotation command is outputted to the driver 70 for the motor for adjusting the right side, whereafter the program shifts to the aforementioned Step P322.

If the answer is Y in the aforementioned Step P318, the count value S is loaded from the memory M59 in Step P325. Then, in Step P326, 1 is added to the count value S of the memory M59 for overwriting, whereafter the program shifts to Step P322 mentioned above.

Then, in Step P322 mentioned above, the count value S is loaded from the memory M59, whereafter it is determined in Step P327 whether the count value S is 2. If the answer is Y in this Step P327, it is determined in Step P328 whether the cylinder engagement signal for the rotary screen cylinder is ON. If the answer is Y in this step, the program returns to the aforementioned Step P234. If the answer is N, the program returns to the aforementioned Step P121.

If the answer is N in the above-mentioned Step P327, the count value is loaded from the counter 68 for detecting the current position of the left side of the squeegee, and stored into the memory M62, in Step P329. Then, in Step P330, the desired count value of the counter for detecting the position of the left side of the squeegee is loaded from the memory M55.

Then, in Step P331, it is determined whether the count value of the counter for detecting the current position of the left side of the squeegee is equal to the desired count value of the counter for detecting the position of the left side of the squeegee. If the answer is Y, the value of the memory M60 for storing the rotating direction of the motor for adjusting the left side is loaded in Step P332. If the answer is N, the program shifts to Step P340 to be described later.

Then, in Step P333, it is determined whether the value of the memory for storing the rotating direction of the motor for adjusting the left side is 1. If the answer is Y, outputting of the normal rotation command to the driver 66 for the motor for adjusting the left side is stopped in Step P334, and the program proceeds to Step P335. If the answer is N, it is determined in Step P336 whether the value of the memory for storing the rotating direction of the motor for adjusting the left side is 2.

If the answer is Y in the above Step P336, outputting of the reverse rotation command to the driver 66 for the motor for adjusting the left side is stopped in Step P337, and the program shifts to the aforementioned Step P335. If the answer is N, the program shifts to the aforementioned Step P340.

Then, in the aforementioned Step P335, the memory M60 for storing the rotating direction of the motor for adjusting the left side is overwritten with 0. Then, in Step P338, the count value S is loaded from the memory M59, whereafter 1 is added to the count value S of the memory M59 for overwriting in Step P339.

Then, in Step P340, the count value is loaded from the counter 72 for detecting the current position of the right side of the squeegee, and stored into the memory M63. Then, in Step P341, the desired count value of the counter for detecting the position of the right side of the squeegee is loaded from the memory M56.

Then, in Step P342, it is determined whether the count value of the counter for detecting the current position of the right side of the squeegee is equal to the desired count value of the counter for detecting the position of the right side of the squeegee. If the answer is Y, the value of the memory M61 for storing the rotating direction of the motor for adjusting the right side is loaded in Step P343. If the answer is N, the program returns to Step P322.

Then, in Step P344, it is determined whether the value of the memory for storing the rotating direction of the motor for adjusting the right side is 1. If the answer is Y, outputting of the normal rotation command to the driver 70 for the motor for adjusting the right side is stopped in Step P345, and the program proceeds to Step P346. If the answer is N, it is determined in Step P347 whether the value of the memory for storing the rotating direction of the motor for adjusting the right side is 2.

If the answer is Y in the above Step P347, outputting of the reverse rotation command to the driver 70 for the motor for adjusting the right side is stopped in Step P348, and the program shifts to the aforementioned Step P346. If the answer is N, the program returns to Step P322.

Then, in the aforementioned Step P346, the memory M61 for storing the rotating direction of the motor for adjusting the right side is overwritten with 0. Then, in Step P349, the count value S is loaded from the memory M59, whereafter 1 is added to the count value S of the memory M59 for overwriting in Step P350. Then, the program returns to Step P322.

In accordance with the above-described motion flow, when the squeegee throw-on and throw-off automatic control switch 52 is ON and the cylinder engagement signal for the rotary screen cylinder 11 is ON, the squeegee 38 is moved to the predetermined retreat position when it enters the rotation phase of the rotary screen cylinder 11 corresponding to the position of the leading end of the notch of the impression cylinder 13.

Then, in Step P351 shifted from the aforementioned Step P119, the throw-off position (count value of the counter) of the squeegee is loaded from the memory M54.

Then, in Step P352, the memory M55 for storing the desired count value of the counter for detecting the position of the left side of the squeegee is overwritten with the throw-off position (count value of the counter) of the squeegee. Then, in Step P353, the memory M56 for storing the desired count value of the counter for detecting the position of the right side of the squeegee is overwritten with the throw-off position (count value of the counter) of the squeegee.

Then, in Step P354, the count value S of the memory M59 is overwritten with 0, whereafter the memory M60 for storing the rotating direction of the motor for adjusting the left side is overwritten with 0 in Step P355. Then, in Step P356, the memory M61 for storing the rotating direction of the motor for adjusting the right side is overwritten with 0.

Then, in Step P357, the count value is loaded from the counter 74 for detecting the rotation phase of the rotary screen cylinder, and stored into the memory M68. Then, in Step P358, the rotation phase of the rotary screen cylinder during squeegee throw-off is loaded from the memory M58.

Then, in Step P359, it is determined whether the count value of the counter for detecting the rotation phase of the rotary screen cylinder is equal to the rotation phase of the rotary screen cylinder during squeegee throw-off. If the answer is N, the program returns to Step P357 mentioned above. If the answer is Y, the count value is loaded from the counter 68 for detecting the current position of the left side of the squeegee, and stored into the memory M62, in Step P360. Then, in Step P361, the desired count value of the counter for detecting the position of the left side of the squeegee is loaded from the memory M55.

Then, in Step P362, it is determined whether the count value of the counter for detecting the current position of the left side of the squeegee is equal to the desired count value of the counter for detecting the position of the left side of the squeegee. If the answer is N, it is determined, in Step P363, whether the count value of the counter for detecting the current position of the left side of the squeegee is less than the desired count value of the counter for detecting the position of the left side of the squeegee.

If the answer is Y in the above Step P363, the memory M60 for storing the rotating direction of the motor for adjusting the left side is overwritten with 1 in Step P364. Then, in Step P365, a normal rotation command is outputted to the driver 66 for the motor for adjusting the left side, whereafter the program proceeds to Step P366. If the answer is N in Step P363, the memory M60 for storing the rotating direction of the motor for adjusting the left side is overwritten with 2 in Step P367. Then, in Step P368, a reverse rotation command is outputted to the driver 66 for the motor for adjusting the left side, whereafter the program shifts to the aforementioned Step P366.

If the answer is Y in the aforementioned Step P362, the count value S is loaded from the memory M59 in Step P369. Then, in Step P370, 1 is added to the count value S of the memory M59 for overwriting, whereafter the program shifts to Step P366 mentioned above.

Then, in the aforementioned Step P366, the count value is loaded from the counter 72 for detecting the current position of the right side of the squeegee, and stored into the memory M63. Then, in Step P371, the desired count value of the counter for detecting the position of the right side of the squeegee is loaded from the memory M56.

Then, in Step P372, it is determined whether the count value of the counter for detecting the current position of the right side of the squeegee is equal to the desired count value of the counter for detecting the position of the right side of the squeegee. If the answer is N, it is determined, in Step P373, whether the count value of the counter for detecting the current position of the right side of the squeegee is less than the desired count value of the counter for detecting the position of the right side of the squeegee.

If the answer is Y in the above Step P373, the memory M61 for storing the rotating direction of the motor for adjusting the right side is overwritten with 1 in Step P374. Then, in Step P375, a normal rotation command is outputted to the driver 70 for the motor for adjusting the right side, whereafter the program proceeds to Step P376. If the answer is N in Step P373, the memory M61 for storing the rotating direction of the motor for adjusting the right side is overwritten with 2 in Step P377. Then, in Step P378, a reverse rotation command is outputted to the driver 70 for the motor for adjusting the right side, whereafter the program shifts to the aforementioned Step P376.

If the answer is Y in the aforementioned Step P372, the count value S is loaded from the memory M59 in Step P379. Then, in Step P380, 1 is added to the count value S of the memory M59 for overwriting, whereafter the program shifts to Step P376 mentioned above.

Then, in Step P376 mentioned above, the count value S is loaded from the memory M59, whereafter it is determined in Step P381 whether the count value S is 2. If the answer is Y in this Step P381, outputting of the enabling signal to the counter 76 for counting the total number of revolutions during squeegee throw-on is stopped in Step P382, and the program returns to Step P1.

Then, in Step P383, the count value is loaded from the counter 68 for detecting the current position of the left side of the squeegee, and stored into the memory M62. Then, in Step P384, the desired count value of the counter for detecting the position of the left side of the squeegee is loaded from the memory M55.

Then, in Step P385, it is determined whether the count value of the counter for detecting the current position of the left side of the squeegee is equal to the desired count value of the counter for detecting the position of the left side of the squeegee. If the answer is Y, the value of the memory M60 for storing the rotating direction of the motor for adjusting the left side is loaded in Step P386. If the answer is N, the program shifts to Step P394 to be described later.

Then, in Step P387, it is determined whether the value of the memory for storing the rotating direction of the motor for adjusting the left side is 1. If the answer is Y, outputting of the normal rotation command to the driver 66 for the motor for adjusting the left side is stopped in Step P388, and the program proceeds to Step P389. If the answer is N, it is determined in Step P390 whether the value of the memory for storing the rotating direction of the motor for adjusting the left side is 2.

If the answer is Y in the above Step P390, outputting of the reverse rotation command to the driver 66 for the motor for adjusting the left side is stopped in Step P391, and the program shifts to the aforementioned Step P389. If the answer is N, the program shifts to the aforementioned Step P394.

Then, in the aforementioned Step P389, the memory M60 for storing the rotating direction of the motor for adjusting the left side is overwritten with 0. Then, in Step P392, the count value S is loaded from the memory M59, whereafter 1 is added to the count value S of the memory M59 for overwriting in Step P393.

Then, in Step P394, the count value is loaded from the counter 72 for detecting the current position of the right side of the squeegee, and stored into the memory M63. Then, in Step P395, the desired count value of the counter for detecting the position of the right side of the squeegee is loaded from the memory M56.

Then, in Step P396, it is determined whether the count value of the counter for detecting the current position of the right side of the squeegee is equal to the desired count value of the counter for detecting the position of the right side of the squeegee. If the answer is Y, the value of the memory M61 for storing the rotating direction of the motor for adjusting the right side is loaded in Step P397. If the answer is N, the program returns to Step P376.

Then, in Step P398, it is determined whether the value of the memory for storing the rotating direction of the motor for adjusting the right side is 1. If the answer is Y, outputting of the normal rotation command to the driver 70 for the motor for adjusting the right side is stopped in Step P399, and the program proceeds to Step P400. If the answer is N, it is determined in Step P401 whether the value of the memory for storing the rotating direction of the motor for adjusting the right side is 2.

If the answer is Y in the above Step P401, outputting of the reverse rotation command to the driver 70 for the motor for adjusting the right side is stopped in Step P402, and the program shifts to the aforementioned Step P400. If the answer is N, the program returns to Step P376.

Then, in the aforementioned Step P400, the memory M61 for storing the rotating direction of the motor for adjusting the right side is overwritten with 0. Then, in Step P403, the count value S is loaded from the memory M59, whereafter 1 is added to the count value S of the memory M59 for overwriting in Step P404. Then, the program returns to Step P376.

In accordance with the above-described motion flow, when the squeegee throw-on and throw-off automatic control switch 52 is brought to the OFF-state, the squeegee 38 is moved to the throw-off position.

According to the present Embodiment 1, as described above, the throw-on position of the squeegee 38 during printing is preset, based on the type of the material W to be printed (i.e., difference in the material, e.g., paper, cloth, film or corrugated board), in conformity with the thickness of the material to be printed, the material for the screen printing forme 11*c*, the thickness of the screen printing forme, the picture pattern area rate, the mesh size of the screen printing forme 11*c*, the viscosity of ink, the yield value of ink, the type of the pigment of ink, the material for the squeegee, and the thickness of the squeegee. Thus, burden on the operator can be lessened by automation, and the rate of operation can be increased and the occurrence of wasted paper can be curtailed by shortening the period of time until normal printing products can be obtained by printing.

In the present Embodiment 1, moreover, even when the squeegee 38 is located at a position where it opposes the notch 13*b* of the impression cylinder 13 (i.e., the retreat position), the leading end of the squeegee 38 does not leave the inner peripheral surface of the screen printing forme 11*c*, and only its pressure exerted on this surface (i.e., pressing force) is rendered lower than the pressure during printing. Thus, the screen printing forme 11*c* is prevented from being pushed into the notch 13*b* of the impression cylinder 13 by the squeegee 38 and damaged thereby, and there is no ink leaking out toward the downstream side in the rotating direction of the screen printing forme 11*c*, so that deterioration of printing quality is prevented.

That is, the following problems are avoided: Because of leaks of ink toward the downstream side in the rotating direction of the screen printing forme 11*c*, the amount of ink remaining in front of the squeegee 38 becomes small to decrease the ink density at the start of printing. The ink leaking out toward the downstream side leaks out through the holes of the picture pattern portion under a centrifugal force during high speed rotation, adheres to outside portions of the holes, and sticks to the outside of the picture pattern portion during printing, thereby deteriorating printing quality.

In the present Embodiment 1, the control pressure may be switched using a hydraulic or pneumatic actuator instead of the motor 36A for adjusting the left side and the motor 36B for adjusting the right side. Moreover, the motors 36A and 36B are disposed on the right side and the left side. However, there may be adopted a configuration in which a one-sided motor moves the right and left sides, for example, by connecting the right and left sides by a lever mechanism.

Embodiment 2

Figure 13:
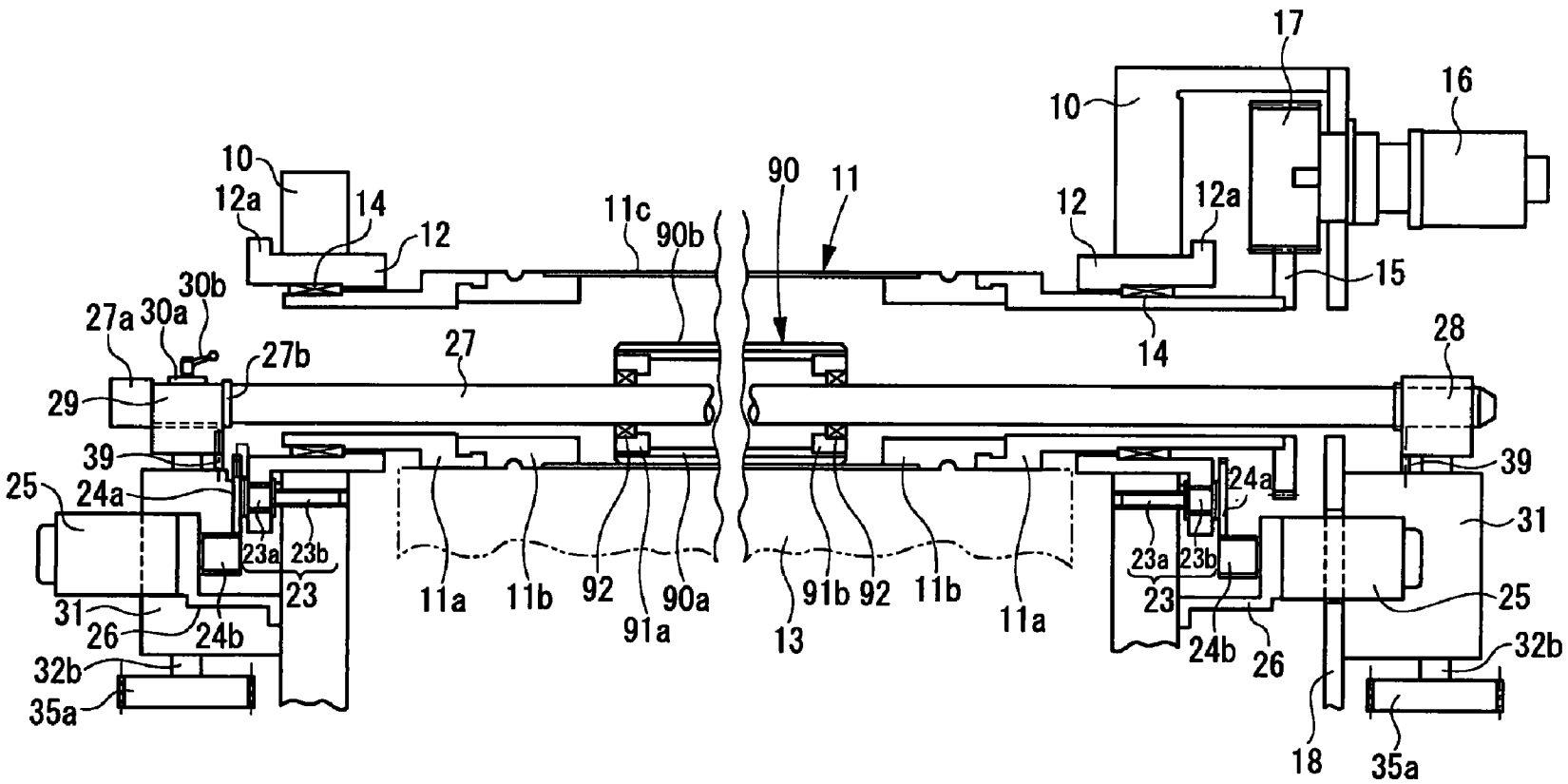
FIG. 13 is a schematic configurational sectional view of a rotary screen printing unit in a rotary screen printing press showing Embodiment 2 of the present invention.
Figure 14A:
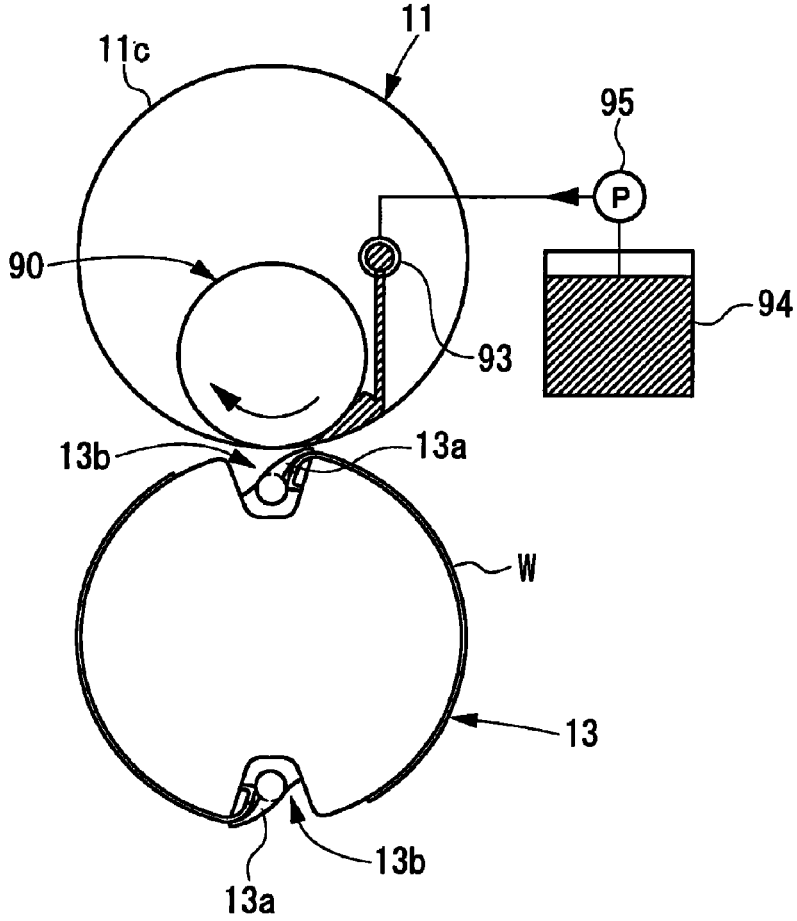
FIG. 14(*a*) is an explanation drawing of an ink supply system.
Figure 14B:
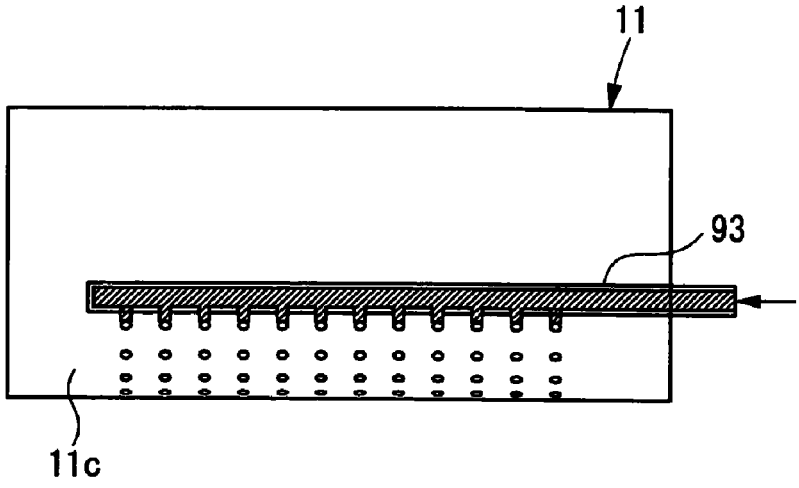
Figure 15C:
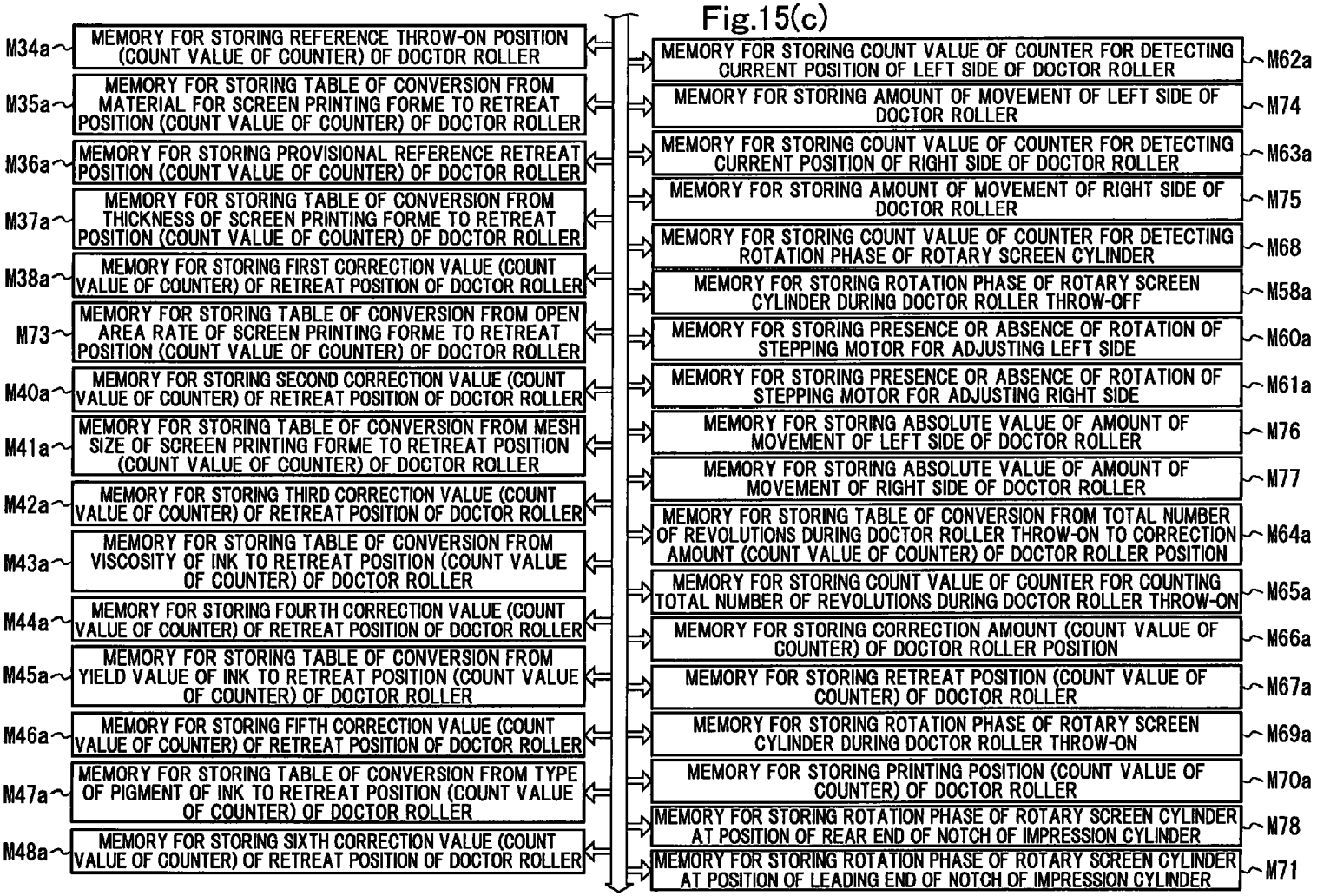
FIG. 15(*a*) is a control block diagram of a doctor roller throw-on and throw-off control device.
Figure 16A:
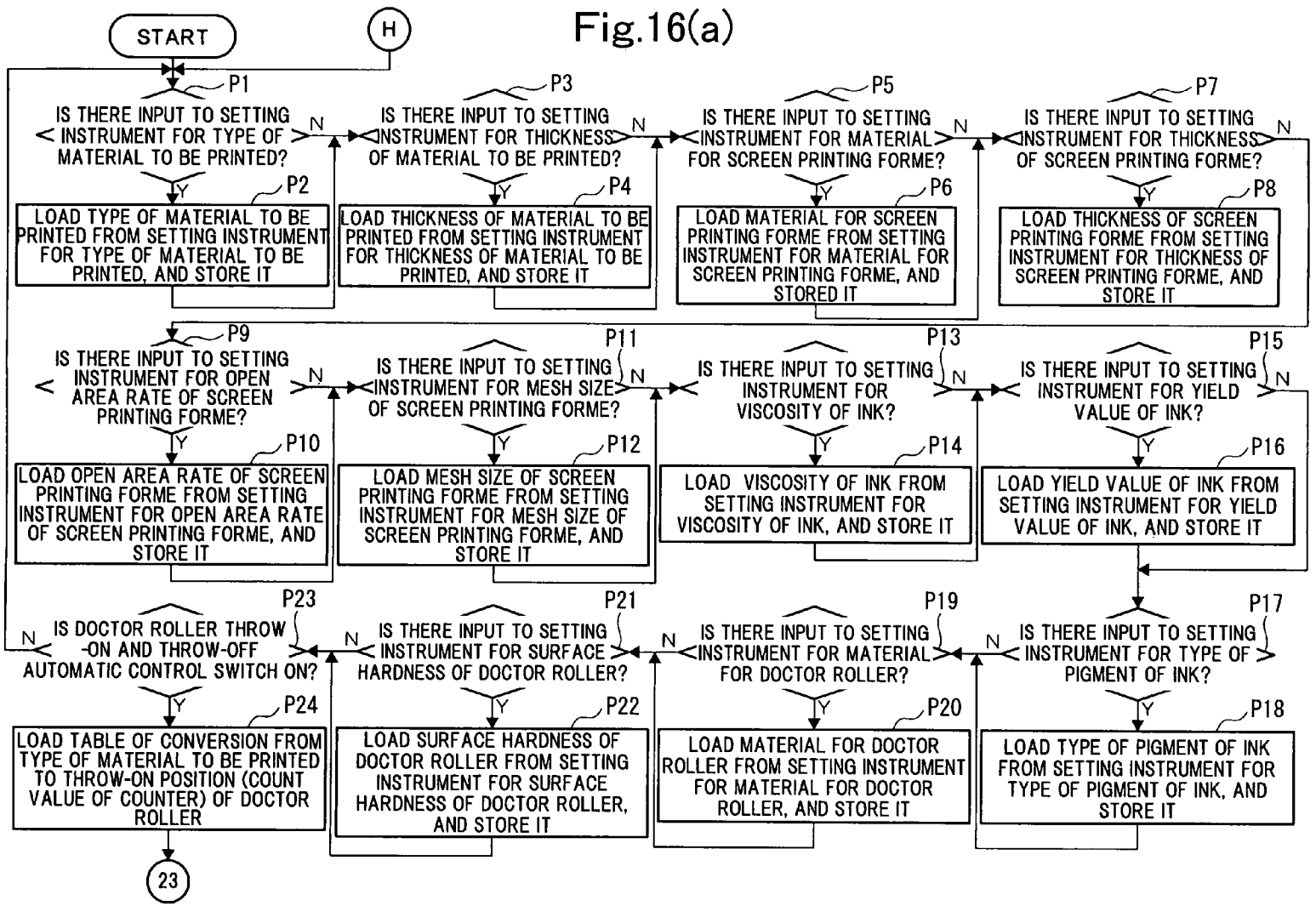
FIG. 16(*a*) is a motion flow chart of the doctor roller throw-on and throw-off control device.
Figure 16B:
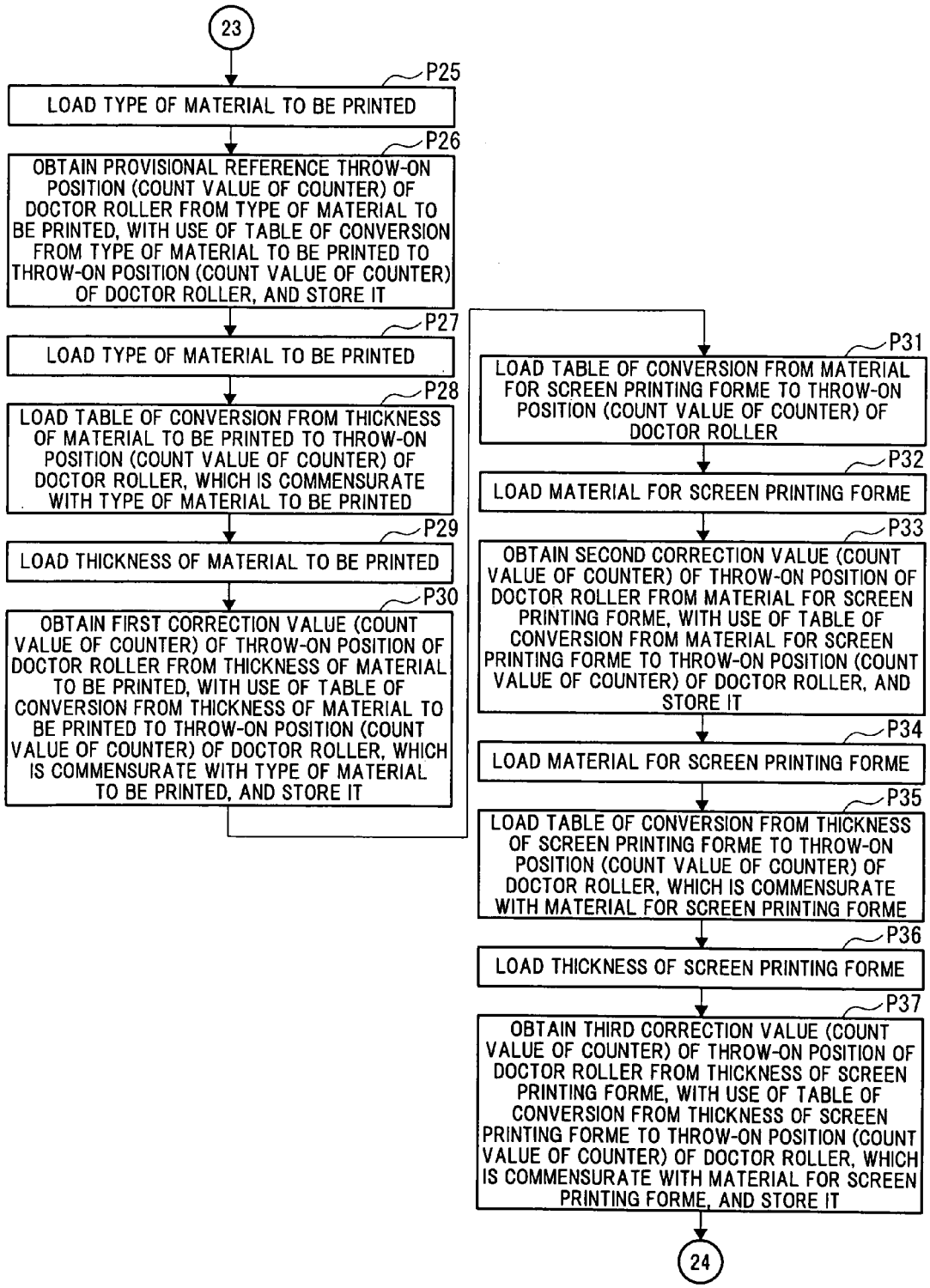
Figure 16C:
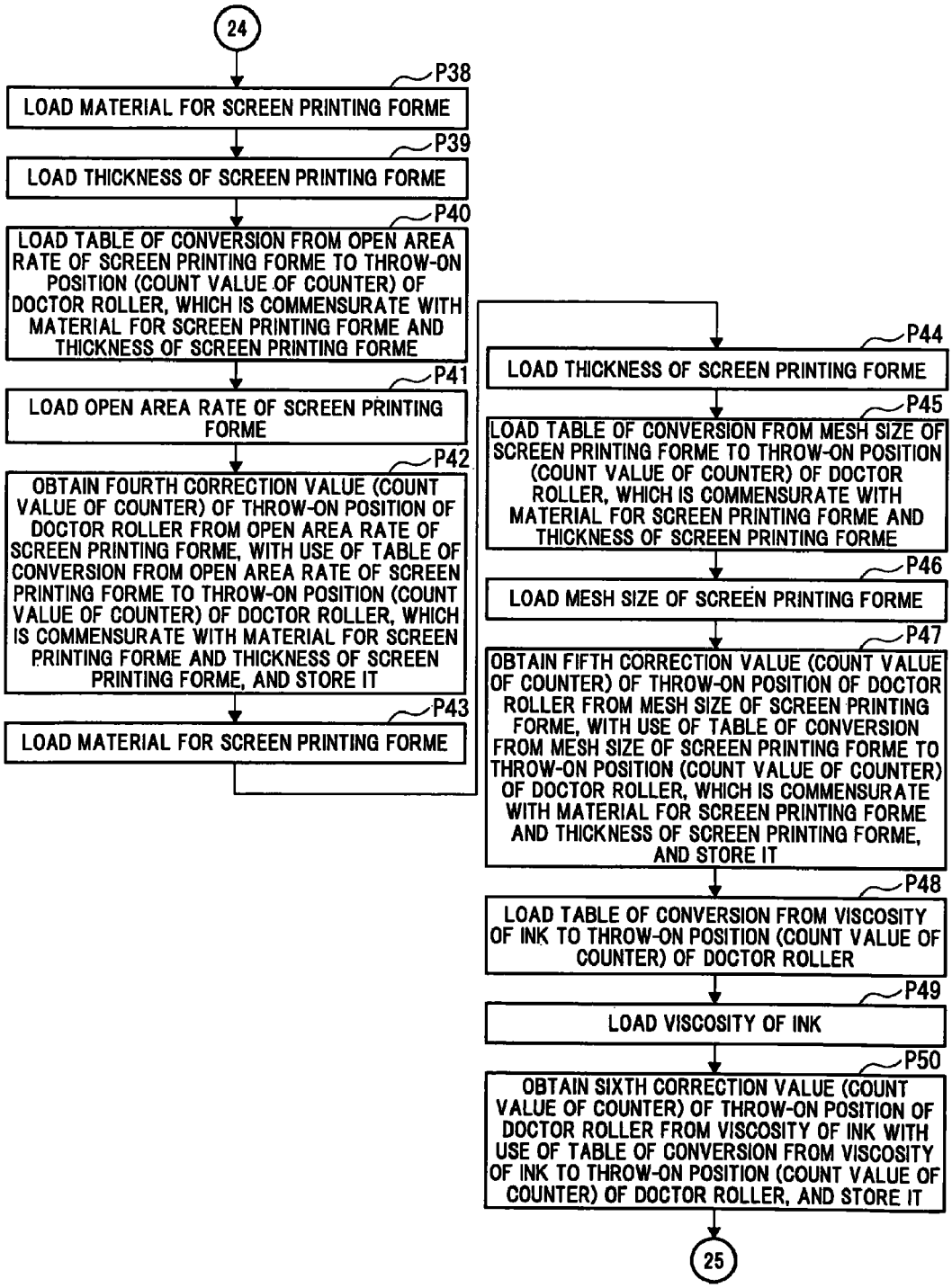
Figure 16D:
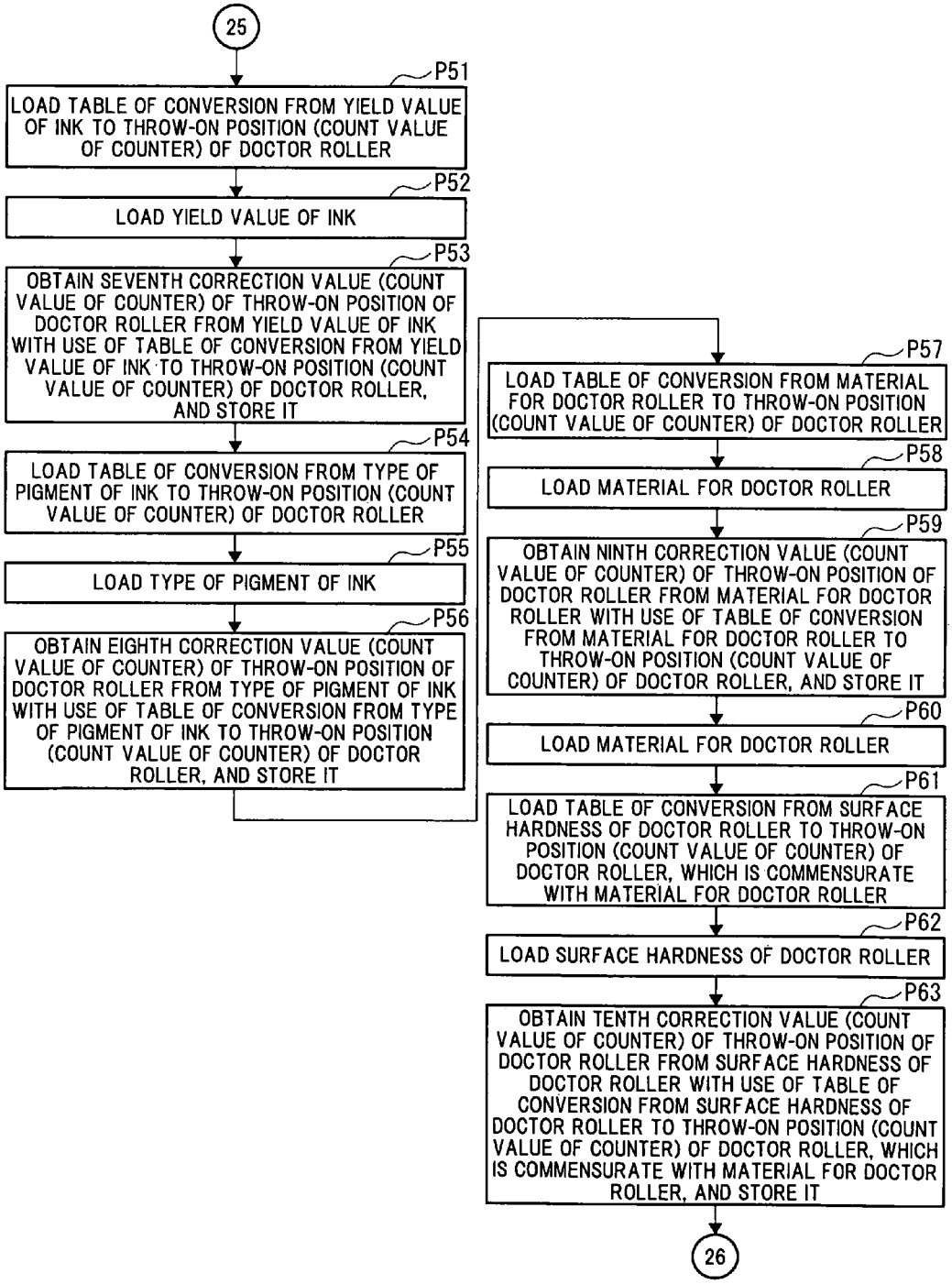
Figure 16E:
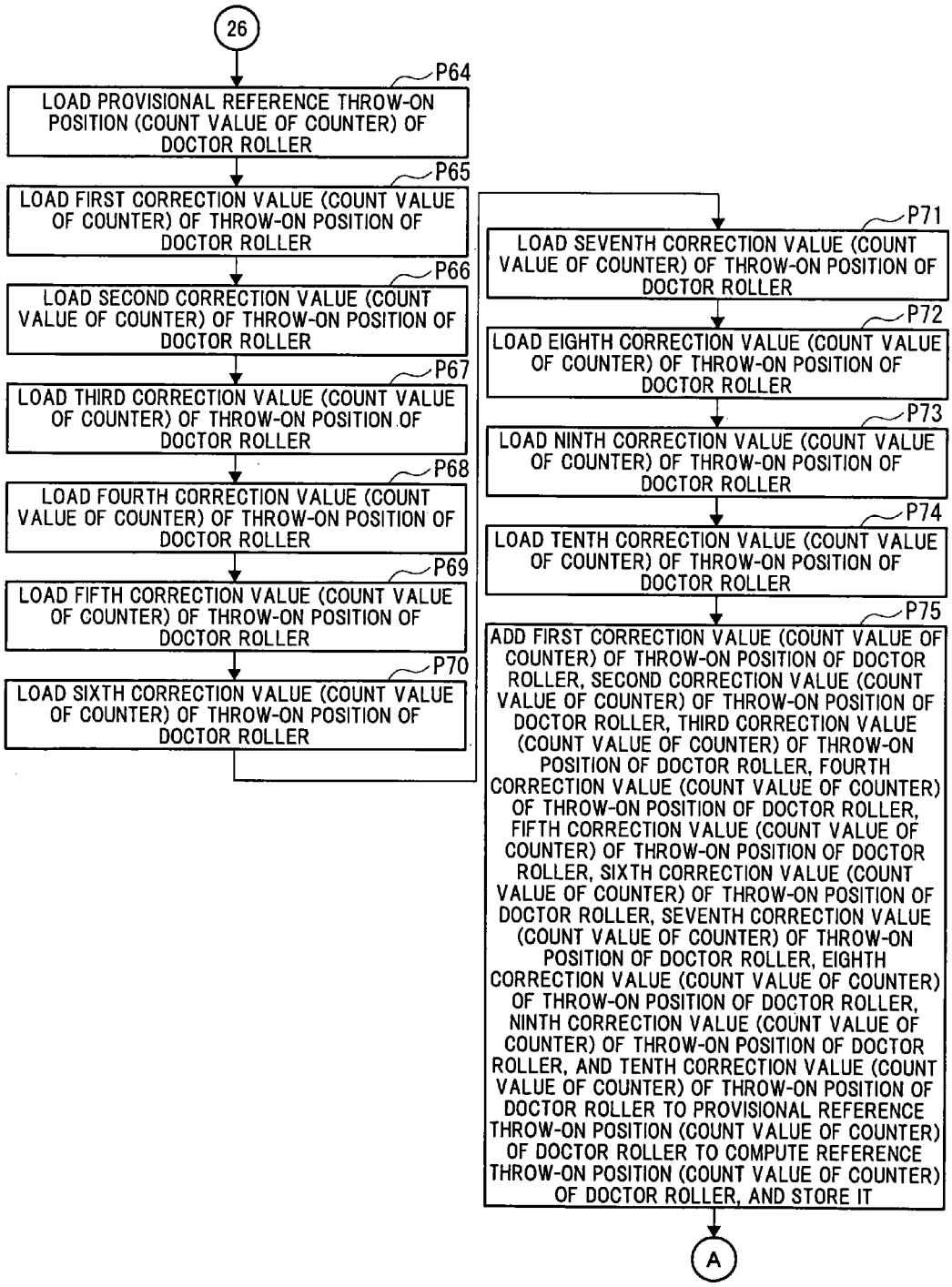
Figure 17A:
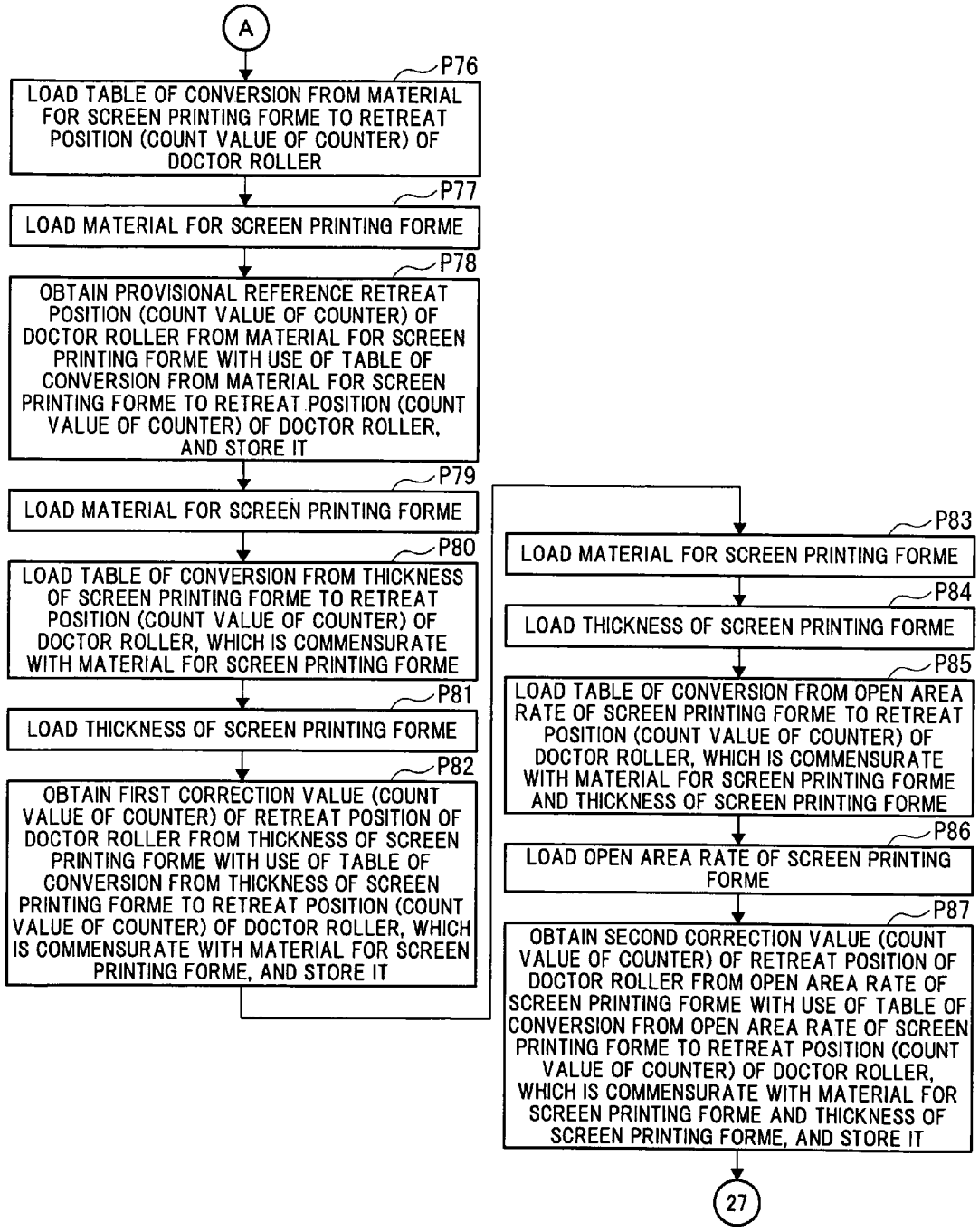
FIG. 17(*a*) is a motion flow chart of the doctor roller throw-on and throw-off control device.
Figure 17B:
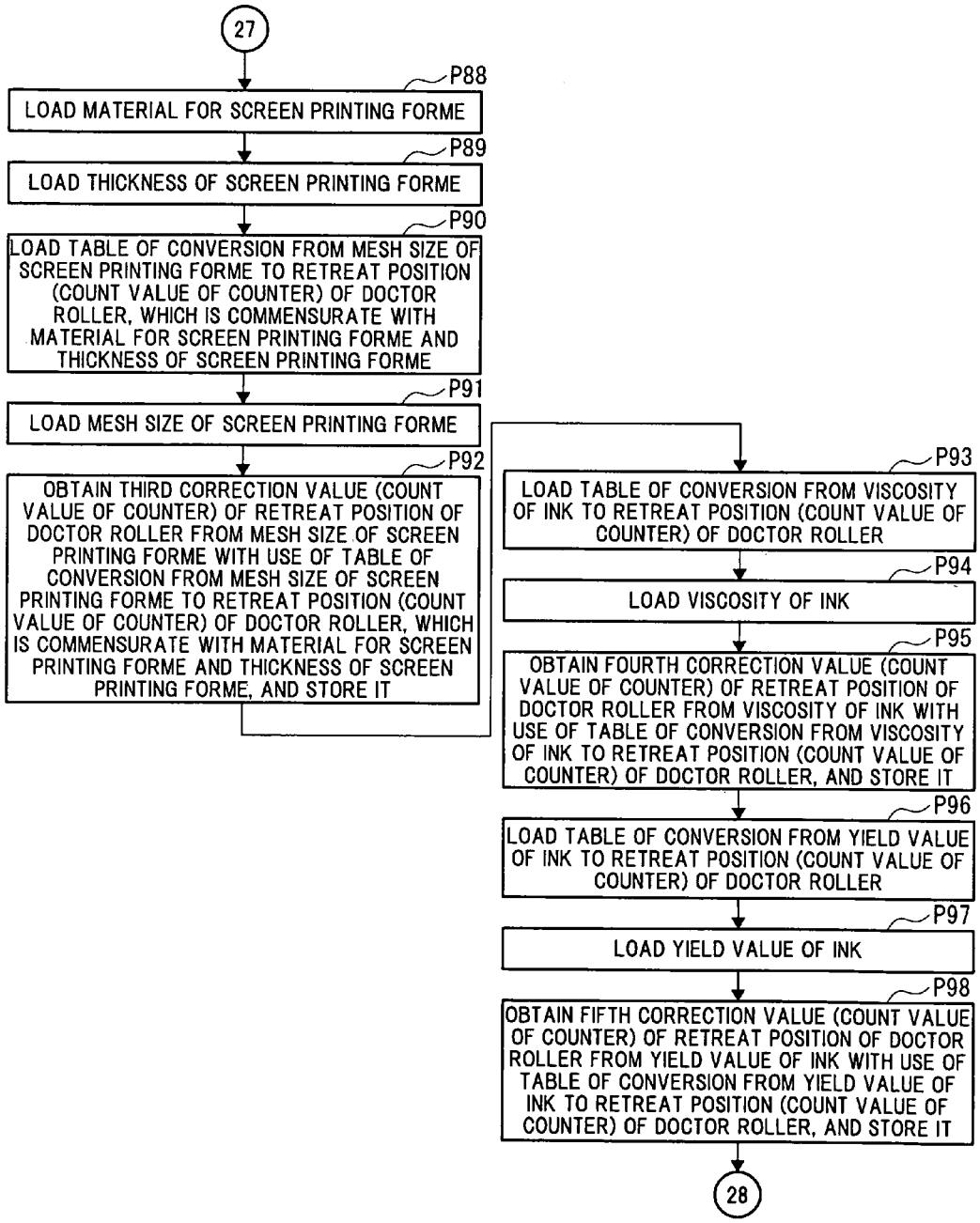
Figure 17C:
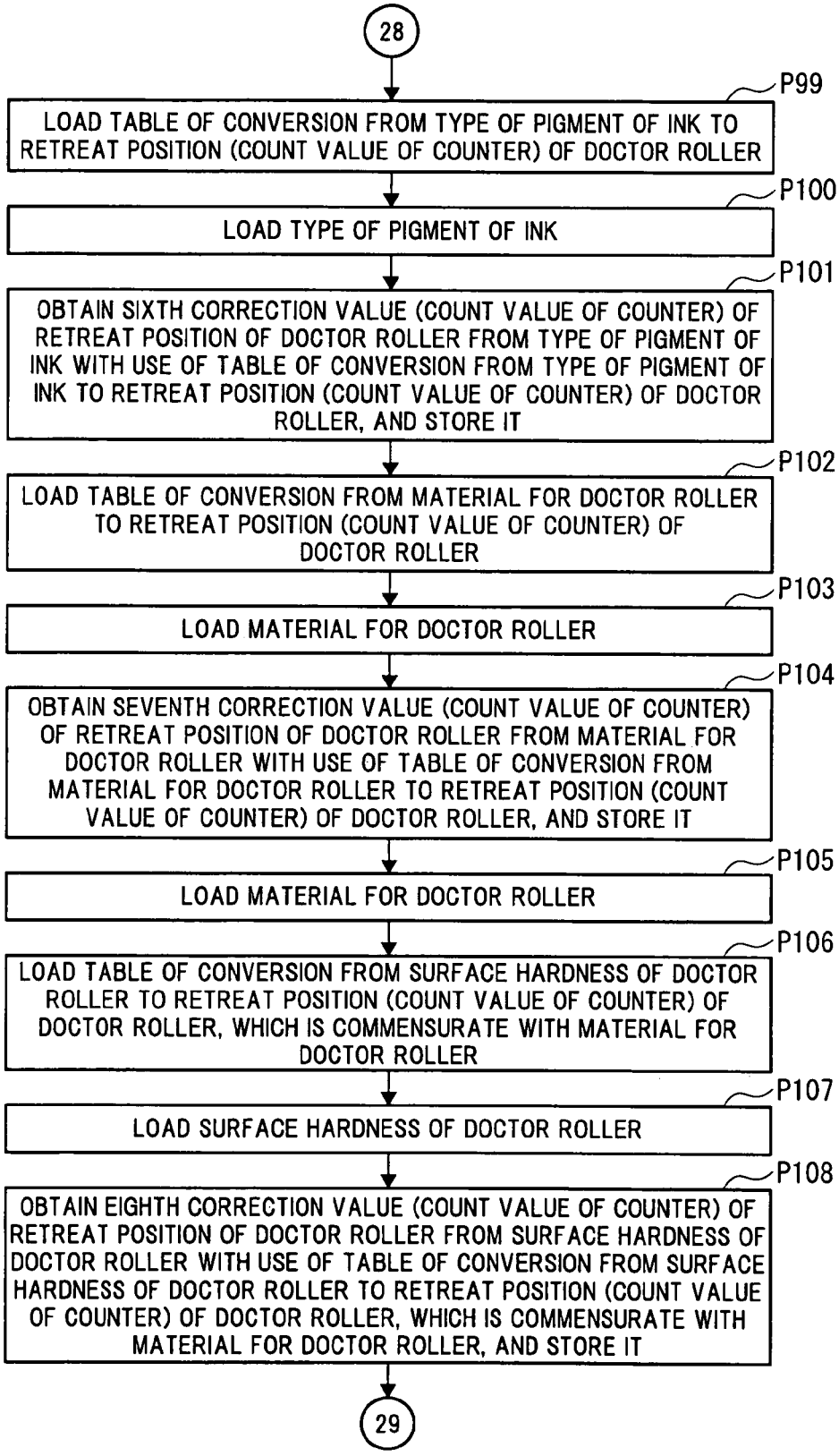
Figure 17D:
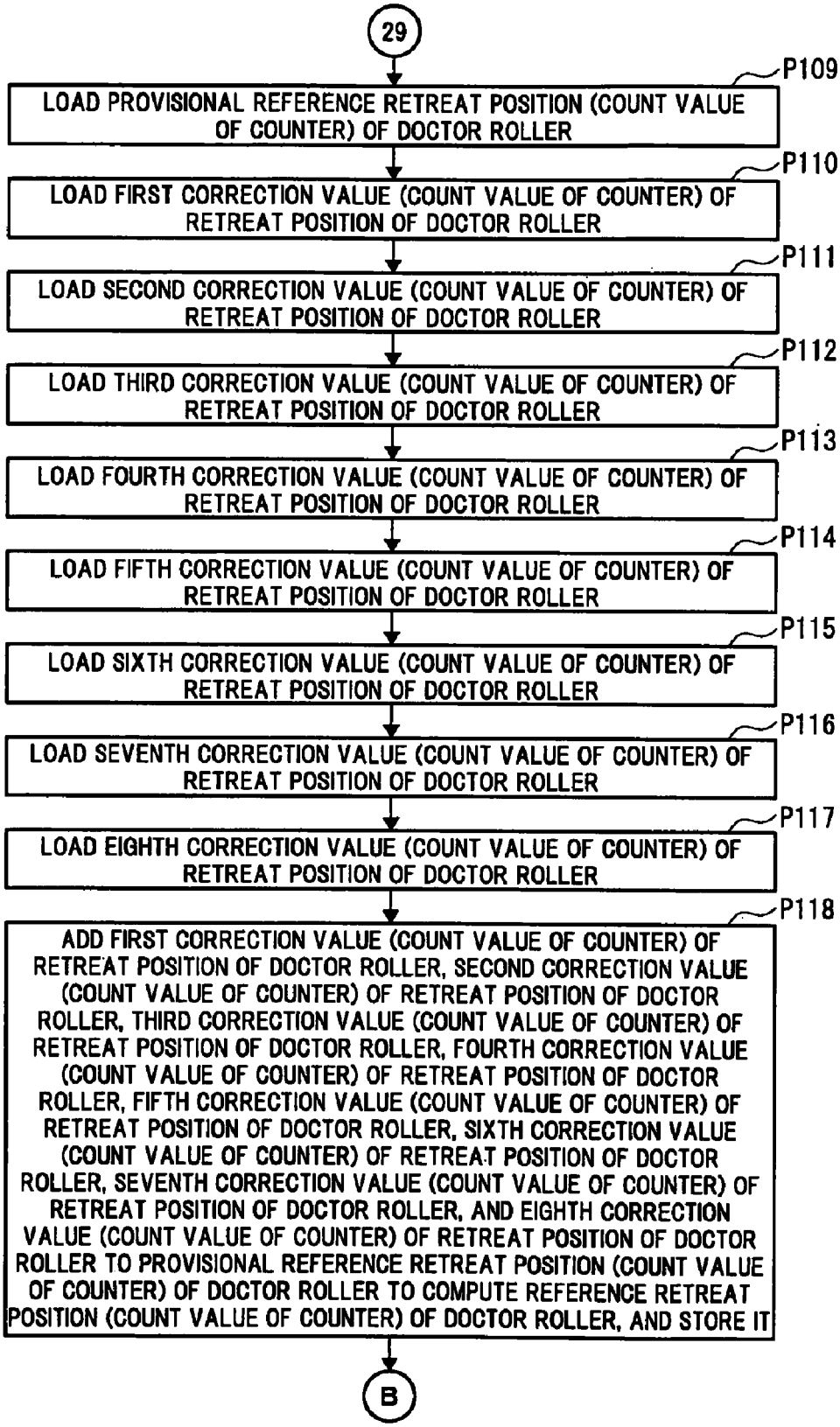
Figure 18A:
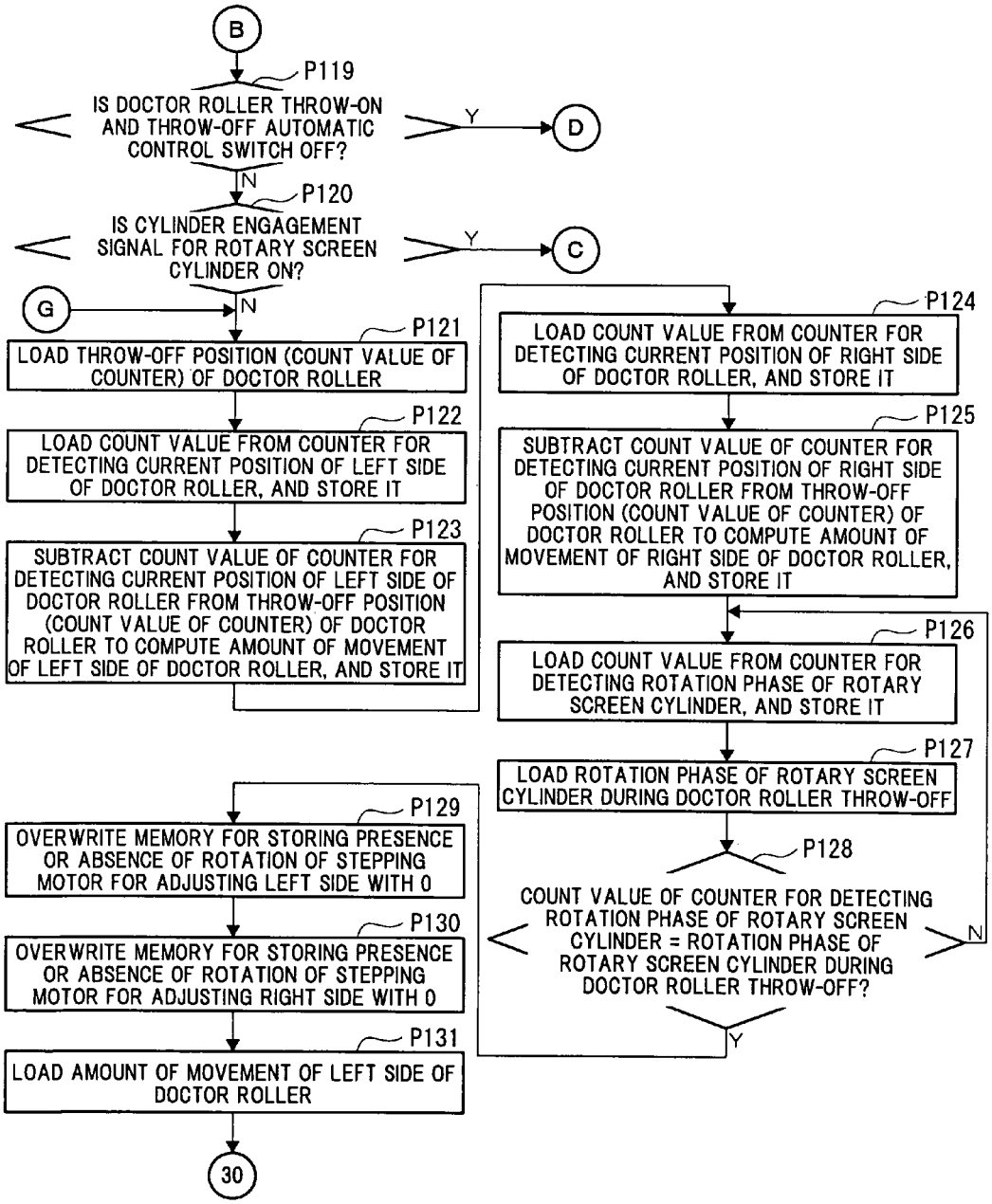
FIG. 18(*a*) is a motion flow chart of the doctor roller throw-on and throw-off control device.
Figure 18B:
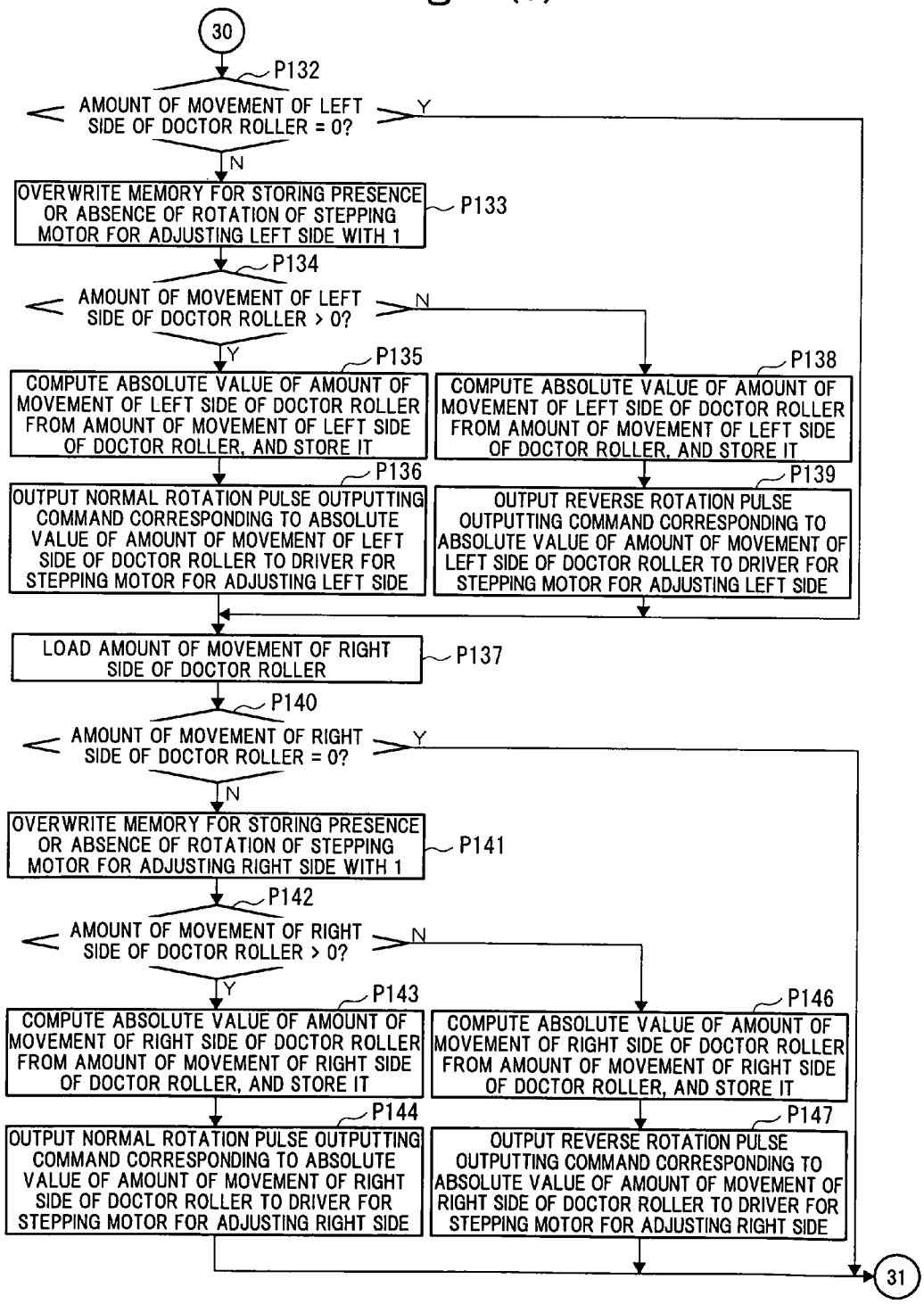
Figure 18C:
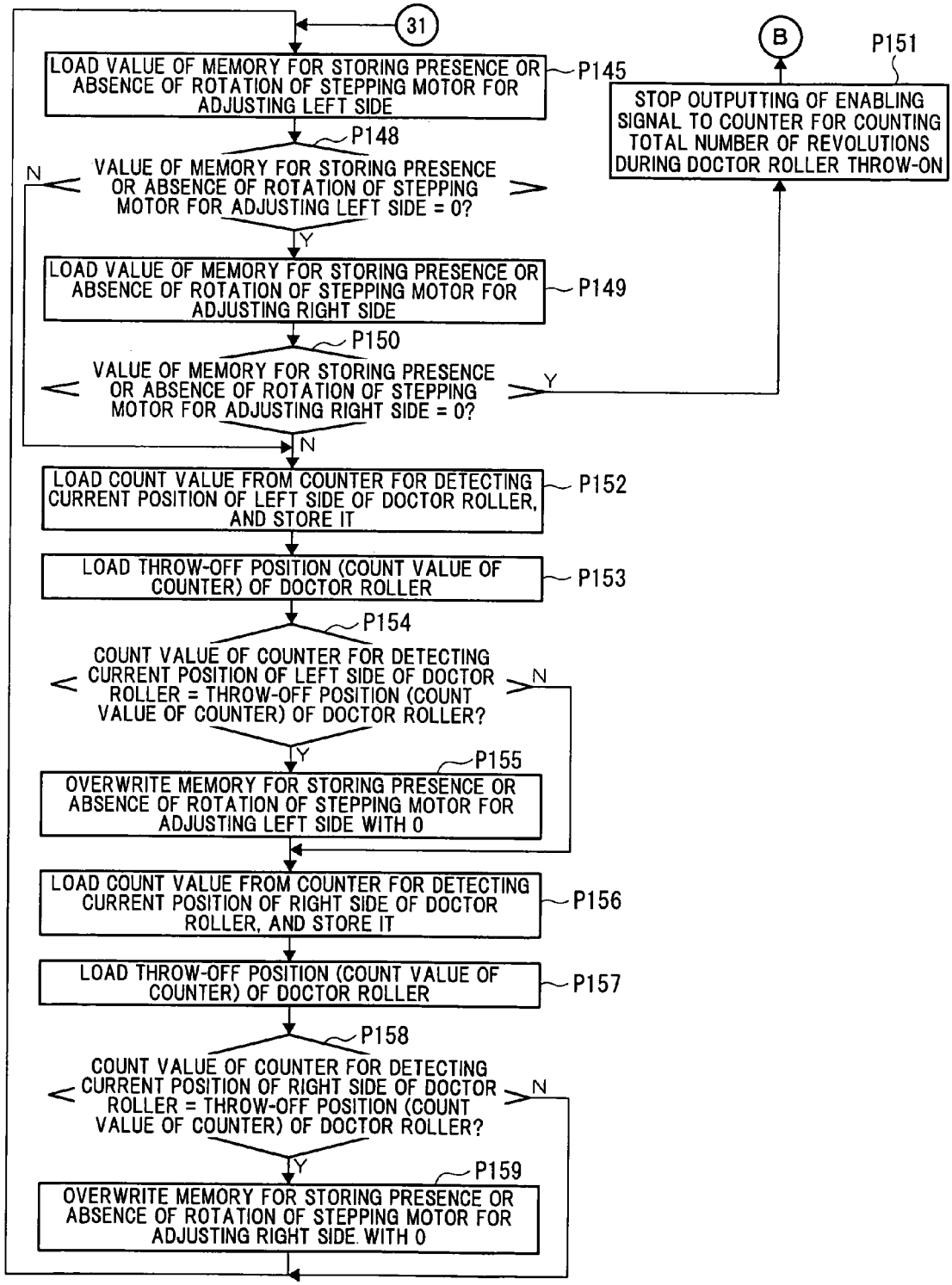
Figure 19A:
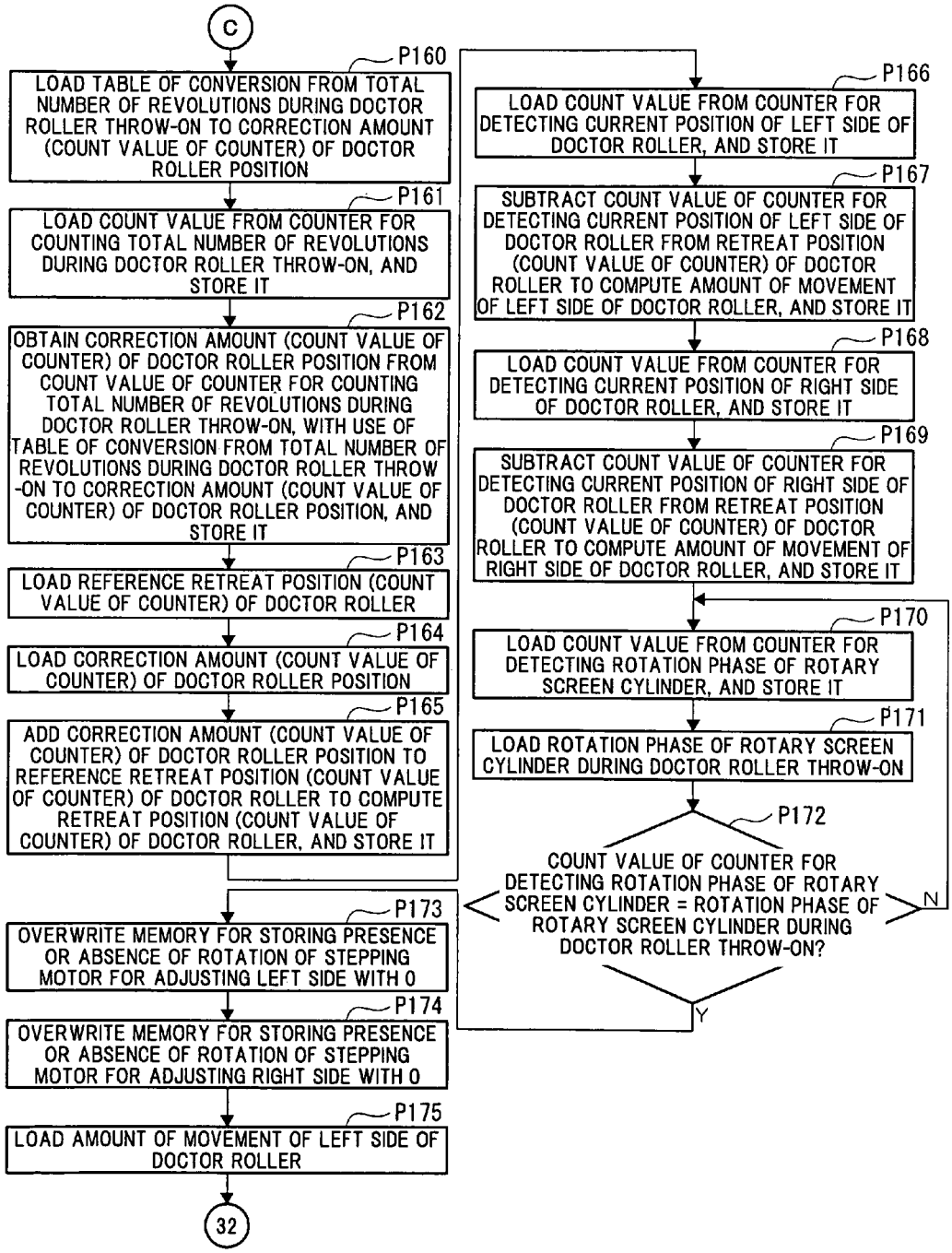
FIG. 19(*a*) is a motion flow chart of the doctor roller throw-on and throw-off control device.
Figure 19B:
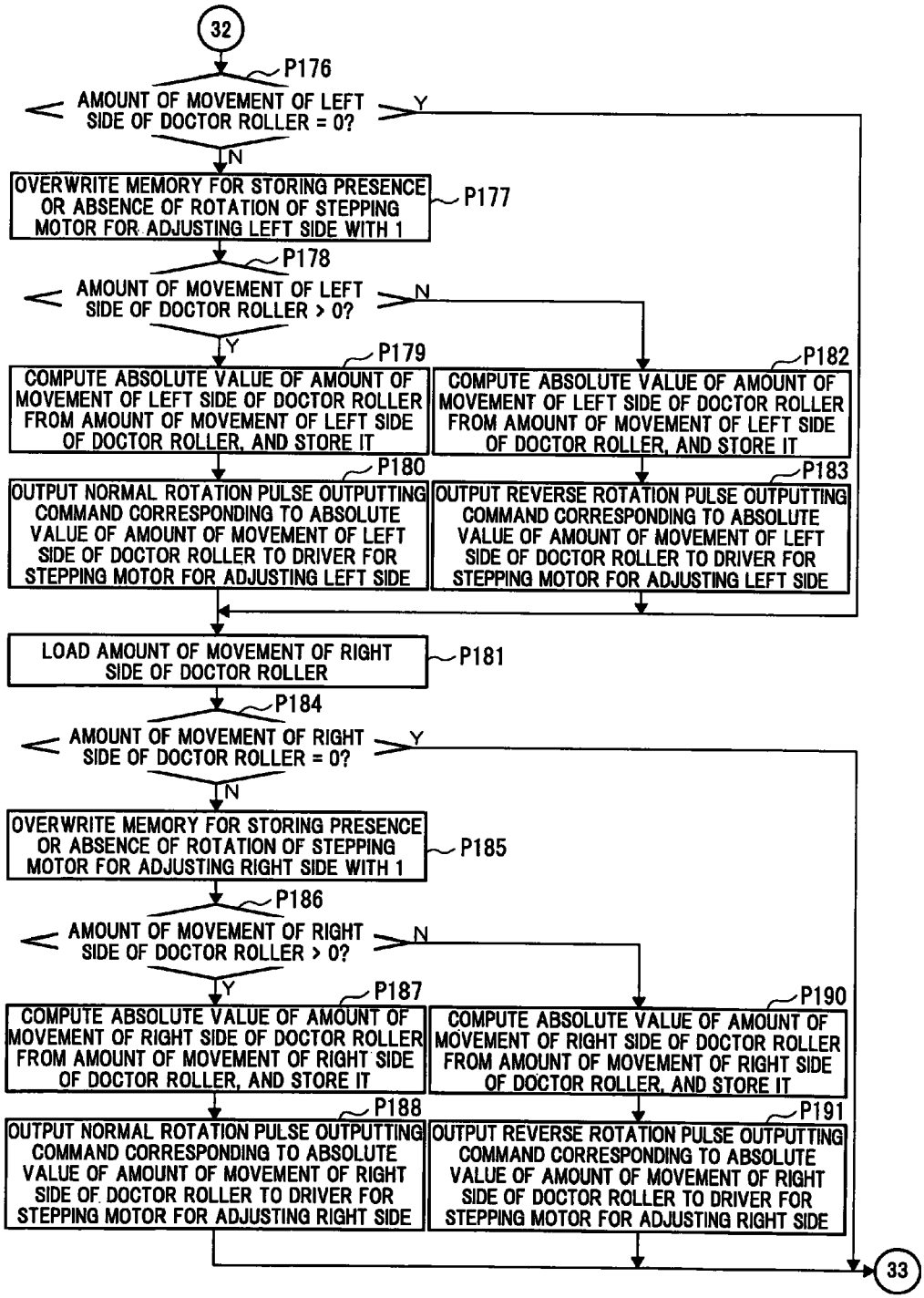
Figure 19C:
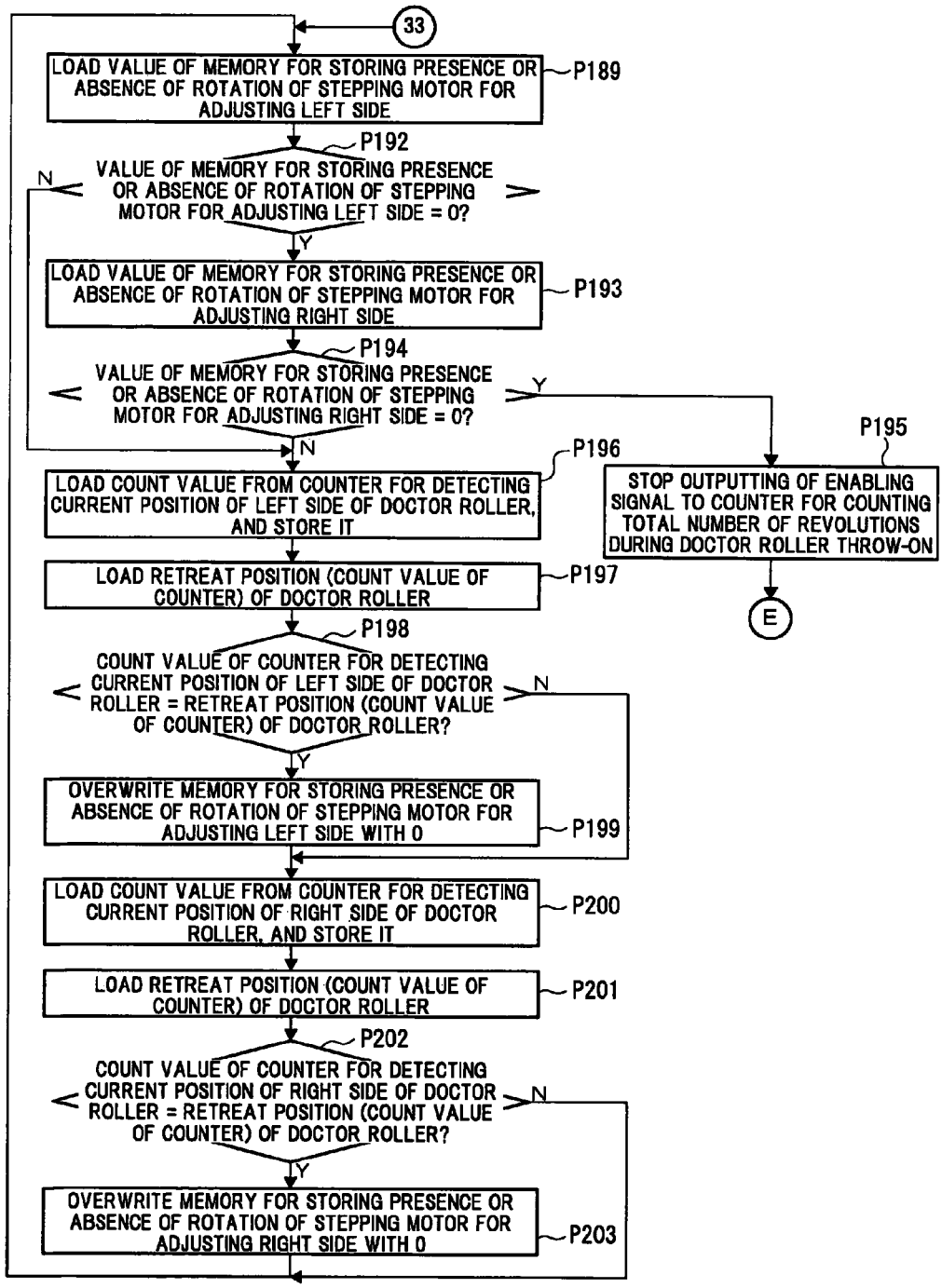
Figure 20A:
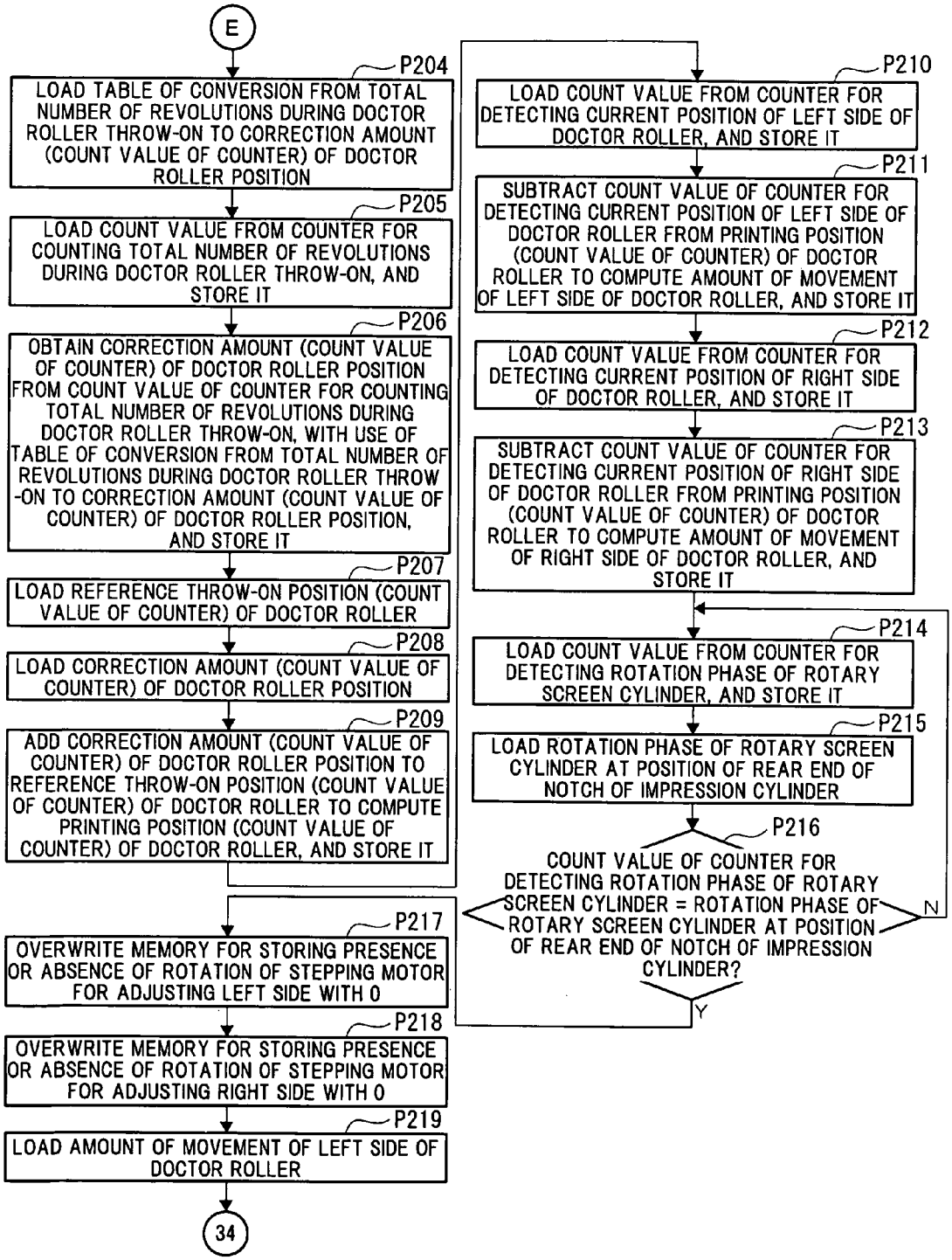
FIG. 20(*a*) is a motion flow chart of the doctor roller throw-on and throw-off control device.
Figure 20B:
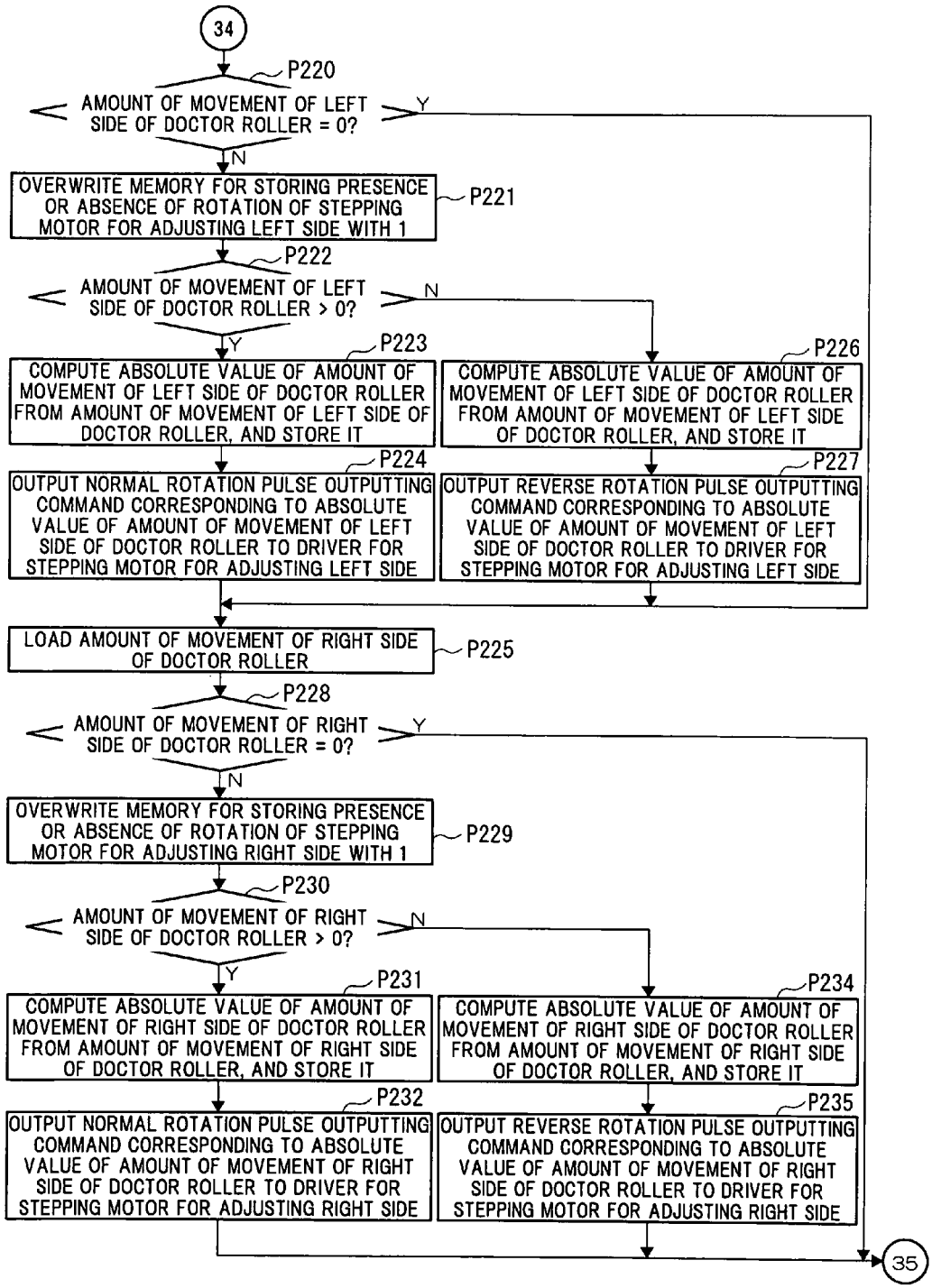
Figure 20C:
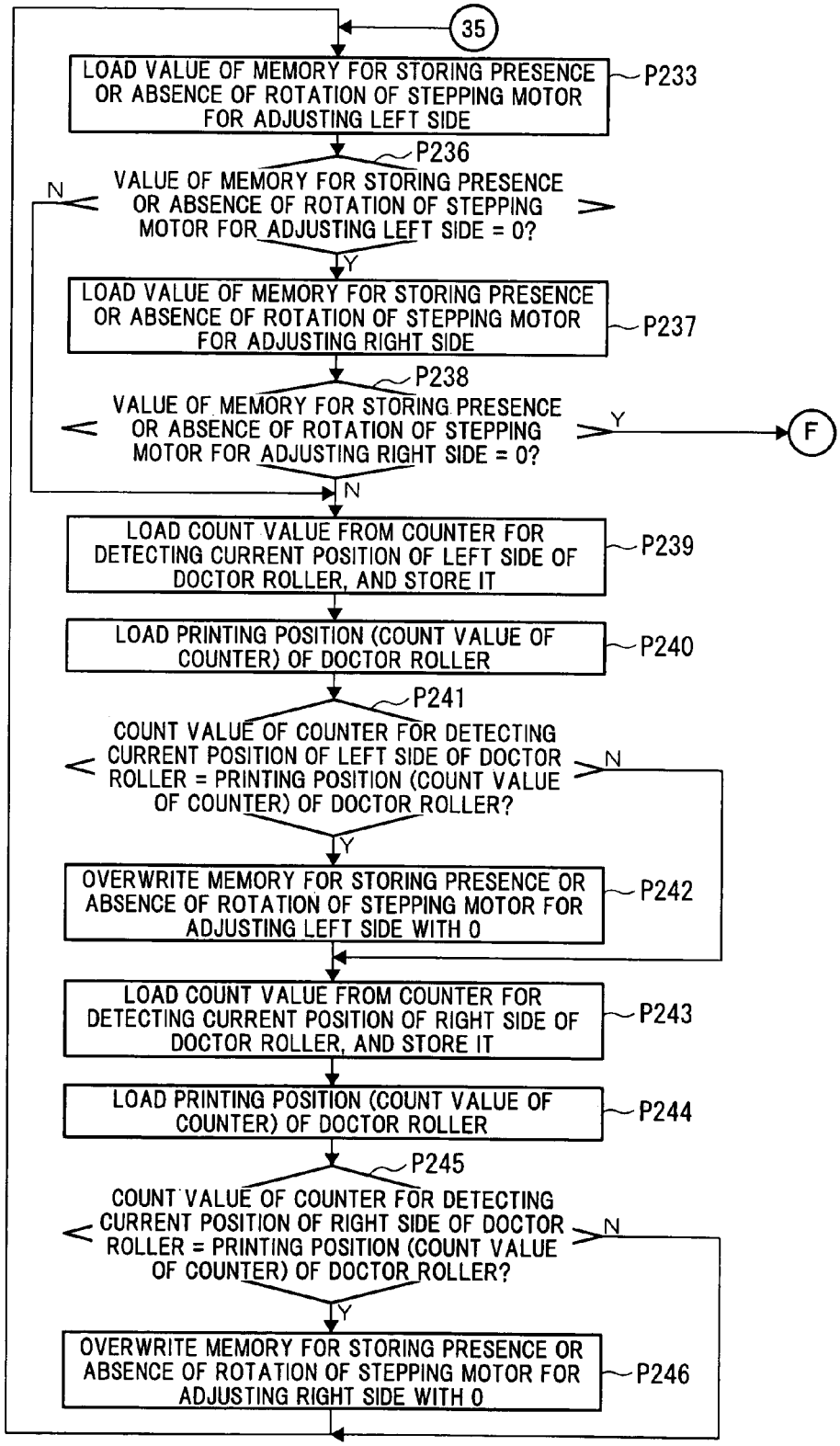
Figure 21A:
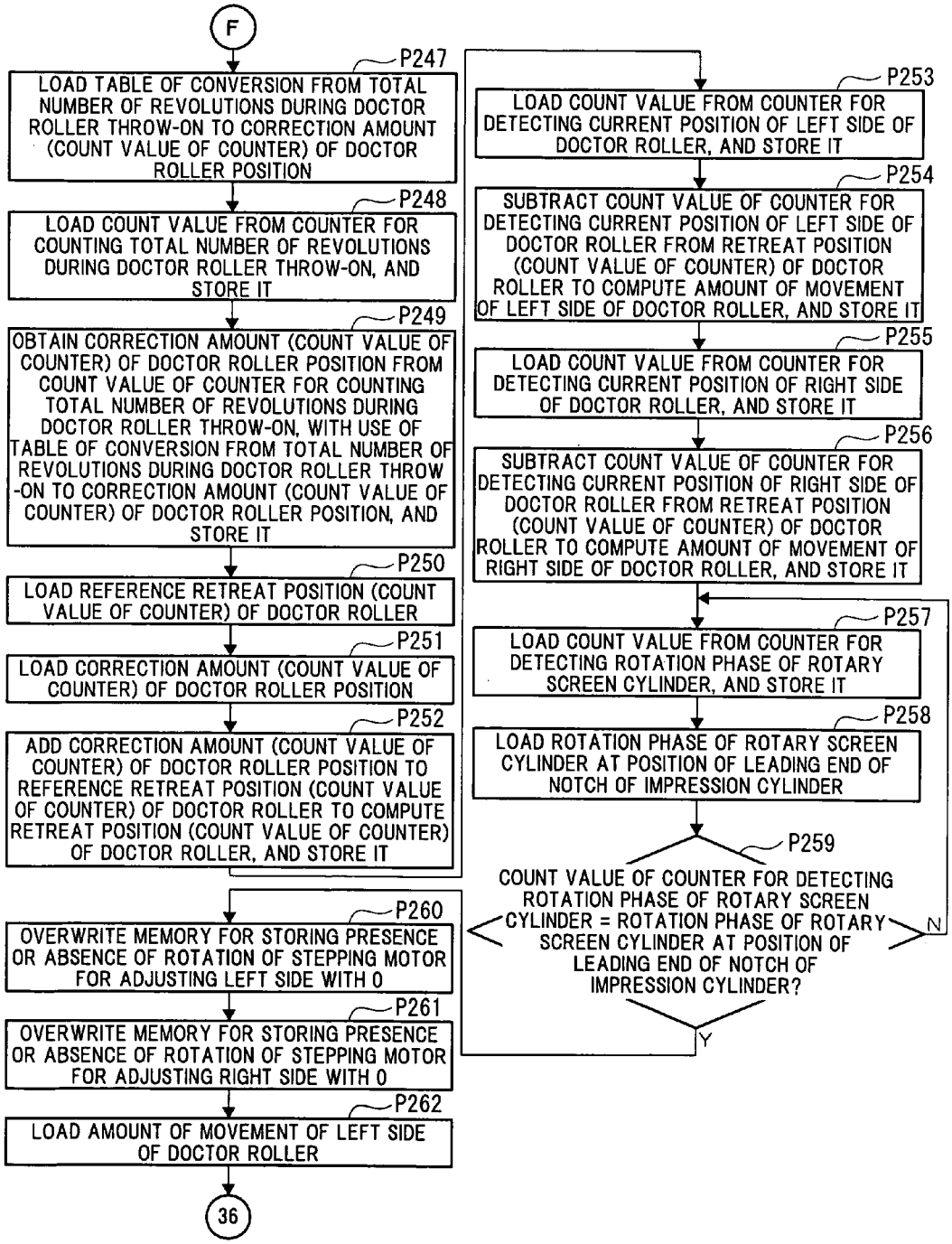
FIG. 21(*a*) is a motion flow chart of the doctor roller throw-on and throw-off control device.
Figure 21B:
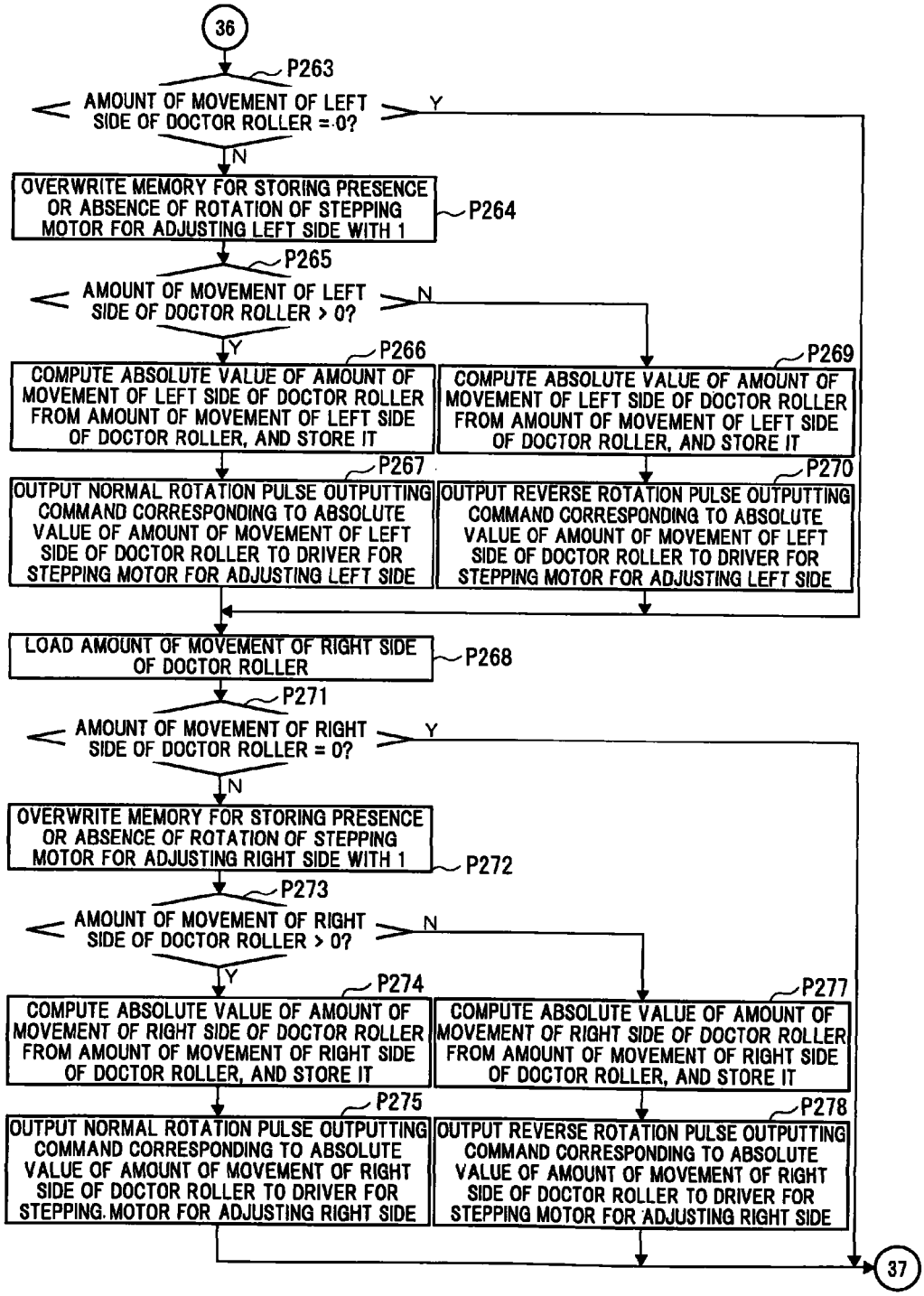
Figure 21C:
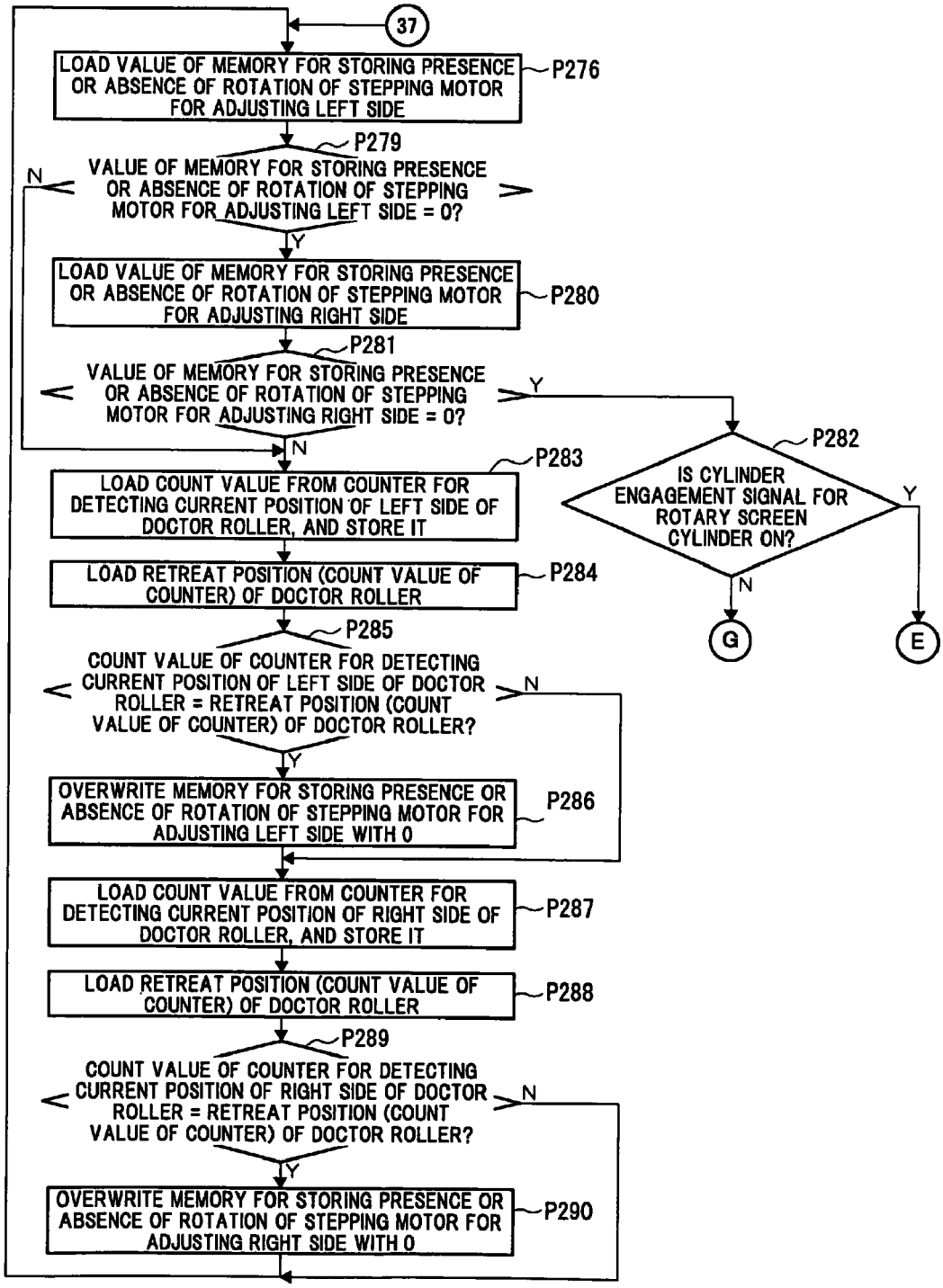
Figure 22A:
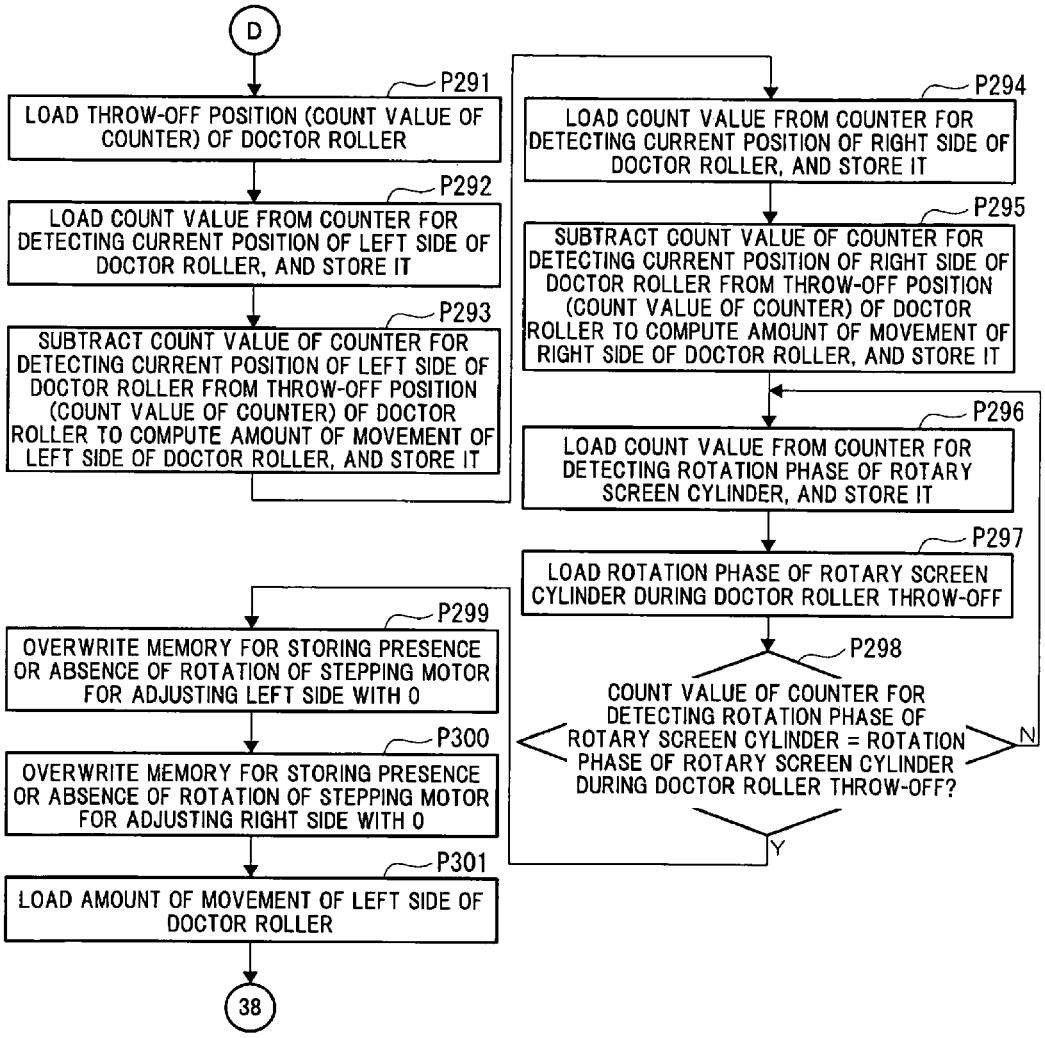
FIG. 22(*a*) is a motion flow chart of the doctor roller throw-on and throw-off control device.
Figure 22B:
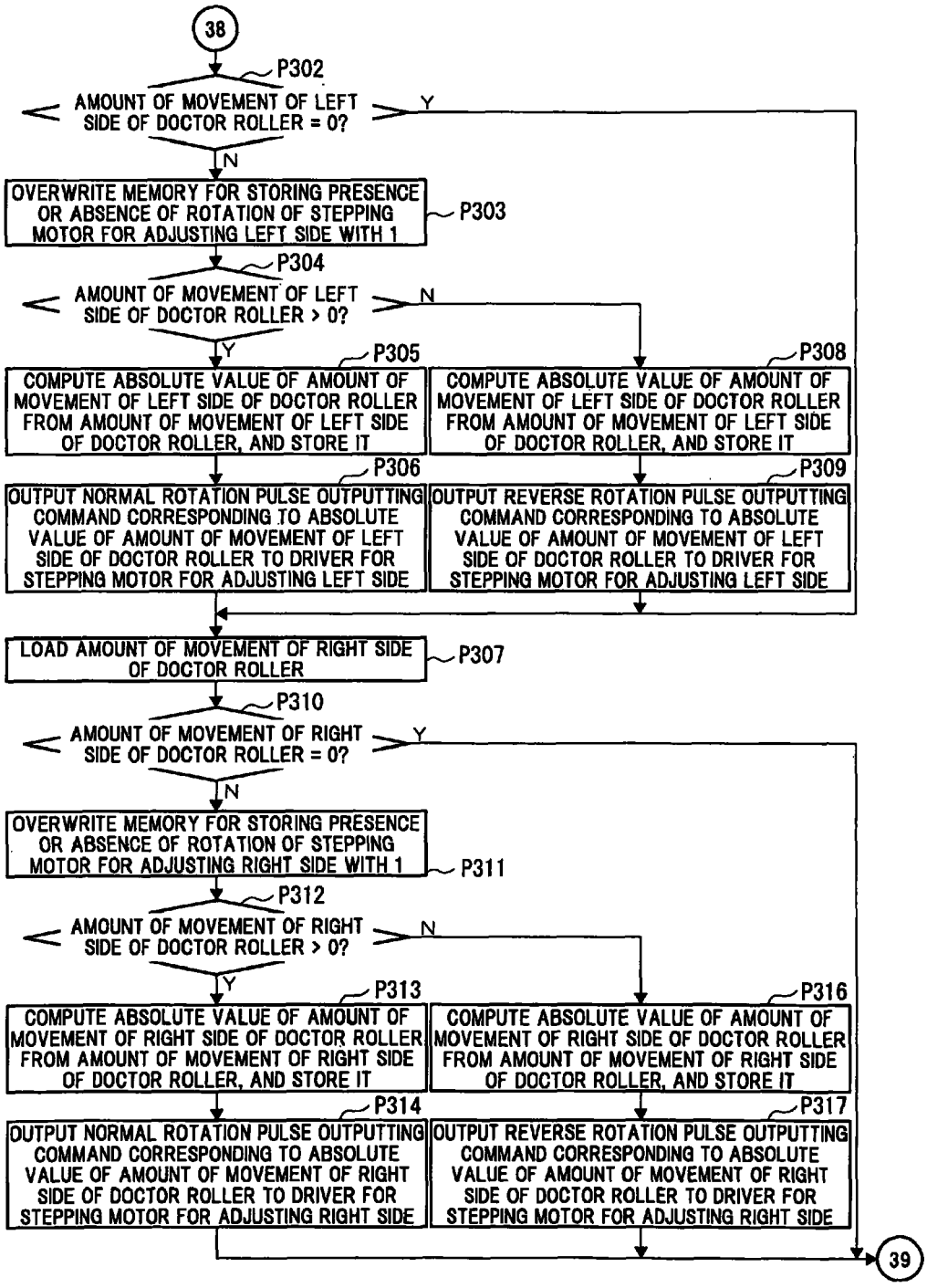
Figure 22C:
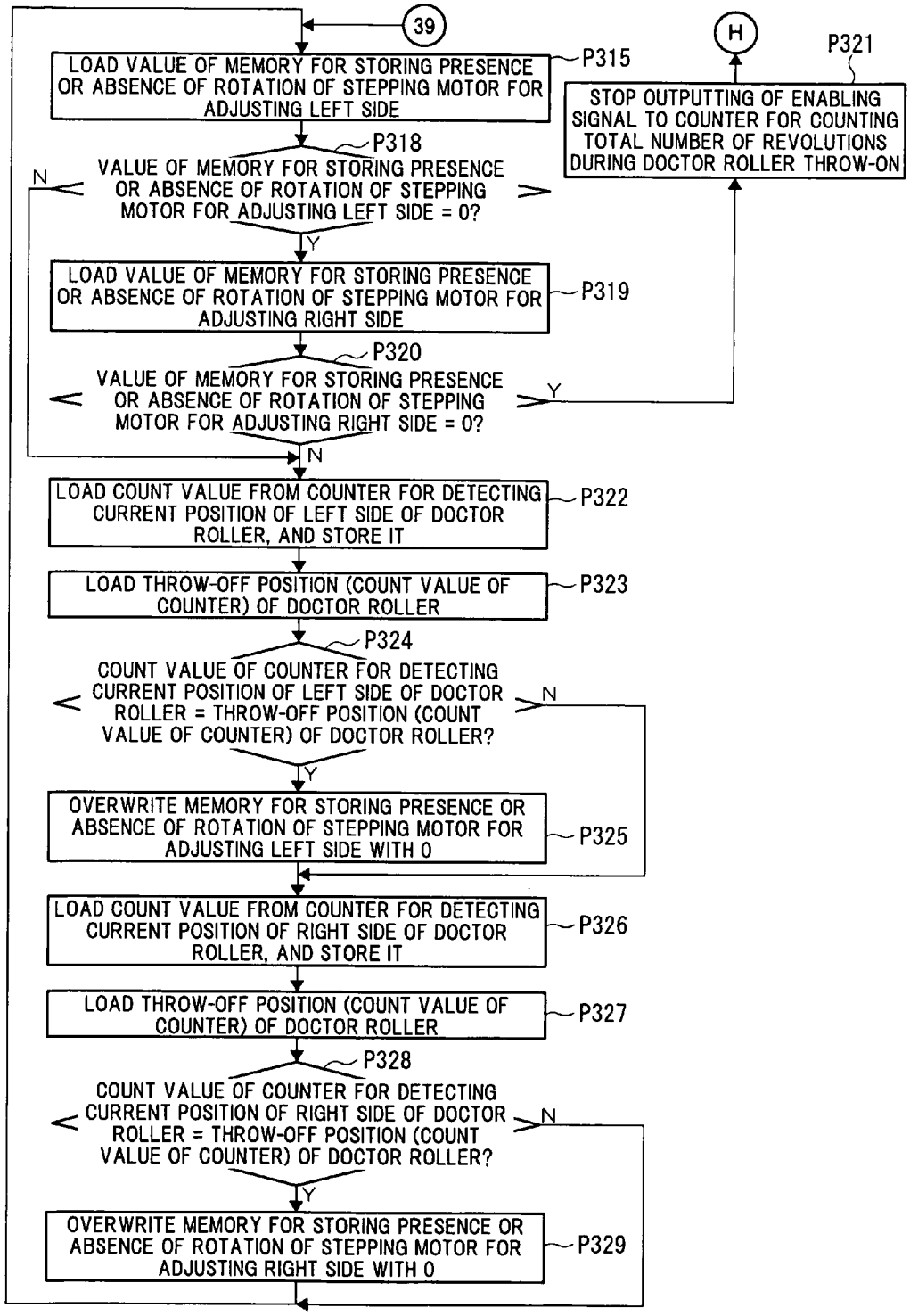

FIG. 13 is a schematic configurational sectional view of a rotary screen printing unit in a rotary screen printing press showing Embodiment 2 of the present invention. FIG. 14(*a*) is an explanation drawing of an ink supply system. FIG. 14(*b*) is an explanation drawing of an ink supply pipe. FIGS. 15(*a*) to 15(*c*) are control block diagrams of a doctor roller throw-on and throw-off control device. FIGS. 16(*a*) to 16(*e*) are motion flow charts of the doctor roller throw-on and throw-off control device. FIGS. 17(*a*) to 17(*d*) are motion flow charts of the doctor roller throw-on and throw-off control device. FIGS. 18(*a*) to 18(*c*) are motion flow charts of the doctor roller throw-on and throw-off control device. FIGS. 19(*a*) to 19(*c*) are motion flow charts of the doctor roller throw-on and throw-off control device. FIGS. 20(*a*) to 20(*c*) are motion flow charts of the doctor roller throw-on and throw-off control device. FIGS. 21(*a*) to 21(*c*) are motion flow charts of the doctor roller throw-on and throw-off control device. FIGS. 22(*a*) to 22(*c*) are motion flow charts of the doctor roller throw-on and throw-off control device.

The present Embodiment 2 is an embodiment in which a stepping motor 36Aa for adjusting a left side and a stepping motor 36Bb for adjusting a right side (see FIGS. 15(*a*) and 15(*b*)) are used instead of the motor 36A for adjusting the left side of the support shaft 27 and the motor 36B for adjusting the right side of the support shaft 27 in Embodiment 1, and a doctor roller 90 is used instead of the squeegee 38 as the liquid transfer member, as shown in FIG. 13.

The doctor roller 90 has a double structure composed of an inner roller 90*a* formed from a metal and an outer roller 90*b* formed from rubber. The doctor roller 90 is rotatably supported on a support shaft 27 via bearings 92 at left and right end members 91*a* and 91*b* fitted into the inner roller 90*a*.

As shown in FIGS. 14(*a*) and 14(*b*), an ink supply pipe 93 is horizontally installed within the screen printing forme 11*c*, and ink stored within an external tank 94 is supplied to the ink supply pipe 93 by a pump 95. The ink is dropped from the ink supply pipe 93 toward the inner peripheral surface of the screen printing forme 11*c* at multiple points in the cylinder axis direction of the rotary screen cylinder 11.

Thus, the outer peripheral surface of the doctor roller 90 makes a rolling contact with the inner peripheral surface of the screen printing forme 11*c*, whereby the ink supplied to the interior of the screen printing forme 11*c* through the ink supply pipe 93 is transferred to the printing surface of the material W to be printed via the holes of the screen printing forme 11*c*.

Other features are the same as those in Embodiment 1, so that duplicate explanations are omitted by reference to FIGS. 1 to 4(*a*), 4(*b*).

The doctor roller throw-on and throw-off control device 40B of the present Embodiment 2 comprises CPU 41, RAM 42, ROM 43, and input/output devices 44 to 50 connected together by BUS (bus line), as shown in FIGS. 15(*a*) to 15(*c*). To the BUS (bus line), the following memories are connected: A memory M1 for storing the type of the material to be printed, a memory M2 for storing the thickness of the material to be printed, a memory M3 for storing the material for the screen printing forme, a memory M4 for storing the thickness of the screen printing forme, a memory M5*a* for storing the open area rate of the screen printing forme, a memory M6 for storing the mesh size of the screen printing forme, a memory M7 for storing the viscosity of ink, a memory M8 for storing the yield value of ink, a memory M9 for storing the type of a pigment of ink, a memory M10*a* for storing the material for the doctor roller, and a memory M11*a* for storing the surface hardness of the doctor roller.

To the BUS (bus line), the following memories are further connected: A memory M12*a* for storing a table of conversion from the type of the material to be printed to the throw-on position (count value of a counter) of the doctor roller, a memory M13*a* for storing the provisional reference throw-on position (count value of the counter) of the doctor roller, a memory M14*a* for storing a table of conversion from the thickness of the material to be printed to the throw-on position (count value of the counter) of the doctor roller, a memory M15*a* for storing the first correction value (count value of the counter) of the throw-on position of the doctor roller, a memory M16*a* for storing a table of conversion from the material for the screen printing forme to the throw-on position (count value of the counter) of the doctor roller, a memory M17*a* for storing the second correction value (count value of the counter) of the throw-on position of the doctor roller, a memory M18*a* for storing a table of conversion from the thickness of the screen printing forme to the throw-on position (count value of the counter) of the doctor roller, a memory M19*a* for storing the third correction value (count value of the counter) of the throw-on position of the doctor roller, and a memory M21*a* for storing the fourth correction value (count value of the counter) of the throw-on position of the doctor roller.

To the BUS (bus line), the following memories are further connected: A memory M22*a* for storing a table of conversion from the mesh size of the screen printing forme to the throw-on position (count value of the counter) of the doctor roller, a memory M23*a* for storing the fifth correction value (count value of the counter) of the throw-on position of the doctor roller, a memory M24*a* for storing a table of conversion from the viscosity of ink to the throw-on position (count value of the counter) of the doctor roller, a memory M25*a* for storing the sixth correction value (count value of the counter) of the throw-on position of the doctor roller, a memory M26*a* for storing a table of conversion from the yield value of ink to the throw-on position (count value of the counter) of the doctor roller, a memory M27*a* for storing the seventh correction value (count value of the counter) of the throw-on position of the doctor roller, a memory M28*a* for storing a table of conversion from the type of the pigment of ink to the throw-on position (count value of the counter) of the doctor roller, a memory M29*a* for storing the eighth correction value (count value of the counter) of the throw-on position of the doctor roller, a memory M30*a* for storing a table of conversion from the material for the doctor roller to the throw-on position (count value of the counter) of the doctor roller, a memory M31*a* for storing the ninth correction value (count value of the counter) of the throw-on position of the doctor roller, a memory M32*a* for storing a table of conversion from the surface hardness of the doctor roller to the throw-on position (count value of the counter) of the doctor roller, and a memory M33*a* for storing the tenth correction value (count value of the counter) of the throw-on position of the doctor roller.

To the BUS (bus line), the following memories are further connected: A memory M34*a* for storing the reference throw-on position (count value of the counter) of the doctor roller, a memory M35*a* for storing a table of conversion from the material for the screen printing forme to the retreat position (count value of the counter) of the doctor roller, a memory M36*a* for storing the provisional reference retreat position (count value of the counter) of the doctor roller, a memory M37*a* for storing a table of conversion from the thickness of the screen printing forme to the retreat position (count value of the counter) of the doctor roller, a memory M38*a* for storing the first correction value (count value of the counter) of the retreat position of the doctor roller, a memory M40*a* for storing the second correction value (count value of the counter) of the retreat position of the doctor roller, a memory M41*a* for storing a table of conversion from the mesh size of the screen printing forme to the retreat position (count value of the counter) of the doctor roller, a memory M42*a* for storing the third correction value (count value of the counter) of the retreat position of the doctor roller, a memory M43*a* for storing a table of conversion from the viscosity of ink to the retreat position (count value of the counter) of the doctor roller, a memory M44*a* for storing the fourth correction value (count value of the counter) of the retreat position of the doctor roller, a memory M45*a* for storing a table of conversion from the yield value of ink to the retreat position (count value of the counter) of the doctor roller, and a memory M46*a* for storing the fifth correction value (count value of the counter) of the retreat position of the doctor roller.

To the BUS (bus line), the following memories are further connected: A memory M47*a* for storing a table of conversion from the type of the pigment of ink to the retreat position (count value of the counter) of the doctor roller, a memory M48*a* for storing the sixth correction value (count value of the counter) of the retreat position of the doctor roller, a memory M49*a* for storing a table of conversion from the material for the doctor roller to the retreat position (count value of the counter) of the doctor roller, a memory M50*a* for storing the seventh correction value (count value of the counter) of the retreat position of the doctor roller, a memory M51*a* for storing a table of conversion from the surface hardness of the doctor roller to the retreat position (count value of the counter) of the doctor roller, a memory M52*a* for storing the eighth correction value (count value of the counter) of the retreat position of the doctor roller, a memory M53*a* for storing the reference retreat position (count value of the counter) of the doctor roller, a memory M54*a* for storing the throw-off position (count value of the counter) of the doctor roller, and a memory M58*a* for storing the rotation phase of the rotary screen cylinder during doctor roller throw-off.

To the BUS (bus line), the following memories are further connected: A memory M60*a* for storing the presence or absence of rotation of a stepping motor for adjusting a left side, a memory M61*a* for storing the presence or absence of rotation of a stepping motor for adjusting a right side, a memory M62*a* for storing the count value of a counter for detecting the current position of the left side of the doctor roller, a memory M63*a* for storing the count value of a counter for detecting the current position of the right side of the doctor roller, a memory M64*a* for storing a table of conversion from the total number of revolutions during doctor roller throw-on to the correction amount (count value of the counter) of the doctor roller position, a memory M65*a* for storing the count value of a counter for counting the total number of revolutions during doctor roller throw-on, a memory M66*a* for storing the correction amount (count value of the counter) of the doctor roller position, a memory M67*a* for storing the retreat position (count value of the counter) of the doctor roller, a memory M68 for storing the count value of a counter for detecting the rotation phase of the rotary screen cylinder, a memory M69*a* for storing the rotation phase of the rotary screen cylinder during doctor roller throw-on, a memory M70*a* for storing the printing position (count value of the counter) of the doctor roller, a memory M71 for storing the rotation phase of the rotary screen cylinder at the position of the leading end of the notch of the impression cylinder, a memory M72 for storing a table of conversion from the open area rate of the screen printing forme to the throw-on position (count value of the counter) of the doctor roller, a memory M73 for storing a table of conversion from the open area rate of the screen printing forme to the retreat position (count value of the counter) of the doctor roller, a memory M74 for storing the amount of movement of the left side of the doctor roller, a memory M75 for storing the amount of movement of the right side of the doctor roller, a memory M76 for storing the absolute value of the amount of movement of the left side of the doctor roller, a memory M77 for storing the absolute value of the amount of movement of the right side of the doctor roller, and a memory M78 for storing the rotation phase of the rotary screen cylinder at the position of the rear end of the notch of the impression cylinder.

To the input/output device 44, the following are connected: A doctor roller throw-on and throw-off automatic control switch 52*a*, an input device 53 such as a keyboard, a display device 54 such as CRT or a display, and an output device 55 such as a printer or a floppy disk (registered trademark) drive.

To the input/output device 45, the following are connected: A setting instrument 56 for the type of the material to be printed, a setting instrument 57 for the thickness of the material to be printed, a setting instrument 58 for the material for the screen printing forme, a setting instrument 59 for the thickness of the screen printing forme, a setting instrument 60 for the mesh size of the screen printing forme, a setting instrument 61 for the viscosity of ink, a setting instrument 62 for the yield value of ink, a setting instrument 63 for the type of the pigment of ink, a setting instrument 64*a* for the material for the doctor roller, a setting instrument 65*a* for the surface hardness of the doctor roller, and a setting instrument 80 for the open area rate of the screen printing forme.

To the input/output device 46, the stepping motor 36Aa for adjusting the left side is connected via a driver 66*a* for the stepping motor for adjusting the left side, and a counter 68*a* for detecting the current position of the left side of the doctor roller is also connected.

To the input/output device 47, the stepping motor 36Bb for adjusting the right side is connected via a driver 70*a* for the stepping motor for adjusting the right side, and a counter 72*a* for detecting the current position of the right side of the doctor roller is also connected.

To the input/output device 48, a rotary encoder 75 for detecting the rotation phase of the rotary screen cylinder is connected via a counter 74 for detecting the rotation phase of the rotary screen cylinder. The rotary encoder 75 for detecting the rotation phase of the rotary screen cylinder is provided on a rotating part of the rotary screen printing press rotating in synchronism with the rotary screen cylinder in such a manner as to generate a zero pulse in the reference rotation phase of the rotary screen cylinder. Thus, the counter 74 for detecting the rotation phase of the rotary screen cylinder is reset in the reference rotation phase of the rotary screen cylinder each time the rotary screen cylinder makes one rotation. Then, the counter 74 for detecting the rotation phase of the rotary screen cylinder counts clock pulses generated in accordance with the rotation of the rotary screen cylinder, producing a count value conformed to the rotation phase of the rotary screen cylinder.

To the input/output device 49, a sensor 77 for detecting one rotation of the rotary screen cylinder is connected via a counter 76*a* for counting the total number of revolutions during doctor roller throw-on. The sensor 77 for detecting one rotation of the rotary screen cylinder is provided on a rotating part of the rotary screen printing press so as to produce one pulse each time the rotary screen cylinder makes one rotation. Thus, the counter 76*a* for counting the total number of revolutions during doctor roller throw-on is adapted to count the number of revolutions of the rotary screen cylinder in an operating state.

To the input/output device 50, a cylinder engagement circuit 78 for the rotary screen cylinder is connected.

The control actions or motions of the doctor roller throw-on and throw-off control device 40B configured as above will be described in detail based on the motion flow charts of FIGS. 16(*a*) to 16(*e*), FIGS. 17(*a*) to 17(*d*), FIGS. 18(*a*) to 18(*c*), FIGS. 19(*a*) to 19(*c*), FIGS. 20(*a*) to 20(*c*), FIGS. 21(*a*) to 21(*c*), and FIGS. 22(*a*) to 22(*c*).

In Step P1, it is determined whether there is an input to the setting instrument 56 for the type of the material to be printed. If the answer is Y (yes), the type of the material W to be printed is loaded from the setting instrument 56 for the type of the material to be printed, and stored into the memory M1, in Step P2, and the program proceeds to Step P3. If the answer is N (no), the program directly shifts to Step P3.

Then, in Step P3, it is determined whether there is an input to the setting instrument 57 for the thickness of the material to be printed. If the answer is Y, the thickness of the material to be printed is loaded from the setting instrument 57 for the thickness of the material to be printed, and stored into the memory M2, in Step P4. Then, the program proceeds to Step P5. If the answer is N, the program directly shifts to Step P5.

Then, in Step P5, it is determined whether there is an input to the setting instrument 58 for the material for the screen printing forme. If the answer is Y, the material for the screen printing forme 11*c* is loaded from the setting instrument 58 for the material for the screen printing forme, and stored into the memory M3, in Step P6. Then, the program proceeds to Step P7. If the answer is N, the program directly shifts to Step P7.

Then, in Step P7, it is determined whether there is an input to the setting instrument 59 for the thickness of the screen printing forme. If the answer is Y, the thickness of the screen printing forme is loaded from the setting instrument 59 for the thickness of the screen printing forme, and stored into the memory M4, in Step P8. Then, the program proceeds to Step P9. If the answer is N, the program directly shifts to Step P9.

Then, in Step P9, it is determined whether there is an input to the setting instrument 80 for the open area rate of the screen printing forme. If the answer is Y, the open area rate of the screen printing forme is loaded from the setting instrument 80 for the open area rate of the screen printing forme, and stored into the memory M5*a*, in Step P10. Then, the program proceeds to Step P11. If the answer is N, the program directly shifts to Step P11.

Then, in Step P11, it is determined whether there is an input to the setting instrument 60 for the mesh size of the screen printing forme. If the answer is Y, the mesh size of the screen printing forme 11*c* is loaded from the setting instrument 60 for the mesh size of the screen printing forme, and stored into the memory M6, in Step P12. Then, the program proceeds to Step P13. If the answer is N, the program directly shifts to Step P13.

Then, in Step P13, it is determined whether there is an input to the setting instrument 61 for the viscosity of ink. If the answer is Y, the viscosity of ink is loaded from the setting instrument 61 for the viscosity of ink, and stored into the memory M7, in Step P14. Then, the program proceeds to Step P15. If the answer is N, the program directly shifts to Step P15.

Then, in Step P15, it is determined whether there is an input to the setting instrument 62 for the yield value of ink. If the answer is y, the yield value of ink is loaded from the setting instrument 62 for the yield value of ink, and stored into the memory M8, in Step P16. Then, the program proceeds to Step P17. If the answer is N, the program directly shifts to Step P17.

Then, in Step P17, it is determined whether there is an input to the setting instrument 63 for the type of the pigment of ink. If the answer is Y, the type of the pigment of ink is loaded from the setting instrument 63 for the type of the pigment of ink, and stored into the memory M9, in Step P18. Then, the program proceeds to Step P19. If the answer is N, the program directly shifts to Step P19.

Then, in Step P19, it is determined whether there is an input to the setting instrument 64*a* for the material for the doctor roller. If the answer is Y, the material for the doctor roller 90 is loaded from the setting instrument 64*a* for the material for the doctor roller, and stored into the memory M10*a*, in Step P20. Then, the program proceeds to Step P21. If the answer is N, the program directly shifts to Step P21.

Then, in Step P21, it is determined whether there is an input to the setting instrument 65*a* for the surface hardness of the doctor roller. If the answer is Y, the surface hardness of the doctor roller is loaded from the setting instrument 65*a* for the surface hardness of the doctor roller, and stored into the memory M11*a*, in Step P22. Then, the program proceeds to Step P23. If the answer is N, the program directly shifts to Step P23.

Then, in Step P23, it is determined whether the doctor roller throw-on and throw-off automatic control switch 52*a* is ON. If the answer is Y, the table of conversion from the type of the material to be printed to the throw-on position (count value of the counter) of the doctor roller is loaded from the memory M12*a* in Step P24. If the answer is N, the program returns to Step P1.

Then, in Step P25, the type of the material W to be printed is loaded from the memory M1. Then, in Step P26, the provisional reference throw-on position (count value of the counter) of the doctor roller is obtained from the type of the material W to be printed, with the use of the table of conversion from the type of the material to be printed to the throw-on position (count value of the counter) of the doctor roller, and is stored into the memory M13*a*.

Then, in Step P27, the type of the material W to be printed is loaded from the memory M1. Then, in Step P28, the table of conversion from the thickness of the material to be printed to the throw-on position (count value of the counter) of the doctor roller, which is commensurate with the type of the material to be printed, is loaded from the memory M14*a*.

Then, in Step P29, the thickness of the material to be printed is loaded from the memory M2. Then, in Step P30, the first correction value (count value of the counter) of the throw-on position of the doctor roller is obtained from the thickness of the material to be printed, with the use of the table of conversion from the thickness of the material to be printed to the throw-on position (count value of the counter) of the doctor roller, which is commensurate with the type of the material to be printed, and this correction value is stored into the memory M15*a*.

Then, in Step P31, the table of conversion from the material for the screen printing forme to the throw-on position (count value of the counter) of the doctor roller is loaded from the memory M16*a*. Then, in Step P32, the material for the screen printing forme 11*c* is loaded from the memory M3. Then, in Step P33, the second correction value (count value of the counter) of the throw-on position of the doctor roller is obtained from the material for the screen printing forme 11*c*, with the use of the table of conversion from the material for the screen printing forme to the throw-on position (count value of the counter) of the doctor roller, and this correction value is stored into the memory M17*a*.

Then, in Step P34, the material for the screen printing forme 11*c* is loaded from the memory M3. Then, in Step P35, the table of conversion from the thickness of the screen printing forme to the throw-on position (count value of the counter) of the doctor roller, which is commensurate with the material for the screen printing forme, is loaded from the memory M18*a*.

Then, in Step P36, the thickness of the screen printing forme is loaded from the memory M4. Then, in Step P37, the third correction value (count value of the counter) of the throw-on position of the doctor roller is obtained from the thickness of the screen printing forme, with the use of the table of conversion from the thickness of the screen printing forme to the throw-on position (count value of the counter) of the doctor roller, which is commensurate with the material for the screen printing forme, and this correction value is stored into the memory M19*a*.

Then, in Step P38, the material for the screen printing forme 11*c* is loaded from the memory M3. Then, in Step P39, the thickness of the screen printing forme is loaded from the memory M4. Then, in Step P40, the table of conversion from the open area rate of the screen printing forme to the throw-on position (count value of the counter) of the doctor roller, which is commensurate with the material for the screen printing forme and the thickness of the screen printing forme, is loaded from the memory M72.

Then, in Step P41, the open area rate of the screen printing forme is loaded from the memory M5*a*. Then, in Step P42, the fourth correction value (count value of the counter) of the throw-on position of the doctor roller is obtained from the open area rate of the screen printing forme, with the use of the table of conversion from the open area rate of the screen printing forme to the throw-on position (count value of the counter) of the doctor roller, which is commensurate with the material for the screen printing forme and the thickness of the screen printing forme, and this correction value is stored into the memory M21*a*.

Then, in Step P43, the material for the screen printing forme 11*c* is loaded from the memory M3. Then, in Step P44, the thickness of the screen printing forme is loaded from the memory M4. Then, in Step P45, the table of conversion from the mesh size of the screen printing forme to the throw-on position (count value of the counter) of the doctor roller, which is commensurate with the material for the screen printing forme and the thickness of the screen printing forme, is loaded from the memory M22*a*.

Then, in Step P46, the mesh size of the screen printing forme is loaded from the memory M6. Then, in Step P47, the fifth correction value (count value of the counter) of the throw-on position of the doctor roller is obtained from the mesh size of the screen printing forme, with the use of the table of conversion from the mesh size of the screen printing forme to the throw-on position (count value of the counter) of the doctor roller, which is commensurate with the material for the screen printing forme and the thickness of the screen printing forme, and this correction value is stored into the memory M23*a*.

Then, in Step P48, the table of conversion from the viscosity of ink to the throw-on position (count value of the counter) of the doctor roller is loaded from the memory M24*a*. Then, in Step P49, the viscosity of ink is loaded from the memory M7. Then, in Step P50, the sixth correction value (count value of the counter) of the throw-on position of the doctor roller is obtained from the viscosity of ink with the use of the table of conversion from the viscosity of ink to the throw-on position (count value of the counter) of the doctor roller, and this correction value is stored into the memory M25*a*.

Then, in Step P51, the table of conversion from the yield value of ink to the throw-on position (count value of the counter) of the doctor roller is loaded from the memory M26*a*. Then, in Step P52, the yield value of ink is loaded from the memory M8. Then, in Step P53, the seventh correction value (count value of the counter) of the throw-on position of the doctor roller is obtained from the yield value of ink with the use of the table of conversion from the yield value of ink to the throw-on position (count value of the counter) of the doctor roller, and this correction value is stored into the memory M27*a*.

Then, in Step P54, the table of conversion from the type of the pigment of ink to the throw-on position (count value of the counter) of the doctor roller is loaded from the memory M28*a*. Then, in Step P55, the type of the pigment of ink is loaded from the memory M9. Then, in Step P56, the eighth correction value (count value of the counter) of the throw-on position of the doctor roller is obtained from the type of the pigment of ink with the use of the table of conversion from the type of the pigment of ink to the throw-on position (count value of the counter) of the doctor roller, and this correction value is stored into the memory M29*a*.

Then, in Step P57, the table of conversion from the material for the doctor roller to the throw-on position (count value of the counter) of the doctor roller is loaded from the memory M30*a*. Then, in Step P58, the material for the doctor roller 90 is loaded from the memory M10*a*. Then, in Step P59, the ninth correction value (count value of the counter) of the throw-on position of the doctor roller is obtained from the material for the doctor roller 90 with the use of the table of conversion from the material for the doctor roller to the throw-on position (count value of the counter) of the doctor roller, and this correction value is stored into the memory M31*a*.

Then, in Step P60, the material for the doctor roller 90 is loaded from the memory M10*a*. Then, in Step P61, the table of conversion from the surface hardness of the doctor roller to the throw-on position (count value of the counter) of the doctor roller, which is commensurate with the material for the doctor roller, is loaded from the memory M32*a*.

Then, in Step P62, the surface hardness of the doctor roller is loaded from the memory M11*a*. Then, in Step P63, the tenth correction value (count value of the counter) of the throw-on position of the doctor roller is obtained from the surface hardness of the doctor roller with the use of the table of conversion from the surface hardness of the doctor roller to the throw-on position (count value of the counter) of the doctor roller, which is commensurate with the material for the doctor roller, and this correction value is stored into the memory M33*a*.

Then, in Step P64, the provisional reference throw-on position (count value of the counter) of the doctor roller is loaded from the memory M13*a*, whereafter, in Step P65, the first correction value (count value of the counter) of the throw-on position of the doctor roller is loaded from the memory M15*a*. Then, in Step P66, the second correction value (count value of the counter) of the throw-on position of the doctor roller is loaded from the memory M17*a*.

Then, in Step P67, the third correction value (count value of the counter) of the throw-on position of the doctor roller is loaded from the memory M19*a*, whereafter, in Step P68, the fourth correction value (count value of the counter) of the throw-on position of the doctor roller is loaded from the memory M21*a*. Then, in Step P69, the fifth correction value (count value of the counter) of the throw-on position of the doctor roller is loaded from the memory M23*a*.

Then, in Step P70, the sixth correction value (count value of the counter) of the throw-on position of the doctor roller is loaded from the memory M25*a*, whereafter, in Step P71, the seventh correction value (count value of the counter) of the throw-on position of the doctor roller is loaded from the memory M27*a*. Then, in Step P72, the eighth correction value (count value of the counter) of the throw-on position of the doctor roller is loaded from the memory M29*a*.

Then, in Step P73, the ninth correction value (count value of the counter) of the throw-on position of the doctor roller is loaded from the memory M31*a*, whereafter, in Step P74, the tenth correction value (count value of the counter) of the throw-on position of the doctor roller is loaded from the memory M33*a*.

Then, in Step P75, the first correction value (count value of the counter) of the throw-on position of the doctor roller, the second correction value (count value of the counter) of the throw-on position of the doctor roller, the third correction value (count value of the counter) of the throw-on position of the doctor roller, the fourth correction value (count value of the counter) of the throw-on position of the doctor roller, the fifth correction value (count value of the counter) of the throw-on position of the doctor roller, the sixth correction value (count value of the counter) of the throw-on position of the doctor roller, the seventh correction value (count value of the counter) of the throw-on position of the doctor roller, the eighth correction value (count value of the counter) of the throw-on position of the doctor roller, the ninth correction value (count value of the counter) of the throw-on position of the doctor roller, and the tenth correction value (count value of the counter) of the throw-on position of the doctor roller are added to the provisional reference throw-on position (count value of the counter) of the doctor roller to compute the reference throw-on position (count value of the counter) of the doctor roller, and this reference throw-on position (count value of the counter) of the doctor roller is stored into the memory M34*a*.

In accordance with the above-described motion flow, the throw-on position of the doctor roller 90 during printing is preset, based on the type of the material W to be printed (i.e., difference in the material, e.g., paper, cloth, film or corrugated board), in conformity with the thickness of the material to be printed, the material for the screen printing forme 11*c*, the thickness of the screen printing forme, the open area rate of the screen printing forme, the mesh size of the screen printing forme 11*c*, the viscosity of ink, the yield value of ink, the type of the pigment of ink, the material for the doctor roller, and the surface hardness of the doctor roller.

Then, in Step P76, the table of conversion from the material for the screen printing forme to the retreat position (count value of the counter) of the doctor roller is loaded from the memory M35*a*. Then, in Step P77, the material for the screen printing forme 11*c* is loaded from the memory M3. Then, in Step P78, the provisional reference retreat position (count value of the counter) of the doctor roller is obtained from the material for the screen printing forme 11*c* with the use of the table of conversion from the material for the screen printing forme to the retreat position (count value of the counter) of the doctor roller, and is stored into the memory M36*a*.

Then, in Step P79, the material for the screen printing forme 11*c* is loaded from the memory M3. Then, in Step P80, the table of conversion from the thickness of the screen printing forme to the retreat position (count value of the counter) of the doctor roller, which is commensurate with the material for the screen printing forme, is loaded from the memory M37*a*.

Then, in Step P81, the thickness of the screen printing forme is loaded from the memory M4. Then, in Step P82, the first correction value (count value of the counter) of the retreat position of the doctor roller is obtained from the thickness of the screen printing forme with the use of the table of conversion from the thickness of the screen printing forme to the retreat position (count value of the counter) of the doctor roller, which is commensurate with the material for the screen printing forme, and this correction value is stored into the memory M38*a*.

Then, in Step P83, the material for the screen printing forme 11*c* is loaded from the memory M3, whereafter, in Step P84, the thickness of the screen printing forme is loaded from the memory M4. Then, in Step P85, the table of conversion from the open area rate of the screen printing forme to the retreat position (count value of the counter) of the doctor roller, which is commensurate with the material for the screen printing forme and the thickness of the screen printing forme, is loaded from the memory M73.

Then, in Step P86, the open area rate of the screen printing forme is loaded from the memory M5*a*. Then, in Step P87, the second correction value (count value of the counter) of the retreat position of the doctor roller is obtained from the open area rate of the screen printing forme with the use of the table of conversion from the open area rate of the screen printing forme to the retreat position (count value of the counter) of the doctor roller, which is commensurate with the material for the screen printing forme and the thickness of the screen printing forme, and this correction value is stored into the memory M40*a*.

Then, in Step P88, the material for the screen printing forme is loaded from the memory M3. Then, in Step P89, the thickness of the screen printing forme is loaded from the memory M4. Then, in Step P90, the table of conversion from the mesh size of the screen printing forme to the retreat position (count value of the counter) of the doctor roller, which is commensurate with the material for the screen printing forme and the thickness of the screen printing forme, is loaded from the memory M41*a*.

Then, in Step P91, the mesh size of the screen printing forme 11*c* is loaded from the memory M6. Then, in Step P92, the third correction value (count value of the counter) of the retreat position of the doctor roller is obtained from the mesh size of the screen printing forme 11*c* with the use of the table of conversion from the mesh size of the screen printing forme to the retreat position (count value of the counter) of the doctor roller, which is commensurate with the material for the screen printing forme and the thickness of the screen printing forme, and this correction value is stored into the memory M42*a*.

Then, in Step-P93, the table of conversion from the viscosity of ink to the retreat position (count value of the counter) of the doctor roller is loaded from the memory M43*a*. Then, in Step P94, the viscosity of ink is loaded from the memory M7. Then, in Step P95, the fourth correction value (count value of the counter) of the retreat position of the doctor roller is obtained from the viscosity of ink with the use of the table of conversion from the viscosity of ink to the retreat position (count value of the counter) of the doctor roller, and this correction value is stored into the memory M44*a*.

Then, in Step P96, the table of conversion from the yield value of ink to the retreat position (count value of the counter) of the doctor roller is loaded from the memory M45*a*. Then, in Step P97, the yield value of ink is loaded from the memory M8. Then, in Step P98, the fifth correction value (count value of the counter) of the retreat position of the doctor roller is obtained from the yield value of ink with the use of the table of conversion from the yield value of ink to the retreat position (count value of the counter) of the doctor roller, and this correction value is stored into the memory M46*a*.

Then, in Step P99, the table of conversion from the type of the pigment of ink to the retreat position (count value of the counter) of the doctor roller is loaded from the memory M47*a*. Then, in Step P100, the type of the pigment of ink is loaded from the memory M9. Then, in Step P101, the sixth correction value (count value of the counter) of the retreat position of the doctor roller is obtained from the type of the pigment of ink with the use of the table of conversion from the type of the pigment of ink to the retreat position (count value of the counter) of the doctor roller, and this correction value is stored into the memory M48*a*.

Then, in Step P102, the table of conversion from the material for the doctor roller to the retreat position (count value of the counter) of the doctor roller is loaded from the memory M49*a*. Then, in Step P103, the material for the doctor roller is loaded from the memory M10*a*. Then, in Step P104, the seventh correction value (count value of the counter) of the retreat position of the doctor roller is obtained from the material for the doctor roller with the use of the table of conversion from the material for the doctor roller to the retreat position (count value of the counter) of the doctor roller, and this correction value is stored into the memory M50*a*.

Then, in Step P105, the material for the doctor roller is loaded from the memory M10*a*. Then, in Step P106, the table of conversion from the surface hardness of the doctor roller to the retreat position (count value of the counter) of the doctor roller, which is commensurate with the material for the doctor roller, is loaded from the memory M51*a*.

Then, in Step P107, the surface hardness of the doctor roller is loaded from the memory M11*a*. Then, in Step P108, the eighth correction value (count value of the counter) of the retreat position of the doctor roller is obtained from the surface hardness of the doctor roller with the use of the table of conversion from the surface hardness of the doctor roller to the retreat position (count value of the counter) of the doctor roller, which is commensurate with the material for the doctor roller, and this correction value is stored into the memory M52*a*.

Then, in Step P109, the provisional reference retreat position (count value of the counter) of the doctor roller is loaded from the memory M36*a*, whereafter, in Step P110, the first correction value (count value of the counter) of the retreat position of the doctor roller is loaded from the memory M38*a*. Then, in Step P111, the second correction value (count value of the counter) of the retreat position of the doctor roller is loaded from the memory M40*a*.

Then, in Step P112, the third correction value (count value of the counter) of the retreat position of the doctor roller is loaded from the memory M42*a*, whereafter, in Step P113, the fourth correction value (count value of the counter) of the retreat position of the doctor roller is loaded from the memory M44*a*. Then, in Step P114, the fifth correction value (count value of the counter) of the retreat position of the doctor roller is loaded from the memory M46*a*.

Then, in Step P115, the sixth correction value (count value of the counter) of the retreat position of the doctor roller is loaded from the memory M48*a*, whereafter, in Step P116, the seventh correction value (count value of the counter) of the retreat position of the doctor roller is loaded from the memory M50*a*. Then, in Step P117, the eighth correction value (count value of the counter) of the retreat position of the doctor roller is loaded from the memory M52*a*.

Then, in Step P118, the first correction value (count value of the counter) of the retreat position of the doctor roller, the second correction value (count value of the counter) of the retreat position of the doctor roller, the third correction value (count value of the counter) of the retreat position of the doctor roller, the fourth correction value (count value of the counter) of the retreat position of the doctor roller, the fifth correction value (count value of the counter) of the retreat position of the doctor roller, the sixth correction value (count value of the counter) of the retreat position of the doctor roller, the seventh correction value (count value of the counter) of the retreat position of the doctor roller, and the eighth correction value (count value of the counter) of the retreat position of the doctor roller are added to the provisional reference retreat position (count value of the counter) of the doctor roller to compute the reference retreat position (count value of the counter) of the doctor roller. This reference retreat position (count value of the counter) of the doctor roller is stored into the memory M53*a*. The reference retreat position (count value of the counter) of the doctor roller obtained is a position closer to the throw-off position of the doctor roller than to the reference throw-on position of the doctor roller obtained in Step P75, in other words, a position at which the doctor roller 90 does not leave the inner peripheral surface of the screen printing forme 11*c*, and its pressing force decreases.

In accordance with the above-described motion flow, the retreat position of the doctor roller 90 when opposing the notch 13*b* of the impression cylinder 13 (in other words, the pressing force acting on the inner peripheral surface of the screen printing forme 11*c*) is preset, based on the material for the screen printing forme 11*c*, in conformity with the thickness of the screen printing forme, the open area rate of the screen printing forme, the mesh size of the screen printing forme 11*c*, the viscosity of ink, the yield value of ink, the type of the pigment of ink, the material for the doctor roller, and the surface hardness of the doctor roller.

Then, in Step P119, it is determined whether the doctor roller throw-on and throw-off automatic control switch 52*a* is OFF. If the answer is Y (yes), the program shifts to Step P291 to be described later. If the answer is N (no), it is determined, in Step P120, whether a cylinder engagement signal from the cylinder engagement circuit 78 for the rotary screen cylinder is ON.

If the answer is Y in the above Step P120, the program shifts to Step P160 to be described later. If the answer is N, the throw-off position (count value of the counter) of the doctor roller is loaded from the memory M54*a* in Step P121.

Then, in Step P122, the count value is loaded from the counter 68*a* for detecting the current position of the left side of the doctor roller, and stored into the memory M62*a*. Then follows Step P123 in which the count value of the counter for detecting the current position of the left side of the doctor roller is subtracted from the throw-off position (count value of the counter) of the doctor roller to compute the amount of movement of the left side of the doctor roller, which is stored into the memory M74.

Then, in Step P124, the count value is loaded from the counter 72*a* for detecting the current position of the right side of the doctor roller, and stored into the memory M63*a*. Then follows Step P125 in which the count value of the counter for detecting the current position of the right side of the doctor roller is subtracted from the throw-off position (count value of the counter) of the doctor roller to compute the amount of movement of the right side of the doctor roller, which is stored into the memory M75.

Then, in Step P126, the count value is loaded from the counter 74 for detecting the rotation phase of the rotary screen cylinder, and stored into the memory M68. Then, in Step P127, the rotation phase of the rotary screen cylinder during doctor roller throw-off is loaded from the memory M58*a*.

Then, in Step P128, it is determined whether the count value of the counter for detecting the rotation phase of the rotary screen cylinder is equal to the rotation phase of the rotary screen cylinder during doctor roller throw-off. If the answer is N, the program returns to Step P126 mentioned above. If the answer is Y, Step P129 is executed in which the memory M60*a* for storing the presence or absence of rotation of the stepping motor for adjusting the left side is overwritten with 0. Then, in Step P130, the memory M61*a* for storing the presence or absence of rotation of the stepping motor for adjusting the right side is overwritten with 0.

Then, in Step P131, the amount of movement of the left side of the doctor roller is loaded from the memory M74. Then, in Step P132, it is determined whether the amount of movement of the left side of the doctor roller is equal to 0. If the answer is Y in Step P132, the program shifts to Step P137 to be described later. If the answer is N in Step P132, the memory M60*a* for storing the presence or absence of rotation of the stepping motor for adjusting the left side is overwritten with 1 in Step P133.

Then, in Step P134, it is determined whether the amount of movement of the left side of the doctor roller is larger than 0. If the answer is Y in Step P134, Step P135 is executed to compute the absolute value of the amount of movement of the left side of the doctor roller from the amount of movement of the left side of the doctor roller, and store it into the memory M76. Then, in Step P136, a normal rotation pulse outputting command corresponding to the absolute value of the amount of movement of the left side of the doctor roller is outputted to the driver 66*a* for the stepping motor for adjusting the left side. Then, the program proceeds to the aforementioned Step P137.

If the answer is N in the above Step P134, Step P138 is executed to compute the absolute value of the amount of movement of the left side of the doctor roller from the amount of movement of the left side of the doctor roller, and store it into the memory M76. Then, in Step P139, a reverse rotation pulse outputting command corresponding to the absolute value of the amount of movement of the left side of the doctor roller is outputted to the driver 66*a* for the stepping motor for adjusting the left side. Then, the program shifts to the aforementioned Step P137.

Then, in the above Step P137, the amount of movement of the right side of the doctor roller is loaded from the memory M75. Then, in Step P140, it is determined whether the amount of movement of the right side of the doctor roller is equal to 0. If the answer is Y in Step P140, the program shifts to Step P145 to be described later. If the answer is N in Step P140, the memory M61*a* for storing the presence or absence of rotation of the stepping motor for adjusting the right side is overwritten with 1 in Step P141.

Then, in Step P142, it is determined whether the amount of movement of the right side of the doctor roller is larger than 0. If the answer is Y in Step P142, Step P143 is executed to compute the absolute value of the amount of movement of the right side of the doctor roller from the amount of movement of the right side of the doctor roller, and store it into the memory M77. Then, in Step P144, a normal rotation pulse outputting command corresponding to the absolute value of the amount of movement of the right side of the doctor roller is outputted to the driver 70*a* for the stepping motor for adjusting the right side. Then, the program proceeds to Step P145.

If the answer is N in the above Step P142, Step P146 is executed to compute the absolute value of the amount of movement of the right side of the doctor roller from the amount of movement of the right side of the doctor roller, and store it into the memory M77. Then, in Step P147, a reverse rotation pulse outputting command corresponding to the absolute value of the amount of movement of the right side of the doctor roller is outputted to the driver 70*a* for the stepping motor for adjusting the right side. Then, the program shifts to the aforementioned Step P145.

Subsequently, in Step P145, the value of the memory M60*a* for storing the presence or absence of rotation of the stepping motor for adjusting the left side is loaded. Then, in Step P148, it is determined whether the value of the memory for storing the presence or absence of rotation of the stepping motor for adjusting the left side is equal to 0. If the answer is Y in Step P148, the value of the memory M61*a* for storing the presence or absence of rotation of the stepping motor for adjusting the right side is loaded in Step P149. If the answer is N in Step P148, the program shifts to Step P152 to be described later.

Then, in Step P150, it is determined whether the value of the memory for storing the presence or absence of rotation of the stepping motor for adjusting the right side is equal to 0. If the answer is Y in Step P150, outputting of the enabling signal to the counter 76*a* for counting the total number of revolutions during doctor roller throw-on is stopped in Step P151, and the program returns to Step P119. If the answer is N in Step P150, the aforementioned Step P152 is executed to load the count value from the counter 68*a* for detecting the current position of the left side of the doctor roller, and store it into the memory M62*a*.

Then, in Step P153, the throw-off position (count value of the counter) of the doctor roller is loaded from the memory M54*a*. Then, in Step P154, it is determined whether the count value of the counter for detecting the current position of the left side of the doctor roller is equal to the throw-off position (count value of the counter) of the doctor roller. If the answer is Y, the memory M60*a* for storing the presence or absence of rotation of the stepping motor for adjusting the left side is overwritten with 0 in Step P155, and the program proceeds to Step P156. If the answer is N, the program directly shifts to Step P156.

Then, in the above Step P156, the count value is loaded from the counter 72*a* for detecting the current position of the right side of the doctor roller, and stored into the memory M63*a*. Then, in Step P157, the throw-off position (count value of the counter) of the doctor roller is loaded from the memory M54*a*.

Then, in Step P158, it is determined whether the count value of the counter 72*a* for detecting the current position of the right side of the doctor roller is equal to the throw-off position (count value of the counter) of the doctor roller. If the answer is Y, the memory M61*a* for storing the presence or absence of rotation of the stepping motor for adjusting the right side is overwritten with in Step P159, and the program returns to Step P145. If the answer is N, the program directly returns to Step P145.

In accordance with the above-described motion flow, when the doctor roller throw-on and throw-off automatic control switch 52*a* is ON and the cylinder engagement signal for the rotary screen cylinder 11 is OFF, the doctor roller 90 is moved to the throw-off position.

Then, in Step P160 shifted from the aforementioned Step P120, the table of conversion from the total number of revolutions during doctor roller throw-on to the correction amount (count value of the counter) of the doctor roller position is loaded from the memory M64*a*. Then, in Step P161, the count value is loaded from the counter 76*a* for counting the total number of revolutions during doctor roller throw-on, and stored into the memory M65*a*.

Then, in Step P162, the correction amount (count value of the counter) of the doctor roller position is obtained from the count value of the counter 76*a* for counting the total number of revolutions during doctor roller throw-on, with the use of the table of conversion from the total number of revolutions during doctor roller throw-on to the correction amount (count value of the counter) of the doctor roller position, and this correction amount is stored into the memory M66*a*. Then, in Step P163, the reference retreat position (count value of the counter) of the doctor roller is loaded from the memory M53*a*.

Then, in Step P164, the correction amount (count value of the counter) of the doctor roller position is loaded from the memory M66*a*. Then, in Step P165, the correction amount (count value of the counter) of the doctor roller position is added to the reference retreat position (count value of the counter) of the doctor roller to compute the retreat position (count value of the counter) of the doctor roller, which is stored into the memory M67*a*.

Then, in Step P166, the count value is loaded from the counter 68*a* for detecting the current position of the left side of the doctor roller, and stored into the memory M62*a*. Then follows Step P167 in which the count value of the counter for detecting the current position of the left side of the doctor roller is subtracted from the retreat position (count value of the counter) of the doctor roller to compute the amount of movement of the left side of the doctor roller, which is stored into the memory M74.

Then, in Step P168, the count value is loaded from the counter 72*a* for detecting the current position of the right side of the doctor roller, and stored into the memory M63*a*. Then follows Step P169 in which the count value of the counter for detecting the current position of the right side of the doctor roller is subtracted from the retreat position (count value of the counter) of the doctor roller to compute the amount of movement of the right side of the doctor roller, which is stored into the memory M75.

Then, in Step P170, the count value is loaded from the counter 74 for detecting the rotation phase of the rotary screen cylinder, and stored into the memory M68. Then, in Step P171, the rotation phase of the rotary screen cylinder during doctor roller throw-on is loaded from the memory M69*a*.

Then, in Step P172, it is determined whether the count value of the counter for detecting the rotation phase of the rotary screen cylinder is equal to the rotation phase of the rotary screen cylinder during doctor roller throw-off. If the answer is N, the program returns to Step P170 mentioned above. If the answer is Y, Step P173 is executed in which the memory M60*a* for storing the presence or absence of rotation of the stepping motor for adjusting the left side is overwritten with 0. Then, in Step P174, the memory M61*a* for storing the presence or absence of rotation of the stepping motor for adjusting the right side is overwritten with 0.

Then, in Step P175, the amount of movement of the left side of the doctor roller is loaded from the memory M74. Then, in Step P176, it is determined whether the amount of movement of the left side of the doctor roller is equal to 0. If the answer is Y in Step P176, the program shifts to Step P181 to be described later. If the answer is N in Step P177, the memory M60*a* for storing the presence or absence of rotation of the stepping motor for adjusting the left side is overwritten with 1 in Step P177.

Then, in Step P178, it is determined whether the amount of movement of the left side of the doctor roller is larger than 0. If the answer is Y in Step P178, Step P179 is executed to compute the absolute value of the amount of movement of the left side of the doctor roller from the amount of movement of the left side of the doctor roller, and store it into the memory M76. Then, in Step P180, a normal rotation pulse outputting command corresponding to the absolute value of the amount of movement of the left side of the doctor roller is outputted to the driver 66*a* for the stepping motor for adjusting the left side. Then, the program proceeds to Step P181.

If the answer is N in Step P178, Step P182 is executed to compute the absolute value of the amount of movement of the left side of the doctor roller from the amount of movement of the left side of the doctor roller, and store it into the memory M76. Then, in Step P183, a reverse rotation pulse outputting command corresponding to the absolute value of the amount of movement of the left side of the doctor roller is outputted to the driver 66*a* for the stepping motor for adjusting the left side. Then, the program shifts to the aforementioned Step P181.

Then, in the above Step P181, the amount of movement of the right side of the doctor roller is loaded from the memory M75. Then, in Step P184, it is determined whether the amount of movement of the right side of the doctor roller is equal to 0. If the answer is Y in Step P184, the program shifts to Step P189 to be described later. If the answer is N in Step P184, the memory M61*a* for storing the presence or absence of rotation of the stepping motor for adjusting the right side is overwritten with 1 in Step P185.

Then, in Step P186, it is determined whether the amount of movement of the right side of the doctor roller is larger than 0. If the answer is Y in Step P186, Step P187 is executed to compute the absolute value of the amount of movement of the right side of the doctor roller from the amount of movement of the right side of the doctor roller, and store it into the memory M77. Then, in Step P188, a normal rotation pulse outputting command corresponding to the absolute value of the amount of movement of the right side of the doctor roller is outputted to the driver 70*a* for the stepping motor for adjusting the right side. Then, the program proceeds to Step P189.

If the answer is N in Step P186, Step P190 is executed to compute the absolute value of the amount of movement of the right side of the doctor roller from the amount of movement of the right side of the doctor roller, and store it into the memory M77. Then, in Step P191, a reverse rotation pulse outputting command corresponding to the absolute value of the amount of movement of the right side of the doctor roller is outputted to the driver 70*a* for the stepping motor for adjusting the right side. Then, the program shifts to the aforementioned Step P189.

Subsequently, in the above Step P189, the value of the memory M60*a* for storing the presence or absence of rotation of the stepping motor for adjusting the left side is loaded. Then, in Step P192, it is determined whether the value of the memory for storing the presence or absence of rotation of the stepping motor for adjusting the left side is equal to 0. If the answer is Y in Step P192, the value of the memory M61*a* for storing the presence or absence of rotation of the stepping motor for adjusting the right side is loaded in Step P193. If the answer is N, the program shifts to Step P196 to be described later.

Subsequently, in Step P194, it is determined whether the value of the memory for storing the presence or absence of rotation of the stepping motor for adjusting the right side is equal to 0. If the answer is Y, Step P195 is executed to stop the outputting of an enabling signal to the counter 76*a* for counting the total number of revolutions during doctor roller throw-on, and the program shifts to Step P204 to be described later. If the answer is N, the aforementioned Step P196 is executed to load the count value from the counter 68*a* for detecting the current position of the left side of the doctor roller, and store it into the memory M62*a*.

Then, in Step P197, the retreat position (count value of the counter) of the doctor roller is loaded from the memory M67*a*. Then, in Step P198, it is determined whether the count value of the counter for detecting the current position of the left side of the doctor roller is equal to the retreat position (count value of the counter) of the doctor roller. If the answer is Y, the memory M60*a* for storing the presence or absence of rotation of the stepping motor for adjusting the left side is overwritten with 0 in Step P199, and the program proceeds to Step P200. If the answer is N, the program directly shifts to Step P200.

Then, in the aforementioned Step P200, the count value is loaded from the counter 72*a* for detecting the current position of the right side of the doctor roller, and stored into the memory M63*a*. Then, in Step P201, the retreat position (count value of the counter) of the doctor roller is loaded from the memory M67*a*.

Then, in Step P202, it is determined whether the count value of the counter 72*a* for detecting the current position of the right side of the doctor roller is equal to the retreat position (count value of the counter) of the doctor roller. If the answer is Y, the memory M61*a* for storing the presence or absence of rotation of the stepping motor for adjusting the right side is overwritten with 0 in Step P203, and the program returns to Step P189. If the answer is N, the program directly returns to Step P189.

In accordance with the above-described motion flow, when the doctor roller throw-on and throw-off automatic control switch 52*a* is ON and the cylinder engagement signal for the rotary screen cylinder 11 is ON, the doctor roller 90 is moved to the predetermined retreat position when it opposes the notch 13*b* of the impression cylinder 13.

Then, in Step P204 shifted from the aforementioned Step P195, the table of conversion from the total number of revolutions during doctor roller throw-on to the correction amount (count value of the counter) of the doctor roller position is loaded from the memory M64*a*. Then, in Step P205, the count value is loaded from the counter 76*a* for counting the total number of revolutions during doctor roller throw-on, and stored into the memory M65*a*.

Then, in Step P206, the correction amount (count value of the counter) of the doctor roller position is obtained from the count value of the counter 76*a* for counting the total number of revolutions during doctor roller throw-on, with the use of the table of conversion from the total number of revolutions during doctor roller throw-on to the correction amount (count value of the counter) of the doctor roller position, and this correction amount is stored into the memory M66*a*. Then, in Step P207, the reference throw-on position (count value of the counter) of the doctor roller is loaded from the memory M34*a*.

Then, in Step P208, the correction amount (count value of the counter) of the doctor roller position is loaded from the memory M66*a*. Then, in Step P209, the correction amount (count value of the counter) of the doctor roller position is added to the reference throw-on position (count value of the counter) of the doctor roller to compute the printing position (count value of the counter) of the doctor roller, which is stored into the memory M70*a*.

Then, in Step P210, the count value is loaded from the counter 68*a* for detecting the current position of the left side of the doctor roller, and stored into the memory M62*a*. Then, in Step P211, the count value of the counter for detecting the current position of the left side of the doctor roller is subtracted from the printing position (count value of the counter) of the doctor roller to compute the amount of movement of the left side of the doctor roller, which is stored into the memory M74.

Then, in Step P212, the count value is loaded from the counter 72*a* for detecting the current position of the right side of the doctor roller, and stored into the memory M63*a*. Then, in Step P213, the count value of the counter for detecting the current position of the right side of the doctor roller is subtracted from the printing position (count value of the counter) of the doctor roller to compute the amount of movement of the right side of the doctor roller, which is stored into the memory M75.

Then, in Step P214, the count value is loaded from the counter 74 for detecting the rotation phase of the rotary screen cylinder, and stored into the memory M68. Then, in Step P215, the rotation phase of the rotary screen cylinder at the position of the rear end of the notch of the impression cylinder is loaded from the memory M78.

Then, in Step P216, it is determined whether the count value of the counter for detecting the rotation phase of the rotary screen cylinder is equal to the rotation phase of the rotary screen cylinder at the position of the rear end of the notch of the impression cylinder. If the answer is N, the program returns to Step P214 mentioned above. If the answer is Y, the memory M60*a* for storing the presence or absence of rotation of the stepping motor for adjusting the left side is overwritten with 0 in Step P217. Subsequently, in Step P218, the memory M61*a* for storing the presence or absence of rotation of the stepping motor for adjusting the right side is overwritten with 0.

Then, in Step P219, the amount of movement of the left side of the doctor roller is loaded from the memory M74. Then, in Step P220, it is determined whether the amount of movement of the left side of the doctor roller is equal to 0. If the answer is Y in Step P220, the program shifts to Step P225 to be described later. If the answer is N in Step P220, the memory M60*a* for storing the presence or absence of rotation of the stepping motor for adjusting the left side is overwritten with 1 in Step P221.

Then, in Step P222, it is determined whether the amount of movement of the left side of the doctor roller is larger than 0. If the answer is Y in Step P222, Step P223 is executed to compute the absolute value of the amount of movement of the left side of the doctor roller from the amount of movement of the left side of the doctor roller, and store it into the memory M76. Then, in Step P224, a normal rotation pulse outputting command corresponding to the absolute value of the amount of movement of the left side of the doctor roller is outputted to the driver 66*a* for the stepping motor for adjusting the left side. Then, the program proceeds to the aforementioned Step P225.

If the answer is N in Step P222, Step P226 is executed to compute the absolute value of the amount of movement of the left side of the doctor roller from the amount of movement of the left side of the doctor roller, and store it into the memory M76. Then, in Step P227, a reverse rotation pulse outputting command corresponding to the absolute value of the amount of movement of the left side of the doctor roller is outputted to the driver 66*a* for the stepping motor for adjusting the left side. Then, the program shifts to the aforementioned Step P225.

Then, in the above Step P225, the amount of movement of the right side of the doctor roller is loaded from the memory M75. Then, in Step P228, it is determined whether the amount of movement of the right side of the doctor roller is equal to 0. If the answer is Y in Step P228, the program shifts to Step P233 to be described later. If the answer is N in Step P228, the memory M61*a* for storing the presence or absence of rotation of the stepping motor for adjusting the right side is overwritten with 1 in Step P229.

Then, in Step P230, it is determined whether the amount of movement of the right side of the doctor roller is larger than 0. If the answer is Y in Step P230, Step P231 is executed to compute the absolute value of the amount of movement of the right side of the doctor roller from the amount of movement of the right side of the doctor roller, and store it into the memory M77. Then, in Step P232, a normal rotation pulse outputting command corresponding to the absolute value of the amount of movement of the right side of the doctor roller is outputted to the driver 70*a* for the stepping motor for adjusting the right side. Then, the program proceeds to the aforementioned Step P233.

If the answer is N in the above Step P230, Step P234 is executed to compute the absolute value of the amount of movement of the right side of the doctor roller from the amount of movement of the right side of the doctor roller, and store it into the memory M77. Then, in Step P235, a reverse rotation pulse outputting command corresponding to the absolute value of the amount of movement of the right side of the doctor roller is outputted to the driver 70*a* for the stepping motor for adjusting the right side. Then, the program shifts to the aforementioned Step P233.

Subsequently, in the above Step P233, the value of the memory M60*a* for storing the presence or absence of rotation of the stepping motor for adjusting the left side is loaded. Then, in Step P236, it is determined whether the value of the memory for storing the presence or absence of rotation of the stepping motor for adjusting the left side is equal to 0. If the answer is Y in Step P236, the value of the memory M61*a* for storing the presence or absence of rotation of the stepping motor for adjusting the right side is loaded in Step P237. If the answer is N, the program shifts to Step P239 to be described later.

Then, in Step P238, it is determined whether the value of the memory for storing the presence or absence of rotation of the stepping motor for adjusting the right side is equal to 0. If the answer is Y in Step P238, the program shifts to Step P247 to be described later. If the answer is N in Step P238, the aforementioned Step P239 is executed to load the count value from the counter 68*a* for detecting the current position of the left side of the doctor roller, and store it into the memory M62*a*.

Then, in Step P240, the printing position (count value of the counter) of the doctor roller is loaded from the memory M70*a*. Then, in Step P241, it is determined whether the count value of the counter for detecting the current position of the left side of the doctor roller is equal to the printing position (count value of the counter) of the doctor roller. If the answer is Y, the memory M60*a* for storing the presence or absence of rotation of the stepping motor for adjusting the left side is overwritten with 0 in Step P242, and the program proceeds to Step P243. If the answer is N in Step P241, the program directly shifts to Step P243.

Then, in the aforementioned Step P243, the count value is loaded from the counter 72*a* for detecting the current position of the right side of the doctor roller, and stored into the memory M63*a*. Then, in Step P244, the printing position (count value of the counter) of the doctor roller is loaded from the memory M70*a*.

Then, in Step P245, it is determined whether the count value of the counter 72*a* for detecting the current position of the right side of the doctor roller is equal to the printing position (count value of the counter) of the doctor roller. If the answer is Y, the memory M61*a* for storing the presence or absence of rotation of the stepping motor for adjusting the right side is overwritten with 0 in Step P246, and the program returns to Step P233. If the answer is N in Step P245, the program directly returns to Step P233.

In accordance with the above-described motion flow, when the doctor roller throw-on and throw-off automatic control switch 52*a* is ON and the cylinder engagement signal for the rotary screen cylinder 11 is ON, the doctor roller 90 is moved to the predetermined printing position when it enters the rotation phase of the rotary screen cylinder 11 corresponding to the position of the rear end of the notch of the impression cylinder 13.

Then, in Step P247 shifted from the aforementioned Step P238, the table of conversion from the total number of revolutions during doctor roller throw-on to the correction amount (count value of the counter) of the doctor roller position is loaded from the memory M64*a*. Then, in Step P248, the count value is loaded from the counter 76*a* for counting the total number of revolutions during doctor roller throw-on, and stored into the memory M65*a*.

Then, in Step P249, the correction amount (count value of the counter) of the doctor roller position is obtained from the count value of the counter 76*a* for counting the total number of revolutions during doctor roller throw-on, with the use of the table of conversion from the total number of revolutions during doctor roller throw-on to the correction amount (count value of the counter) of the doctor roller position, and this correction amount is stored into the memory M66*a*. Then, in Step P250, the reference retreat position (count value of the counter) of the doctor roller is loaded from the memory M53*a*.

Then, in Step P251, the correction amount (count value of the counter) of the doctor roller position is loaded from the memory M66*a*. Then, in Step P252, the correction amount (count value of the counter) of the doctor roller position is added to the reference retreat position (count value of the counter) of the doctor roller to compute the retreat position (count value of the counter) of the doctor roller, which is stored into the memory M67*a*.

Then, Step P253 is executed to load the count value from the counter 68*a* for detecting the current position of the left side of the doctor roller, and store it into the memory M62*a*. Then, in Step P254, the count value of the counter for detecting the current position of the left side of the doctor roller is subtracted from the retreat position (count value of the counter) of the doctor roller to compute the amount of movement of the left side of the doctor roller, which is stored into the memory M74.

Then, Step P255 is executed to load the count value from the counter 72*a* for detecting the current position of the right side of the doctor roller, and store it into the memory M63*a*. Then, in Step P256, the count value of the counter for detecting the current position of the right side of the doctor roller is subtracted from the retreat position (count value of the counter) of the doctor roller to compute the amount of movement of the right side of the doctor roller, which is stored into the memory M75.

Then, in Step P257, the count value is loaded from the counter 74 for detecting the rotation phase of the rotary screen cylinder, and stored into the memory M68. Then, in Step P258, the rotation phase of the rotary screen cylinder at the position of the leading end of the notch of the impression cylinder is loaded from the memory M71.

Then, in Step P259, it is determined whether the count value of the counter for detecting the rotation phase of the rotary screen cylinder is equal to the rotation phase of the rotary screen cylinder at the position of the leading end of the notch of the impression cylinder. If the answer is N, the program returns to Step P257 mentioned above. If the answer is Y, the memory M60*a* for storing the presence or absence of rotation of the stepping motor for adjusting the left side is overwritten with 0 in Step P260. Then, in Step P261, the memory M61*a* for storing the presence or absence of rotation of the stepping motor for adjusting the right side is overwritten with 0.

Then, in Step P262, the amount of movement of the left side of the doctor roller is loaded from the memory M74. Then, in Step P263, it is determined whether the amount of movement of the left side of the doctor roller is equal to 0. If the answer is Y in Step P263, the program shifts to Step P268 to be described later. If the answer is N in Step P263, the memory M60*a* for storing the presence or absence of rotation of the stepping motor for adjusting the left side is overwritten with 1 in Step P264.

Then, in Step P265, it is determined whether the amount of movement of the left side of the doctor roller is larger than 0. If the answer is Y in Step P265, Step P266 is executed to compute the absolute value of the amount of movement of the left side of the doctor roller from the amount of movement of the left side of the doctor roller, and store it into the memory M76. Then, in Step P267, a normal rotation pulse outputting command corresponding to the absolute value of the amount of movement of the left side of the doctor roller is outputted to the driver 66*a* for the stepping motor for adjusting the left side. Then, the program proceeds to the aforementioned Step P268.

If the answer is N in the above Step P265, Step P269 is executed to compute the absolute value of the amount of movement of the left side of the doctor roller from the amount of movement of the left side of the doctor roller, and store it into the memory M76. Then, in Step P270, a reverse rotation pulse outputting command corresponding to the absolute value of the amount of movement of the left side of the doctor roller is outputted to the driver 66*a* for the stepping motor for adjusting the left side. Then, the program shifts to the aforementioned Step P268.

Then, in the aforementioned Step P268, the amount of movement of the right side of the doctor roller is loaded from the memory M75. Then, in Step P271, it is determined whether the amount of movement of the right side of the doctor roller is equal to 0. If the answer is Y in Step P271, the program shifts to Step P276 to be described later. If the answer is N in Step P271, the memory M61*a* for storing the presence or absence of rotation of the stepping motor for adjusting the right side is overwritten with 1 in Step P272.

Then, in Step P273, it is determined whether the amount of, movement of the right side of the doctor roller is larger than 0. If the answer is Y in Step P273, Step P274 is executed to compute the absolute value of the amount of movement of the right side of the doctor roller from the amount of movement of the right side of the doctor roller, and store it into the memory M77. Then, in Step P275, a normal rotation pulse outputting command corresponding to the absolute value of the amount of movement of the right side of the doctor roller is outputted to the driver 70*a* for the stepping motor for adjusting the right side. Then, the program proceeds to the aforementioned Step P276.

If the answer is N in the above Step P273, Step P277 is executed to compute the absolute value of the amount of movement of the right side of the doctor roller from the amount of movement of the right side of the doctor roller, and store it into the memory M77. Then, in Step P278, a reverse rotation pulse outputting command corresponding to the absolute value of the amount of movement of the right side of the doctor roller is outputted to the driver 70*a* for the stepping motor for adjusting the right side. Then, the program shifts to the aforementioned Step P276.

Subsequently, in the aforementioned Step P276, the value of the memory M60*a* for storing the presence or absence of rotation of the stepping motor for adjusting the left side is loaded. Then, in Step P279, it is determined whether the value of the memory for storing the presence or absence of rotation of the stepping motor for adjusting the left side is equal to 0. If the answer is Y in Step P279, the value of the memory M61*a* for storing the presence or absence of rotation of the stepping motor for adjusting the right side is loaded in Step P280. If the answer is N in Step P279, the program shifts to Step P283 to be described later.

Subsequently, in Step P281, it is determined whether the value of the memory for storing the presence or absence of rotation of the stepping motor for adjusting the right side is equal to 0. If the answer is Y in Step P281, Step P282 is executed to determine whether the cylinder engagement signal for the rotary screen cylinder is ON. If the answer is Y, the program returns to Step P204. If the answer is N, the program returns to Step P121.

If the answer is N in the aforementioned Step P281, the count value is loaded from the counter 68*a* for detecting the current position of the left side of the doctor roller, and stored into the memory M62*a*, in the aforementioned Step P283.

Then, in Step P284, the retreat position (count value of the counter) of the doctor roller is loaded from the memory M67*a*. Then, in Step P285, it is determined whether the count value of the counter for detecting the current position of the left side of the doctor roller is equal to the retreat position (count value of the counter) of the doctor roller. If the answer is. Y, the memory M60*a* for storing the presence or absence of rotation of the stepping motor for adjusting the left side is overwritten with 0 in Step P286, and the program proceeds to Step P287. If the answer is N, the program directly shifts to Step P287.

Then, in the aforementioned Step P287, the count value is loaded from the counter 72*a* for detecting the current position of the right side of the doctor roller, and stored into the memory M63*a*. Then, in Step P288, the retreat position (count value of the counter) of the doctor roller is loaded from the memory M67*a*.

Then, in Step P289, it is determined whether the count value of the counter 72*a* for detecting the current position of the right side of the doctor roller is equal to the retreat position (count value of the counter) of the doctor roller. If the answer is Y, the memory M61*a* for storing the presence or absence of rotation of the stepping motor for adjusting the right side is overwritten with 0 in Step P290, and the program returns to Step P276. If the answer is N, the program directly returns to Step P276.

In accordance with the above-described motion flow, when the doctor roller throw-on and throw-off automatic control switch 52*a* is ON and the cylinder engagement signal for the rotary screen cylinder 11 is ON, the doctor roller 90 is moved to the predetermined retreat position when it enters the rotation phase of the rotary screen cylinder 11 corresponding to the position of the leading end of the notch of the impression cylinder 13.

Then, in Step P291 shifted from the aforementioned Step P119, the throw-off position (count value of the counter) of the doctor roller is loaded from the memory M54*a*.

Then, Step P292 is executed to load the count value from the counter 68*a* for detecting the current position of the left side of the doctor roller, and store it into the memory M62*a*. Then, in Step P293, the count value of the counter for detecting the current position of the left side of the doctor roller is subtracted from the throw-off position (count value of the counter) of the doctor roller to compute the amount of movement of the left side of the doctor roller, which is stored into the memory M74.

Then, Step P294 is executed to load the count value from the counter 72*a* for detecting the current position of the right side of the doctor roller, and store it into the memory M63*a*. Then, in Step P295, the count value of the counter for detecting the current position of the right side of the doctor roller is subtracted from the throw-off position (count value of the counter) of the doctor roller to compute the amount of movement of the right side of the doctor roller, which is stored into the memory M75.

Then, in Step P296, the count value is loaded from the counter 74 for detecting the rotation phase of the rotary screen cylinder, and stored into the memory M68. Then, in Step P297, the rotation phase of the rotary screen cylinder during doctor roller throw-off is loaded from the memory M58*a*.

Then, in Step P298, it is determined whether the count value of the counter for detecting the rotation phase of the rotary screen cylinder is equal to the rotation phase of the rotary screen cylinder during doctor roller throw-off. If the answer is N, the program returns to Step P296 mentioned above. If the answer is Y, the memory M60*a* for storing the presence or absence of rotation of the stepping motor for adjusting the left side is overwritten with 0 in Step P299. Then, in Step P300, the memory M61*a* for storing the presence or absence of rotation of the stepping motor for adjusting the right side is overwritten with 0.

Then, in Step P301, the amount of movement of the left side of the doctor roller is loaded from the memory M74. Then, in Step P302, it is determined whether the amount of movement of the left side of the doctor roller is equal to 0. If the answer is Y in Step P302, the program shifts to Step P307 to be described later. If the answer is N in Step P302, the memory M60*a* for storing the presence or absence of rotation of the stepping motor for adjusting the left side is overwritten with 1 in Step P303.

Then, in Step P304, it is determined whether the amount of movement of the left side of the doctor roller is larger than 0. If the answer is Y in Step P304, Step P305 is executed to compute the absolute value of the amount of movement of the left side of the doctor roller from the amount of movement of the left side of the doctor roller, and store it into the memory M76. Then, in Step P306, a normal rotation pulse outputting command corresponding to the absolute value of the amount of movement of the left side of the doctor roller is outputted to the driver 66*a* for the stepping motor for adjusting the left side. Then, the program proceeds to the aforementioned Step P307.

If the answer is N in the aforementioned Step P304, Step P308 is executed to compute the absolute value of the amount of movement of the left side of the doctor roller from the amount of movement of the left side of the doctor roller, and store it into the memory M76. Then, in Step P309, a reverse rotation pulse outputting command corresponding to the absolute value of the amount of movement of the left side of the doctor roller is outputted to the driver 66*a* for the stepping motor for adjusting the left side. Then, the program shifts to Step P307 mentioned above.

Then, in the above Step P307, the amount of movement of the right side of the doctor roller is loaded from the memory M75. Then, in Step P310, it is determined whether the amount of movement of the right side of the doctor roller is equal to 0. If the answer is Y in Step P310, the program shifts to Step P315 to be described later. If the answer is N in Step P310, the memory M61*a* for storing the presence or absence of rotation of the stepping motor for adjusting the right side is overwritten with 1 in Step P311.

Then, in Step P312, it is determined whether the amount of movement of the right side of the doctor roller is larger than 0. If the answer is Y in Step P312, Step P313 is executed to compute the absolute value of the amount of movement of the right side of the doctor roller from the amount of movement of the right side of the doctor roller, and store it into the memory M77. Then, in Step P314, a normal rotation pulse outputting command corresponding to the absolute value of the amount of movement of the right side of the doctor roller is outputted to the driver 70*a* for the stepping motor for adjusting the right side. Then, the program proceeds to the aforementioned Step P315.

If the answer is N in the aforementioned Step P312, Step P316 is executed to compute the absolute value of the amount of movement of the right side of the doctor roller from the amount of movement of the right side of the doctor roller, and store it into the memory M77. Then, in Step P317, a reverse rotation pulse outputting command corresponding to the absolute value of the amount of movement of the right side of the doctor roller is outputted to the driver 70*a* for the stepping motor for adjusting the right side. Then, the program shifts to the aforementioned Step P315.

Subsequently, in the above Step P315, the value of the memory M60*a* for storing the presence or absence of rotation of the stepping motor for adjusting the left side is loaded. Then, in Step P318, it is determined whether the value of the memory for storing the presence or absence of rotation of the stepping motor for adjusting the left side is equal to 0. If the answer is Y in Step P318, the value of the memory M61*a* for storing the presence or absence of rotation of the stepping motor for adjusting the right side is loaded in Step P319. If the answer is N in Step P318, the program shifts to Step P322 to be described later.

Subsequently, in Step P320, it is determined whether the value of the memory for storing the presence or absence of rotation of the stepping motor for adjusting the right side is equal to 0. If the answer is Y in Step P320, Step P321 is executed to stop the outputting of the enabling signal to the counter 76*a* for counting the total number of revolutions during doctor roller throw-on. Then, the program returns to Step P1. If the answer is N in Step P320, the aforementioned Step P322 is executed to load the count value from the counter 68*a* for detecting the current position of the left side of the doctor-roller, and store it into the memory M62*a*.

Then, in Step P323, the throw-off position (count value of the counter) of the doctor roller is loaded from the memory M54*a*. Then, in Step P324, it is determined whether the count value of the counter for detecting the current position of the left side of the doctor roller is equal to the throw-off position (count value of the counter) of the doctor roller. If the answer is Y, the memory M60*a* for storing the presence or absence of rotation of the stepping motor for adjusting the left side is overwritten with 0 in Step P325, and the program proceeds to Step P326. If the answer is N in Step P324, the program directly shifts to Step P326.

Then, in the aforementioned Step P326, the count value is loaded from the counter 72*a* for detecting the current position of the right side of the doctor roller, and stored into the memory M63*a*. Then, in Step P327, the throw-off position (count value of the counter) of the doctor roller is loaded from the memory M54*a*.

Then, in Step P328, it is determined whether the count value of the counter 72*a* for detecting the current position of the right side of the doctor roller is equal to the throw-off position (count value of the counter) of the doctor roller. If the answer is Y, the memory M61*a* for storing the presence or absence of rotation of the stepping motor for adjusting the right side is overwritten with 0 in Step P329, and the program returns to Step P315. If the answer is N in Step P328, the program directly returns to Step P315.

In accordance with the above-described motion flow, when the doctor roller throw-on and throw-off automatic control switch 52*a* is brought to the OFF-state, the doctor roller 90 is moved to the throw-off position.

According to the present Embodiment 2, as described above, the throw-on position of the doctor roller 90 during printing is preset, based on the type of the material W to be printed (i.e., difference in the material, e.g., paper, cloth, film or corrugated board), in conformity with the thickness of the material to be printed, the material for the screen printing forme 11*c*, the thickness of the screen printing forme, the open area rate of the screen printing forme, the mesh size of the screen printing forme 11*c*, the viscosity of ink, the yield value of ink, the type of the pigment of ink, the material for the doctor roller, and the surface hardness of the doctor roller. Thus, burden on the operator can be lessened by automation, and the rate of operation can be increased and the occurrence of wasted paper can be curtailed by shortening the period of time until normal printing products can be obtained by printing.

In the present Embodiment 2, moreover, even when the doctor roller 90 is located at a position where it opposes the notch 13*b* of the impression cylinder 13 (i.e., the retreat position), the outer peripheral surface of the doctor roller 90 does not leave the inner peripheral surface of the screen printing forme 11*c*, and only its pressure exerted on this surface (i.e., pressing force) is rendered lower than the pressure during printing. Thus, the screen printing forme 11*c* is prevented from being pushed into the notch 13*b* of the impression cylinder 13 by the doctor roller 90 and damaged thereby, and there is no ink leaking out toward the downstream side in the rotating direction of the screen printing forme 11*c*, so that deterioration of printing quality is prevented.

That is, the following problems are avoided: Because of leaks of ink toward the downstream side in the rotating direction of the screen printing forme 11*c*, the amount of ink remaining in front of the doctor roller 90 becomes small to decrease the ink density at the start of printing. The ink leaking out toward the downstream side leaks out through the holes of the picture pattern portion under a centrifugal force during high speed rotation, adheres to outside portions of the holes, and sticks to the outside of the picture pattern portion during printing, thereby deteriorating printing quality.

In the present Embodiment 2, moreover, the control pressure may be switched using a hydraulic or pneumatic actuator instead of the stepping motor 36Aa for adjusting the left side and the stepping motor 36Bb for adjusting the right side. Furthermore, the motors 36Aa and 36Bb are disposed on the right side and the left side. However, there may be adopted a configuration in which a one-sided motor moves the right and left sides, for example, by connecting the right and left sides by a lever mechanism.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid transfer member pressing force adjusting method of a rotary stencil printing plate liquid coating machine including, a stencil printing plate cylinder which supports a stencil printing plate and supported rotatably, a pressing body which is provided to oppose the stencil printing plate cylinder, and supported rotatably, a liquid transfer member located within the stencil printing plate cylinder and, during liquid coating, contacts an inner peripheral surface of the stencil printing plate, while being pressed against the inner peripheral surface of the stencil printing plate, to transfer a liquid stored within the stencil printing plate cylinder to a material to be liquid coated, which is supplied between the stencil printing plate cylinder and the pressing body, via holes of the stencil printing plate, a setting unit that allows a type and a thickness of the material to be liquid coated to be set, and a control device for obtaining the pressing force of the liquid transfer member acting on the inner peripheral surface of the stencil printing plate during the liquid coating, the method comprising:

setting, by the setting unit, the type and thickness of the material to be liquid coated; and obtaining, by the control device, the pressing force based on the set type and thickness of the material to be liquid coated and a preset relationship between the set type and thickness of the material to be liquid coated and a pressing force of the stencil printing plate during the liquid coating.

2. The liquid transfer member pressing force adjusting method of a rotary stencil printing plate liquid coating machine according to claim 1, wherein the setting unit allows a type of the stencil printing plate to be set, wherein in the obtaining step, the pressing force is obtained further from the set type of the stencil printing plate.

3. The liquid transfer member pressing force adjusting method of a rotary stencil printing plate liquid coating machine according to claim 1, wherein the rotary stencil printing plate liquid coating machine further includes, a picture pattern area rate measuring device that obtains a picture pattern area rate of a picture pattern to be applied by the liquid coating to the material to be liquid coated, wherein the setting unit allows a size of each of the holes of the stencil printing plate to be set, and wherein in the obtaining step, the pressing force is obtained further from the obtained picture pattern area rate and further from the set size of each of the holes of the stencil printing plate and the measured picture pattern area rate.

4. The liquid transfer member pressing force adjusting method of a rotary stencil printing plate liquid coating machine according to claim 1, wherein the setting unit allows a type of the liquid used in the liquid coating to be set, and wherein in the obtaining step, the pressing force is obtained further from the set type of the liquid used in the liquid coating.

5. The liquid transfer member pressing force adjusting method of a rotary stencil printing plate liquid coating machine according to claim 1, wherein the setting unit allows a type of the liquid transfer member to be set, and wherein in the obtaining step, the pressing force is obtained further from the set type of the liquid transfer member.

6. The liquid transfer member pressing force adjusting method of a rotary stencil printing plate liquid coating machine according to claim 1, wherein the stencil printing plate liquid coating machine further including, an adjusting unit that adjusts the pressing force of the liquid transfer member acting on the inner peripheral surface of the stencil printing plate by adjusting a position of the liquid transfer member, and wherein the control device controls the adjusting unit based on the obtained pressing force.

7. The liquid transfer member pressing force adjusting method of a rotary stencil printing plate liquid coating machine according to claim 6, wherein the adjusting unit adjusts the position of the liquid transfer member by a motor.

8. The liquid transfer member pressing force adjusting method of a rotary stencil printing plate liquid coating machine according to claim 1, further comprising:

a conversion table indicative of a relationship between the set type and thickness of the material to be liquid coated and a pressing force of the liquid transfer member acting on the inner peripheral surface of the stencil printing plate during the liquid coating, wherein in the obtaining step, the pressing force is obtained based on the set type and thickness of the material to be liquid coated and the conversion table.

9. A liquid transfer member pressing force adjusting apparatus of a rotary stencil printing plate liquid coating machine, comprising:

a stencil printing plate cylinder which supports a stencil printing plate and supported rotatably;

a pressing body provided to oppose the stencil printing plate cylinder, and supported rotatably;

a liquid transfer member located within the stencil printing plate cylinder and, during liquid coating, contacts an inner peripheral surface of the stencil printing plate, while being pressed against the inner peripheral surface of the stencil printing plate, to transfer a liquid stored within the stencil printing plate cylinder to a material to be liquid coated, which is supplied between the stencil printing plate cylinder and the pressing body, via holes of the stencil printing plate, a setting unit that allows a type and a thickness of the material to be liquid coated to be set;

an adjusting unit that adjusts the pressing force; and control means that controls the adjusting unit to control the pressing force in accordance with the set type and thickness of the material to be liquid coated and a preset relationship between the set type and thickness of the material to be liquid coated and a pressing force of the stencil printing plate during the liquid coating.

10. The liquid transfer member pressing force adjusting apparatus of a rotary stencil printing plate liquid coating machine according to claim 9, wherein the setting unit allows a type of the stencil printing plate to be set, and wherein the control means controls the pressing force further in accordance with the set type of the stencil printing plate.

11. The liquid transfer member pressing force adjusting apparatus of a rotary stencil printing plate liquid coating machine according to claim 9, further comprising:

a picture pattern area rate measuring device that obtains measures a picture pattern area rate of a picture pattern to be applied by the liquid coating to the material to be liquid coated, wherein the setting unit allows a size of each of the holes of the stencil printing plate to be set, and wherein the control means controls the pressing force further in accordance with the obtained picture pattern area rate, and further in accordance with the set size of each of the holes of the stencil printing plate.

12. The liquid transfer member pressing force adjusting apparatus of a rotary stencil printing plate liquid coating machine according to claim 9, wherein the setting unit allows a type of the liquid used in the liquid coating to be set, and wherein the control means controls the pressing force further in accordance with the set type of the liquid used in the liquid coating.

13. The liquid transfer member pressing force adjusting apparatus of a rotary stencil printing plate liquid coating machine according to claim 9, wherein the setting unit allows a type of the liquid transfer member to be set, and wherein the control means controls the pressing force further in accordance with the set type of the liquid transfer member.

14. The liquid transfer member pressing force adjusting apparatus of a rotary stencil printing plate liquid coating machine according to claim 9, wherein the adjusting unit makes adjustment of the pressing force of the liquid transfer member acting on the inner peripheral surface of the stencil printing plate by controlling a position of the liquid transfer member.

15. The liquid transfer member pressing force adjusting apparatus of a rotary stencil printing plate liquid coating machine according to claim 14, wherein the adjusting unit makes adjustment of the position of the liquid transfer member by drivingly controlling a motor.

16. The liquid transfer member pressing force adjusting apparatus of a rotary stencil printing plate liquid coating machine according to claim 9, further comprising:

a conversion table indicative of a relationship between the set type and thickness of the material to be liquid coated and a pressing force of the liquid transfer member acting on the inner peripheral surface of the stencil printing plate during the liquid coating, wherein the control means controls the adjusting unit to control the pressing force in accordance with the set type and thickness of the material to be liquid coated and the conversion table.

17. A liquid transfer member pressing force adjusting method of a rotary stencil printing plate liquid coating machine, comprising:

providing a stencil printing plate cylinder which supports a stencil printing plate and supported rotatably;

providing a pressing body to oppose the stencil printing plate cylinder, and supported rotatably;

providing a liquid transfer member located within the stencil printing plate cylinder and, during liquid coating, contacts an inner peripheral surface of the stencil printing plate, while being pressed against the inner peripheral surface of the stencil printing plate, to transfer a liquid stored within the stencil printing plate cylinder to a material to be liquid coated, which is supplied between the stencil printing plate cylinder and the pressing body, via holes of the stencil printing plate;

providing a setting unit that allows a type and a thickness of the material to be liquid coated to be set; and obtaining the pressing force from the set type and thickness of the material to be liquid coated and a preset relationship between the set type and thickness of the material to be liquid coated and a pressing force of the stencil printing plate during the liquid coating.

18. A rotary stencil printing plate liquid coating machine, comprising:

a stencil printing plate cylinder which supports a stencil printing plate and is supported rotatably;

a pressing body which is provided to oppose the stencil printing plate cylinder, and is supported rotatably;

a liquid transfer member which is located within the stencil printing plate cylinder and, during liquid coating, contacts an inner peripheral surface of the stencil printing plate, while being pressed against the inner peripheral surface of the stencil printing plate, to transfer a liquid stored within the stencil printing plate cylinder to a material to be liquid coated, which is supplied between the stencil printing plate cylinder and the pressing body, via holes of the stencil printing plate;

a setting unit that allows a type and a thickness of the material to be liquid coated to be set; and control means which obtains the pressing force in accordance with the set type and thickness of the material to be liquid coated and a preset relationship between the set type and thickness of the material to be liquid coated and a pressing force of the stencil printing plate during the liquid coating.

* * * * *